US009805556B2

(12) United States Patent
Lee et al.

(10) Patent No.: US 9,805,556 B2
(45) **Date of Patent: *Oct. 31, 2017**

(54) ELECTRONIC GAMING DEVICE WITH DYNAMIC STACKING FUNCTIONALITY

(71) Applicant: Cadillac Jack, Inc., Duluth, GA (US)

(72) Inventors: Sigmund Hyunjai Lee, Atlanta, GA (US); Jason Prometheus Pawloski, Atlanta, GA (US); Eric Steven Boese, Decatur, GA (US); Marc Christopher McDermott, Lawrenceville, GA (US); Nathan MacGregor, Atlanta, GA (US)

(73) Assignee: Cadillac Jack, Inc., Duluth, GA (US)

( * ) Notice: Subject to any disclaimer, the term of this patent is extended or adjusted under 35 U.S.C. 154(b) by 202 days.

This patent is subject to a terminal disclaimer.

(21) Appl. No.: 14/672,153

(22) Filed: Mar. 28, 2015

(65) Prior Publication Data

US 2015/0379831 A1 Dec. 31, 2015

Related U.S. Application Data

(60) Provisional application No. 62/019,237, filed on Jun. 30, 2014, provisional application No. 62/030,019, filed on Jul. 28, 2014.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC .. G07F 17/3265; G07F 17/3267; G07F 17/34; G07F 17/326
See application file for complete search history.

(56) References Cited

U.S. PATENT DOCUMENTS

| | | | |
|---|---|---|---|
| 6,089,977 | A | 7/2000 | Bennett |
| 6,439,993 | B1 | 8/2002 | O'Halloran |
| 6,918,832 | B2 | 7/2005 | Baerlocher et al. |
| 7,014,559 | B1 | 3/2006 | Fong |
| 7,189,161 | B1 | 3/2007 | Wiltshire et al. |
| 7,252,591 | B2 | 8/2007 | Van Asdale |
| 7,758,414 | B1 | 7/2010 | Marks et al. |
| 8,096,869 | B2 | 1/2012 | Yoshimi |
| 8,251,794 | B2 | 8/2012 | O'Halloran |
| 8,366,540 | B2 | 2/2013 | Yoshimi |
| 8,585,487 | B2 | 11/2013 | Rodgers et al. |
| 8,608,544 | B2 | 12/2013 | Aoki et al. |
| 8,616,955 | B2 | 12/2013 | Yoshimi |
| 8,622,810 | B2 | 1/2014 | Yoshimi |

(Continued)

FOREIGN PATENT DOCUMENTS

EP 1 469 434 10/2004

*Primary Examiner* — Dmitry Suhol
*Assistant Examiner* — David Duffy
(74) *Attorney, Agent, or Firm* — Weide & Miller, Ltd.

(57) ABSTRACT

Examples disclosed herein relate to a gaming device, a gaming system, and/or a method that may: determine one or more wagers relating to one or more game plays; determine one or more stacking areas to turn on to utilize during a first spin; determine one or more stacking areas to turn on to utilize during a second spin; determine any non-compliant overlap reel positions between a first spin and a second spin; and correct any non-compliant overlap reel positions.

17 Claims, 146 Drawing Sheets

(56) References Cited

U.S. PATENT DOCUMENTS 8,628,401 B2 1/2014 Yoshimi
8,641,508 B2 2/2014 Yoshimi
8,795,059 B2 * 8/2014 Aoki ..... G07F 17/32 463/20
9,098,982 B2 * 8/2015 Mastropietro ..... G07F 17/34
9,214,066 B2 * 12/2015 Collette ..... G07F 17/326
9,230,401 B2 1/2016 O'Halloran
9,330,527 B2 * 5/2016 Collette ..... G07F 17/326
9,361,763 B1 * 6/2016 Aoki ..... G07F 17/34
9,483,900 B2 * 11/2016 Aoki ..... G07F 17/32
2004/0033827 A1 2/2004 Gilmore et al.
2005/0107154 A1 5/2005 Pacey
2005/0208996 A1 9/2005 Friedman
2007/0105611 A1 5/2007 O'Halloran
2012/0046089 A1 2/2012 Kemper
2012/0115570 A1 * 5/2012 Collette ..... G07F 17/326 463/20
2012/0309498 A1 12/2012 O'Halloran
2014/0221079 A1 * 8/2014 Rucker ..... G07F 17/3267 463/21
2014/0274282 A1 * 9/2014 Mastropietro ..... G07F 17/34 463/20
2014/0295935 A1 10/2014 Pawloski
2014/0295936 A1 10/2014 Pawloski
2015/0080103 A1 * 3/2015 Nakamura ..... G07F 17/3213 463/20
2015/0279166 A1 * 10/2015 Mastropietro ..... G07F 17/34 463/20
2015/0379828 A1 * 12/2015 Lee ..... G07F 17/326 463/20
2015/0379829 A1 * 12/2015 Lee ..... G07F 17/326 463/20
2015/0379830 A1 * 12/2015 Lee ..... G07F 17/326 463/20
2016/0063806 A1 * 3/2016 Collette ..... G07F 17/326 463/21
2016/0232755 A1 * 8/2016 Collette ..... G07F 17/326

* cited by examiner

700A

| | A | B | C | D | E | F | G | H | I | J | K | L | M |
|---|---|---|---|---|---|---|---|---|---|---|---|---|---|
| 1 | **Reel 1** | **Reel 2** | **Reel 3** | **Reel 4** | **Reel 5** | | **#1** | **#2** | **#3** | **#4** | **#5** | | **Percentage** |
| 2 | | | | | | | | | | | | | |
| 3 | M2 | M2 | M2 | M2 | M2 | | 30 | 30 | 40 | 30 | 20 | | 1% |
| 4 | M2 | M2 | M2 | M2 | M2 | | 20 | 20 | 20 | 20 | 50 | | 1% |
| 5 | M1 | F5 | WW | WW | M1 | | 50 | 20 | 50 | 20 | 50 | | 5% |
| 6 | ... | ... | ... | ... | ... | | ... | ... | ... | ... | ... | | ... |
| 101 | S1 | S1 | S1 | S1 | S1 | | 40 | 40 | 10 | 20 | 40 | | 2% |
| 102 | S1 | S1 | S1 | S1 | S1 | | 20 | 20 | 4 | 10 | 60 | | 1% |
| 103 | | | | | | | | | | | | | |
| 104 | | | | | | | | | | | | Total: | 100% |

FIG. 7A

700B

| 710 | 712 | 714 | 716 | 718 | 720 | 722 | 724 | 726 | 728 | 730 |
|---|---|---|---|---|---|---|---|---|---|---|
| INDEX | REEL 1 | REEL 2 | REEL 3 | REEL 4 | REEL 5 | # 1 | # 2 | # 3 | # 4 | # 5 |
| 1 | M2 | M2 | M2 | M2 | M2 | 30 | 30 | 40 | 30 | 20 |
| 2 | M2 | M2 | M2 | M2 | M2 | 20 | 20 | 20 | 20 | 50 |
| 3 | M1 | F5 | WW | WW | M1 | 50 | 20 | 50 | 20 | 50 |
| 4 | M1 | F5 | WW | WW | M1 | 50 | 20 | 50 | 20 | 50 |
| 5 | M1 | F5 | WW | WW | M1 | 50 | 20 | 50 | 20 | 50 |
| 6 | M1 | F5 | WW | WW | M1 | 50 | 20 | 50 | 20 | 50 |
| 7 | M1 | F5 | WW | WW | M1 | 50 | 20 | 50 | 20 | 50 |
| ≡ | ≡ | ≡ | ≡ | ≡ | ≡ | ≡ | ≡ | ≡ | ≡ | ≡ |
| 1022 | S1 | S1 | S1 | S1 | S1 | 40 | 40 | 10 | 20 | 40 |
| 1023 | S1 | S1 | S1 | S1 | S1 | 40 | 40 | 10 | 20 | 40 |
| 1024 | S1 | S1 | S1 | S1 | S1 | 20 | 20 | 4 | 10 | 60 |

732 738 734 736 740 742 744

FIG. 7B

1. DETERMINE HOW MANY AREAS TO FILL IN A STACK.

EXAMPLE: 4

2. SELECT SYMBOLS TO DISPLAY IN STACK.

EXAMPLE: Z

3. DETERMINE STACK STARTING POSITION AND THE STACK ENDING POSITION.

EXAMPLE: POSITION 1 THROUGH 4

4. POSITION SELECTED SYMBOLS IN DETERMINED STACK AREA.

| 1010 | 1012 |
|---|---|
| X | 15% |
| Y | 15% |
| Z | 25% |
| A | 15% |
| B | 15% |
| C | 15% |

1500B

| SEE PAYS | | | |
|---|---|---|---|
| SYMBOLS ON ANY PAYLINE WITH MAX BET | | | PAYS |
| A | A | A | WIN 100 CREDITS |
| X | X | X | WIN RANDOM 10% BONUS |

5500A

| 5516 | 5502 | 5504 | 5506 | 5508 | 5510 | 5512 | 5514 |
|---|---|---|---|---|---|---|---|
| | REEL STOP | REEL 1 | REEL 2 | REEL 3 | REEL 4 | REEL 5 | WEIGHT |
| 5518 | 0 | A | A | K | K | K | 1 |
| | 1 | Q | Q | Q | Q | Q | 2 |
| | 2 | K | K | K | Q | Q | 3 |
| | 3 | K | K | K | K | K | 1 |

FIG. 55A

5500B

| 5540 | 5522 | 5524 | 5526 | 5528 | 5530 | 5532 | 5534 | 5536 | 5538 |
|---|---|---|---|---|---|---|---|---|---|
| | REEL STOP | REEL 1 | LOCA-TION | COUNT | REEL 2 | LOCA-TION | COUNT | ETC. ●●● | WEIGHT |
| 5542 | 0 | A | 0 | 5 | A | 3 | 7 | ●●● | 1 |
| | 1 | Q | 0 | 6 | Q | 3 | 7 | ●●● | 2 |
| | 2 | K | 0 | 7 | K | 4 | 7 | ●●● | 3 |
| | 3 | K | 3 | 2 | K | 4 | 7 | ●●● | 1 |

FIG. 55B

6000G

| 6006 REEL 3 | | 6018 REEL 3 | | 6060 REEL 3 |
|---|---|---|---|---|
| S1 | + | | = | S1 |
| S2 | + | | = | S2 |
| S3 | + | | = | S3 |
| S4 | + | A | = | A |
| S5 | + | A | = | A |
| S6 | + | A | = | A |
| S7 | + | A | = | A |
| S8 | + | A | = | A |
| S9 | + | | = | S9 |
| S10 | + | | = | S10 |

FIG. 60G

6000H

| 6002 REEL 1 | | 6032 REEL 1 | | 6062 REEL 1 |
|---|---|---|---|---|
| S1 | + | A | = | A |
| S2 | + | A | = | A |
| S3 | + | A | = | A |
| S4 | + | | = | S4 |
| S5 | + | | = | S5 |
| S6 | + | | = | S6 |
| S7 | + | A | = | A |
| S8 | + | A | = | A |
| S9 | + | | = | S9 |
| S10 | + | | = | S10 |

FIG. 60H

6000J

| 6004 REEL 2 | | 6034 REEL 2 | | 6064 REEL 2 |
|---|---|---|---|---|
| S1 | + | | = | S1 |
| S2 | + | | = | S2 |
| S3 | + | | = | S3 |
| S4 | + | | = | S4 |
| S5 | + | | = | S5 |
| S6 | + | | = | S6 |
| S7 | + | A | = | A |
| S8 | + | A | = | A |
| S9 | + | A | = | A |
| S10 | + | A | = | A |

FIG. 60J

6000K

| 6006 REEL 3 | | 6036 REEL 3 | | 6066 REEL 3 |
|---|---|---|---|---|
| S1 | + | A | = | A |
| S2 | + | A | = | A |
| S3 | + | A | = | A |
| S4 | + | | = | S4 |
| S5 | + | | = | S5 |
| S6 | + | | = | S6 |
| S7 | + | | = | S7 |
| S8 | + | | = | S8 |
| S9 | + | A | = | A |
| S10 | + | A | = | A |

FIG. 60K

6000L

| 6002 REEL 1 | | 6042 REEL 1 | | 6068 REEL 1 |
|---|---|---|---|---|
| S1 | + | K | = | K |
| S2 | + | K | = | K |
| S3 | + | K | = | K |
| S4 | + | | = | S4 |
| S5 | + | K | = | K |
| S6 | + | K | = | K |
| S7 | + | K | = | K |
| S8 | + | K | = | K |
| S9 | + | K | = | K |
| S10 | + | K | = | K |

FIG. 60L

6000M

| 6004 REEL 2 | | 6044 REEL 2 | | 6070 REEL 2 |
|---|---|---|---|---|
| S1 | + | A | = | A |
| S2 | + | A | = | A |
| S3 | + | K | = | K |
| S4 | + | K | = | K |
| S5 | + | | = | S5 |
| S6 | + | A | = | A |
| S7 | + | A | = | A |
| S8 | + | A | = | A |
| S9 | + | | = | S9 |
| S10 | + | | = | S10 |

FIG. 60M

ELECTRONIC GAMING DEVICE WITH DYNAMIC STACKING FUNCTIONALITY

CROSS-REFERENCE TO RELATED PATENT APPLICATION

This application claims prior to Provisional Patent Application No. 62/019,237 entitled "ELECTRONIC GAMING DEVICE WITH DYNAMIC STACKING FUNCTIONALITY", filed on Jun. 30, 2014, and this application claims prior to Provisional Patent Application No. 62/030,019 entitled "ELECTRONIC GAMING DEVICE WITH DYNAMIC STACKING FUNCTIONALITY", filed on Jul. 28, 2014, which are incorporated herein by reference in their entireties.

BACKGROUND

Field

The subject matter disclosed herein relates to an electronic gaming device. More specifically, the disclosure relates to providing one or more stacking functionalities on a gaming device.

Information

The gaming industry has numerous casinos located both worldwide and in the United States. Further, numerous gaming entities have one or more online (e.g., non-physical) locations on the internet and/or worldwide web and/or mobile gaming applications (e.g., hand held computers, notebook, etc.). A client of a casino or other gaming entity can gamble via various games of chance. For example, craps, roulette, baccarat, blackjack, and electronic games (e.g., a slot machine) are games of chance where a person may gamble on an outcome.

Paylines of an electronic gaming device (e.g., a slot machine) are one way utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more stacking functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

FIG. 7A is an illustration of stacking game play on a gaming device, according to one embodiment.

FIG. 7B is another illustration of stacking game play on a gaming device, according to one embodiment.

FIG. 50 is another illustration of stacking game play on a gaming device, according to one embodiment.

FIG. 51 is another illustration of stacking game play on a gaming device, according to one embodiment.

FIG. 52 is another illustration of stacking game play on a gaming device, according to one embodiment.

FIG. 53 is a flow diagram for game play, according to one embodiment.

FIG. 54A is another illustration of stacking game play on a gaming device, according to one embodiment.

FIG. 54B is another illustration of stacking game play on a gaming device, according to one embodiment.

FIG. 55A is another illustration of stacking game play on a gaming device, according to one embodiment.

FIG. 55B is another illustration of stacking game play on a gaming device, according to one embodiment.

FIG. 55C is another illustration of stacking game play on a gaming device, according to one embodiment.

FIG. 55D is another illustration of stacking game play on a gaming device, according to one embodiment.

FIG. 55E is another illustration of stacking game play on a gaming device, according to one embodiment.

FIG. 56A is an illustration of stacking game play on a gaming device, according to one embodiment.

Figure 56A:
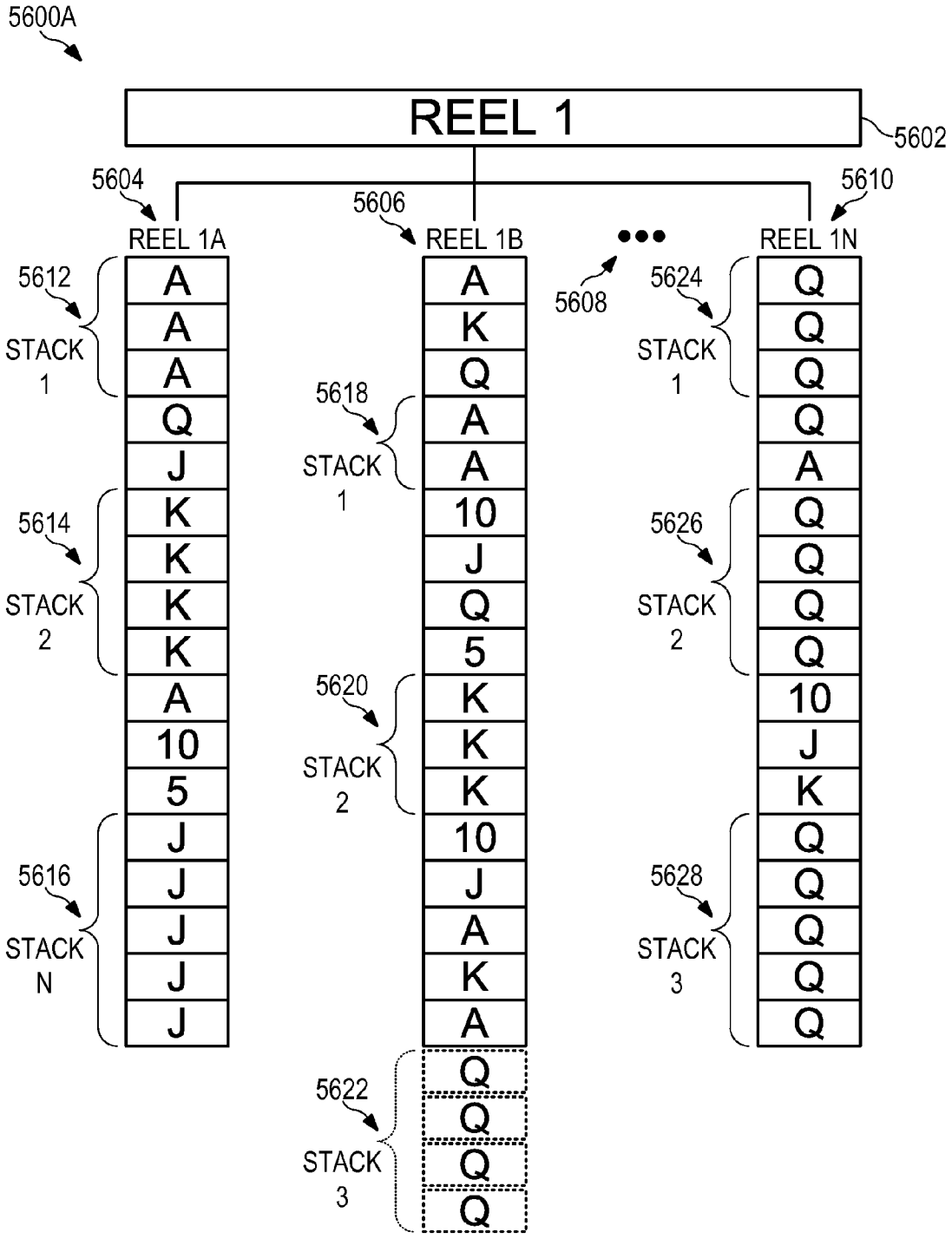
Figure 56B:
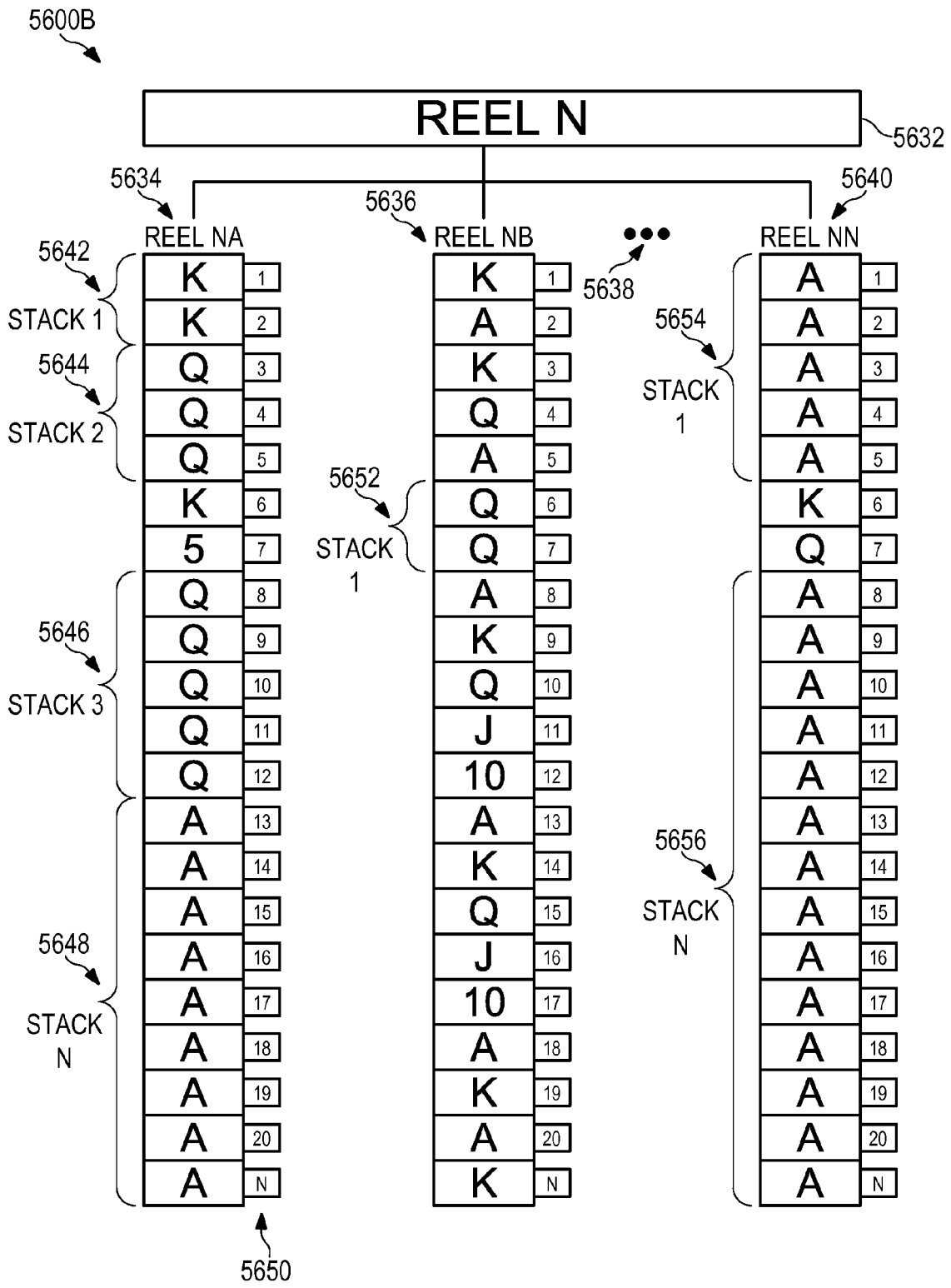

FIG. 56B is another illustration of stacking game play on a gaming device, according to one embodiment.

Figure 56C:
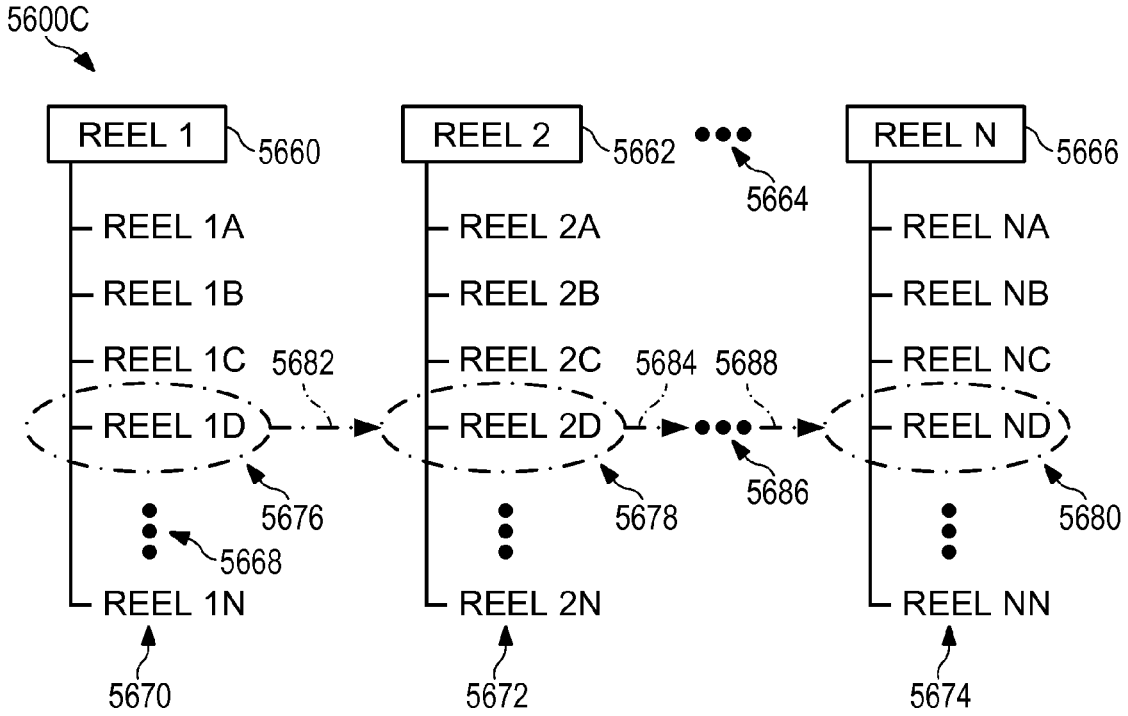

FIG. 56C is an illustration of stacking game play on a gaming device, according to one embodiment.

Figure 56D:
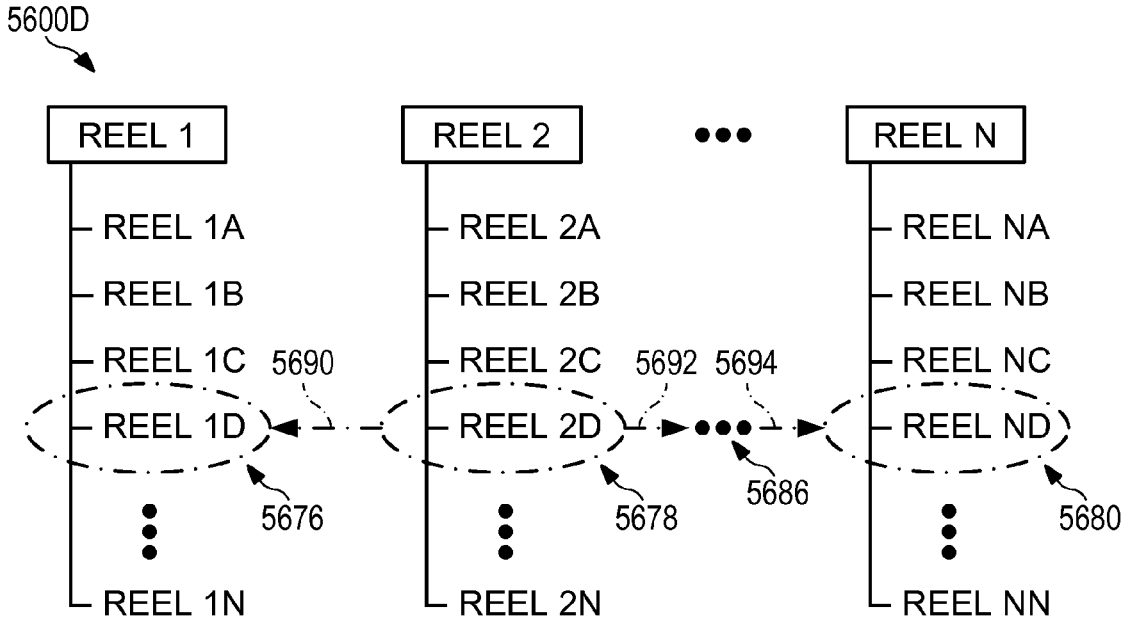

FIG. 56D is another illustration of stacking game play on a gaming device, according to one embodiment.

Figure 56E:
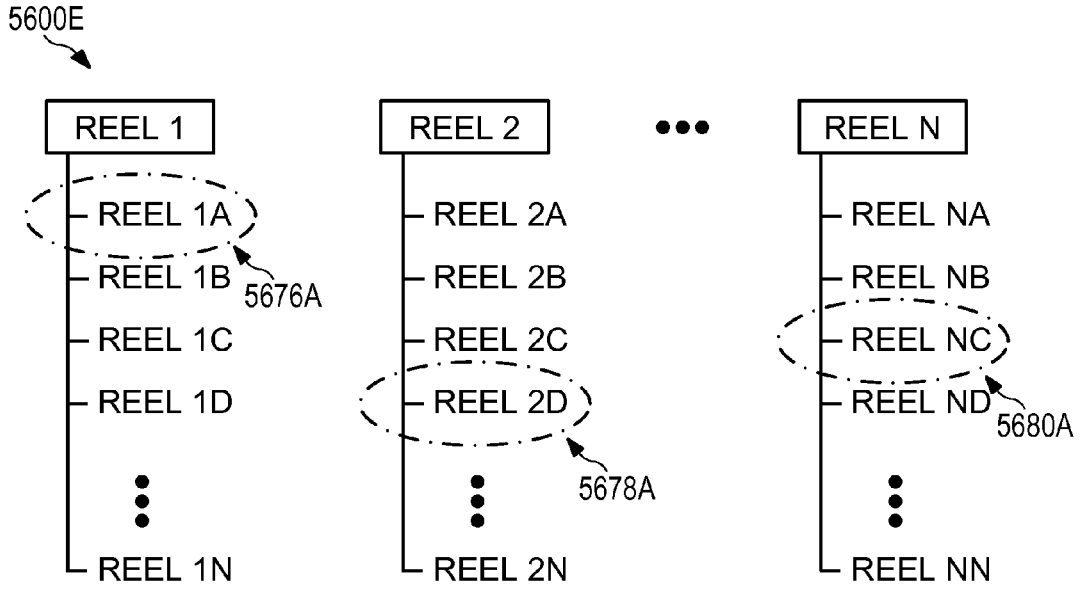

FIG. 56E is an illustration of stacking game play on a gaming device, according to one embodiment.

Figure 56F:
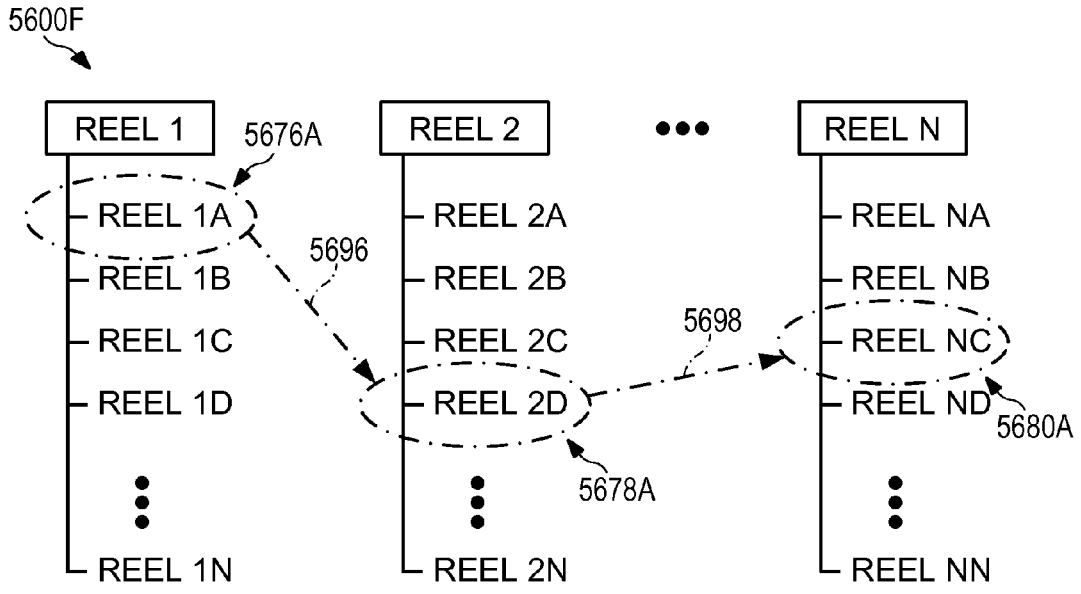

FIG. 56F is another illustration of stacking game play on a gaming device, according to one embodiment.

Figure 56G:
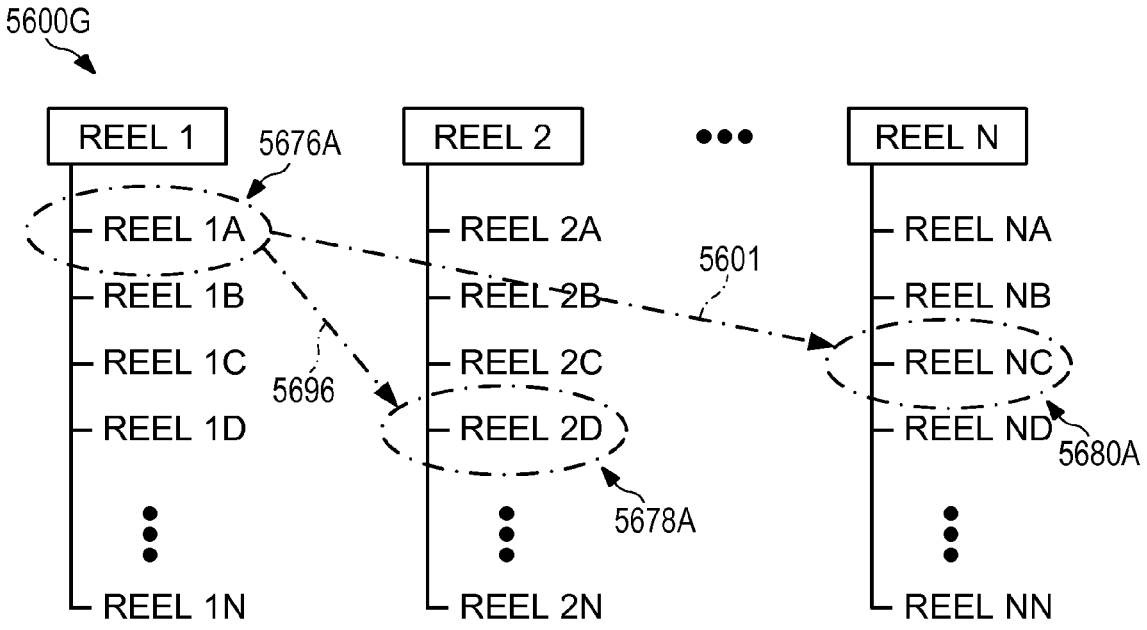

FIG. 56G is another illustration of stacking game play on a gaming device, according to one embodiment.

Figure 57:
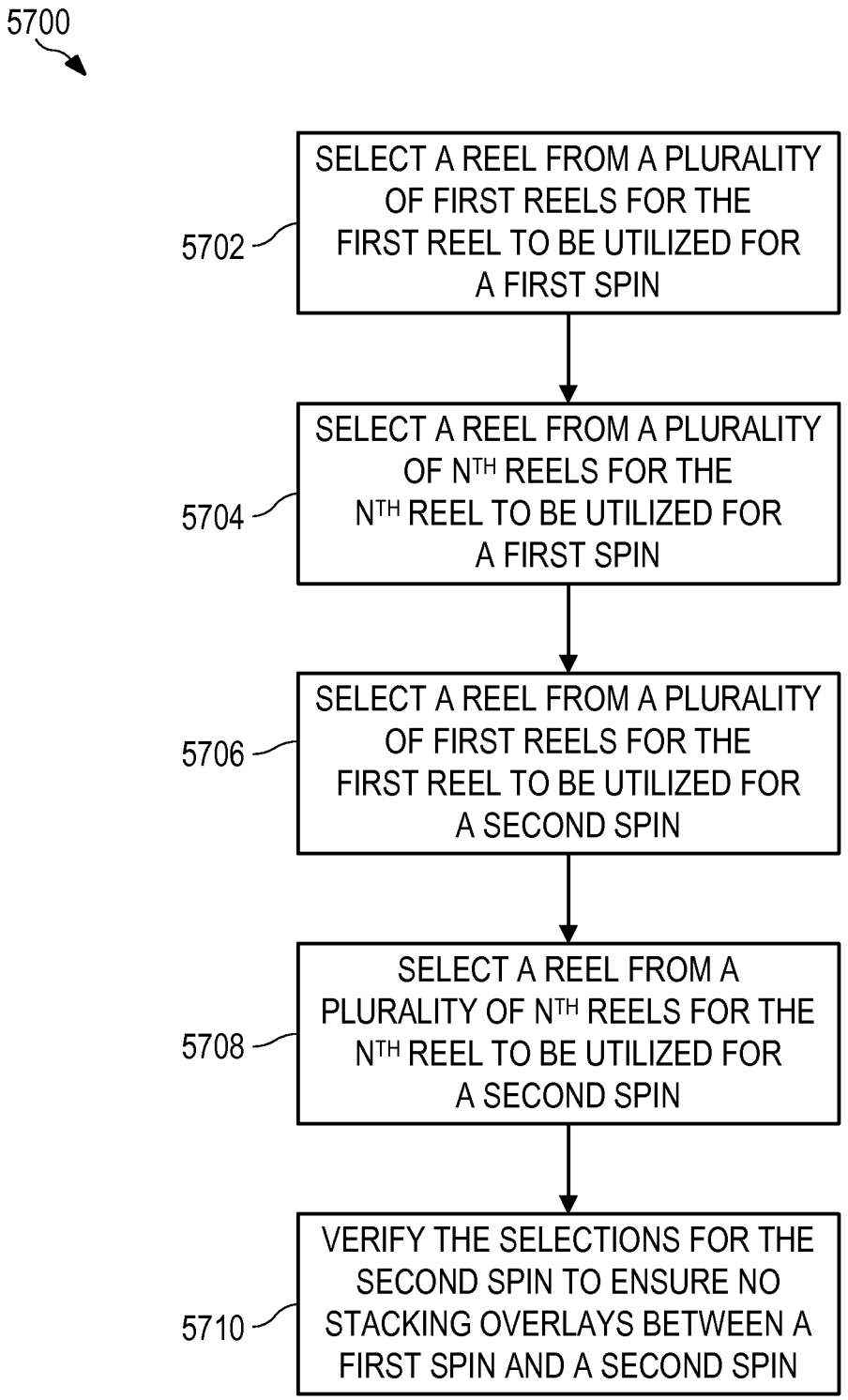

FIG. 57 is a flow diagram for game play, according to one embodiment.

Figure 58A:
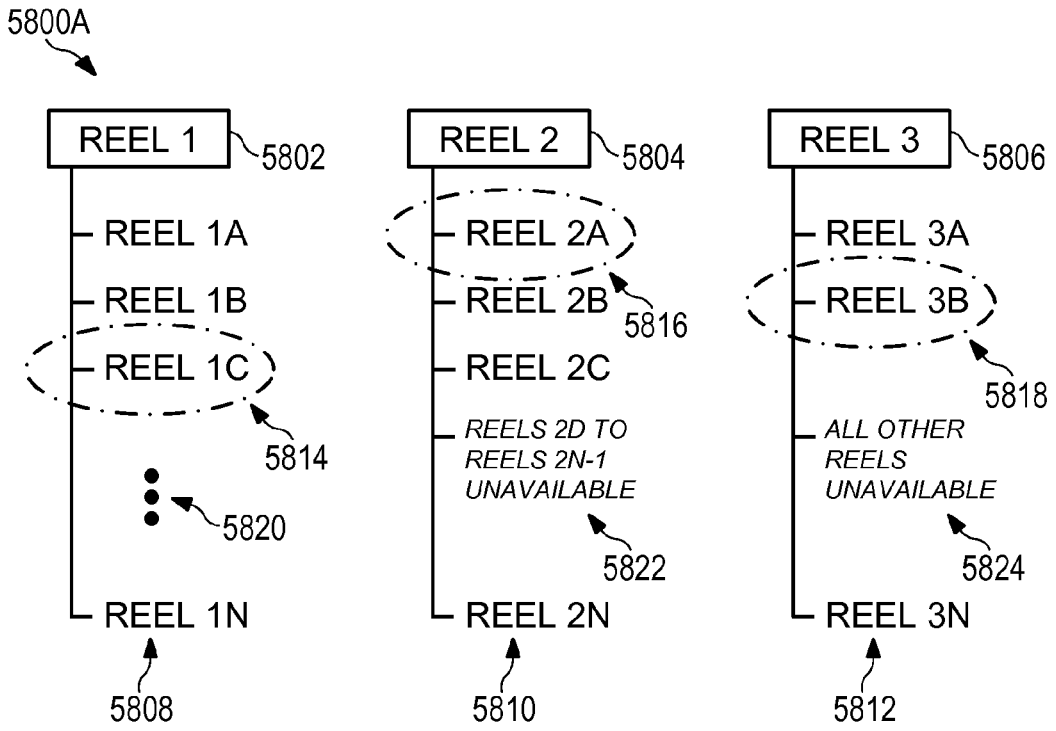

FIG. 58A is an illustration of stacking game play on a gaming device, according to one embodiment.

Figure 58B:
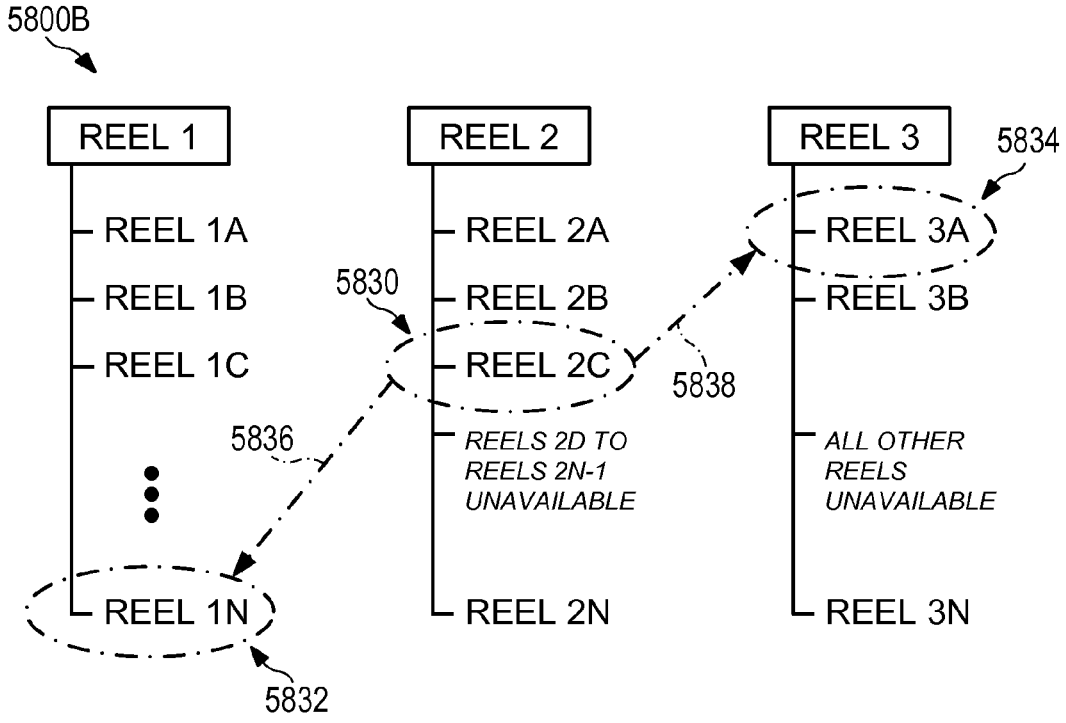

FIG. 58B is another illustration of stacking game play on a gaming device, according to one embodiment.

Figure 59:
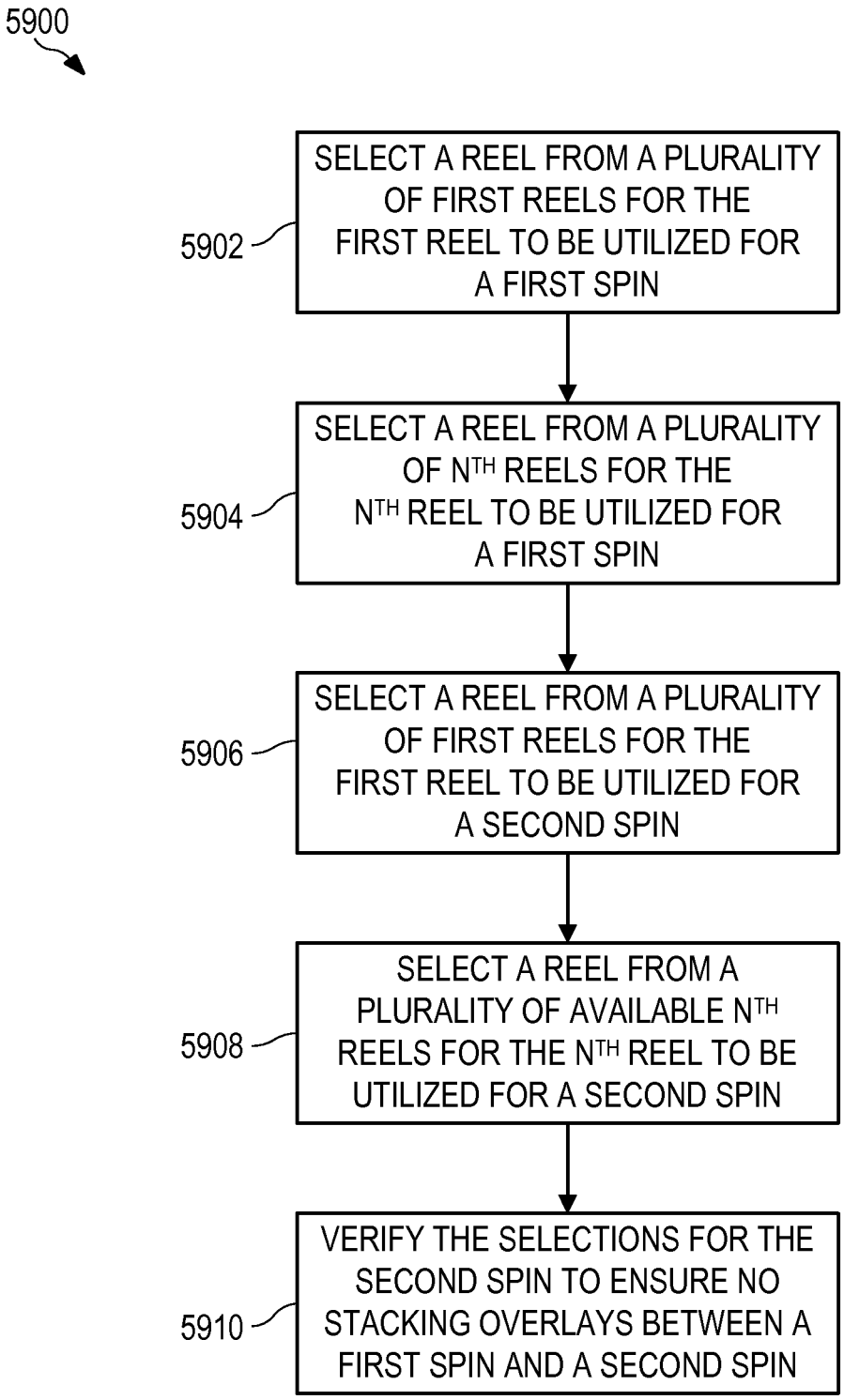

FIG. 59 is a flow diagram for game play, according to one embodiment.

Figure 60A:
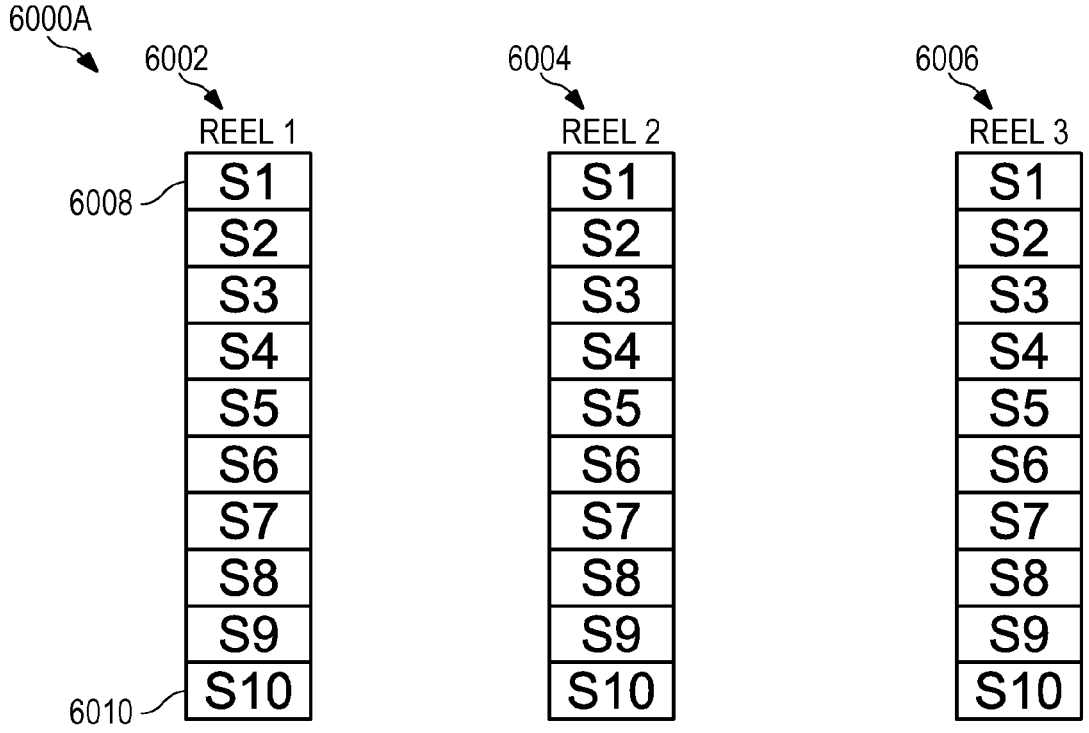

FIG. 60A is an illustration of stacking game play on a gaming device, according to one embodiment.

Figure 60B:
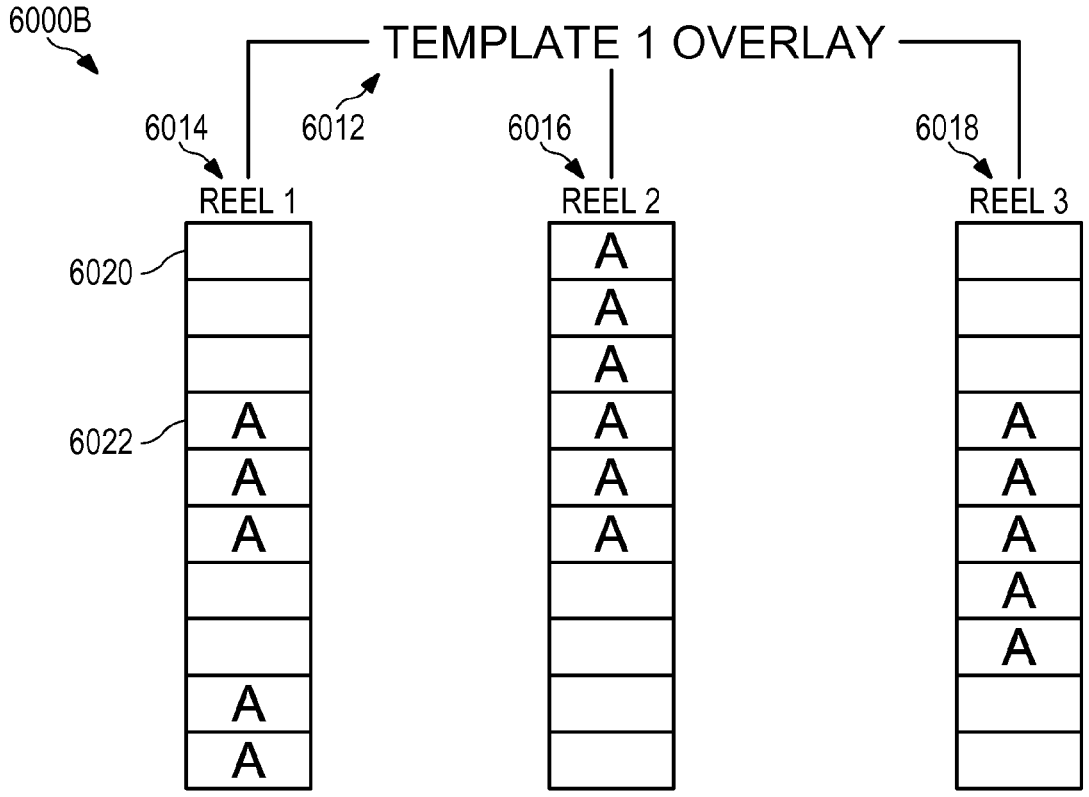

FIG. 60B is another illustration of stacking game play on a gaming device, according to one embodiment.

Figure 60C:
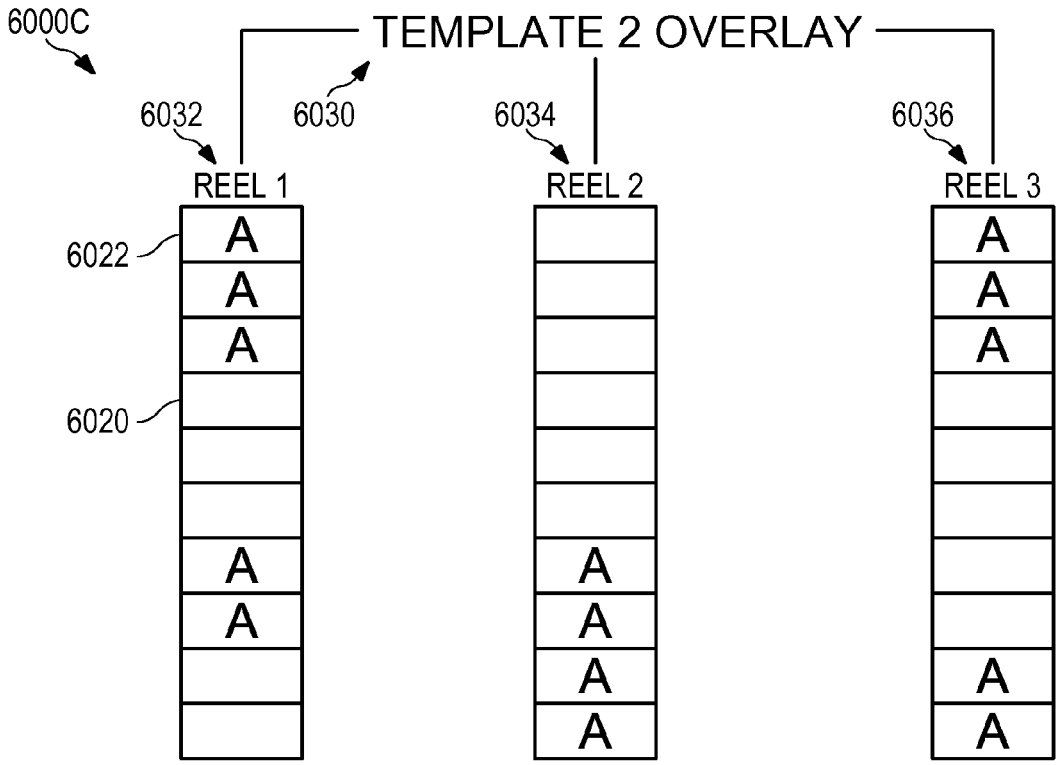

FIG. 60C is an illustration of stacking game play on a gaming device, according to one embodiment.

Figure 60D:
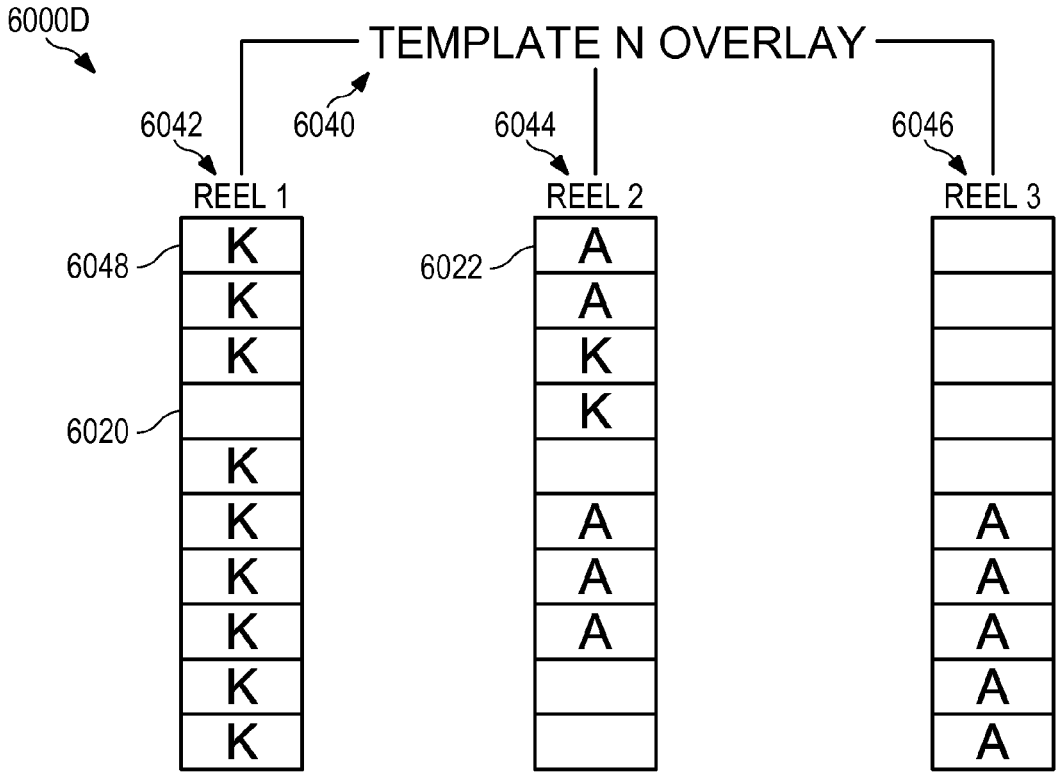

FIG. 60D is another illustration of stacking game play on a gaming device, according to one embodiment.

Figure 60E:
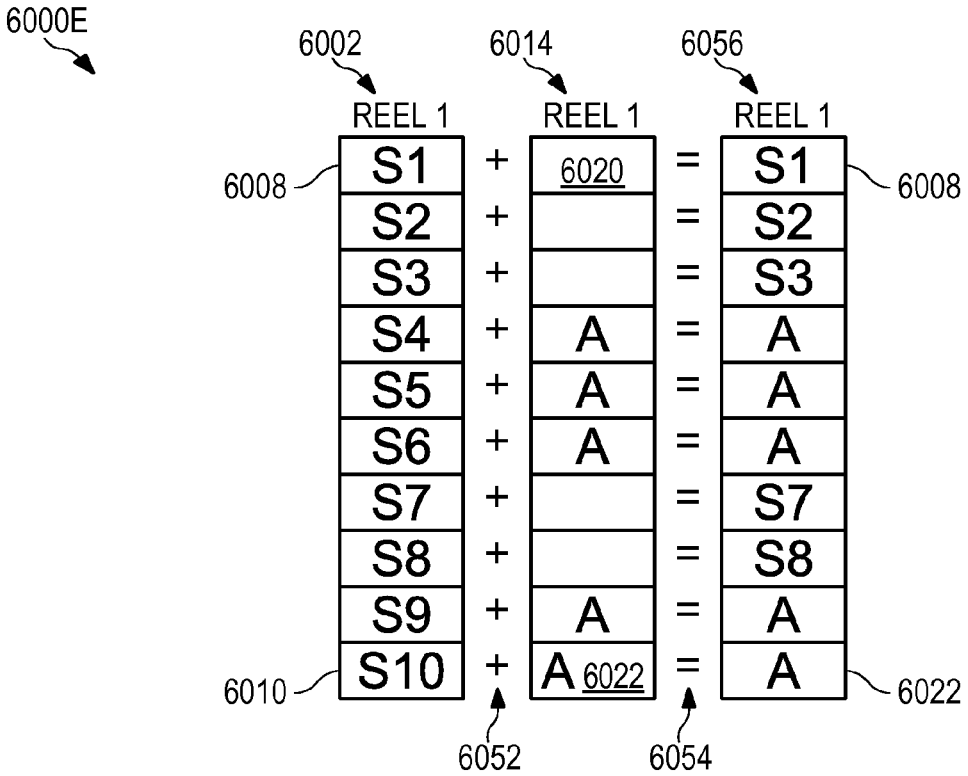

FIG. 60E is an illustration of stacking game play on a gaming device, according to one embodiment.

Figure 60F:
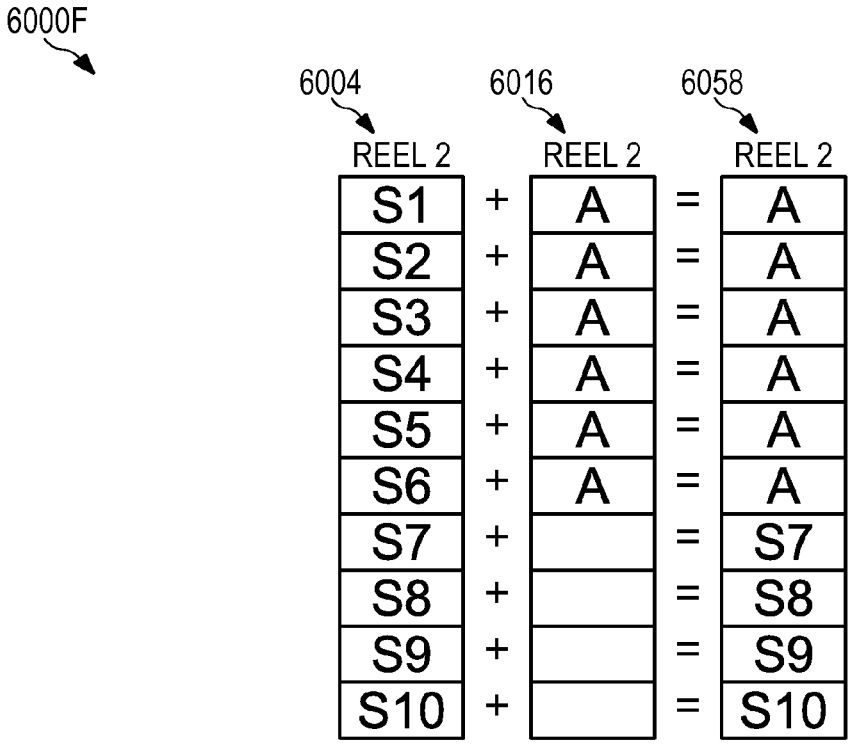

FIG. 60F is another illustration of stacking game play on a gaming device, according to one embodiment.

FIG. 60G is another illustration of stacking game play on a gaming device, according to one embodiment.

FIG. 60H is another illustration of stacking game play on a gaming device, according to one embodiment.

FIG. 60J is another illustration of stacking game play on a gaming device, according to one embodiment.

FIG. 60K is another illustration of stacking game play on a gaming device, according to one embodiment.

FIG. 60L is another illustration of stacking game play on a gaming device, according to one embodiment.

FIG. 60M is another illustration of stacking game play on a gaming device, according to one embodiment.

Figure 60N:
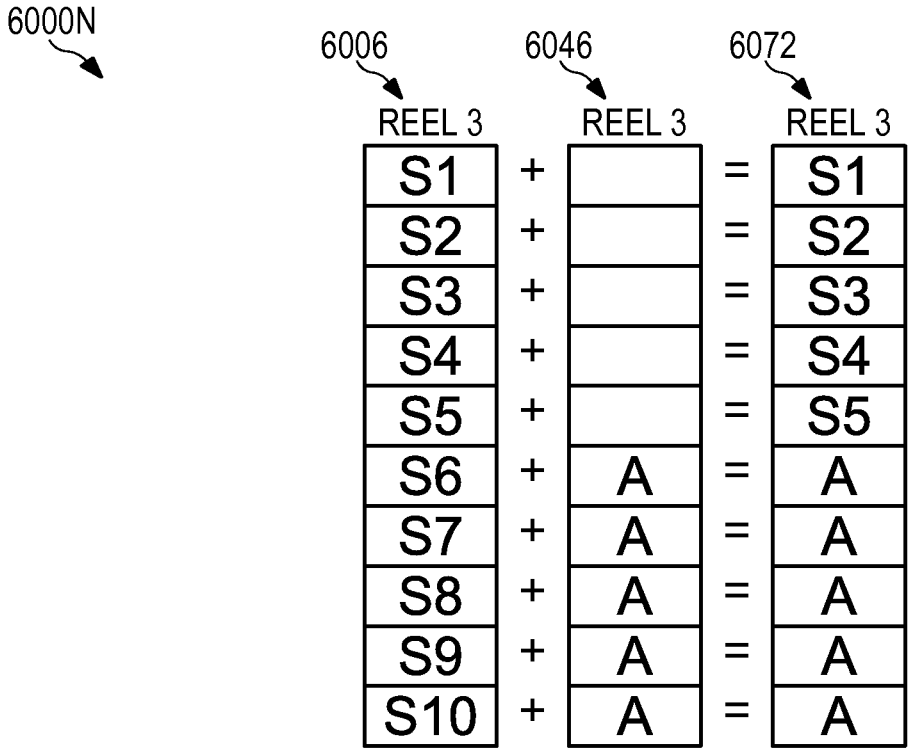

FIG. 60N is another illustration of stacking game play on a gaming device, according to one embodiment.

Figure 61A:
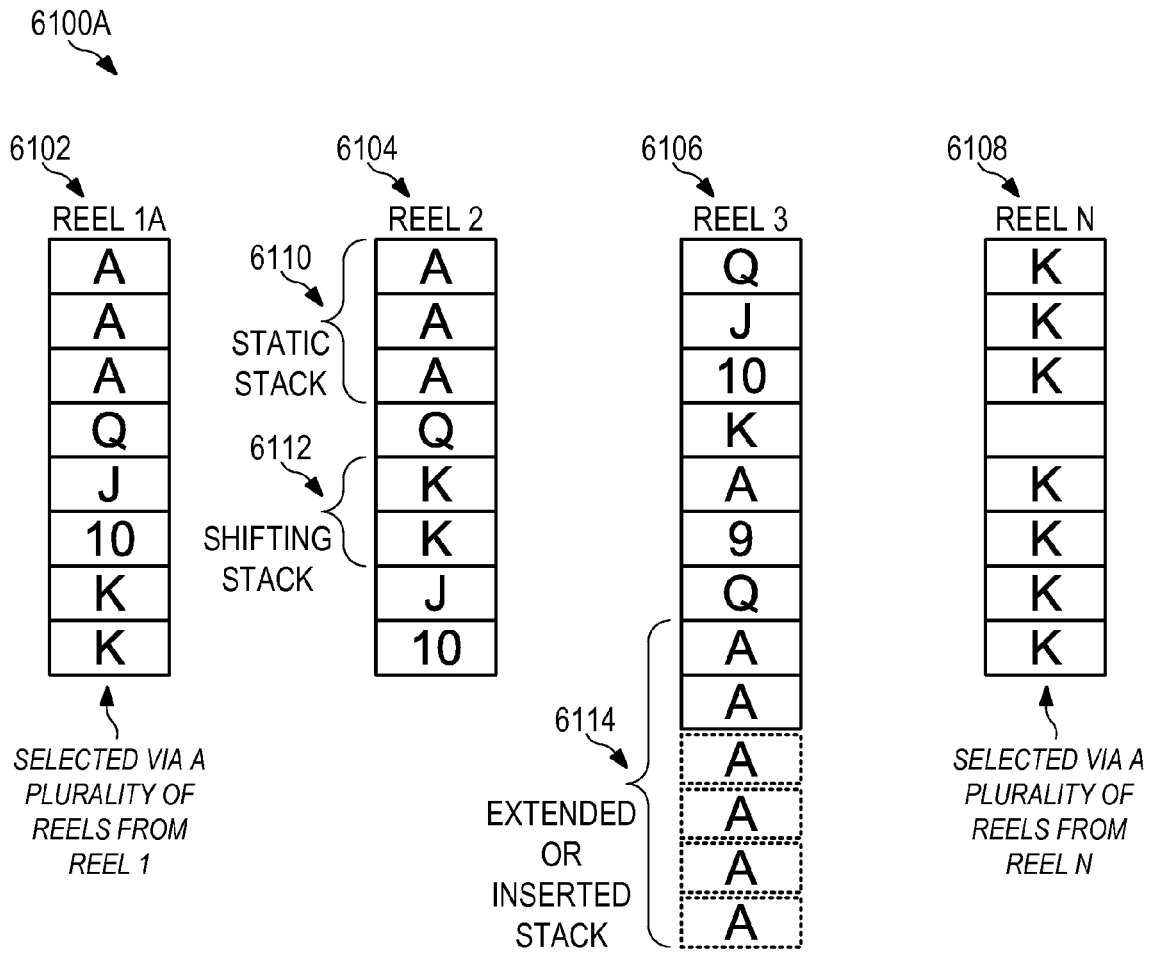

FIG. 61A is an illustration of stacking game play on a gaming device, according to one embodiment.

Figure 61B:
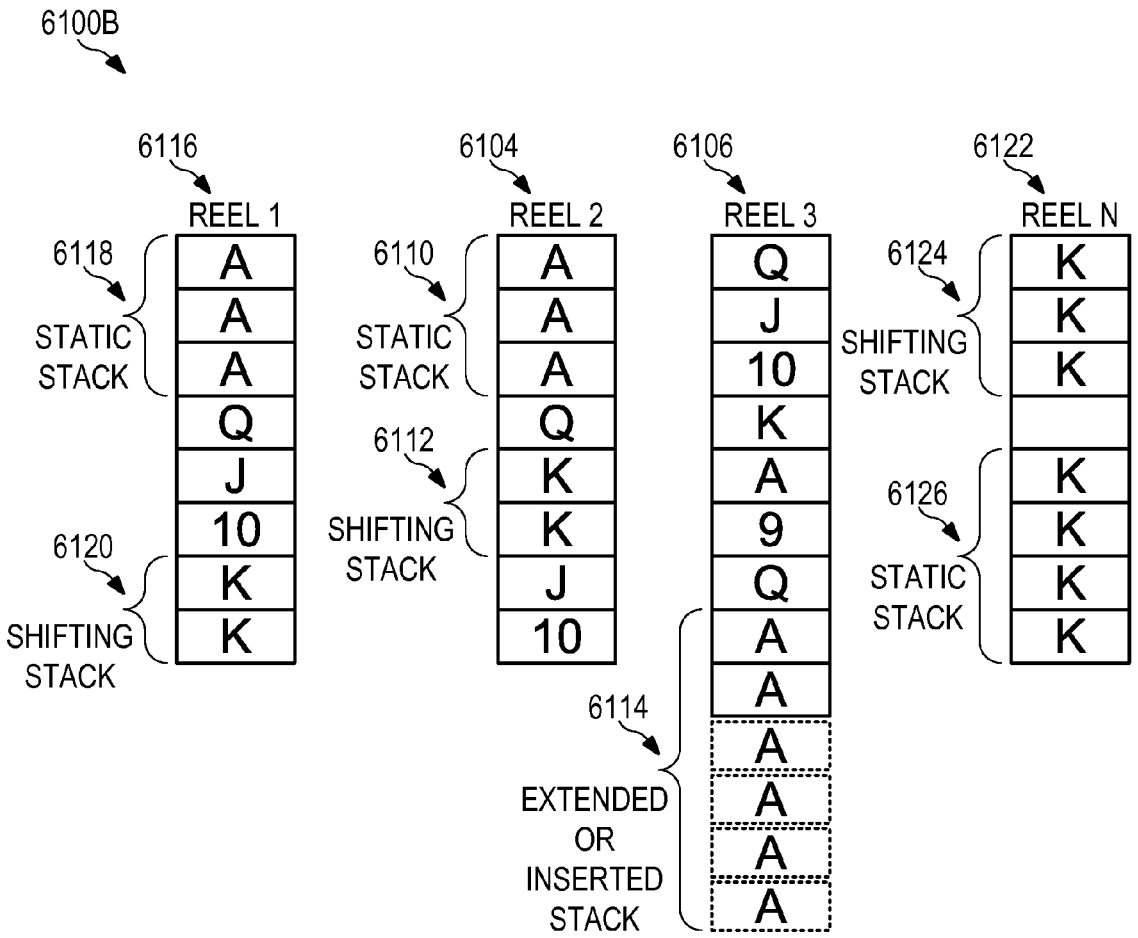

FIG. 61B is another illustration of stacking game play on a gaming device, according to one embodiment.

Figure 61C:
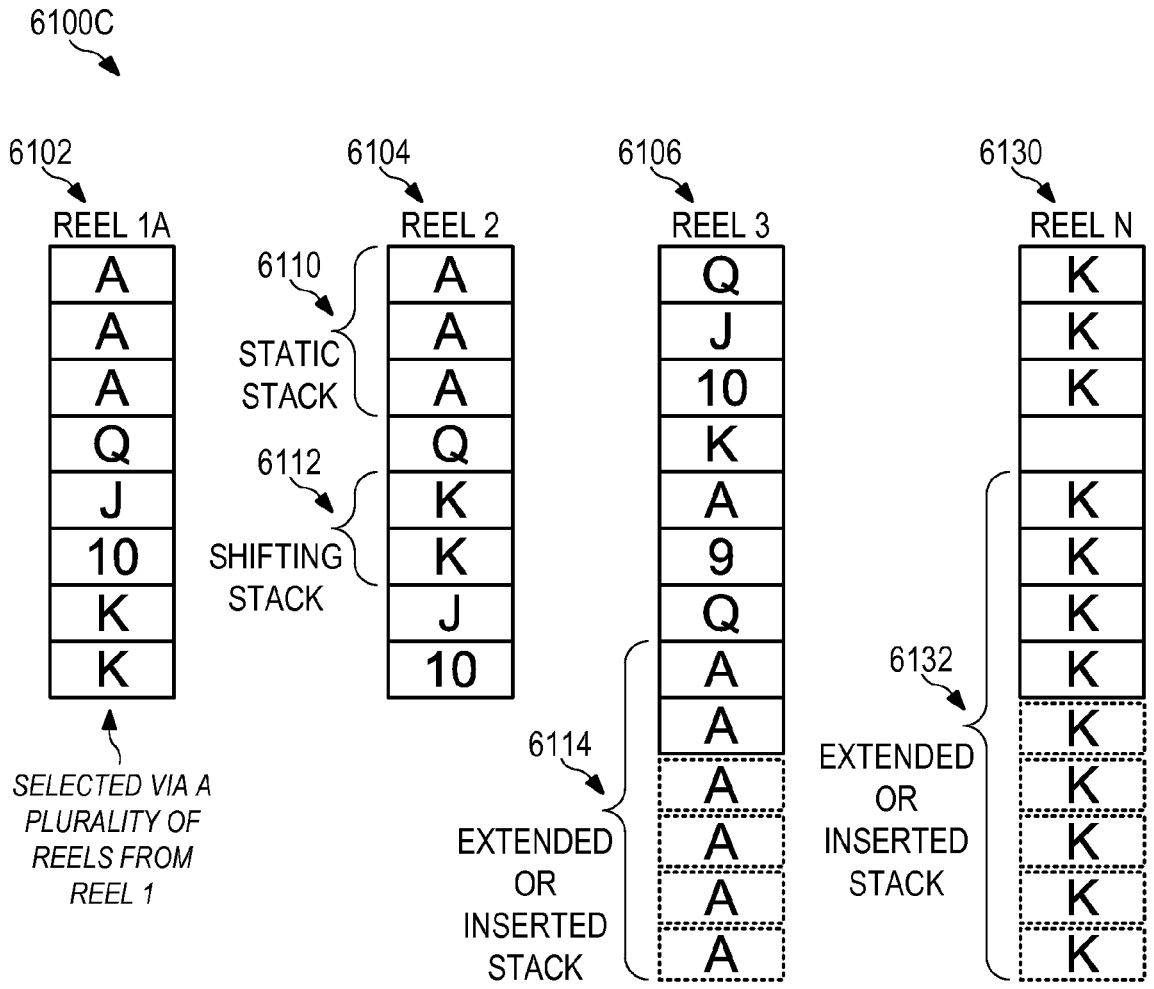

FIG. 61C is an illustration of stacking game play on a gaming device, according to one embodiment.

Figure 61D:
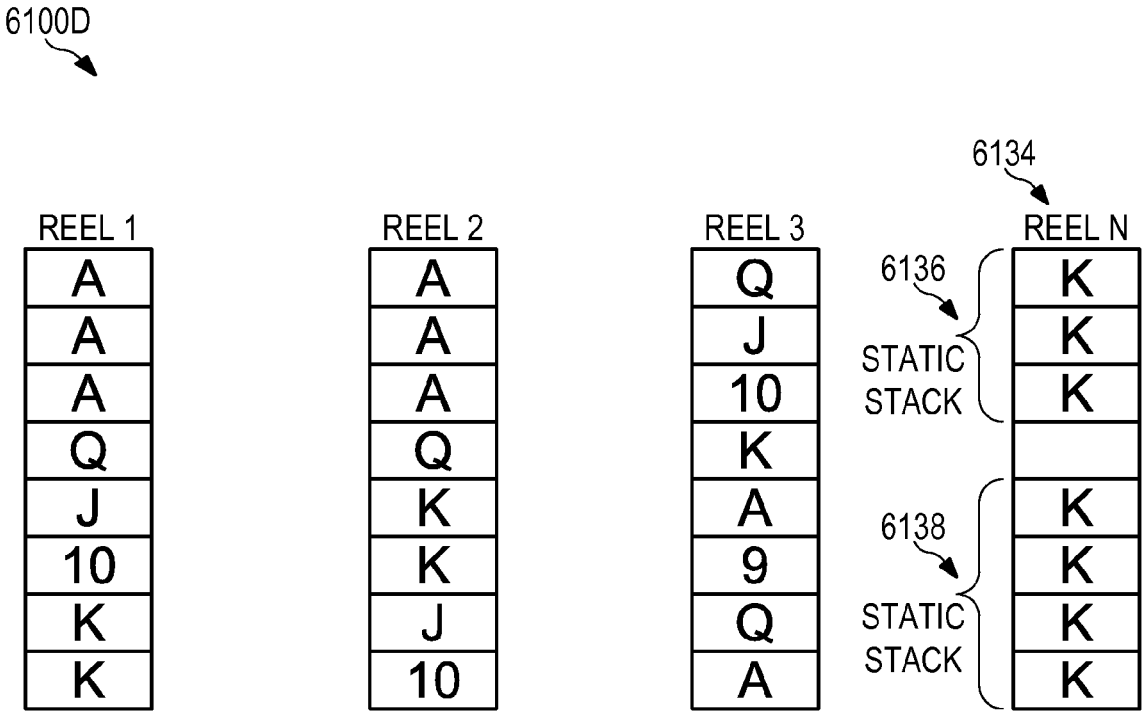

FIG. 61D is another illustration of stacking game play on a gaming device, according to one embodiment.

Figure 61E:
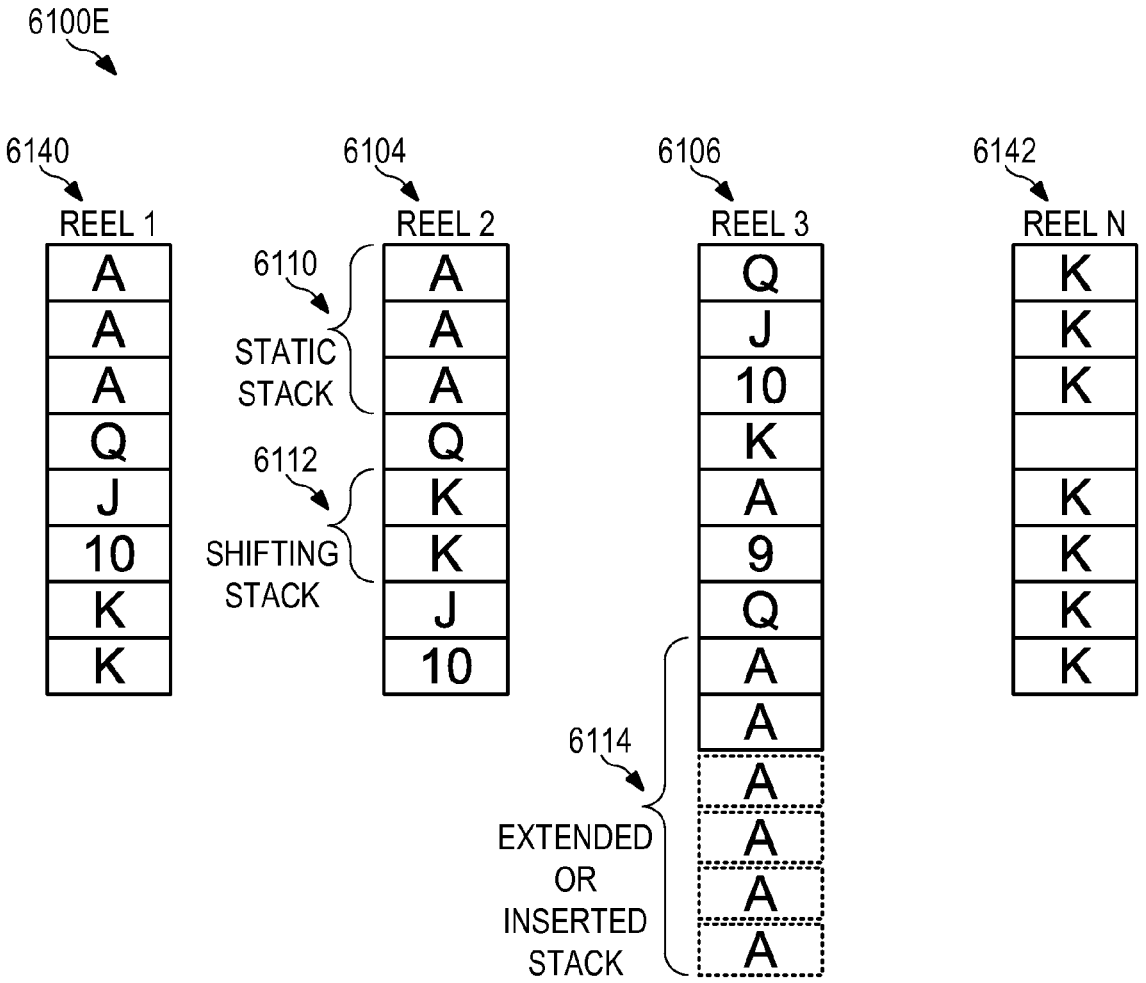

FIG. 61E is an illustration of stacking game play on a gaming device, according to one embodiment.

Figure 62A:
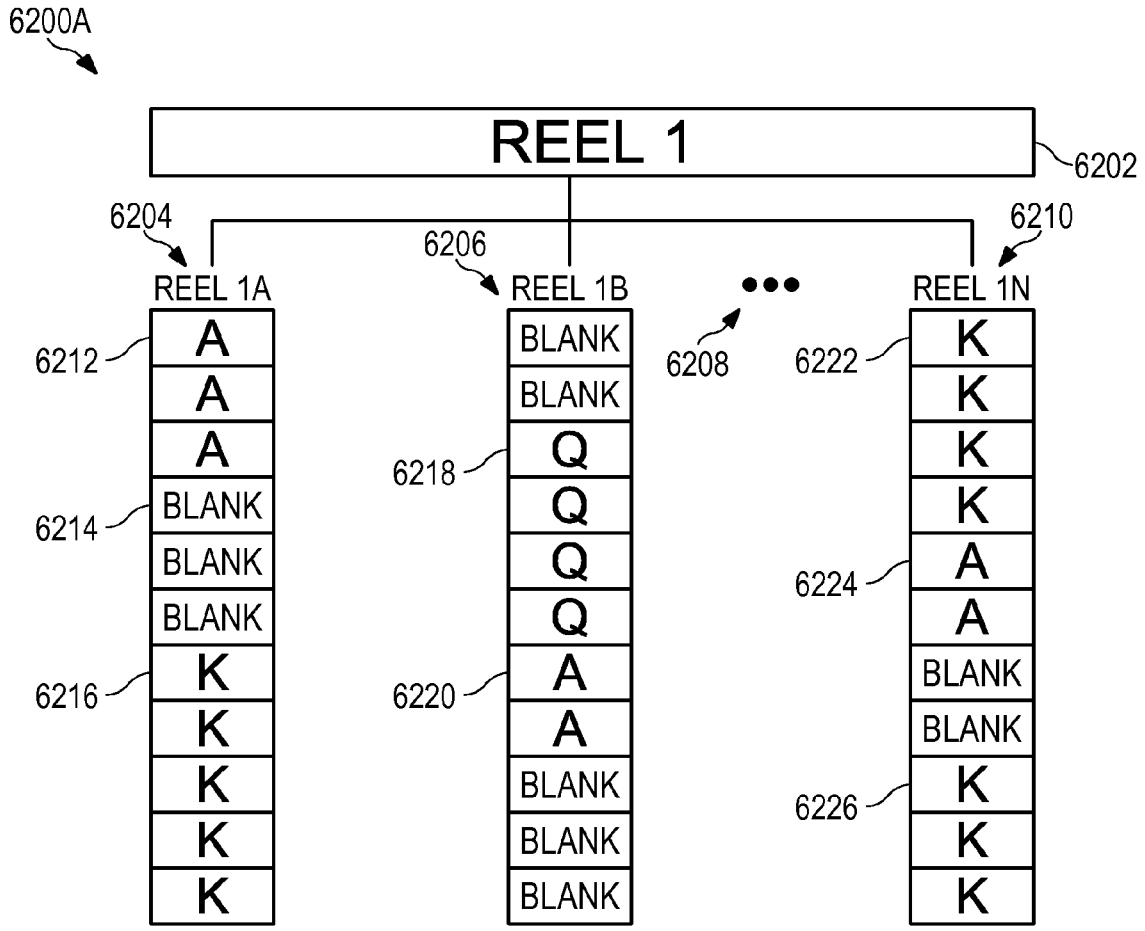

FIG. 62A is an illustration of stacking game play on a gaming device, according to one embodiment.

Figure 62B:
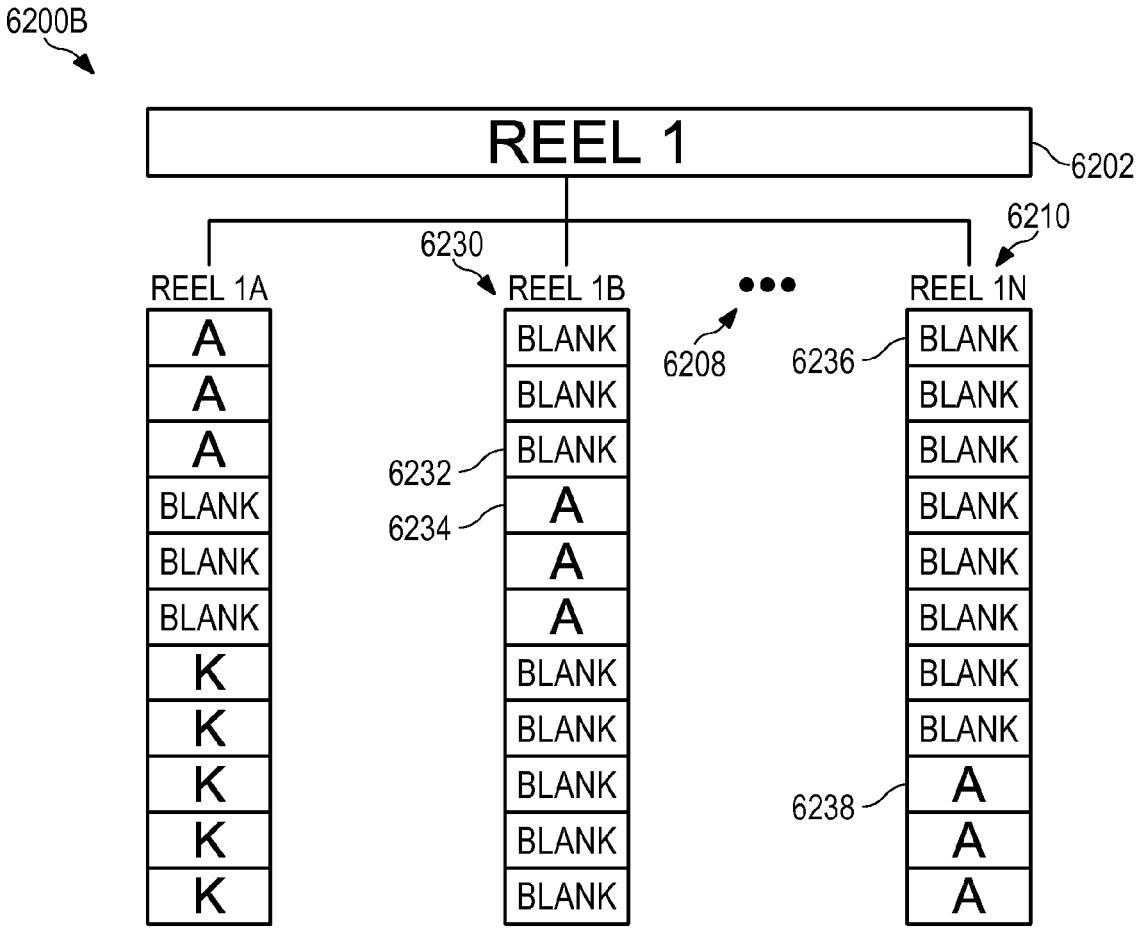

FIG. 62B is another illustration of stacking game play on a gaming device, according to one embodiment.

Figure 62C:
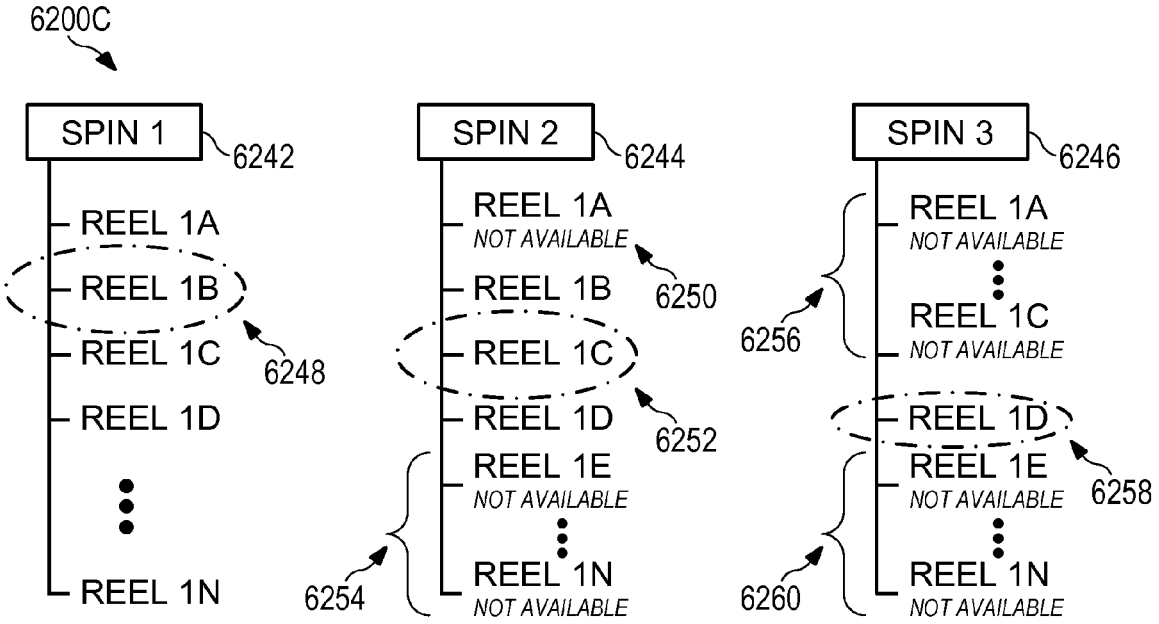

FIG. 62C is an illustration of stacking game play on a gaming device, according to one embodiment.

Figure 63A:
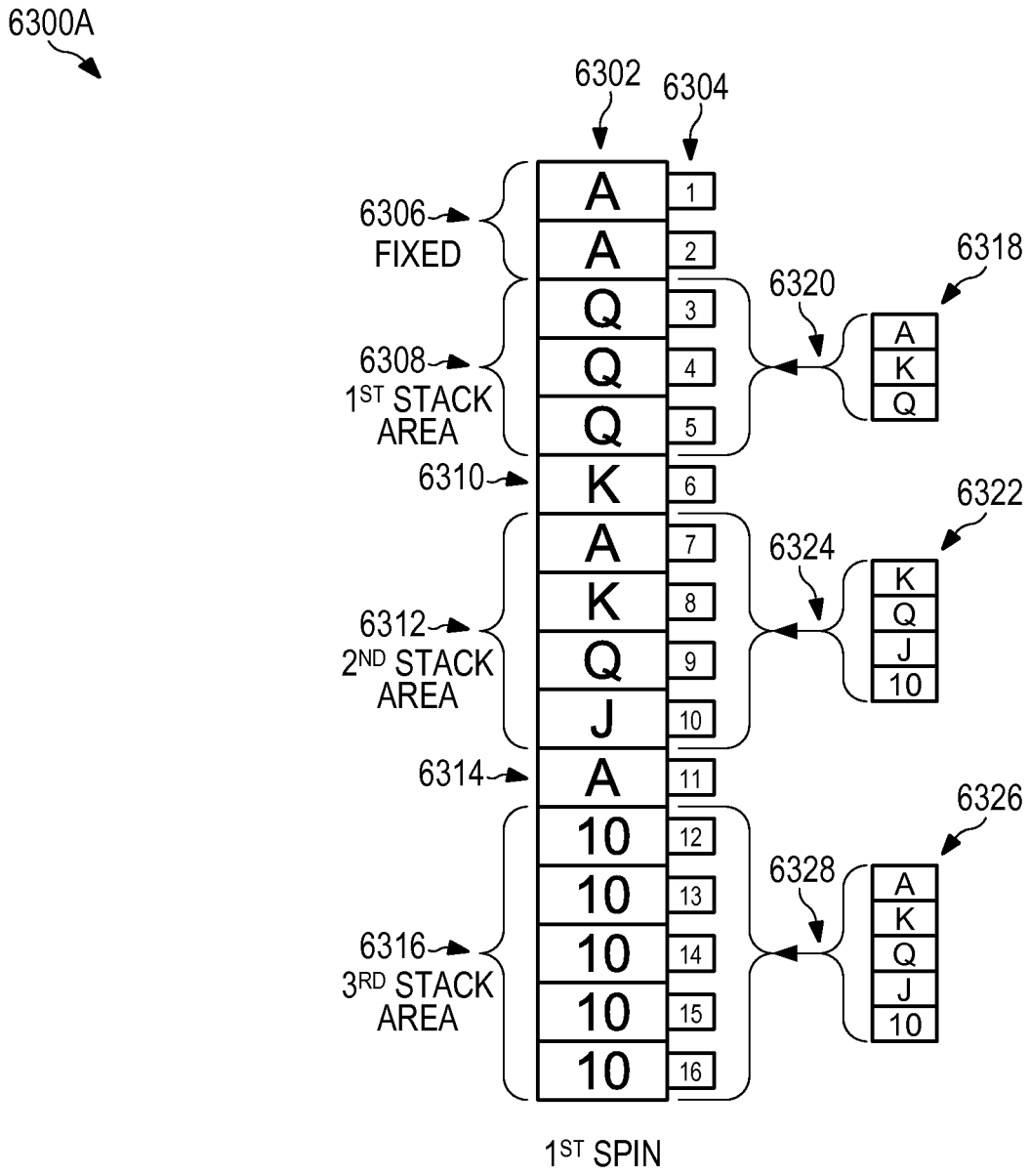

FIG. 63A is an illustration of stacking game play on a gaming device, according to one embodiment.

Figure 63B:
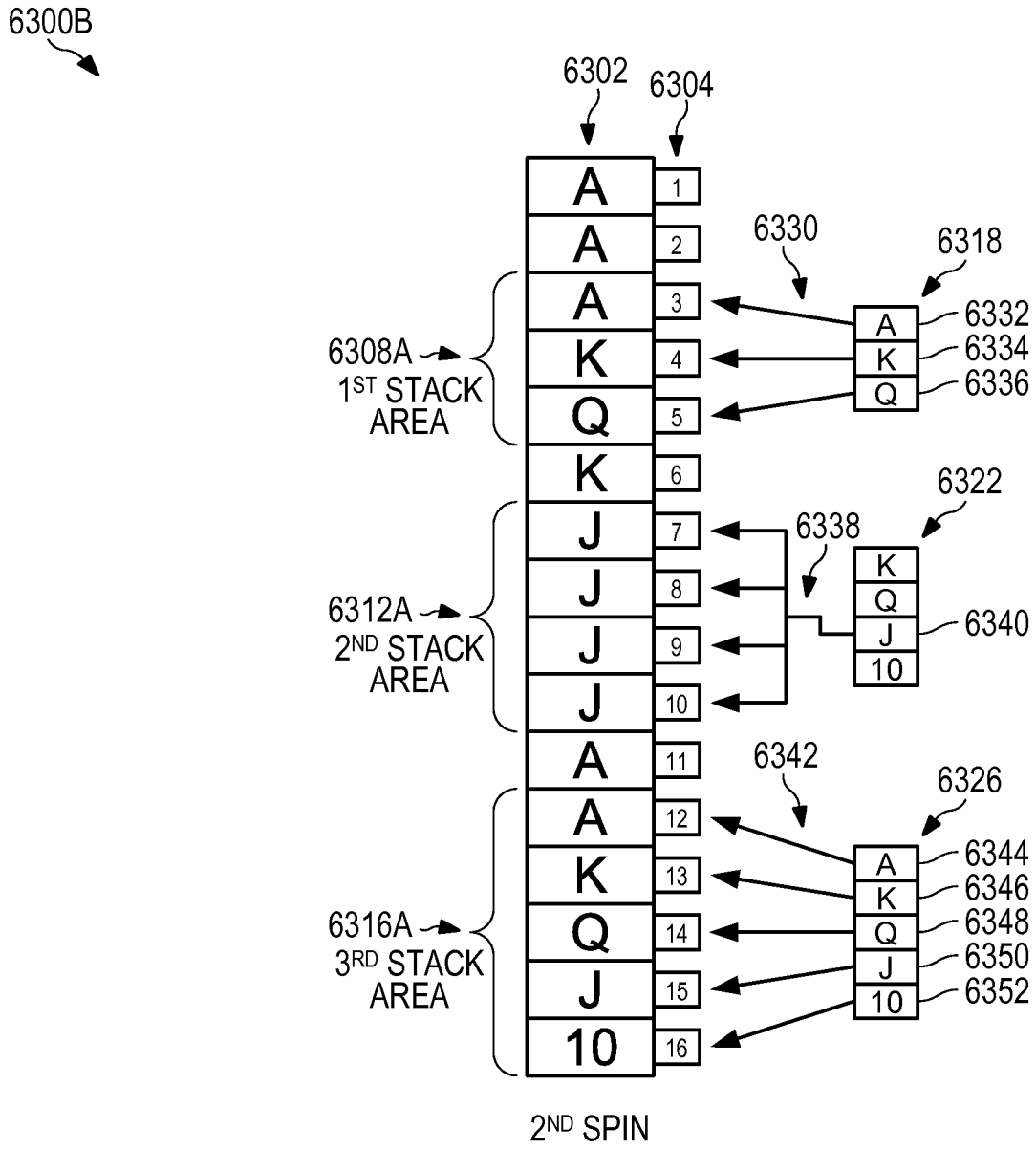

FIG. 63B is another illustration of stacking game play on a gaming device, according to one embodiment.

Figure 63C:
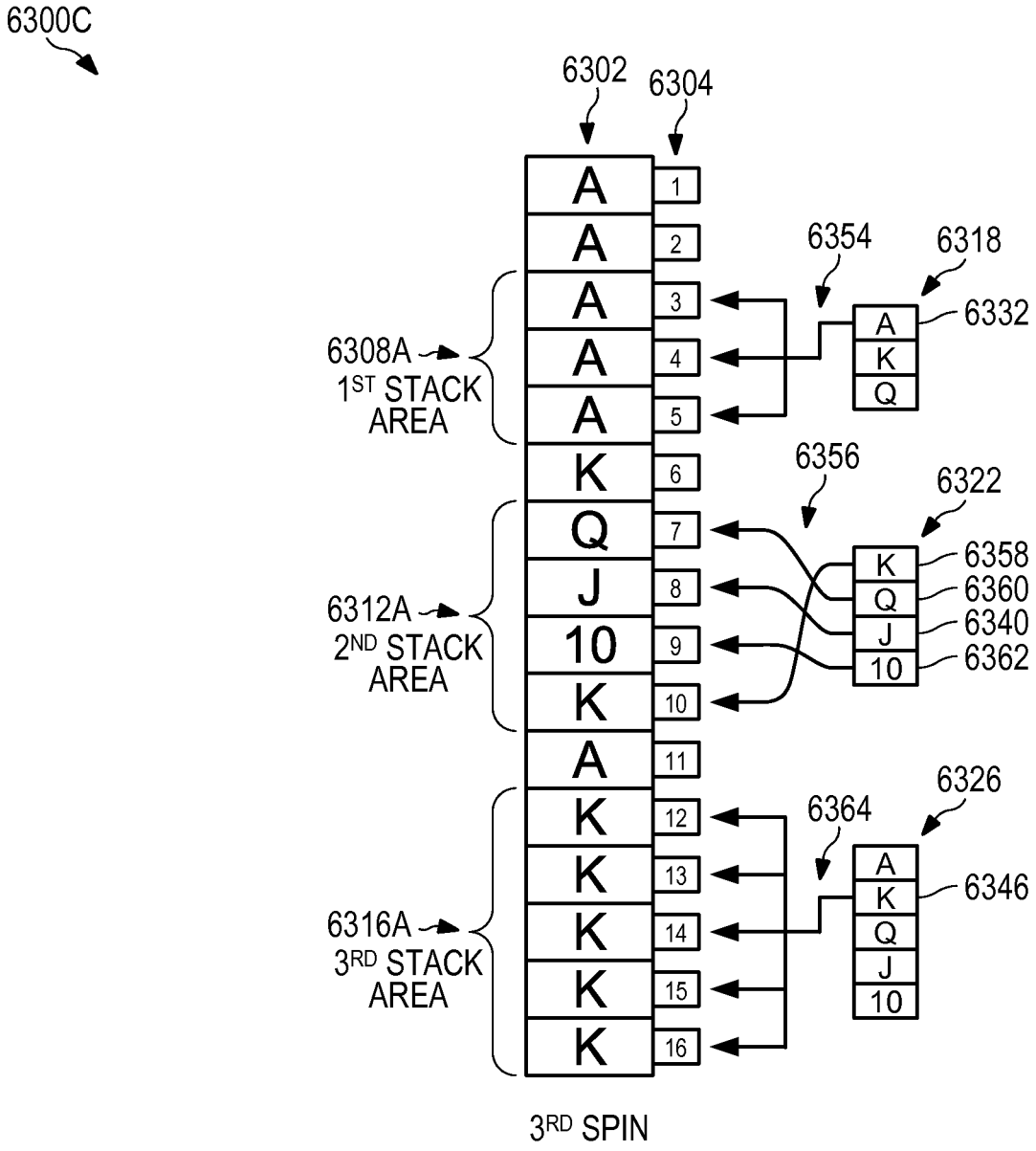

FIG. 63C is an illustration of stacking game play on a gaming device, according to one embodiment.

Figure 64A:
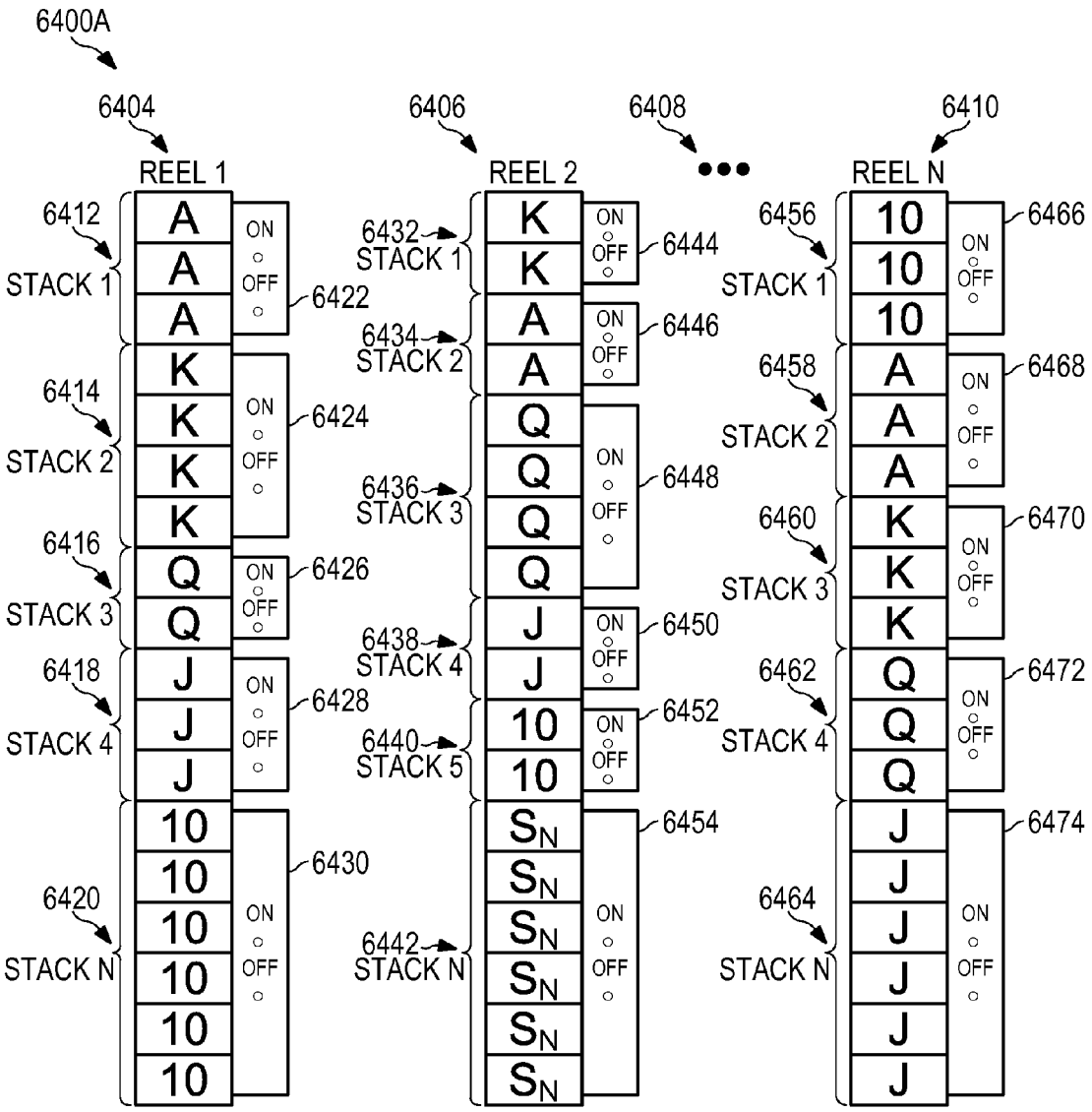

FIG. 64A is an illustration of stacking game play on a gaming device, according to one embodiment.

Figure 64B:
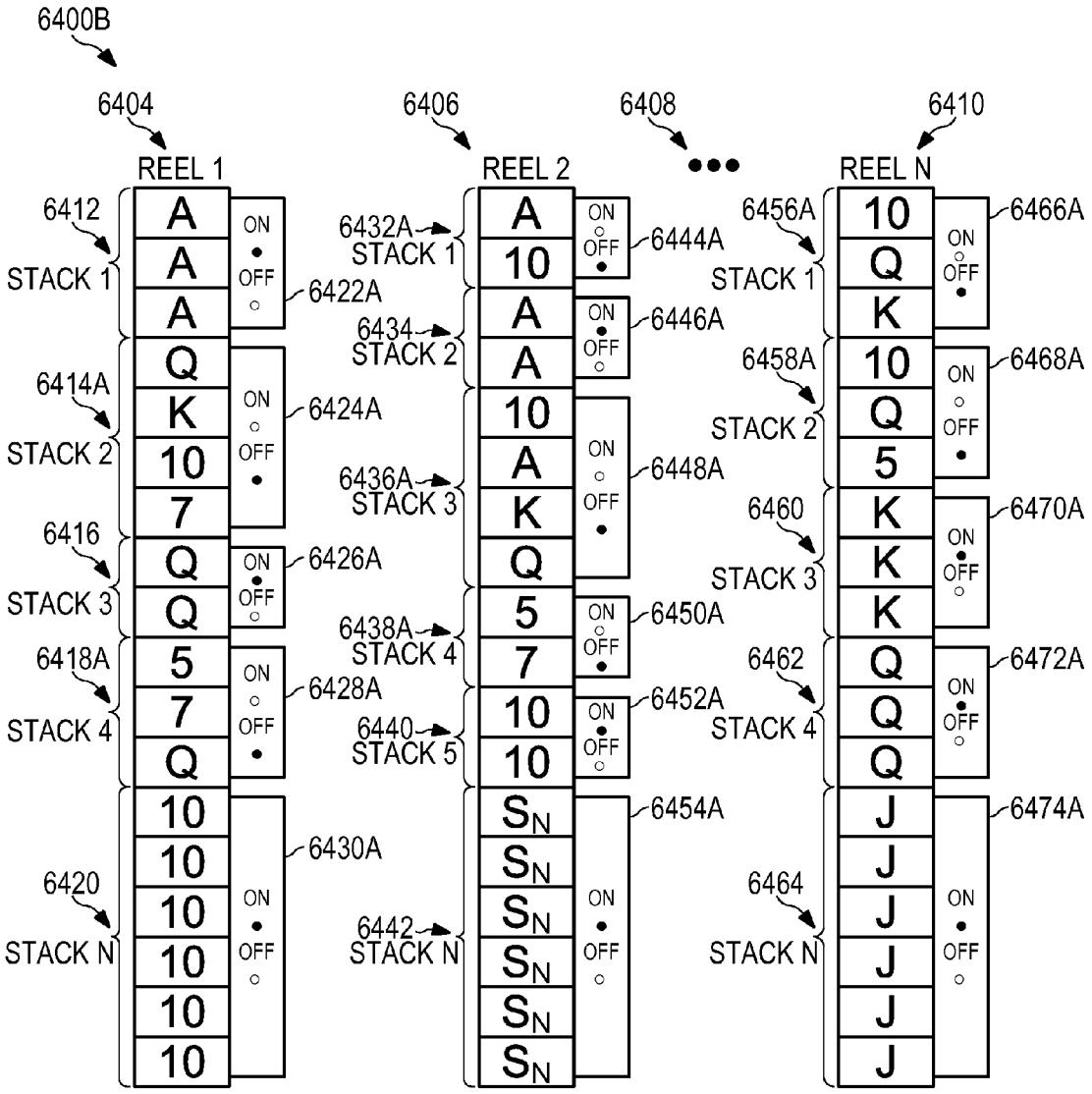

FIG. 64B is another illustration of stacking game play on a gaming device, according to one embodiment.

Figure 64C:
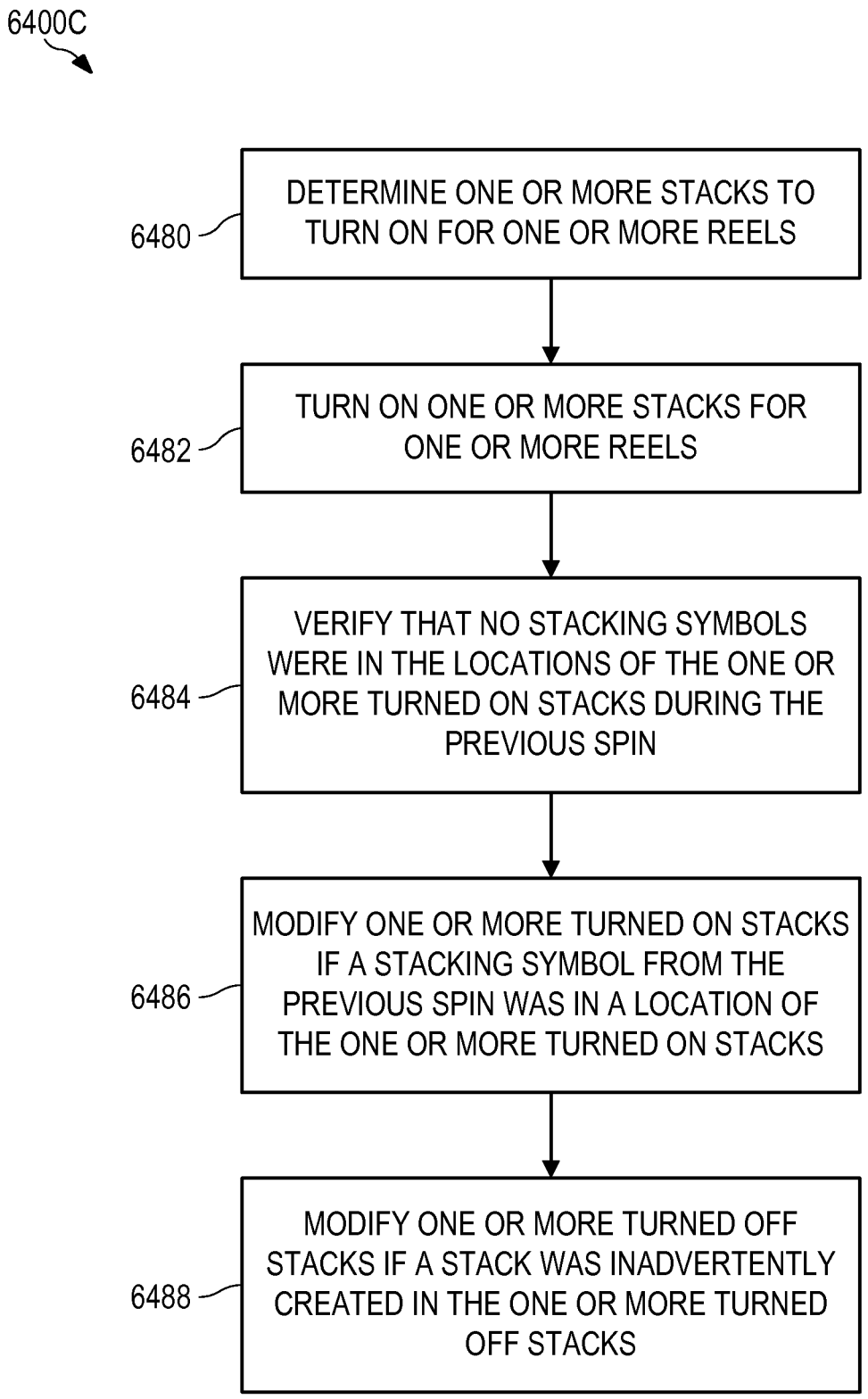

FIG. 64C is an illustration of stacking game play on a gaming device, according to one embodiment.

Figure 64D:
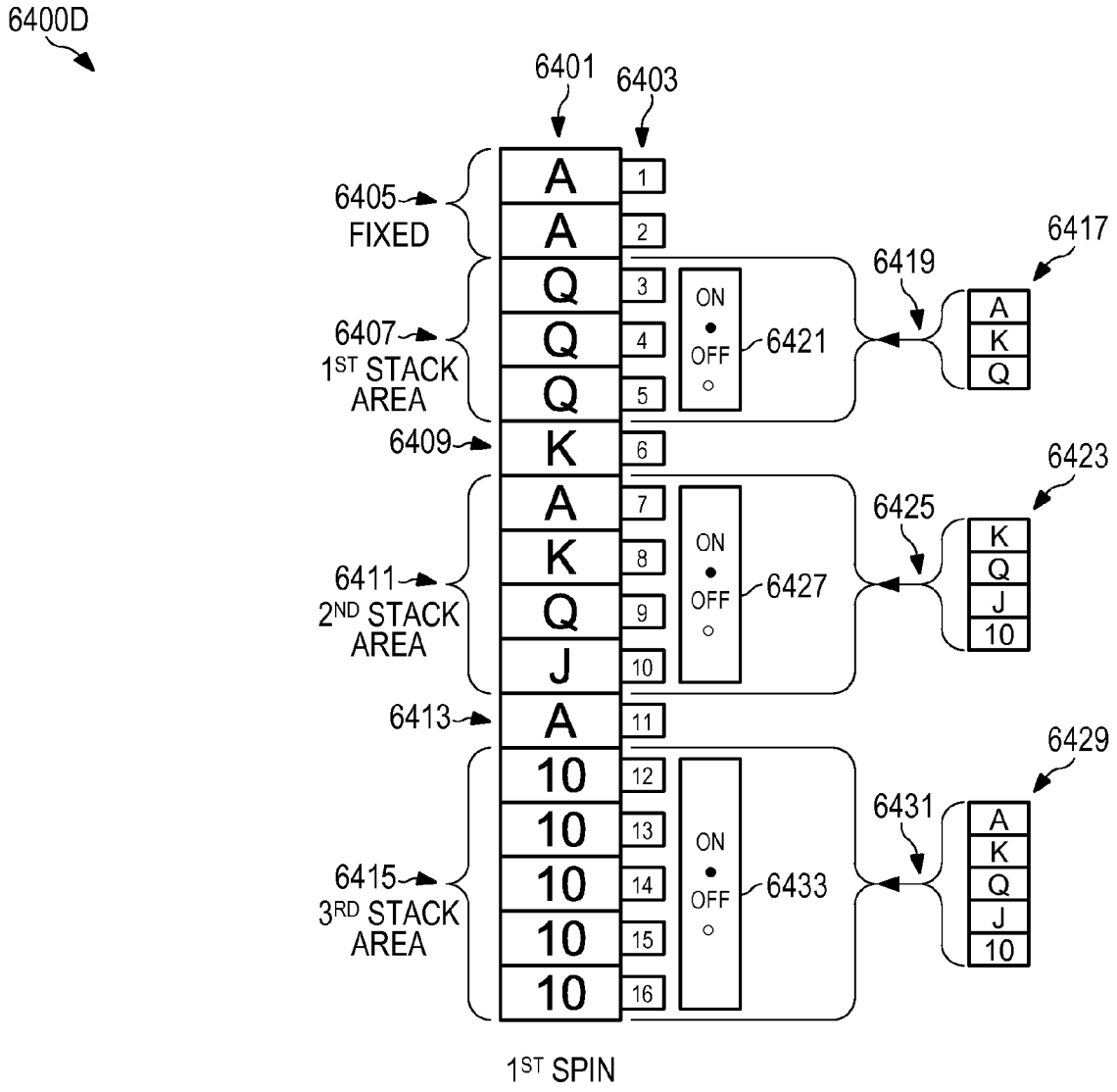

FIG. 64D is an illustration of stacking game play on a gaming device, according to one embodiment.

Figure 64E:
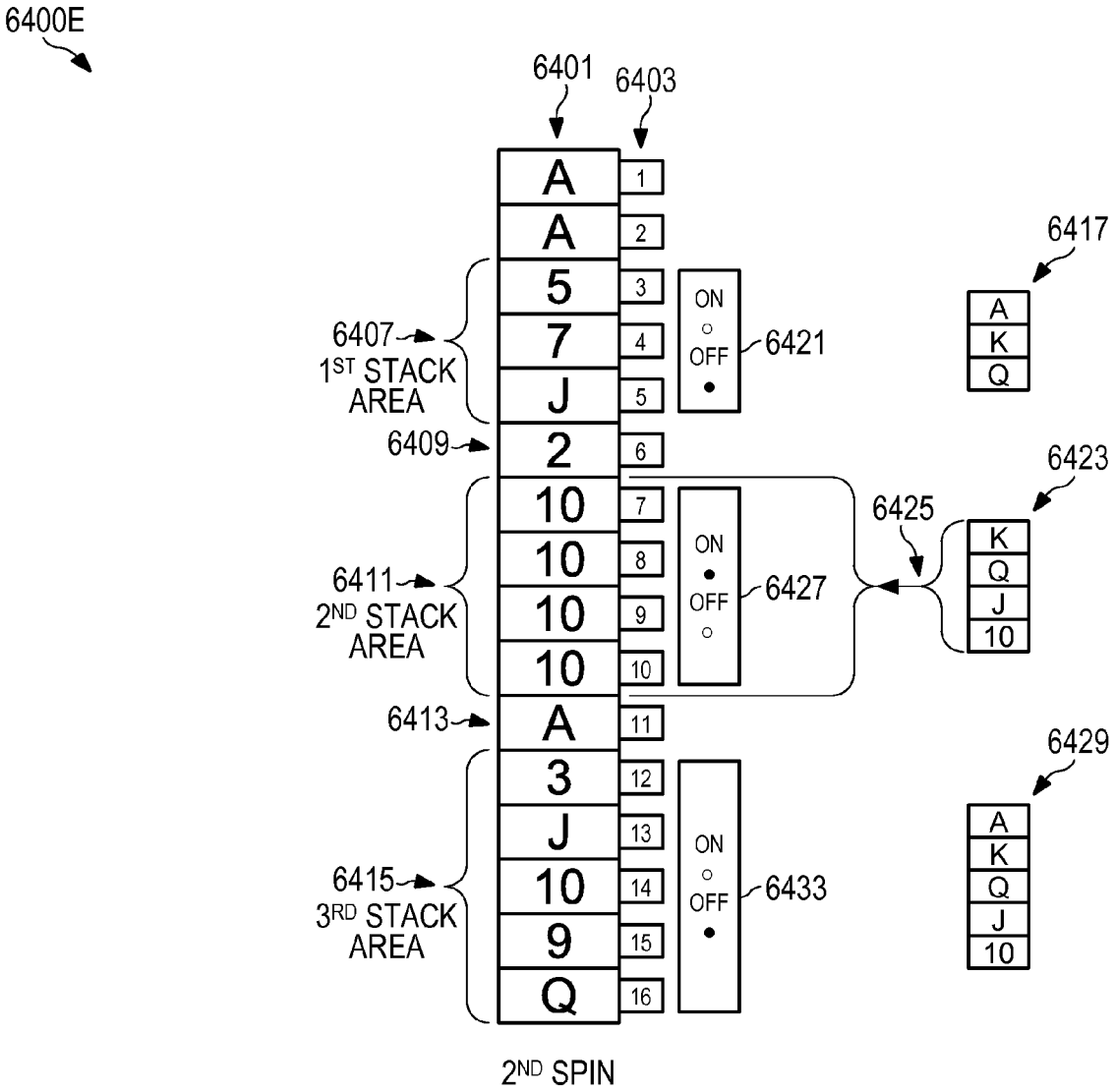

FIG. 64E is another illustration of stacking game play on a gaming device, according to one embodiment.

Figure 64F:
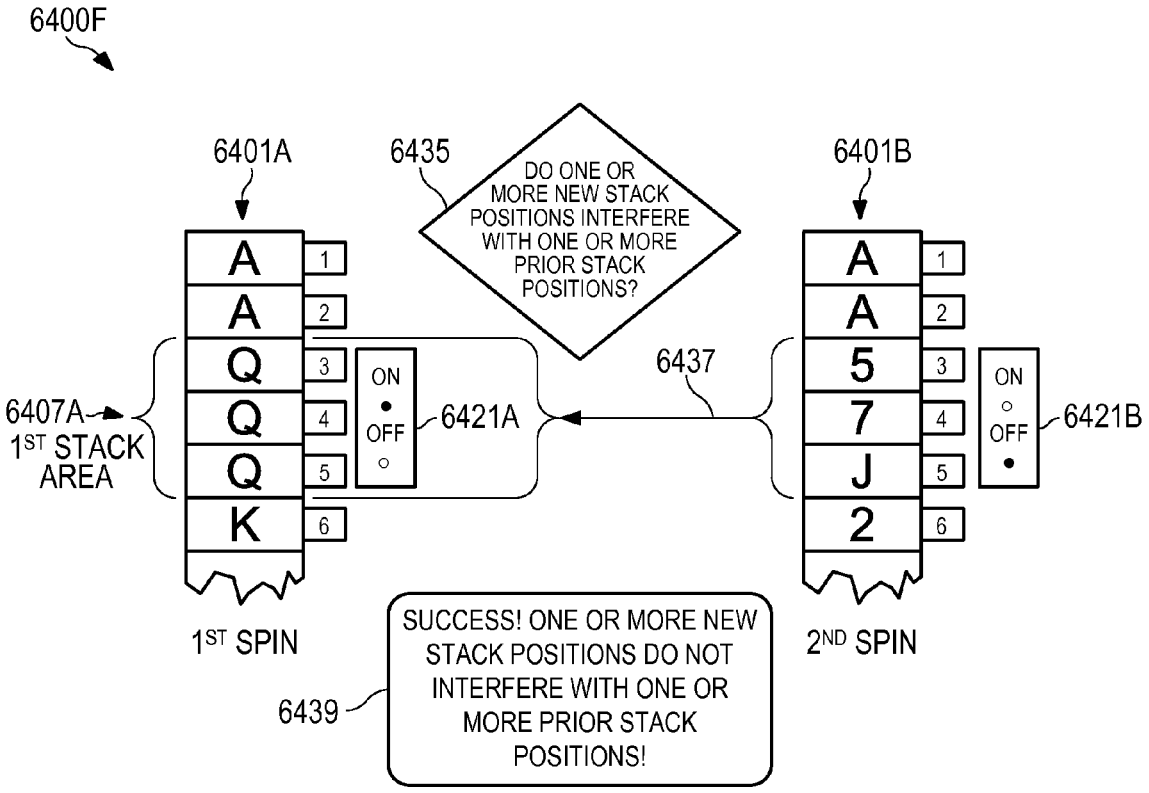

FIG. 64F is an illustration of stacking game play on a gaming device, according to one embodiment.

Figure 64G:
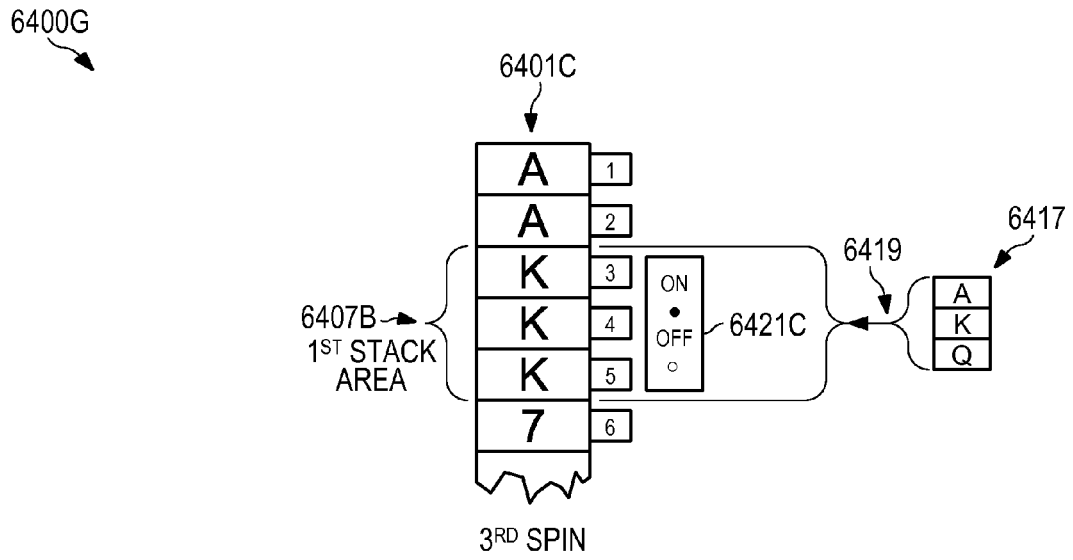

FIG. 64G is an illustration of stacking game play on a gaming device, according to one embodiment.

Figure 64H:
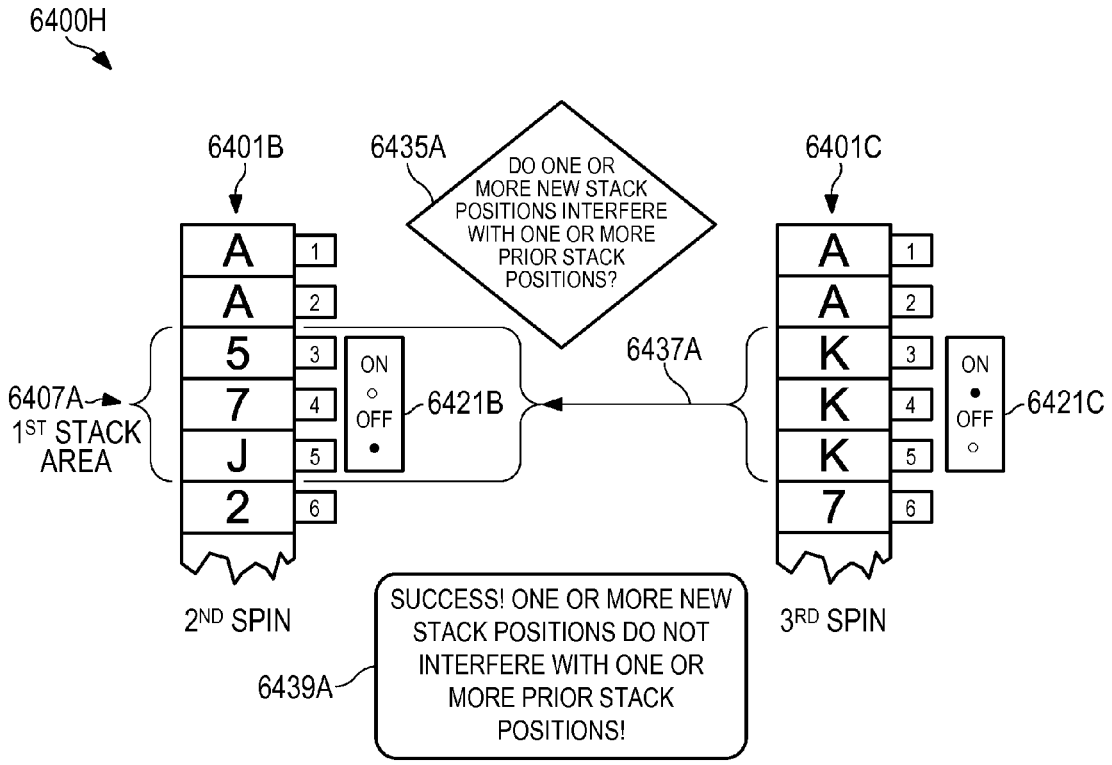

FIG. 64H is another illustration of stacking game play on a gaming device, according to one embodiment.

Figure 64J:
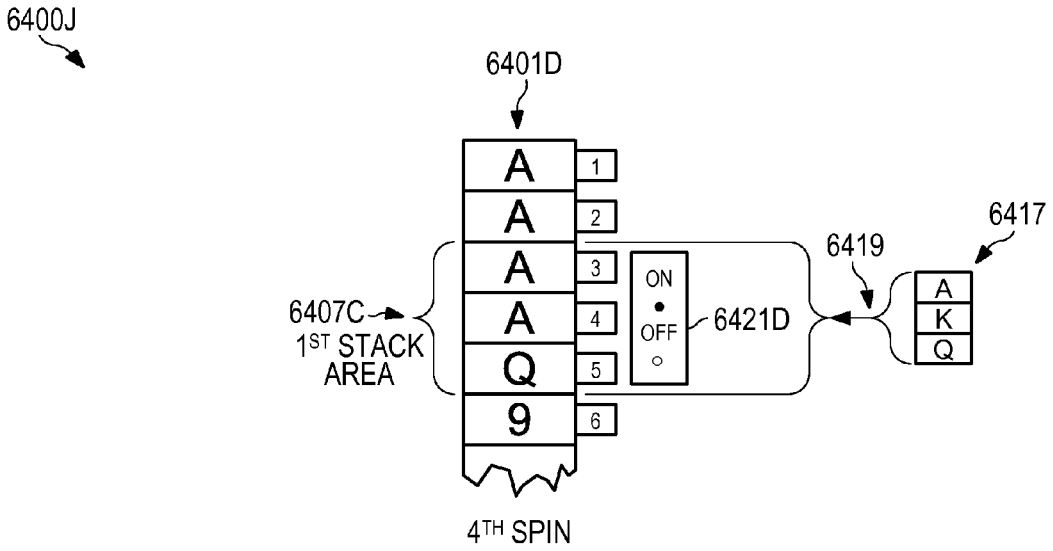

FIG. 64J is an illustration of stacking game play on a gaming device, according to one embodiment.

Figure 64K:
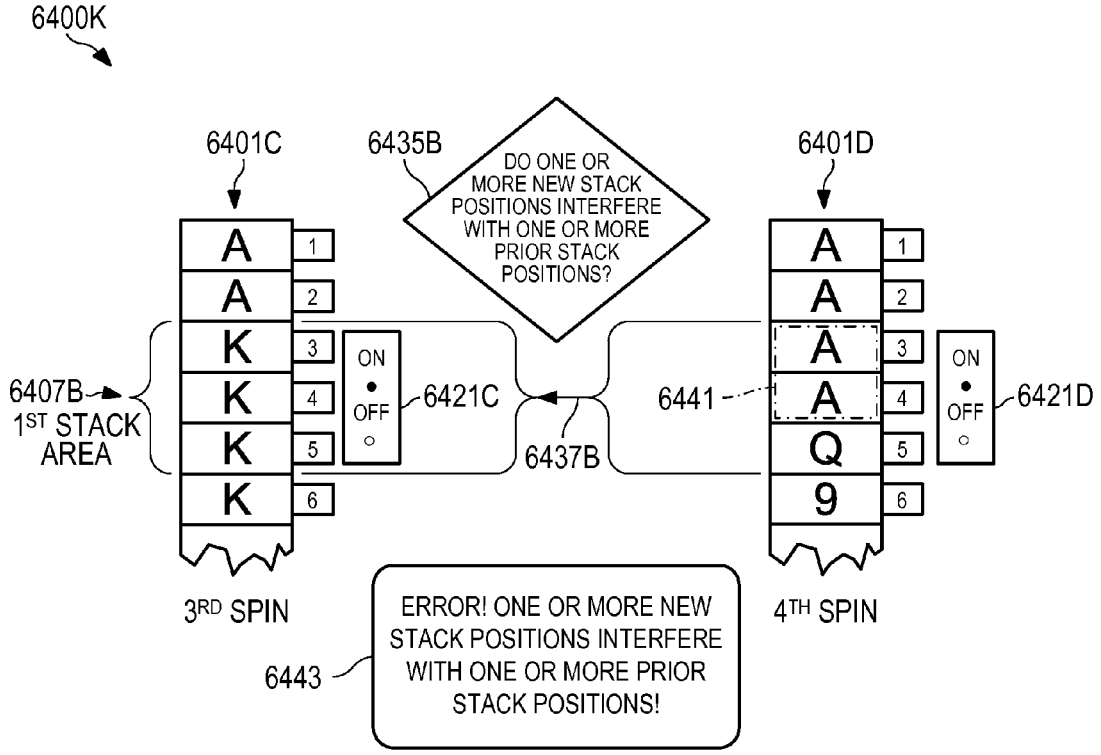

FIG. 64K is an illustration of stacking game play on a gaming device, according to one embodiment.

Figure 64L:
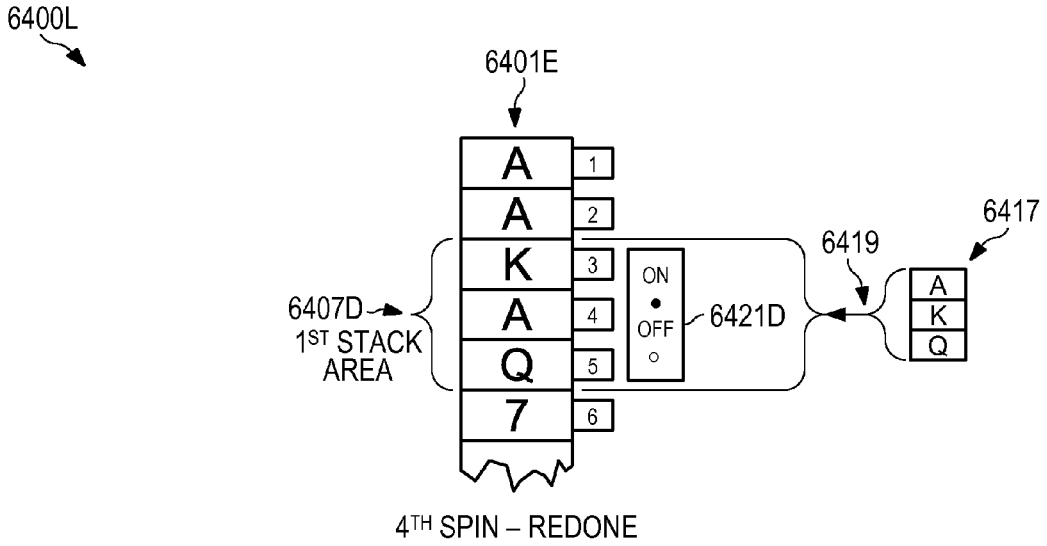

FIG. 64L is another illustration of stacking game play on a gaming device, according to one embodiment.

Figure 64M:
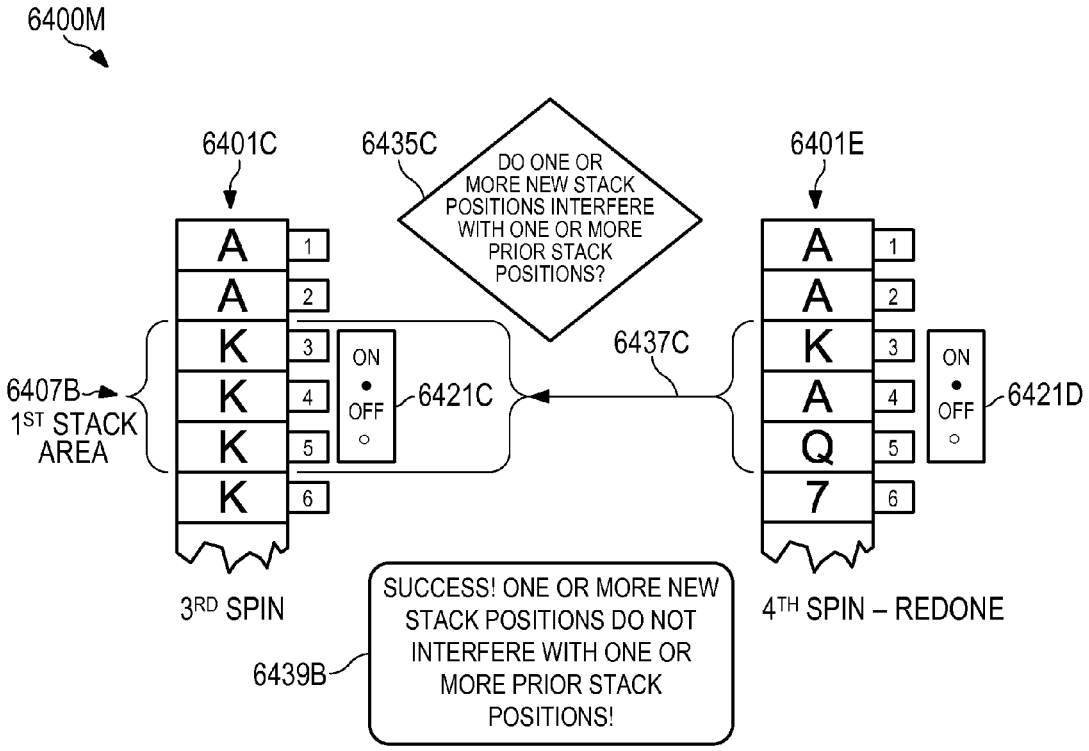

FIG. 64M is an illustration of stacking game play on a gaming device, according to one embodiment.

Figure 64N:
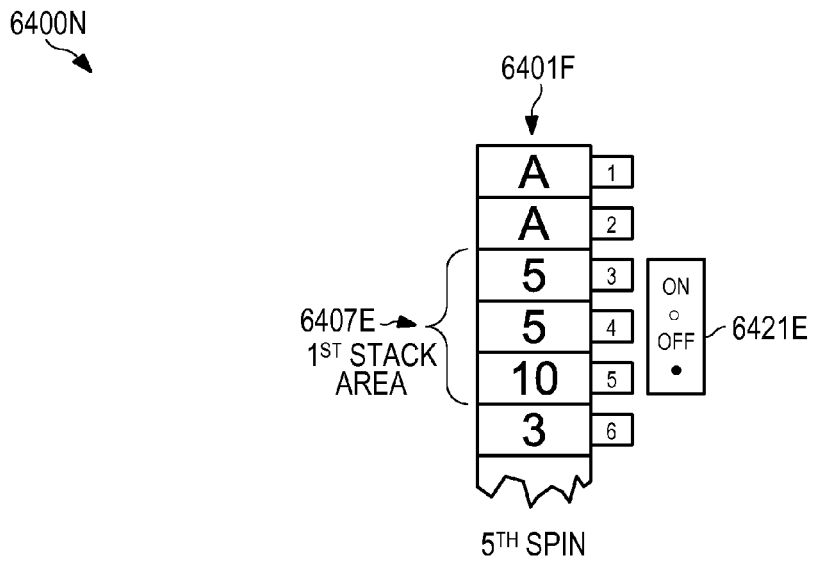

FIG. 64N is an illustration of stacking game play on a gaming device, according to one embodiment.

Figure 64P:
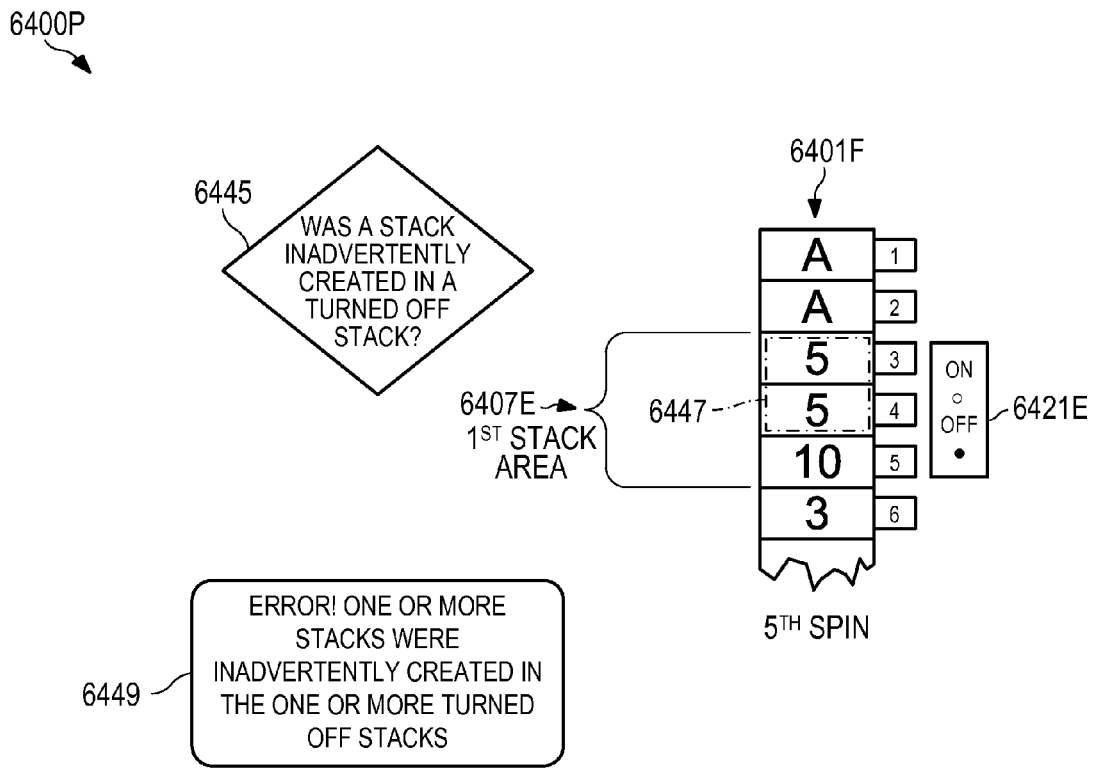

FIG. 64P is another illustration of stacking game play on a gaming device, according to one embodiment.

Figure 64R:
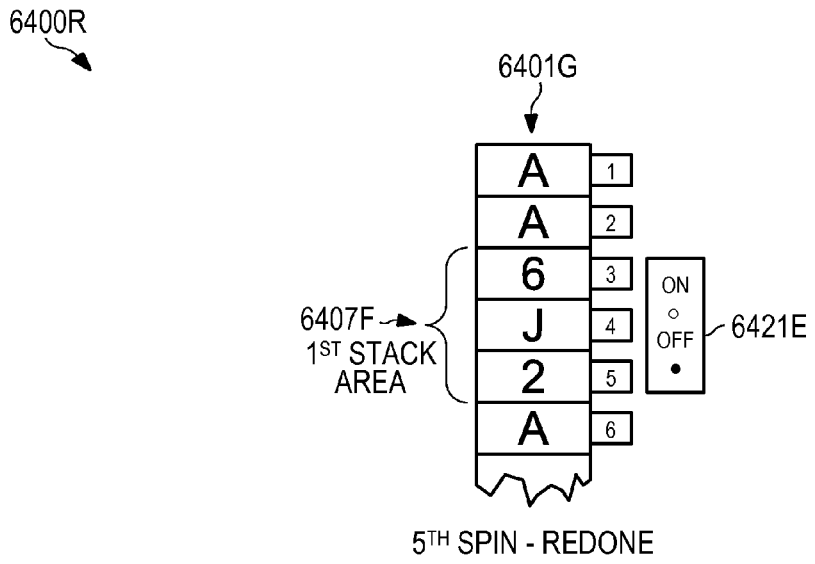

FIG. 64R is an illustration of stacking game play on a gaming device, according to one embodiment.

Figure 64S:
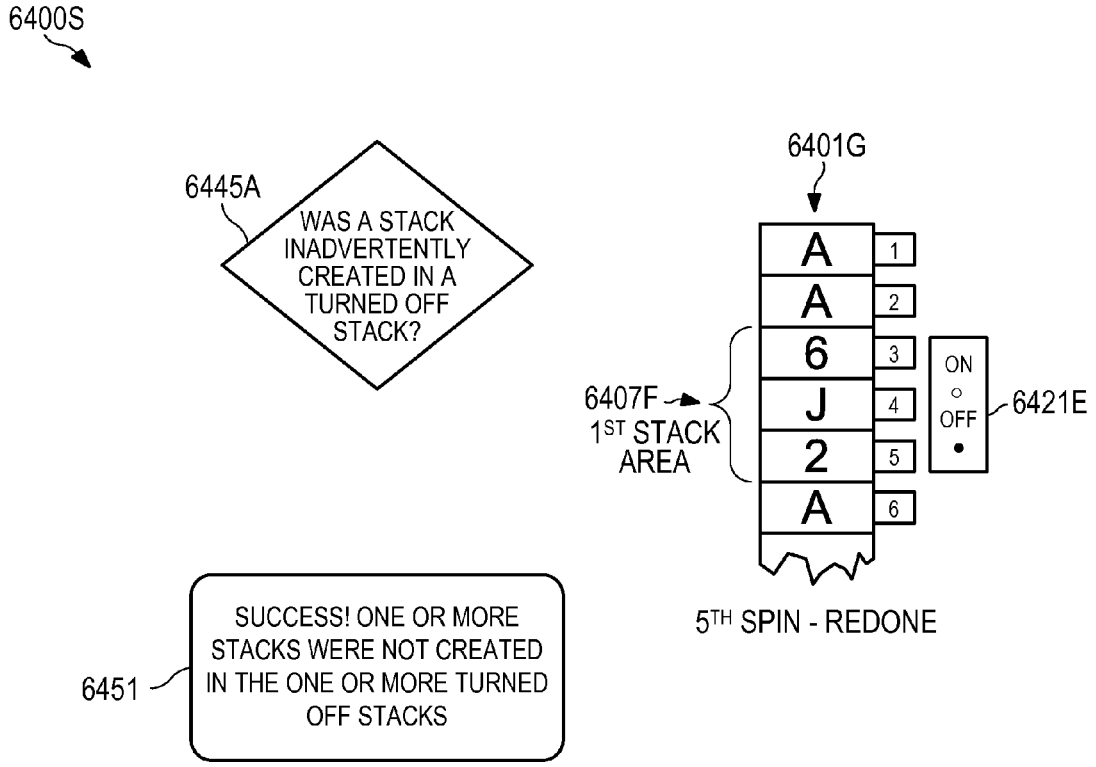

FIG. 64S is an illustration of stacking game play on a gaming device, according to one embodiment.

DETAILED DESCRIPTION

Figure 1:
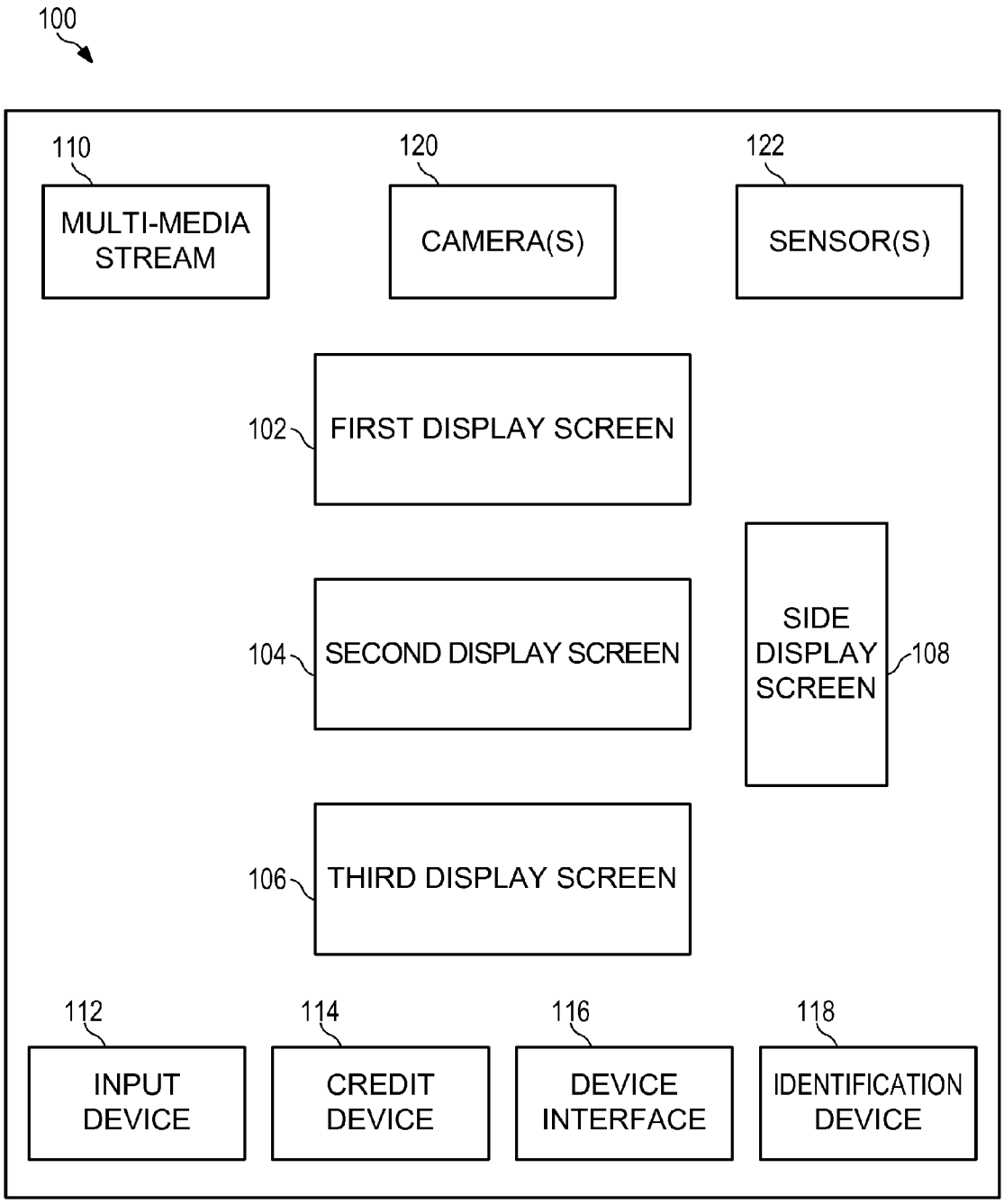
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more stacking gaming options, to make a wager, to make a stacking wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a stacking gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include stacking gaming options only. Therefore, only games which include stacking gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multimedia data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game and/or one or more stacking games. In another embodiment, second display may be the primary display for a second, bonus game, and/or one or more stacking games. For example, base display may display: a reel-type video slot game; and upon a bonus game triggering condition; second display may display a bonus game; and upon a stacking game feature triggering event; first and/or second display (and/or Nth displays) may display a stacking game feature. In various examples, a reserving an electronic gaming device function may be initiated and/or displayed on a first screen, a second screen, an Nth screen, and/or any combination thereof. In one example, the reserved game play function for a first player may be initiated, displayed, and played on a first screen of the electronic gaming device while a normal game play function for a second player may be initiated, displayed, and played on a second screen of the electronic gaming device. The reserving function may be an automated game play where the player can play the electronic gaming device automatically and/or remotely. Further, the reserving function may be where a player holds an electronic gaming device for a specific period of time until they are able to start playing the electronic gaming device. For example, a player wants to play game X but has to go to the bathroom first. Therefore, the player reserves game X for 5 minutes (and/or any other amount of time).

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
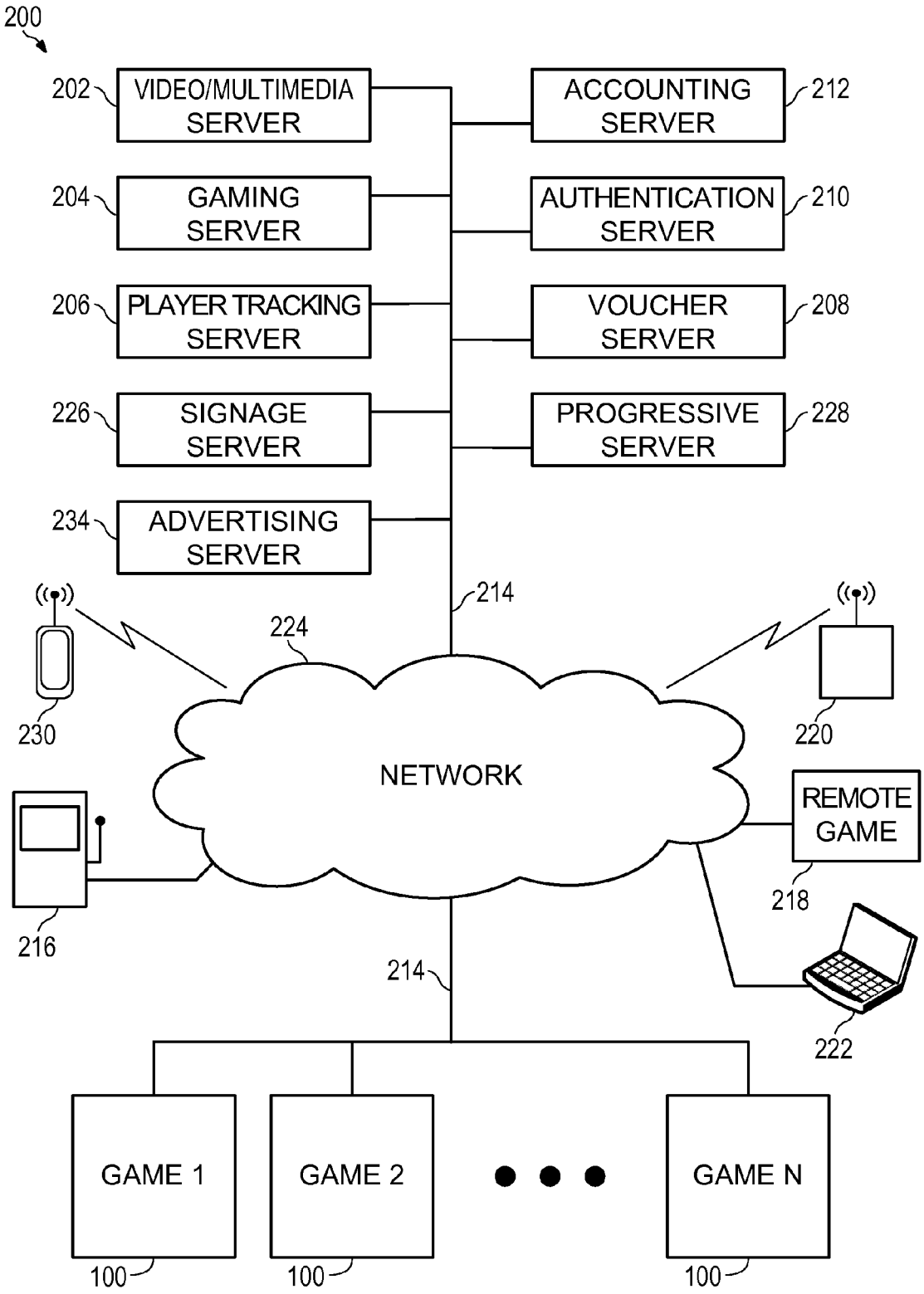
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities (including stacking wagers) to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a stacking game feature functionality; a stacking game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include stacking wagering data and/or payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, stacking wagering data, and/or other transaction data. Transaction data may include the number of wagers, the size of these wagers, the date and time for these wagers, the identity of the players making these wagers, the frequency of the wagers, and/or verification data, and/or confirmation data. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play and/or stacking wagering data for one or more electronic gaming devices 100 and/or other events. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Searching server 232 may implement a search on one or more gaming devices to obtain gaming data. Searching server 232 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching server 232 may implement a wagering function, which may be an automatic wagering mechanism. These functions of searching server 232 may be integrated into one or more servers.

Searching server 232 may include one or more searching structures, one or more searching algorithms, and/or any other searching mechanisms. In general, the search structures may cover which EGMs paid out the most money during a time period, which EGMs kept the most money from players during a time period, which EGMs are the most popular (e.g., top games), which EGMs are the least popular, which EGMs have the most amount of money bet during a period, which EGMs have the highest bet volume, which EGMs are more volatile (e.g., volatility, or deviation from the statistical norms of bet volume, bet amount, pay out, etc.) during a time period, and the like. These searches may also be associated with location queries, time queries, and/or people queries (e.g., where are the electronic gaming machines that allow persistent game play options, where are the table games that most of my friends bet on, where are my favorite EGMs, what are players betting on the most today, when are most bets placed, etc.).

The searching structures may be predetermined searching structures. For example, the method may start searching a first device, then a second device, then a third device, up to an $N^{th}$ device based on one or more searching parameters (e.g., triggering event). In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In this example, the search structure may be a minimum of ten devices to be searched, along with a minimum of five gaming options to be determined.

In another example, the searching structures may be based on one or more specific games (e.g., a first EGM type, a second EGM type, etc.). Searching structure may search one or more of these games. In one example, a player may utilize a searching function to find one or more games that allow stacking function options and/or persistent game play options and/or to find one or more specific game types (e.g., game theme 1). The player may utilize the search feature to reload their persistent game configuration data and/or to restart a specific game type game play.

In another example, the searching structure may be based on a player's preferences, past transactional history, player input, a particular EGM, a particular casino, a particular location within a casino, game outcomes over a time period, payout over a time period, and/or any other criteria.

Figure 3:
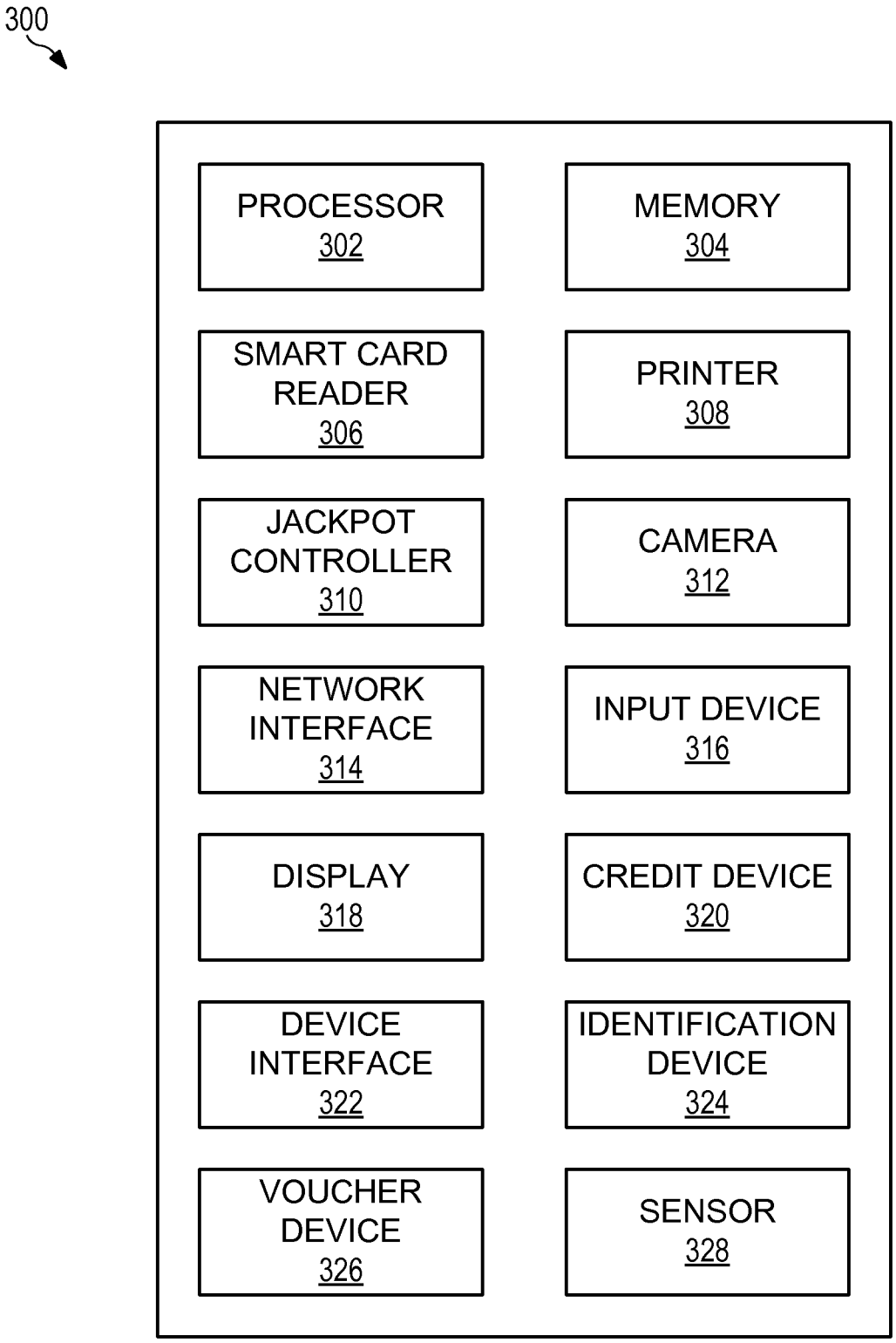
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher and/or a persistent game play receipt (and/or any other form). Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, persistent game play data receipts, stacking wager payouts, stacking wagering vouchers, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature (i.e., avatar) of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes and/or a validating procedure (e.g., persistent gaming receipt validation, etc.). For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212, and/or any other stacking wagering related server (e.g., server to confirm another event (e.g., a horse race, football game, etc.)).

Input device 316 may be mechanical buttons, electronic buttons, a touch screen, and/or any combination thereof. Input device 316 may be utilized to make a wager, to make a stacking wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
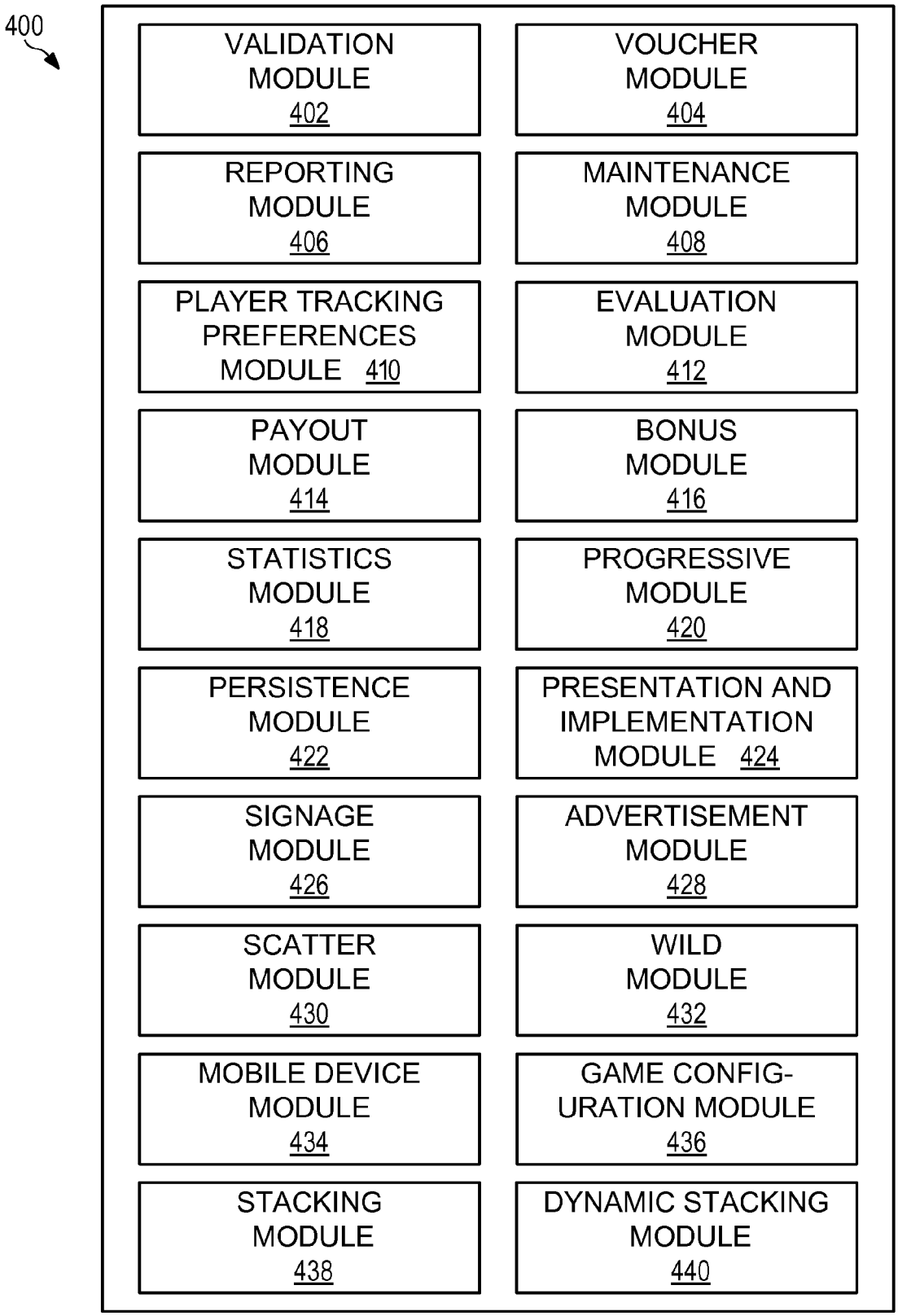
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a bonus module 416, a statistics module 418, a progressive module 420, a persistence game module 422, a presentation and implementation module 424, a tracking module, a signage module 426, an advertisement module 428, a subscription-based progressive module, a 3D gesturing module, a pseudo module, a skill-based module, a scatter module 430, a wild module 432, a mobile device module 434, a game configuration module 436, a stacking module 438, and/or a dynamic stacking module 440 (and/or a shifting stack module).

Validation module 402 may utilize data received from voucher device 326 to confirm the validity of the voucher and/or a persistent gaming data (e.g., a persistent gaming receipt validation procedure).

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module 416 may generate a bonus game, evaluate the results of the bonus game, trigger bonus game presentations, generate bonus game payouts, and/or display any data relating to the bonus game.

Statistics module 418 may be used to maintain data relating to historical game play (including stacking wagering data—(dollar amount, credit amount, spins, credits per line bet, time period, maximum win amount, one or more triggering events to stop game play, etc.)) for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Progressive module 420 may generate, transmit, compile, and/or store one or more data points relating to one or more progressives and/or subscription progressives (e.g., a progressive a player selects and pays to enter). For example, a normal progressive is where the player enters the progressive and has no choice. If the player plays game X, then they are part of the progressive. However, a subscription progressive allows the player to select whether to be part of the progressive game play or not. In other words, a player can choice to be part of progressive A for a first spin, then progressive B for a second spin, and then no progressive for a third spin.

Persistence game module 422 may generate, transmit, compile, and/or store one or more data points and/or presentations relating to one or more persistence gaming options and/or persistence gaming wagers.

Presentation and implementation module 424 may generate, transmit, compile, implement, and/or store one or more presentations.

Tracking module may generate, transmit, compile, and/or store one or more data points related to tracking one or more stacking wagers and/or stacking wager players.

Signage module 426 may generate, transmit, compile, initiate, and/or store one or more presentations for one or more signs.

Advertisement module 428 may generate, transmit, compile, present, implement, initiate, and/or store one or more advertisements. Advertisement module 428 may generate, compile, transmit, and/or store advertisement information relating to one or more stacking, subscription based progressive, and/or any other gaming feature. These advertisements may be presented on one or more display screens, an internet website, and/or any other advertisement avenue.

Searching module may implement a search on one or more gaming devices to obtain gaming data. Searching module may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop up window, a text message, an email, a voice message, a video message and the like. Searching module may implement a wagering function, which may be an automatic wagering mechanism. These functions of searching module may be integrated into one or more servers.

Searching module may include one or more searching structures, one or more searching algorithms, and/or any other searching mechanisms. In general, the search structures may cover which EGMs paid out the most money during a time period, which EGMs kept the most money from players during a time period, which EGMs are the most popular (e.g., top games), which EGMs are the least popular, which EGMs have the most amount of money bet during a period, which EGMs have the highest bet volume, which EGMs are more volatile (e.g., volatility, or deviation from the statistical norms of bet volume, bet amount, pay out, etc.) during a time period, and the like. These searches may also be associated with location queries, time queries, and/or people queries (e.g., where are the stacking game play functionality games, where are theme 1 gaming machines, where are the table games that most of my friends bet on, where are my favorite EGMs, what are players betting on the most today, when are most bets placed, etc.).

The searching structures may be predetermined searching structures. For example, the method may start searching a first device, then a second device, then a third device, up to an $N^{th}$ device based on one or more searching parameters (e.g., triggering event). In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In this example, the search structure may be a minimum of ten devices to be searched, along with a minimum of five gaming options to be determined. For example, a player may want to search for games that have not won a prize over $100 during the last 100 spins. The search may look at the first 10 devices and only find two gaming options. Therefore, the search would continue until five gaming options where discovered which meant that 56 devices needed to be examined.

In another example, the searching structures may be based on one or more specific games (e.g., a first EGM type, a second EGM type, etc.). Searching structure may search one or more of these games.

In another example, the searching structure may be based on a player's preferences, past transactional history, player input, a particular EGM, a particular casino, a particular location within a casino, game outcomes over a time period, payout over a time period, and/or any other criteria.

Wild module 432 may generate a wild game, evaluate the results of the wild game, trigger wild game presentations, generate wild game payouts, and/or display any data relating to the wild game. Further, wild module may determine one or more outcomes of one or more interactions (e.g., collisions of one or more symbols).

Scatter module 430 may generate a scatter game, evaluate the results of the scatter game, trigger scatter game presentations, generate scatter game payouts, and/or display any data relating to the scatter game.

Subscription-based progressive module may generate, compile, transmit, and/or store one or more subscription based progressive structures and/or any other data relating to one or more subscription based progressive structures and/or subscription based stacking game play.

3D gesturing module may generate, compile, transmit, and/or store one or more data points, presentations, reference modules, and/or structure relating to any aspect of 3D gesturing.

Pseudo module may generate, transmit, compile, and/or store one or more data points and/or presentations relating to one or more pseudo gaming options and/or pseudo gaming wagers.

Skill-based module may generate, compile, store, and/or transmit one or more skill-based structures and/or one or more skill-based tournament structures. Skill-based evaluation module may evaluation one or more outcomes of one or more skill-based games and/or skill-based tournament games.

Mobile device module 434 may generate, compile, store, and/or transmit one or more data relating to the mobile device. Further, mobile device module 434 may interact and communicate with mobile device to transfer and/or receive data from and/or to mobile device.

Game configuration module 436 may generate, compile, store, and/or transmit one or more game configuration data. Further, mobile device may also include a game configuration module.

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, treasure based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

In one embodiment, a system, device, and/or method may offer bets that are dependent on a function of a primary slot machine and/or any other device. For example, a second window may open on a primary game screen (and/or any other display and/or any other output device) that offers a wager on the outcome of the next game (e.g., spin, etc.). In one example, the wagering option may be whether the next game (e.g., spin, etc.) will be a winner or a loser. The player may make the wager and play the game. If the results of the game play is consistent with the player's bet, the player wins and is awarded a prize. In one example, the gaming system does not determine the outcome of the future game play before the wager and/or odds are accepted and/or created. In this example, this gaming option may not need to be approved as a gaming device and may not be subject to the rigorous standards of a regulated gaming device. In this example, an accounting system that accepts bets and pays winning bets may be utilized. In these examples, the player is betting on some characteristic of slot machine play and/or another verifiable event outcome.

In one example, the types of wagers that can be accepted are not relegated to the outcomes of the player's slot machine. In various examples, the possibilities for betting options are related to the events and/or occurrences that can be observed, recorded, and/or verified by the system. For example, one wagering option may be whether the progressive jackpot will be triggered and/or hit in the next 3 minutes (specific time period) and/or next 10 spins (specific spin number). In another example, one wagering option may be whether another person (e.g., a friend, a wife, a husband, a stranger, etc.) will win on the next spin. In this example, a loyalty card (and/or some other identification method) may be utilized to identify the player and/or a specific gaming device identification number may be utilized. In another example, one wagering option may be whether the mystery progressive will be hit (e.g., won) before it reaches a certain number (e.g., $300, $1,000, etc.).

In another example, the credits for the wager and the winnings may be moved to and from the primary gaming device through automatic fund transfer ("AFT") transactions from the system. Further, the system may act as the book maker for the bets. The system may meter and account for all transfers in total and by each game in which pseudo wagers have been made.

In another example, the system may determine the one or more event outcomes via SAS communications, communications with a class II server, and/or other communication protocol and/or other forms of communication methods. The system may record one or more outcomes for the wager and relays the results to the player and/or one or more EGMs. In addition, the system may allow for a ticket to be printed as a pseudo wager receipt but this may not be necessary as the pseudo wager information is already stored on the system. In addition, in cases where the pseudo wager cannot be completed, the pseudo wager may be returned to the player or to the player's account. In various examples, one or more rules may be implemented for pseudo wagers that depend on an event occurring over a time period and/or as other events happen to prevent the player from trying to cancel wagers as a limit is approached. For example, a player may want to cancel a bet that the next four spins will be winner once the second spin was not a winner. However, the system may not allow this.

Stacking module 438 may generate, transmit, compile, and/or store one or more data points and/or presentations relating to one or more stacking features and/or stacking functions. Stacking module 438 may evaluate one or more outcomes for one or more events relating to stacking game play. Further, stacking module 438 may determine one or more outcomes of one or more interactions. Stacking module 438 may generate one or more presentations for one or more stacking functions. In addition, stacking module 438 may verify that one or more stacking functions are in compliance with one or more stacking game play parameters.

Dynamic stacking module 440 may generate, transmit, compile, and/or store one or more data points and/or presentations relating to one or more dynamic stacking features and/or dynamic stacking functions.

In one example, a dynamic stack may include two identical symbols being located adjacent to each other. Further, the dynamic stack may increase in size from spin-to-spin; decrease in size from spin-to-spin; change stacking symbols from spin-to-spin (e.g., transition from a first stacking symbol for a first spin to a second stacking symbol for a second spin); change from a stacking symbol to a non-stacking symbol from spin-to-spin; disappear and reappear from spin-to-spin; change shape from spin-to-spin (e.g., go from an L shape to an X shape from a first spin to a second spin); turn on and off from a first spin to a second spin; and/or any combination thereof.

Figure 5:
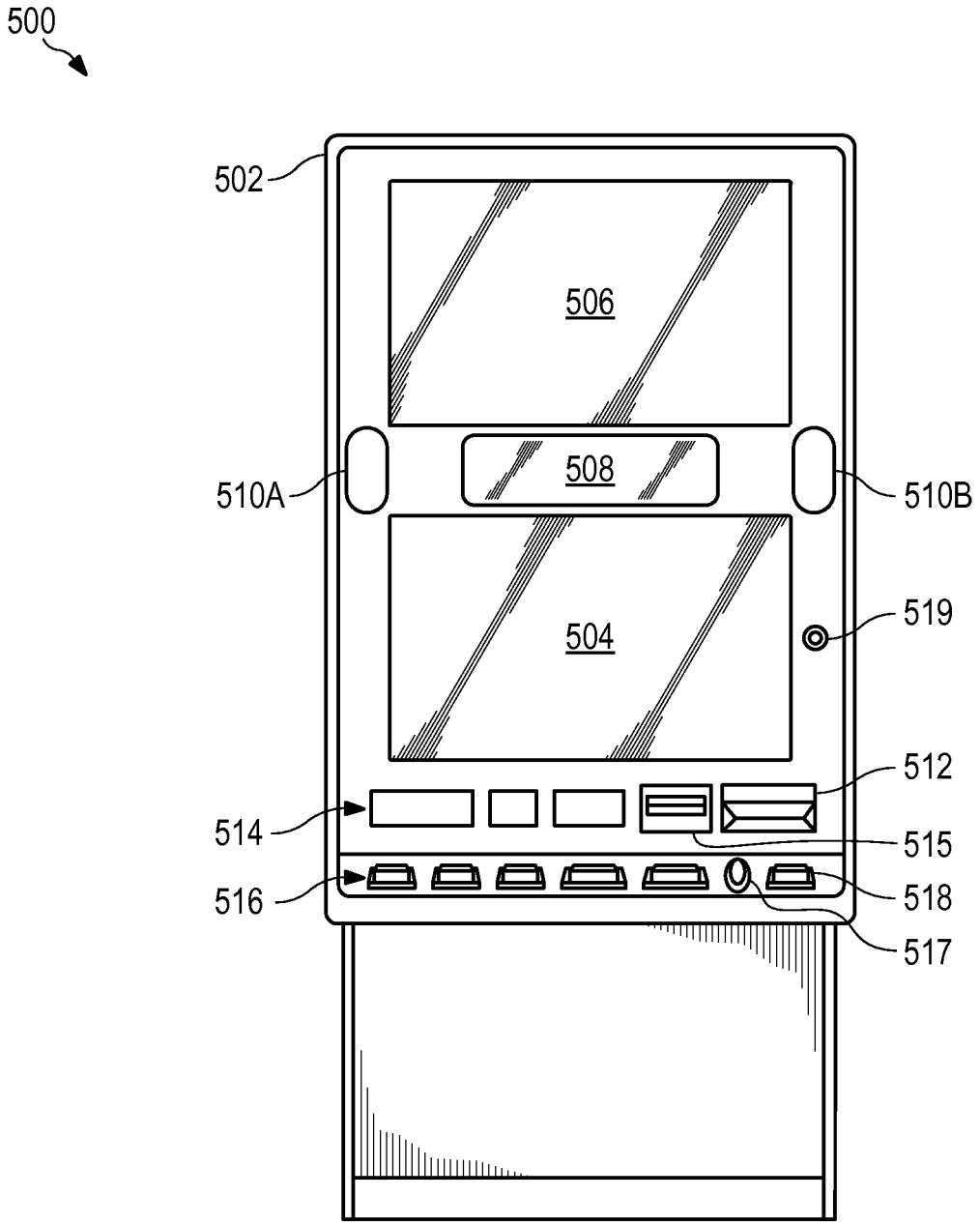
FIG. 5 is an illustration of game play on a gaming device, according to one embodiment.

In FIG. 5, an illustration of a gaming device cabinet 500 is shown, according to one embodiment. A gaming device 502 may include an overhead display 506, a side display 508, a main game display 504, a left speaker 510A, a right speaker 510B, one or more output devices (e.g., a ticket in/ticket out device 512), and/or one or more input devices 516 (e.g., buttons, bill validators, etc.). In one example, overhead display 506 includes a leadership board sponsor and/or a ranking of tournament players. In this example, the XYZ company has sponsored the leadership board and the leadership board states "XYZ LEADER BOARD." In another example, leadership display may include data relating to one or more tournaments, such as, the time remaining (e.g., 1 HOUR 31 MINUTES REMAINING). In this example, side display 508 may display a current mode of operation. For example, a current mode may be a tournament mode, a normal mode, a practice mode, a team mode, an individual mode, any combination thereof, etc.

Figure 6A:
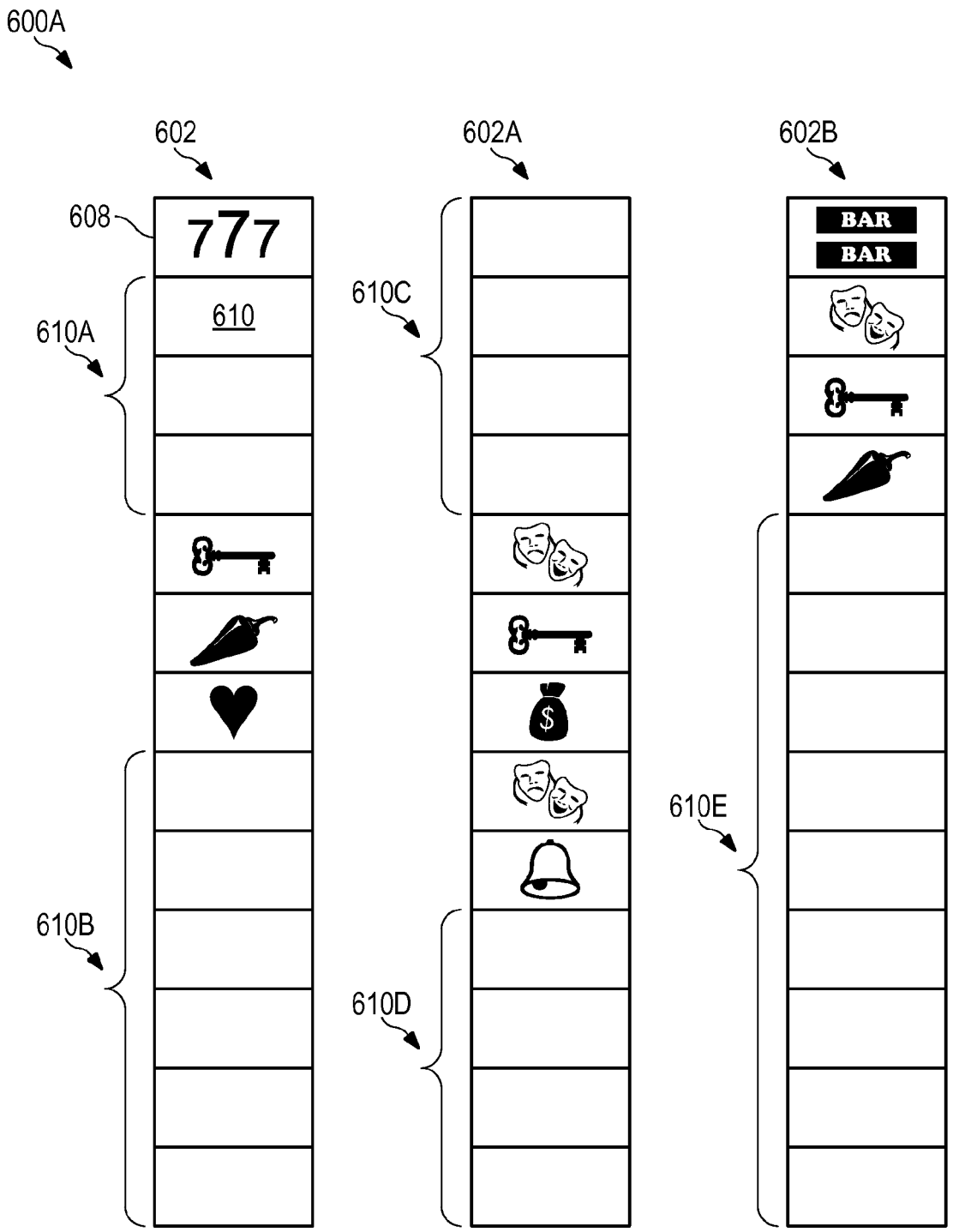
FIG. 6A is an illustration of a stacking game play on a gaming device, according to one embodiment.

In FIG. 6A, an illustration of a stacking game play on a gaming device is shown, according to one embodiment. In this embodiment, a first column 602 (e.g., reel, display column, display areas, etc.) includes one or more static symbols 608 which remain stationary (e.g., are the same symbol in the same symbol location from a first spin and/or a first game play to a second spin and/or a second game play). Further, one or more holding areas 610 may be dynamically filed with one or more symbols from a first spin and/or a first game play to a second spin and/or a second game play. For example, four symbol areas may be filed with Aces for a first spin, and then changed to Kings after the initiation of a second spin. In addition, dynamic substitution of these one or more holding areas 610 may occur before the spin, during the spin, during a bonus spin, and/or after the spin is completed. In one example before a first spin, first column 602 includes a first holding area 610A (where one or more symbols and/or one or more stacking symbols, and/or one or more dynamic stacking symbols) may be placed, displayed, transferred, inserted, located, moved, positioned, redirected, generated, and/or initiated in this area. Further before a first spin, first column 602 may include a second holding area 610B (where one or more symbols and/or one or more stacking symbols, and/or one or more dynamic stacking symbols) may be placed, displayed, transferred, inserted, located, moved, positioned, redirected, generated, and/or initiated in this area. It should be noted that any amount (e.g., 0 to N) of holding areas, stacking symbol areas, static symbol areas, dynamic stacking symbol areas, and/or dynamic symbol areas may be utilized. For example, ten holding areas may be utilized, one hundred holding areas may be utilized, thirty-three holding areas, and/or one thousand holding areas may be utilized. It this example, first holding area 610A has three units and second holding area 610B has six units. It should be noted that any amount of units (e.g., 1 to N) may be utilized. For example, five units may be utilized, ten units may be utilized, fifty-two units may be utilized, one hundred units may be utilized, and/or two thousand units may be utilized.

In another example before a second spin, first column 602A (which is used to show the reel 602 during a second spin) includes a third holding area 610C (where one or more symbols and/or one or more stacking symbols, and/or one or more dynamic stacking symbols) may be placed, displayed, transferred, inserted, located, moved, positioned, redirected, generated, and/or initiated in this area. Further before a second spin, first column 602A may include a fourth holding area 610D (where one or more symbols and/or one or more stacking symbols, and/or one or more dynamic stacking symbols) may be placed, displayed, transferred, inserted, located, moved, positioned, redirected, generated, and/or initiated in this area. It should be noted that any amount (e.g., 0 to N) of holding areas, stacking symbol areas, static symbol areas, dynamic stacking symbol areas, and/or dynamic symbol areas may be utilized. It this example, third holding area 610C has four units and fourth holding area 610D has four units. It should be noted that any amount of units (e.g., 1 to N) may be utilized.

In another example before a third spin, first column 602B (which is used to show the reel 602 during a third spin) includes a fifth holding area 610E (where one or more symbols and/or one or more stacking symbols, and/or one or more dynamic stacking symbols) may be placed, displayed, transferred, inserted, located, moved, positioned, redirected, generated, and/or initiated in this area. It should be noted that any amount (e.g., 0 to N) of holding areas, stacking symbol areas, static symbol areas, dynamic stacking symbol areas, and/or dynamic symbol areas may be utilized. It this example, fifth holding area 610E has nine units. It should be noted that any amount of units (e.g., 1 to N) may be utilized. Further, it should be noted that the changing of one or more stacking areas, dynamic stacking area, and/or any other area may occur before the spin, during the spin, and/or after the completion of a spin. For example, during a first spin there may be three holding areas (e.g., a first holding area, a second holding area, and a third holding area) where the first holding area is located at reel positions five through ten (e.g., 6 units), the second holding area is located at reel positions twenty through twenty-two (e.g., 3 units), and the third holding area is located at reel positions one hundred and one to one hundred and seven (e.g., 7 units). Whereas, during a second spin there may be two holding areas (e.g., a fourth holding area and a fifth holding area) where the fourth holding area is located at reel positions thirty-one to forty-one (e.g., 11 units) and the fifth holding areas is located at reel positions two hundred to two hundred and twenty (e.g., 21 units).

Figure 6B:
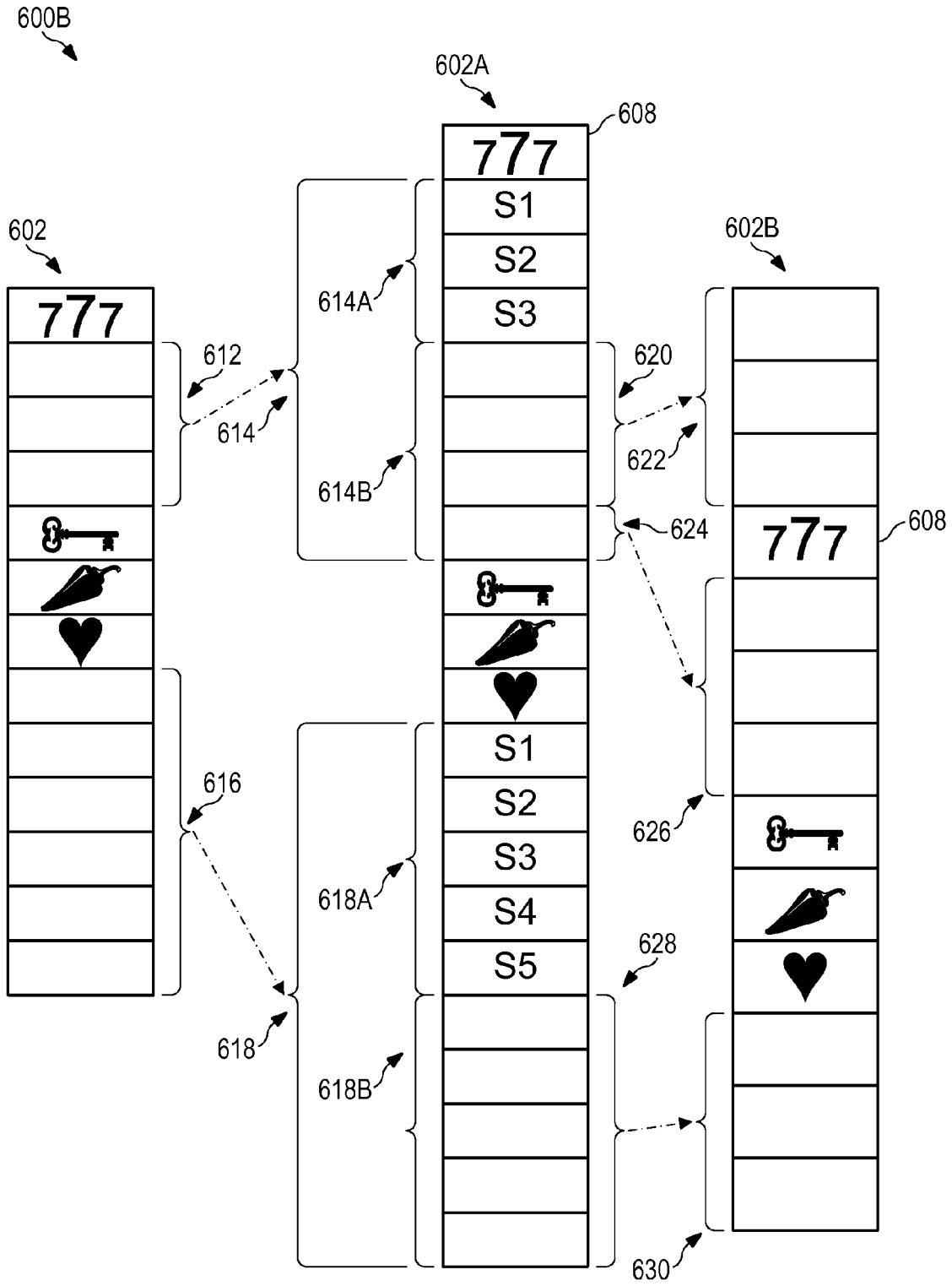
FIG. 6B is an illustration of a stacking game play on a gaming device, according to one embodiment.

In FIG. 6B, an illustration of a stacking game play on a gaming device is shown, according to one embodiment. In one example before a first spin, first column 602 may have first holding area 612 with three units and a second holding area 616 with six units. In another example before a second spin, first column 602A may have first holding area 612 change into a third holding area 614A which still has 3 units and a fourth holding area 614B which has 4 units. Therefore, first holding area 612 has affectively increased in size to 7 units before (and/or during) second spin. However, the first 3 units are filed by non-stacking symbols (e.g., S1, S2, and S3). In addition, the second holding area 616 may have changed into a fifth holding area 618A which decreased in length by one unit (e.g., 5 symbol areas) and a sixth holding area 618A which has 5 units. Therefore, second holding area 616 has affectively increased in size to 10 units. However, the first 5 units are filed by non-stacking symbols (e.g., S1, S2, S3, S4, and S5). It should be noted that any number (e.g., 0 to N) of units may be added and/or subtracted from one or more holding areas, one or more stacking areas, one or more static areas, one or more dynamic stacking areas, and/or one or more dynamic symbol areas. Further, first column 602B may include a sixth holding area 622 and a seventh holding area 626 which may have been generated independently and/or has initiated by splitting former fourth holding area 614B into two parts. In this example, splitting fourth holding area 614B into two parts occurred and then one of the parts (e.g., sixth holding area 622) was placed ahead and/or above static symbol 608. Further, seventh holding area 626 was placed behind and/or below static symbol 608. In addition, eighth holding area 628 (former sixth holding area 618B) transformed into a ninth holding area 630 before a third spin and decreased in size by two units to 3 units in total. In these examples above, the holding areas to place one or more stacking symbols varies from spin to spin which increases the excitement of game play for the player. Further, the stacking symbol utilized in one or more stacks may be changed (e.g., change from a first stacking symbol (e.g., an Ace) to a second stacking symbol (e.g., a King) from a first spin to a second spin). In addition, there may be no overlaps between stacking areas when the stacking symbol changes from a first spin to a second spin. However, there may be overlaps between stacking areas when the stacking symbol remains constant from a first spin to a second spin.

Figure 6C:
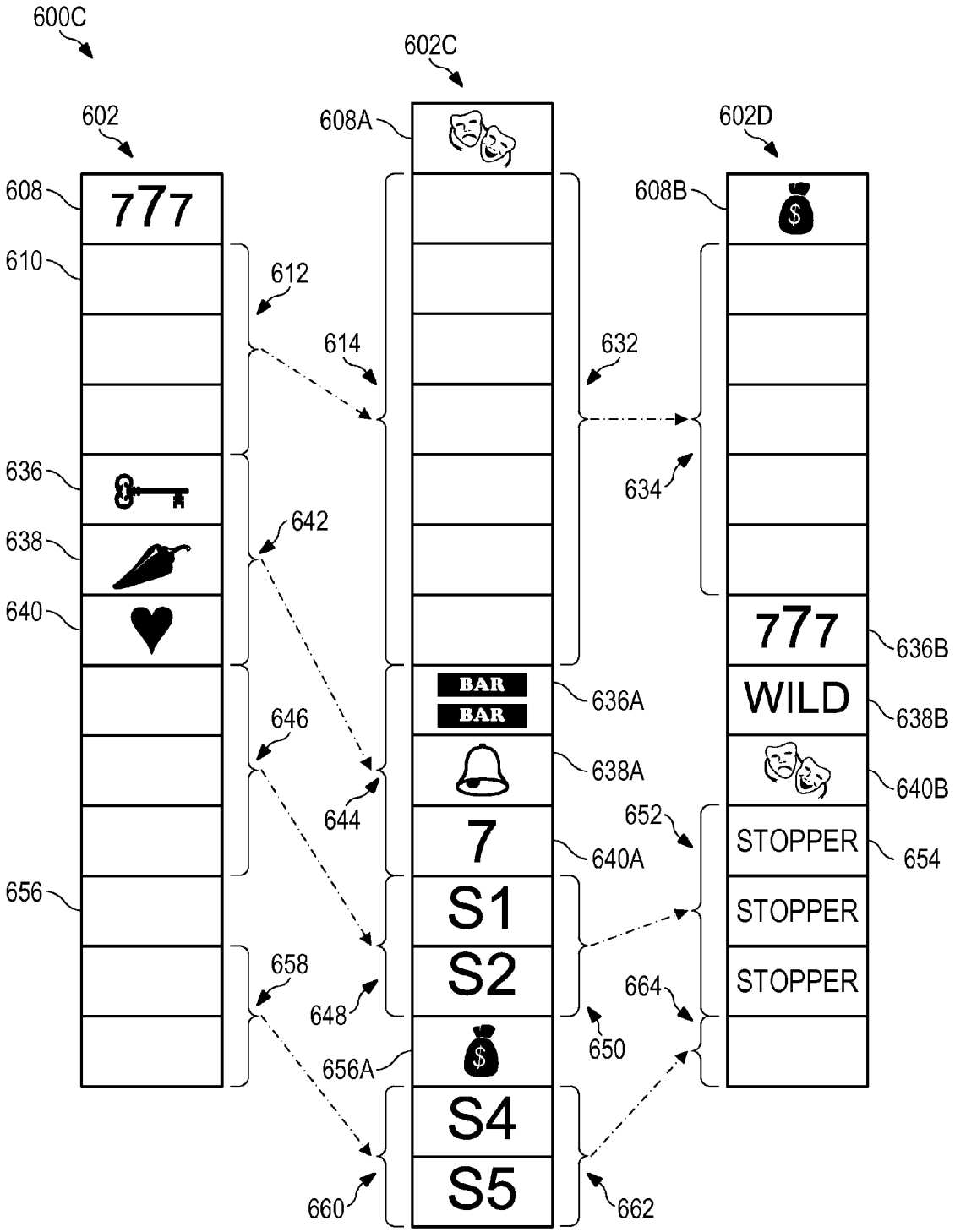
FIG. 6C is an illustration of stacking game play on a gaming device, according to one embodiment.

In FIG. 6C, an illustration of stacking game play on a gaming device is shown, according to one embodiment. In this example, one or more static symbols 608 have turned into one or more dynamic symbols 608A, 636, 638, and 640. In this example, each dynamic symbol 608A, 608B, 636, 638, 640 etc. is generated anew for each game play. Therefore, between game plays these symbol holding areas are blanked out and once the game is initiated, then these dynamic symbol areas are filled with a new symbol and/or a regenerated symbol for game play. In addition, these dynamic symbols may be generated and/or moved for each game play, during each game play, and/or after the completion of any game play function. In addition, one or more stoppers 654 may be located on one or more symbol holding areas. One or more stoppers 654 may have the effect of reducing the probability of a winning event occurring during a current spin. In another example, first holding area 612 (where one or more symbols including stacking symbols may be placed) expands into extended first holding area 614 from a first spin to a second spin. In this example, first holding area 612 had 3 units during a first spin but expanded into 7 units for a second spin. Further, second holding area 642 did not expand from a first spin to a second spin. Therefore, second holding area for the second spin 644 was the same length and/or size but did shift downward by 3 reel positions from a first spin to a second spin.

In FIG. 7A, an illustration of stacking game play on a gaming device is shown, according to one embodiment. In one embodiment, the methodology for symbol replacement is different. In this example, the method may first choose a set of symbols to appear on each reel—{symbol 1, symbol 2, symbol 3, symbol 4, symbol 5} appearing on {reel 1, reel 2, reel 3, reel 4, reel 5}, where the symbols may or may not be identical; then the method may determine how many of each symbols is replaced on each reel. The manner of which symbols, how many spots, and where on the reel the symbols are placed may vary in implementation (see below for details).

In one specific example, each symbol may replace from 20 to 50 symbols on the reel, in increments of 5. Any number of symbols (e.g., 0 to N) and/or any number of increments (e.g., 1 to N) may be utilized. In one example, there are three symbols utilized in increments of ten. In another example, ten symbols are utilized in increments of fifteen. The decision of which symbols to use and how many symbols to replace may be made dependently based upon a random drawing of a weighted table. For example, a subset of the table might look like:

M2 M2 M2 M2 M2 30 30 40 30 20 with probability 1%;

M2 M2 M2 M2 M2 20 20 20 20 50 with probability 1%; and/or

M1 F5 WW WW M1 50 20 50 20 50 with probability 5%.

In this example, the first entry replaces reel 1 with M2, reel 2 with M2, reel 3 with M2, reel 4 with M2 and reel 5 with M2. If this entry is picked, then 30 symbols are replaced on reel 1, 2 and 4, 40 symbols on reel 3 and 20 symbols on reel 5. (See index #1—reference number 732 on FIG. 7B).

Similarly if the second entry is selected, the same symbols are used for the replacement on the same reels, but 20 symbols are replaced on reels 1 through 4 and 50 on the last reel. (See index #2—FIG. 7B). Finally, if the third entry is selected, then 50 symbols of M1 are replaced on reel 1, 20 symbols of F5 are replaced on reel 2, 50 symbols of WW are replaced on reel 3, 20 symbols of WW are replaced on reel 4 and 50 symbols of M1 are replaced on reel 5. (See index #3—FIG. 7B).

If the 101 index is selected, then the S1 symbol would be placed on Reel 1, Reel 2, Reel 3, Reel 4, and Reel 5. The number of S1 symbols on Reel 1 would be 40. The number of S1 symbols on Reel 2 would be 40. The number of S1 symbols on Reel 3 would be 10. The number of S1 symbols on Reel 4 would be 20. The number of S1 symbols on Reel 5 would be 40.

In FIG. 7B, another illustration of stacking game play on a gaming device is shown, according to one embodiment. In this example, the index 710 shows 1024 indexes, however, any number (e.g., 1 to N) may be utilized. In another example, index number 1023 is selected. The number of S1 symbols on Reel 1 and Reel 2 and Reel 5 would be 40. The number of S1 symbols on Reel 3 would be 10 and the number of S1 symbols on Reel 4 would be 20.

Figure 7C:
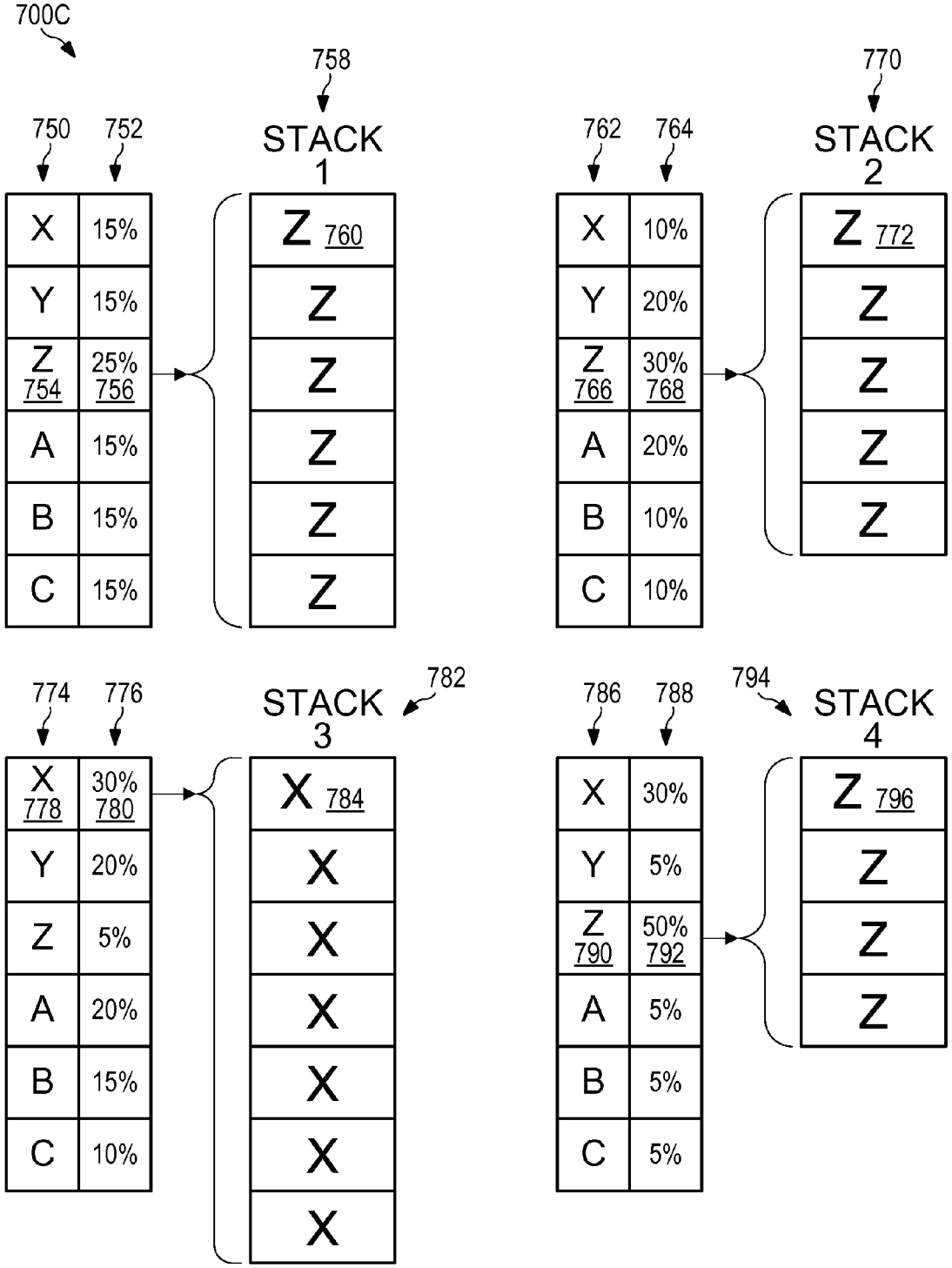
FIG. 7C is another illustration of stacking game play on a gaming device, according to one embodiment.
Figure 7D:
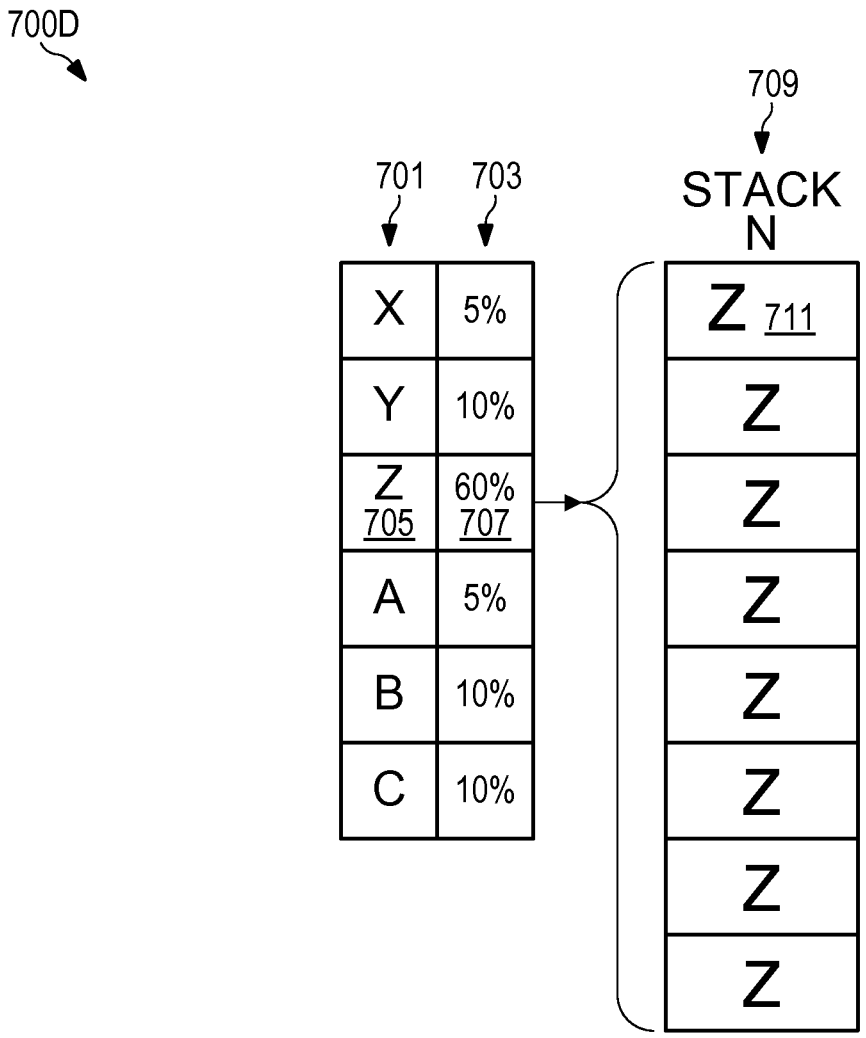
FIG. 7D is another illustration of stacking game play on a gaming device, according to one embodiment.

In FIG. 7C, another illustration of stacking game play on a gaming device is shown, according to one embodiment. In this example, the system, method, and/or device may determine a stack symbol from a plurality of symbols 750. In one example, a first stack symbol 754 (e.g., Z) may be selected. In this example, the weighting for each symbol may be different. In another example, the weighting may be equal for each potential stacking symbol. In this example, the X symbol had a 15% weighting, the Y symbol had a 15% weighting, the Z symbol had a 25% weighting, the A symbol had a 15% weighting, the B symbol had a 15% weighting, and the C symbol had a 15% weighting. Once the Z symbol is selected (reference number 756) for a first stack, the system, method, and/or device may determine the weighting of a plurality of potential stacking symbols for a second stack 770. In this example, the weighting for the Z symbol may be modified based on the selection of the Z symbol for the first stack. In this example, the probability of the Z being selected for the second stack has increased to 30% (see column with reference number 764). In this example, the Z symbol has been selected as the second stacking symbol 768 for the second stack. In this example, the system, method, and/or device may determine the weighting of a plurality of potential stacking symbols for a third stack 782. In this example, the weighting of the Z symbol may be modified based on the selection(s) of the Z symbol for the first stack and/or for the second stack 770. In this example, the probability of the Z symbol being selected for the third stack 782 has decreased to 5% (see column with reference number 776). In this example, the X symbol (reference number 780) has been selected for the third stack 782. In this example, the system, method, and/or device may determine the weighting of a plurality of potential stacking symbols for a fourth stack 794. In this example, the probability of the Z symbol being selected for the fourth stack 794 has increased to 50% because the selection of the X symbol selected for the third stack 782 was a blocking symbol selection. This allows for exciting but not-winning and/or minimally winning outcomes. Further as seen in FIG. 7D, the system, method, and/or device may determine the weighting of a plurality of potential stacking symbols for an Nth stack 709. In this example, the probability of the Z symbol being selected for the Nth stack 709 has increased to 60% because the selection of the X symbol selected for the third stack 782 was a blocking symbol selection and/or because of the selections of the Z symbol for the first stack, the second stack, and/or the fourth stack formed an attractive configuration (a lot of potentially winning/same symbols) but with a non-winning and/or minimal winning outcomes.

Figure 8A:
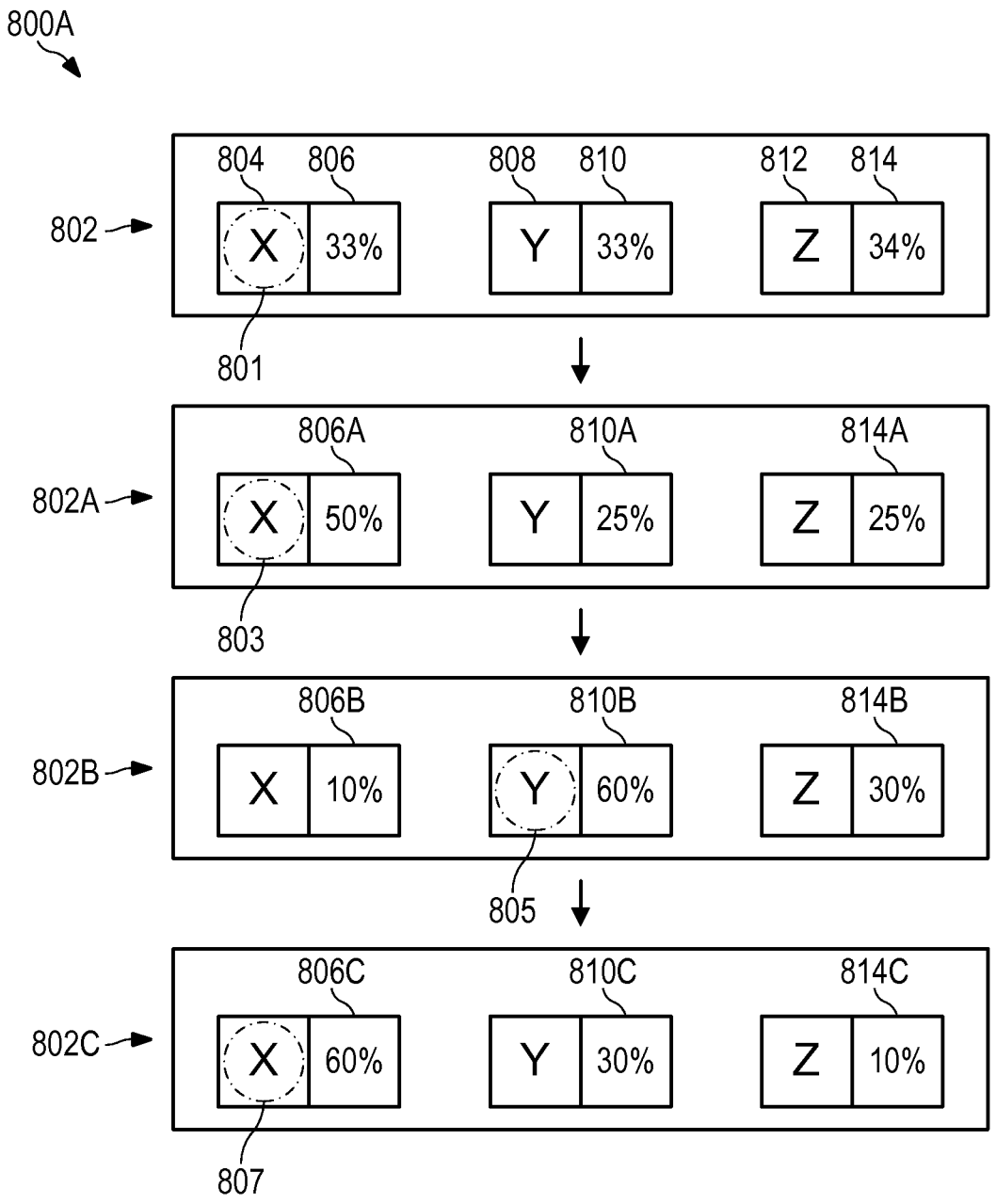
FIG. 8A is another illustration of stacking game play on a gaming device, according to one embodiment.

In FIG. 8A, another illustration of stacking game play on a gaming device is shown, according to one embodiment. In this example, the system, method, and/or device may select one or more symbols from a plurality of symbols to utilize as a stacking symbol. In this example, the three symbols (e.g., X, Y, and Z) have equal weighting (e.g., ⅓, ⅓, and ⅓). In this example, the system, method, and/or device has selected the X symbol (e.g., reference number 801) as the first stacking symbol for the first reel and/or first stacking area. In this example, the system, method, and/or device may then modify the probabilities for each symbol (e.g., X, Y, and Z) to be selected for the second reel and/or second stacking area. In this example, the probability of selecting the X symbol has increased to 50% (this may be increased because the X symbol was selected for the first stack and/or first reel) and the probabilities of selecting the Y symbol and the Z symbol has decreased to 25% for each. In this example, the system, method, and/or device has selected the X symbol (e.g., reference number 803) as the second stacking symbol for the second reel and/or second stacking area. In this example, the system, method, and/or device may then modify the probabilities for each symbol (e.g., X, Y, and Z) to be selected for the third reel and/or third stacking area. In this example, the probability of selecting the X symbol has decreased to 10% (this may be increased because the X symbol was selected for the first stack, second stack, first reel, and/or second reel) and the probabilities of selecting the Y symbol have increased to 60% and the Z symbol has increased to 30%. In this example, the system, method, and/or device has selected the Y symbol (e.g., reference number 805) as the third stacking symbol for the third reel and/or third stacking area. In this example, the system, method, and/or device may then modify the probabilities for each symbol (e.g., X, Y, and Z) to be selected for the Nth reel and/or Nth stacking area. In this example, the probability of selecting the X symbol has increased to 60% (this may be increased because the X symbol was selected for the first stack, second stack, first reel, and/or second reel while a non-X symbol was selected for the third reel and/or third stacking) and the probabilities of selecting the Y symbol has decreased to 30% and the Z symbol has decreased to 10%. In this example, the system, method, and/or device has selected the X symbol (e.g., reference number 807) as the Nth stacking symbol for the Nth reel and/or Nth stacking area.

Figure 8B:
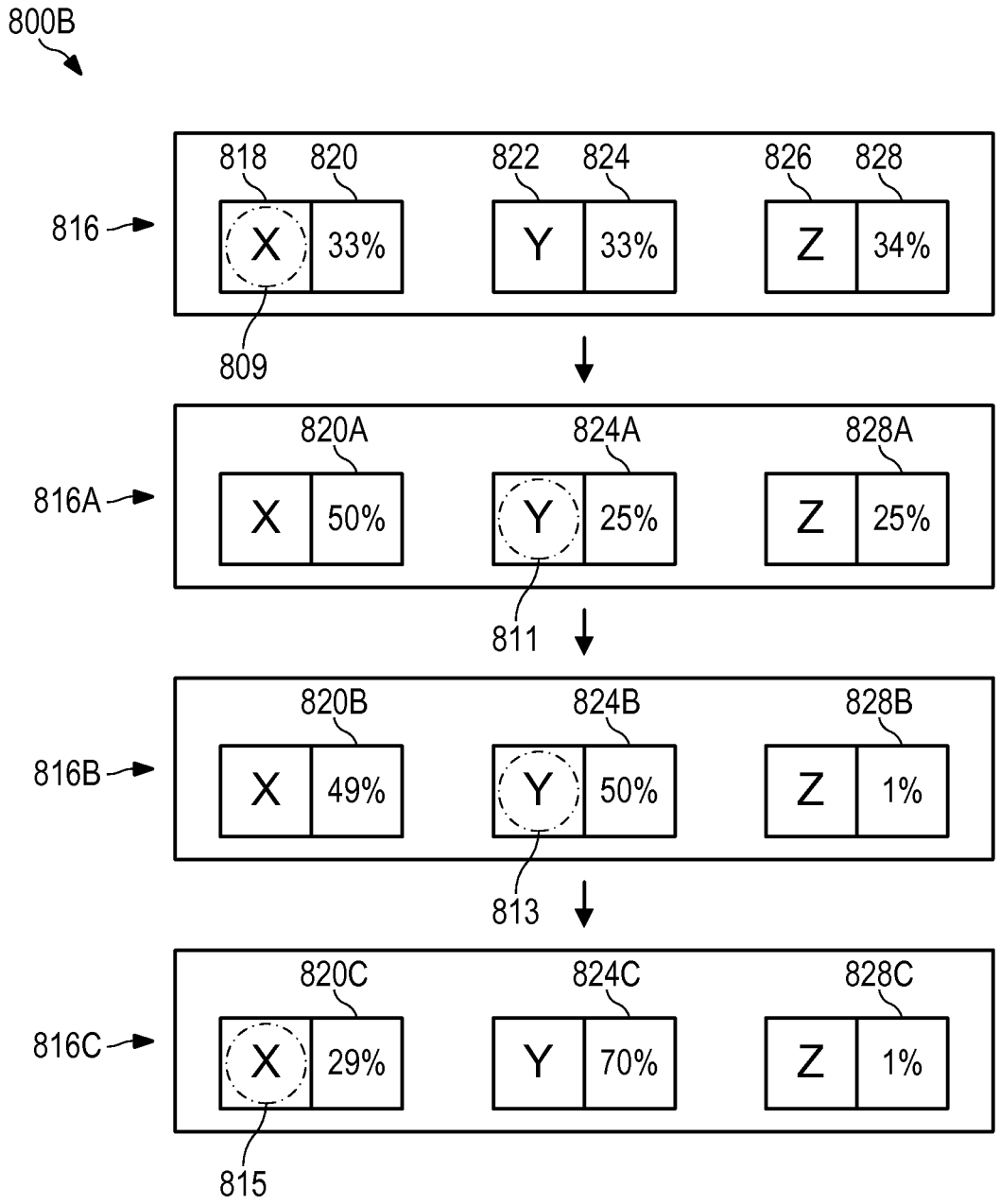
FIG. 8B is another illustration of stacking game play on a gaming device, according to one embodiment.

In FIG. 8B, another illustration of stacking game play on a gaming device is shown, according to one embodiment. In this example, the system, method, and/or device may select one or more symbols from a plurality of symbols to utilize as a stacking symbol. In this example, the three symbols (e.g., X, Y, and Z) have equal weighting (e.g., ⅓, ⅓, and ⅓). In this example, the system, method, and/or device has selected the X symbol (e.g., reference number 809) as the first stacking symbol for the first reel and/or first stacking area. In this example, the system, method, and/or device may then modify the probabilities for each symbol (e.g., X, Y, and Z) to be selected for the second reel and/or second stacking area. In this example, the probability of selecting the X symbol has increased to 50% (this may be increased because the X symbol was selected for the first stack and/or first reel—it should be noted that it could also be decreased and/or remain constant) and the probabilities of selecting the Y symbol and the Z symbol has decreased to 25% for each. In this example, the system, method, and/or device has selected the Y symbol (e.g., reference number 811) as the second stacking symbol for the second reel and/or second stacking area. In this example, the system, method, and/or device may then modify the probabilities for each symbol (e.g., X, Y, and Z) to be selected for the third reel and/or third stacking area. In this example, the probability of selecting the X symbol has decreased to 49% (this may be increased because the X symbol was selected for the first stack and/or first reel while the Y symbol was selected for the second stack and/or second reel—it should be noted that it could also be decreased and/or remain constant) and the probabilities of selecting the Y symbol has increased to 50% and the Z symbol has decreased to 1%. In this example, the system, method, and/or device has selected the Y symbol (e.g., reference number 813) as the third stacking symbol for the third reel and/or third stacking area. In this example, the system, method, and/or device may then modify the probabilities for each symbol (e.g., X, Y, and Z) to be selected for the Nth reel and/or Nth stacking area. In this example, the probability of selecting the X symbol has decreased to 29% (this may be decreased because the X symbol was selected for the first stack and/or first reel, while a non-X symbol was selected for the second reel, second stack, third reel and/or third stacking—it should be noted that it could also be increased and/or remain constant) and the probabilities of selecting the Y symbol has increased to 70% and the Z symbol has remained constant at 1%. In this example, the system, method, and/or device has selected the X symbol (e.g., reference number 815) as the Nth stacking symbol for the Nth reel and/or Nth stacking area.

Figure 8C:
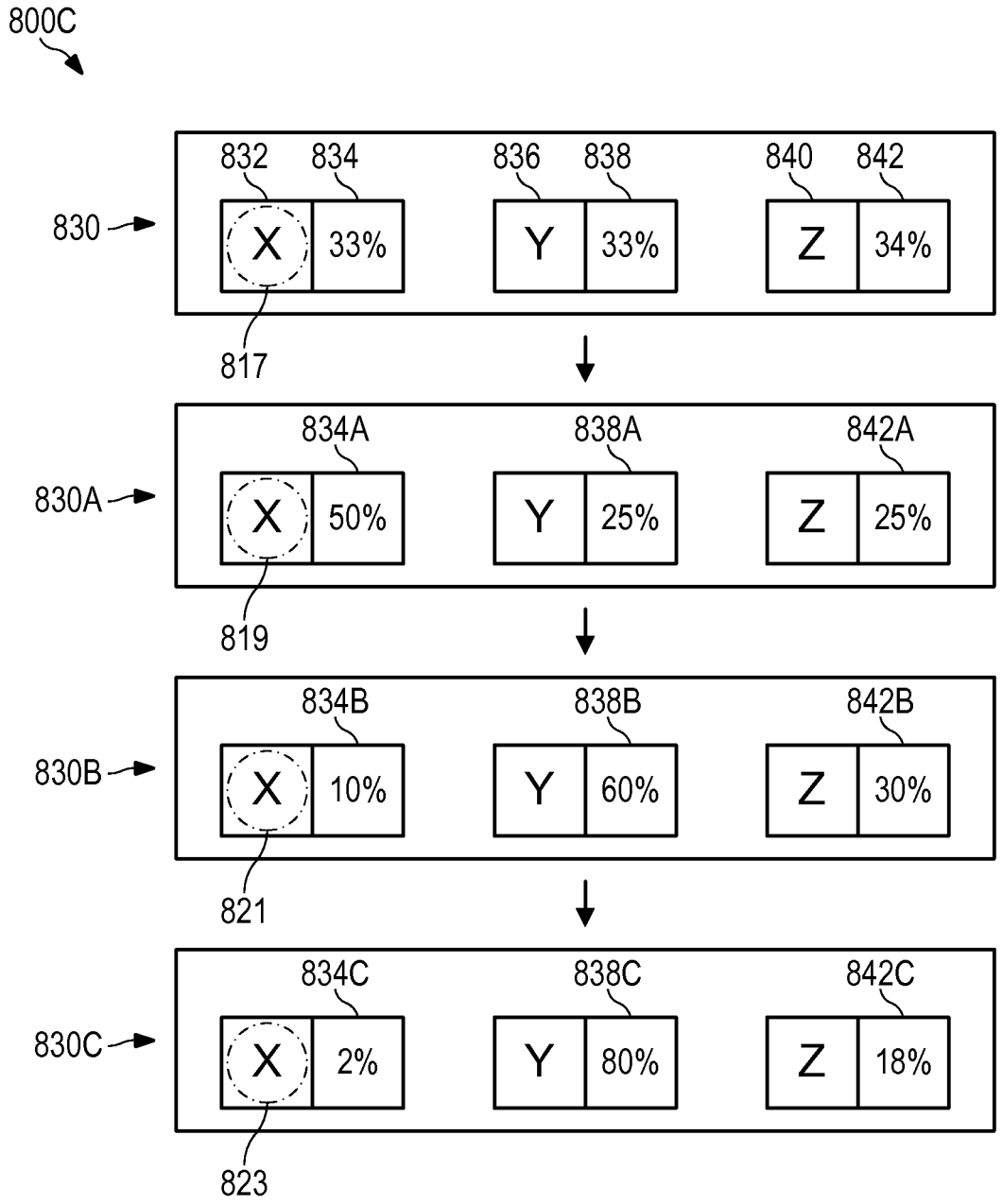
FIG. 8C is another illustration of stacking game play on a gaming device, according to one embodiment.

In FIG. 8C, another illustration of stacking game play on a gaming device is shown, according to one embodiment. In this example, the system, method, and/or device may select one or more symbols from a plurality of symbols to utilize as a stacking symbol. In this example, the three symbols (e.g., X, Y, and Z) have equal weighting (e.g., ⅓, ⅓, and ⅓). In this example, the system, method, and/or device has selected the X symbol (e.g., reference number 817) as the first stacking symbol for the first reel and/or first stacking area. In this example, the system, method, and/or device may then modify the probabilities for each symbol (e.g., X, Y, and Z) to be selected for the second reel and/or second stacking area. In this example, the probability of selecting the X symbol has increased to 50% (this may be increased because the X symbol was selected for the first stack and/or first reel—it should be noted that it could also be decreased and/or remain constant) and the probabilities of selecting the Y symbol and the Z symbol has decreased to 25% for each. In this example, the system, method, and/or device has selected the X symbol (e.g., reference number 819) as the second stacking symbol for the second reel and/or second stacking area. In this example, the system, method, and/or device may then modify the probabilities for each symbol (e.g., X, Y, and Z) to be selected for the third reel and/or third stacking area. In this example, the probability of selecting the X symbol has decreased to 10% (this may be decreased because the X symbol was selected for the first stack, first reel, second stack and/or second reel—it should be noted that it could also be increased and/or remain constant) and the probabilities of selecting the Y symbol have increased to 60% and the Z symbol has increased to 30%. In this example, the system, method, and/or device has selected the X symbol (e.g., reference number 821) as the third stacking symbol for the third reel and/or third stacking area. In this example, the system, method, and/or device may then modify the probabilities for each symbol (e.g., X, Y, and Z) to be selected for the Nth reel and/or Nth stacking area. In this example, the probability of selecting the X symbol has decreased to 2% (this may be decreased because the X symbol was selected for the first stack, first reel, second reel, second stack, third reel and/or third stacking—it should be noted that it could also be increased and/or remain constant) and the probabilities of selecting the Y symbol have increased to 80% and the Z symbol has decreased to 18%. In this example, the system, method, and/or device has selected the X symbol (e.g., reference number 823) as the Nth stacking symbol for the Nth reel and/or Nth stacking area. This may result in a significant winning outcome and/or outcomes.

Figure 8D:
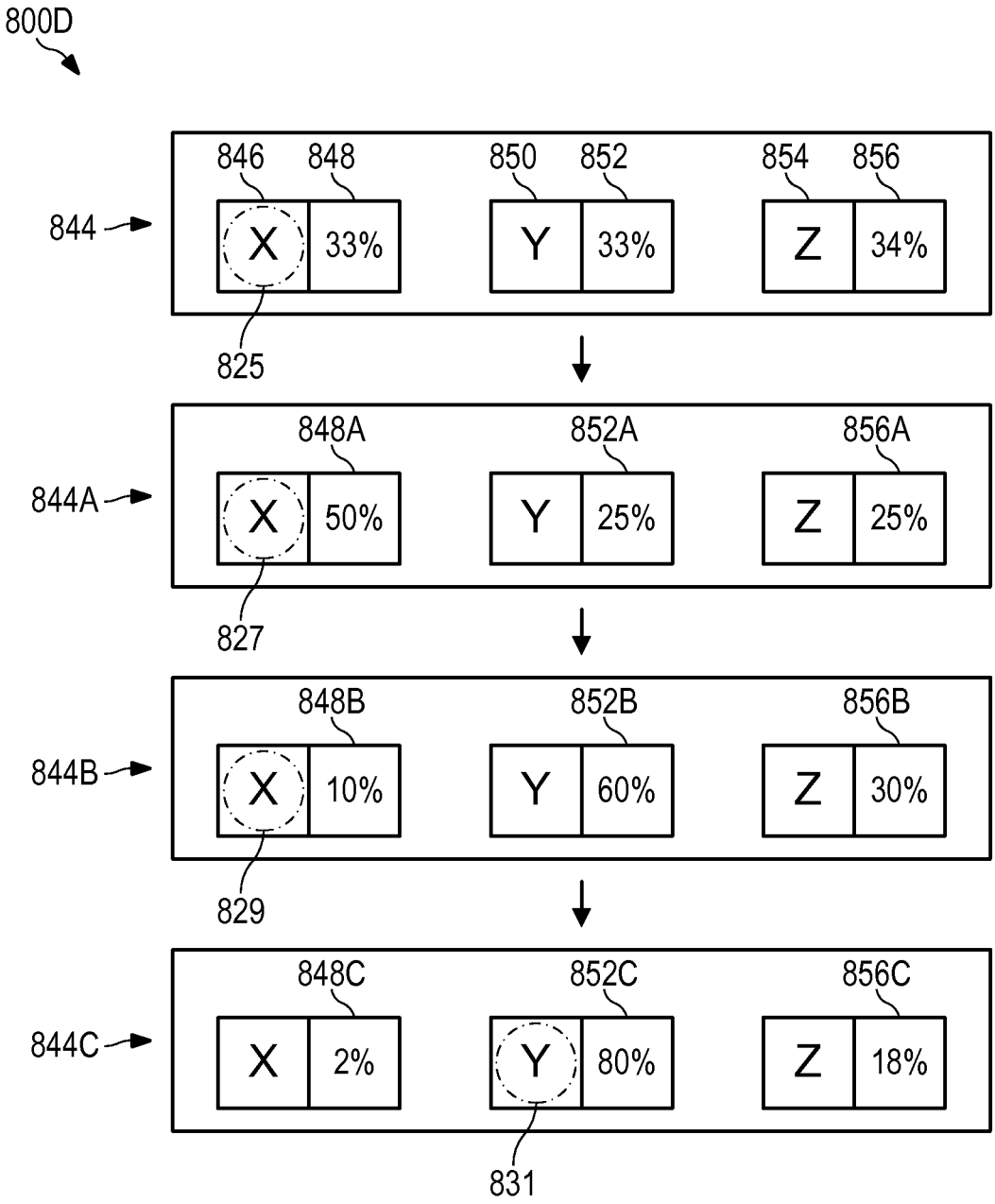
FIG. 8D is another illustration of stacking game play on a gaming device, according to one embodiment.

In FIG. 8D, another illustration of stacking game play on a gaming device is shown, according to one embodiment. In this example, the system, method, and/or device may select one or more symbols from a plurality of symbols to utilize as a stacking symbol. In this example, the three symbols (e.g., X, Y, and Z) have equal weighting (e.g., ⅓, ⅓, and ⅓). In this example, the system, method, and/or device has selected the X symbol (e.g., reference number 825) as the first stacking symbol for the first reel and/or first stacking area. In this example, the system, method, and/or device may then modify the probabilities for each symbol (e.g., X, Y, and Z) to be selected for the second reel and/or second stacking area. In this example, the probability of selecting the X symbol has increased to 50% (this may be increased because the X symbol was selected for the first stack and/or first reel) and the probabilities of selecting the Y symbol and the Z symbol has decreased to 25% for each. In this example, the system, method, and/or device has selected the X symbol (e.g., reference number 827) as the second stacking symbol for the second reel and/or second stacking area. In this example, the system, method, and/or device may then modify the probabilities for each symbol (e.g., X, Y, and Z) to be selected for the third reel and/or third stacking area. In this example, the probability of selecting the X symbol has decreased to 10% (this may be decreased because the X symbol was selected for the first stack, first reel, second stack and/or second reel) and the probabilities of selecting the Y symbol have increased to 60% and the Z symbol has increased to 30%. In this example, the system, method, and/or device has selected the X symbol (e.g., reference number 829) as the third stacking symbol for the third reel and/or third stacking area. In this example, the system, method, and/or device may then modify the probabilities for each symbol (e.g., X, Y, and Z) to be selected for the Nth reel and/or Nth stacking area. In this example, the probability of selecting the X symbol has decreased to 2% (this may be decreased because the X symbol was selected for the first stack, first reel, second reel, second stack, third reel and/or third stacking) and the probabilities of selecting the Y symbol have increased to 80% and the Z symbol has decreased to 18%. In this example, the system, method, and/or device has selected the Y symbol (e.g., reference number 831) as the Nth stacking symbol for the Nth reel and/or Nth stacking area. This may have resulted in an above-average winning outcome.

Figure 9A:
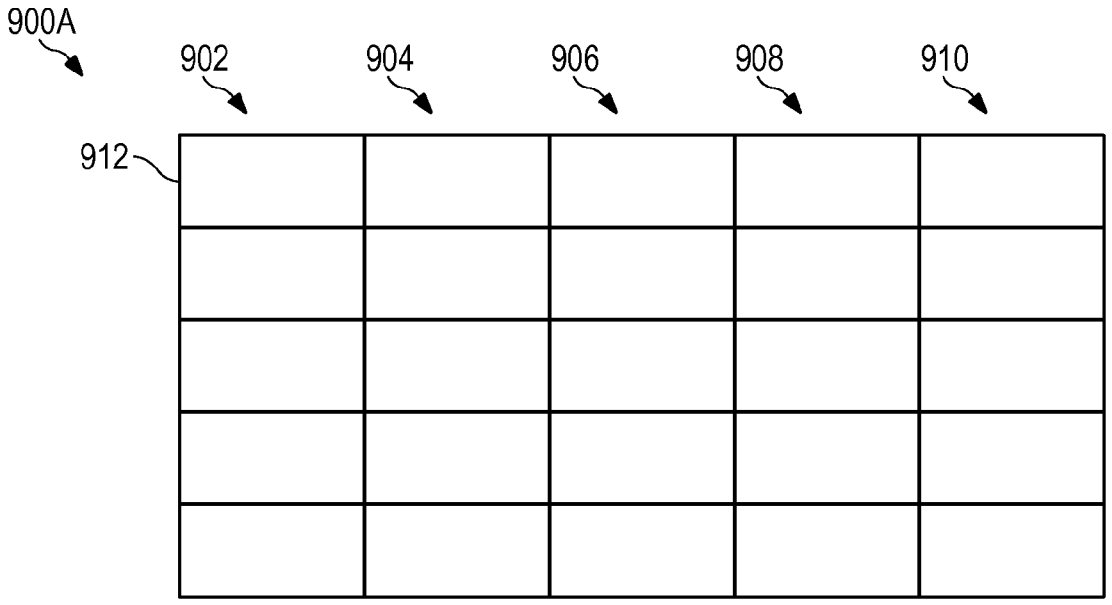
FIG. 9A is another illustration of stacking game play on a gaming device, according to one embodiment.

In FIG. 9A, another illustration of stacking game play on a gaming device is shown, according to one embodiment. In this example, the display matrix is a 5 by 5 grid. However, any size grid N×M may be utilized where N=1 to any number and M=1 to any number. For example, the grid may be 3×4; 4×5; 5×4; 5×2; 7×9; 100×50, etc.

Figure 9B:
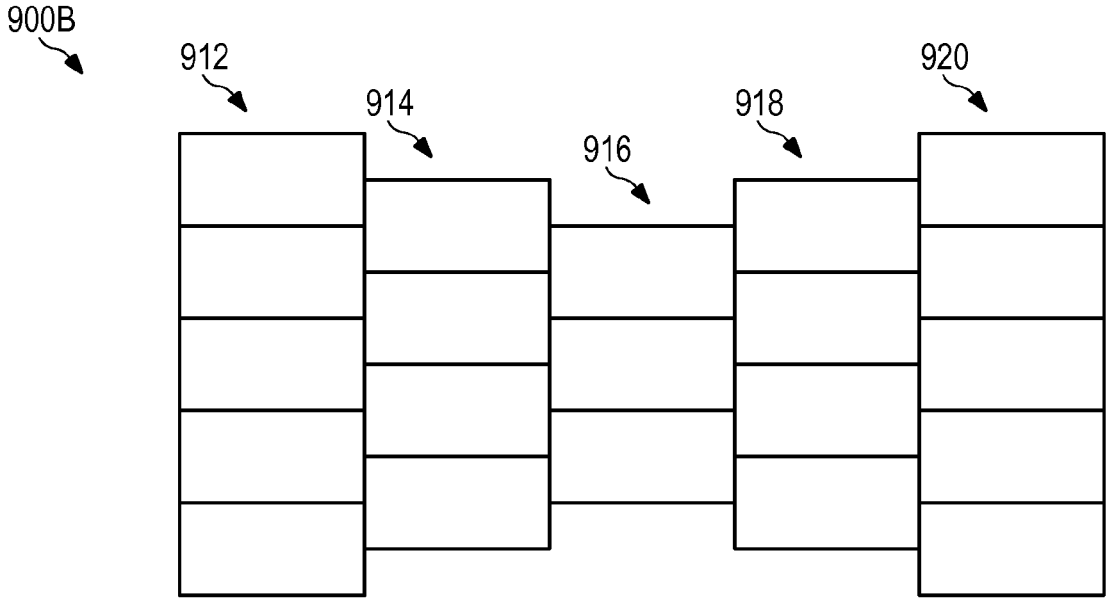
FIG. 9B is another illustration of stacking game play on a gaming device, according to one embodiment.

In FIG. 9B, another illustration of stacking game play on a gaming device is shown, according to one embodiment. In this example, the display matrix includes a first column 912 which has 5 rows, a second column 914 which has 4 rows, a third column 916 which has 3 rows, a fourth column 918 which has 4 rows, and a fifth column 920 which has 5 rows. In should be noted that display matrix may have any number (e.g., 1 to N) of columns with any number of rows (e.g., 1 to N).

Figure 9C:
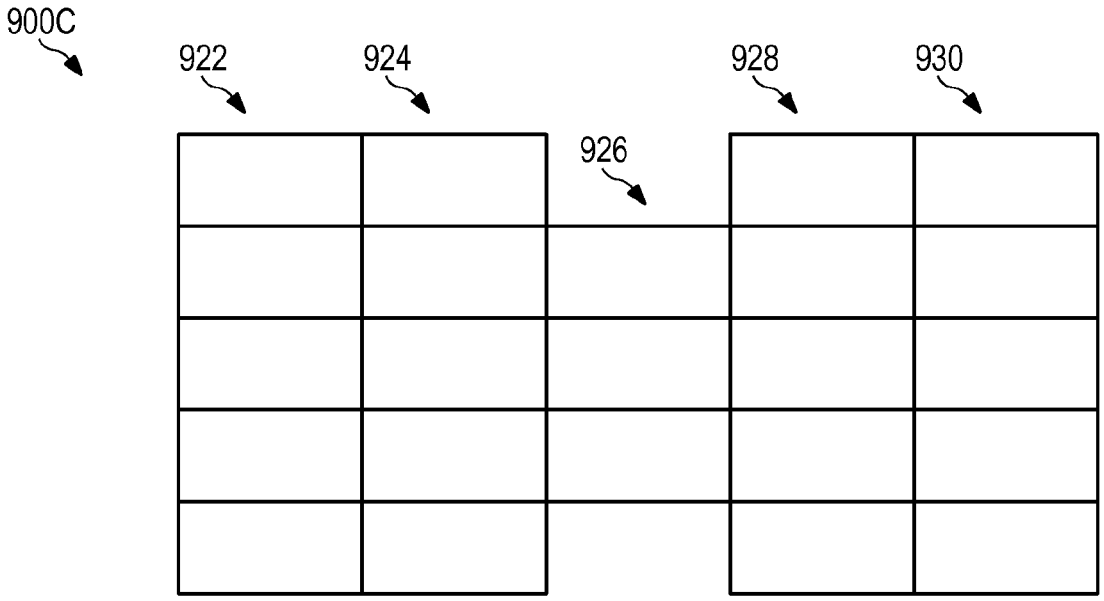
FIG. 9C is another illustration of stacking game play on a gaming device, according to one embodiment.

In FIG. 9C, another illustration of stacking game play on a gaming device is shown, according to one embodiment. In this example, the display matrix includes a first column 922 which has 5 rows, a second column 924 which has 5 rows, a third column 926 which has 3 rows, a fourth column 928 which has 5 rows, and a fifth column 930 which has 5 rows.

Figure 9D:
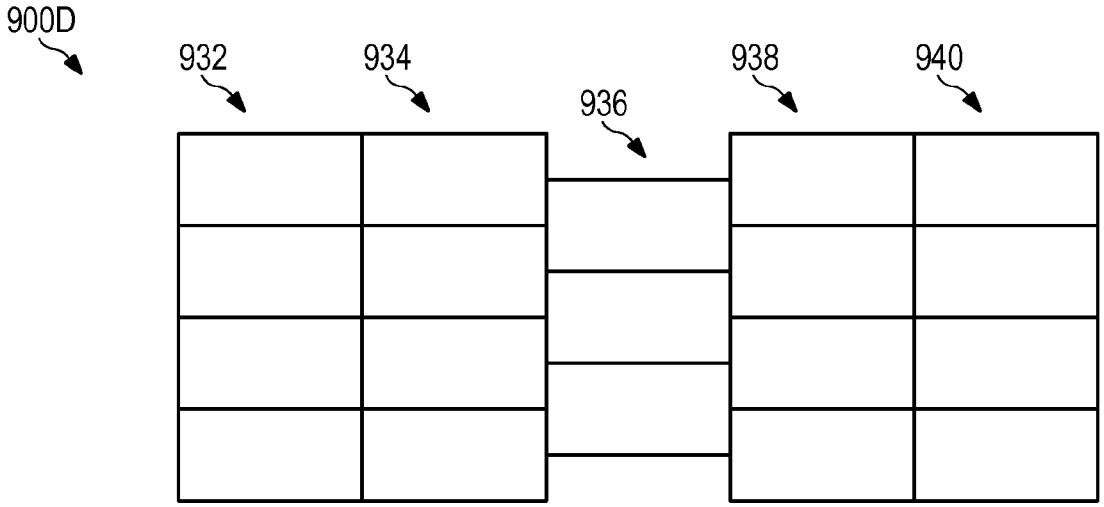
FIG. 9D is another illustration of stacking game play on a gaming device, according to one embodiment.

In FIG. 9D, another illustration of stacking game play on a gaming device is shown, according to one embodiment. In this example, the display matrix includes a first column 932 which has 4 rows, a second column 934 which has 4 rows, a third column 936 which has 3 rows, a fourth column 938 which has 4 rows, and a fifth column 940 which has 4 rows.

Figure 9E:
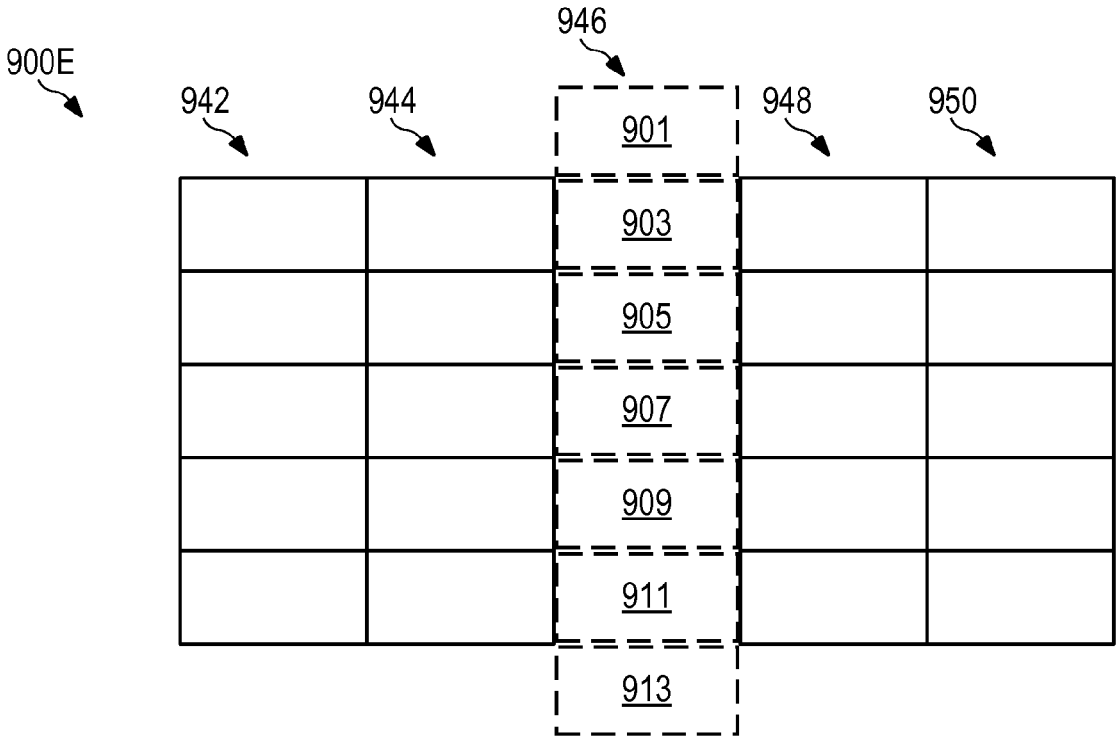
FIG. 9E is another illustration of stacking game play on a gaming device, according to one embodiment.

In FIG. 9E, another illustration of stacking game play on a gaming device is shown, according to one embodiment. In this example, the display matrix includes a first column 942 which has 5 rows, a second column 944 which has 5 rows, a third column 946 which has 3 rows, a fourth column 948 which has 5 rows, and a fifth column 950 which has 5 rows. In this example, third column 946 can expand by any number of display units (e.g., 1-N) which may be based on a triggering event, the number of credits wagered, a bonus game, and/or any other criteria. In this example, third column 946 has expanded by four display units. For example, one or more columns and/or display areas may expand based on a maximum wager, a number of lines wagered on, a length of time playing a wagered amount (e.g., maximum wager, number of lines, etc.), a bonus game trigger, the time of day of game play, a loyalty program, etc.

Figure 9F:
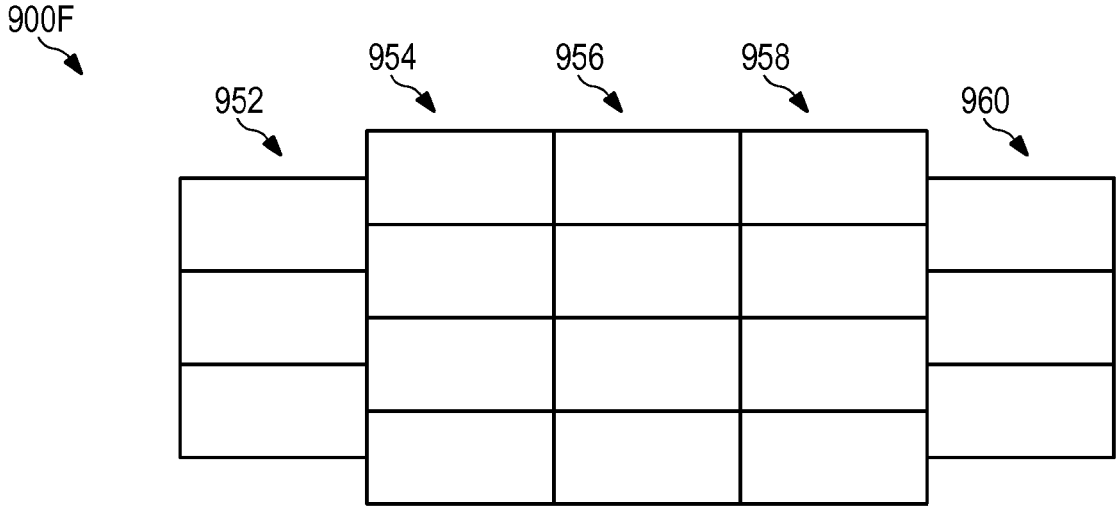
FIG. 9F is another illustration of stacking game play on a gaming device, according to one embodiment.

In FIG. 9F, another illustration of stacking game play on a gaming device is shown, according to one embodiment. In this example, the display matrix includes a first column 952 which has 3 rows, a second column 954 which has 4 rows, a third column 956 which has 4 rows, a fourth column 958 which has 4 rows, and a fifth column 960 which has 3 rows. In should be noted that by increasing and/or decreasing the size of a column the probabilities of winning events can be altered (e.g., increased, decreased, enhanced, blocked, etc.).

Figure 9G:
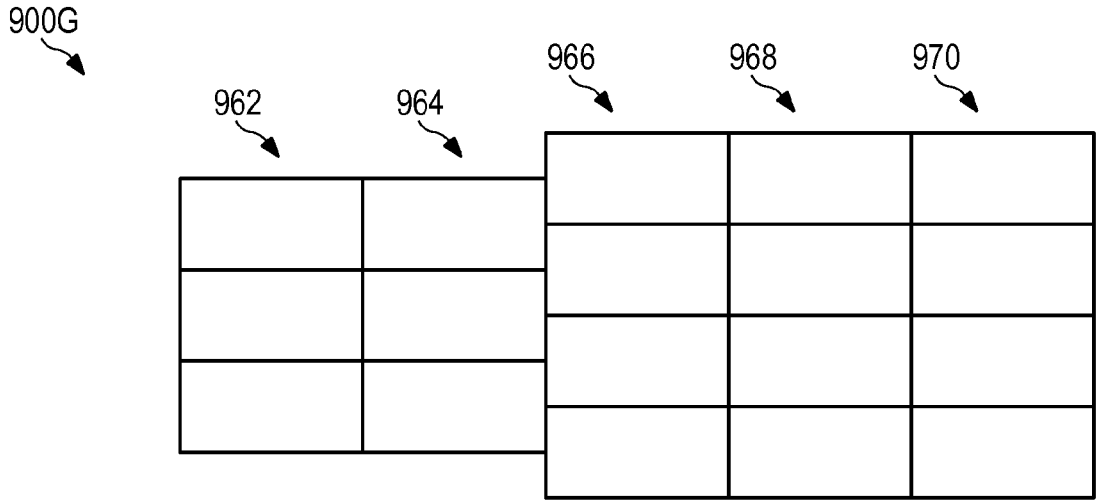
FIG. 9G is another illustration of stacking game play on a gaming device, according to one embodiment.

In FIG. 9G, another illustration of stacking game play on a gaming device is shown, according to one embodiment. In this example, the display matrix includes a first column 962 which has 3 rows, a second column 964 which has 3 rows, a third column 966 which has 4 rows, a fourth column 968 which has 4 rows, and a fifth column 970 which has 4 rows.

Figure 9H:
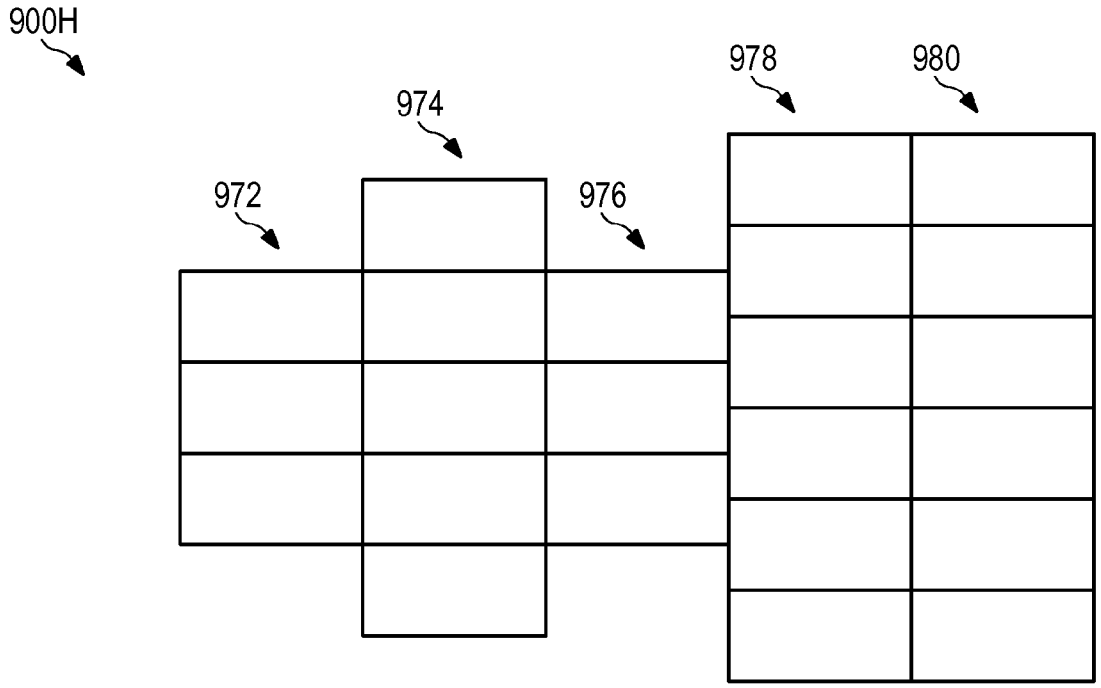
FIG. 9H is another illustration of stacking game play on a gaming device, according to one embodiment.

In FIG. 9H, another illustration of stacking game play on a gaming device is shown, according to one embodiment. In this example, the display matrix includes a first column 972 which has 3 rows, a second column 974 which has 5 rows, a third column 976 which has 3 rows, a fourth column 978 which has 6 rows, and a fifth column 980 which has 6 rows.

Figure 9J:
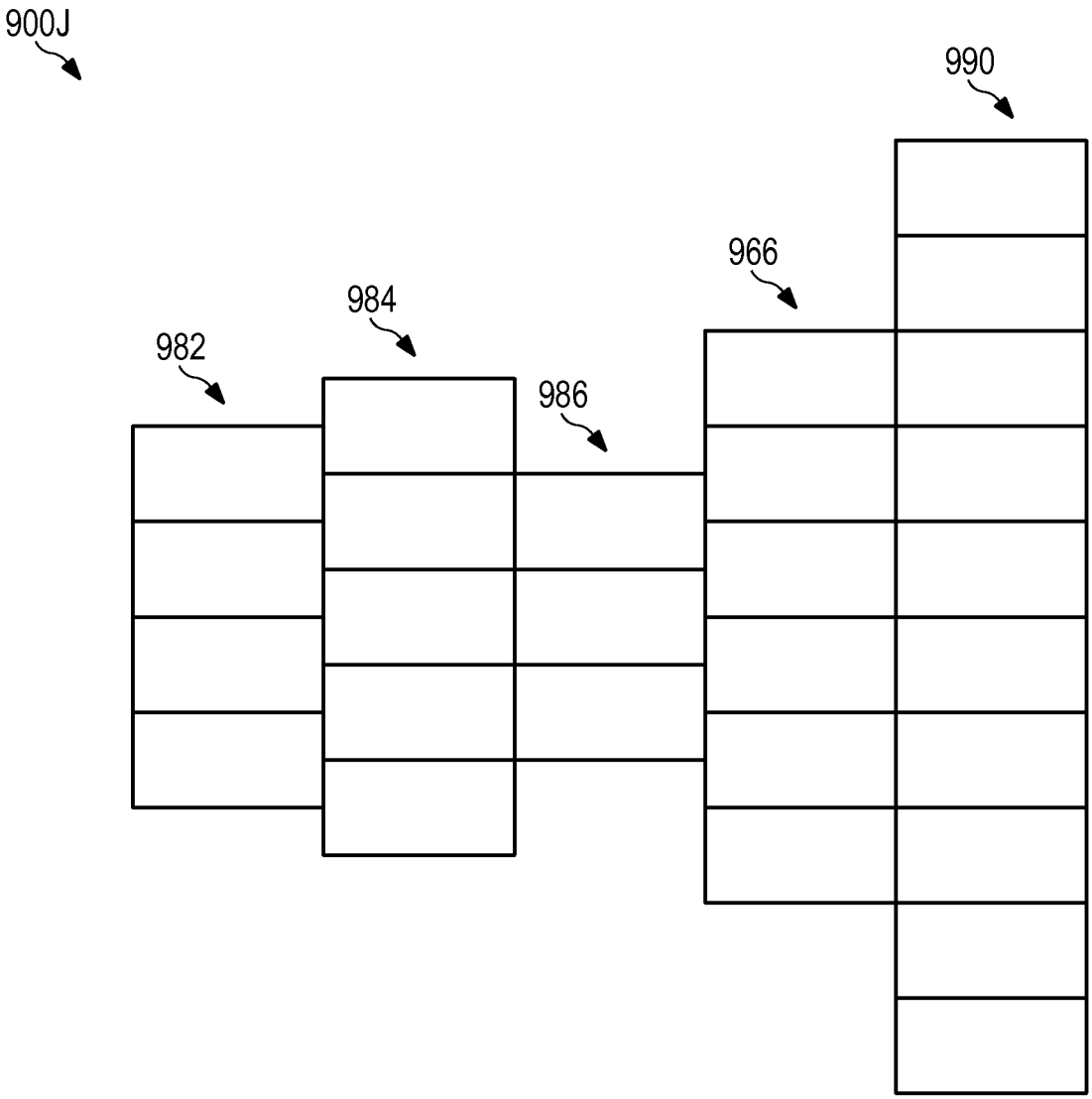
FIG. 9J is another illustration of stacking game play on a gaming device, according to one embodiment.

In FIG. 9J, another illustration of stacking game play on a gaming device is shown, according to one embodiment. In this example, the display matrix includes a first column 982 which has 4 rows, a second column 984 which has 5 rows, a third column 986 which has 3 rows, a fourth column 988 which has 6 rows, and a fifth column 990 which has 10 rows. It should be noted that all of the symbols areas in FIGS. 9A to 9J have remain constant in size and shape.

Further, FIGS. 9A-9J may be utilized with the payline structures of FIGS. 41A-41G and/or any other disclosure in this document.

Figure 10:
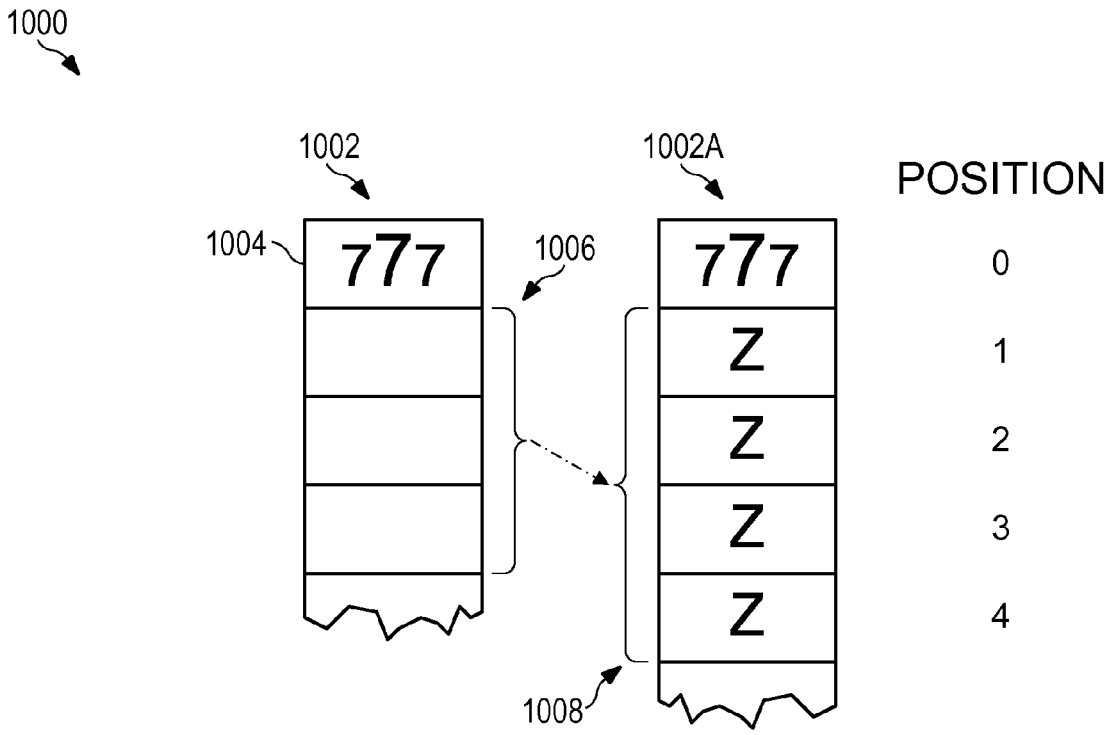
FIG. 10 is another illustration of stacking game play on a gaming device, according to one embodiment.

In FIG. 10, another illustration of stacking game play on a gaming device is shown, according to one embodiment. In this example, the system, device, and/or method may select how many squares 1008 to file in a stack, then the system, device, and/or method may determine which symbol to put in the stack from a look-up table with symbols 1010 and probabilities 1012. Further, the system, device, and/or method may determine a stack starting position (e.g., reel position 1) and a stacking ending position (e.g., reel position 4). In one example, the system, device, and/or method may determine that a specific number of squares (e.g., 4) are going to be utilized for a stacking formation (it should be noted that any number from 0 to N may be utilized and are within the scope of this disclosure). Once the number of squares is determined, then a starting position and an ending position are determined. In this example, the starting position is reel position 1 and the ending position is reel position 4. After the number of squares (e.g., symbol areas) is determined and the starting reel position and the ending reel position is determined, then the stacking symbol may be determined. In one example, six symbols (e.g., X, Y, Z, A, B, and C) may be utilized as stacking symbols. However, any number of symbols from 0 to N may be utilized as potential stacking symbols. In this example, each symbol has a percentage probability of being selected (any percentage may be utilized). In this example, the X, Y, A, B, C symbols all have a 15% chance of being selected. Whereas, the Z symbol has a 25% chance of being selected. In this example, the Z is selected and utilized as the stacking symbols for the 4 square area starting at reel position 1 and ending at reel position 4. Further, all the symbols may have different percentages, the same percentages, some same percentages, some different percentages, and/or any combination of percentages. For example, five symbols can each have a 20% chance. In another example, two symbols can have a 30% chance; one symbol can have a 20% chance; and two symbols can have a 10% chance. In another example, a first symbol can have a 20% chance; a second symbol can have a 5% chance; a third symbol can have a 15% chance; a fourth symbol can have a 25% chance, and a fifth symbol can have the remainder (e.g., 35% chance). It should be noted that any order for the steps may be utilized.

Figure 11A:
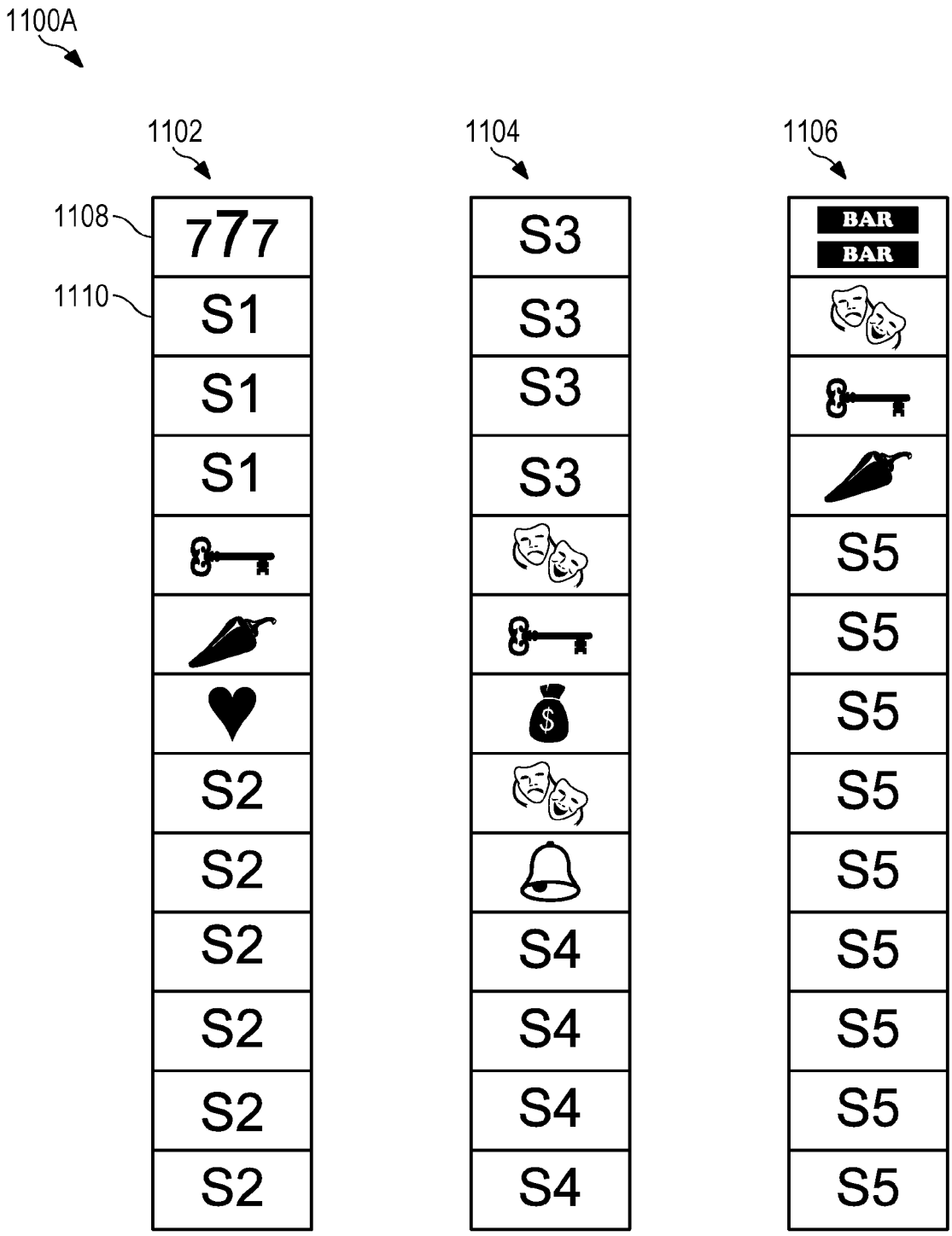
FIG. 11A is another illustration of stacking game play on a gaming device, according to one embodiment.
Figure 11B:
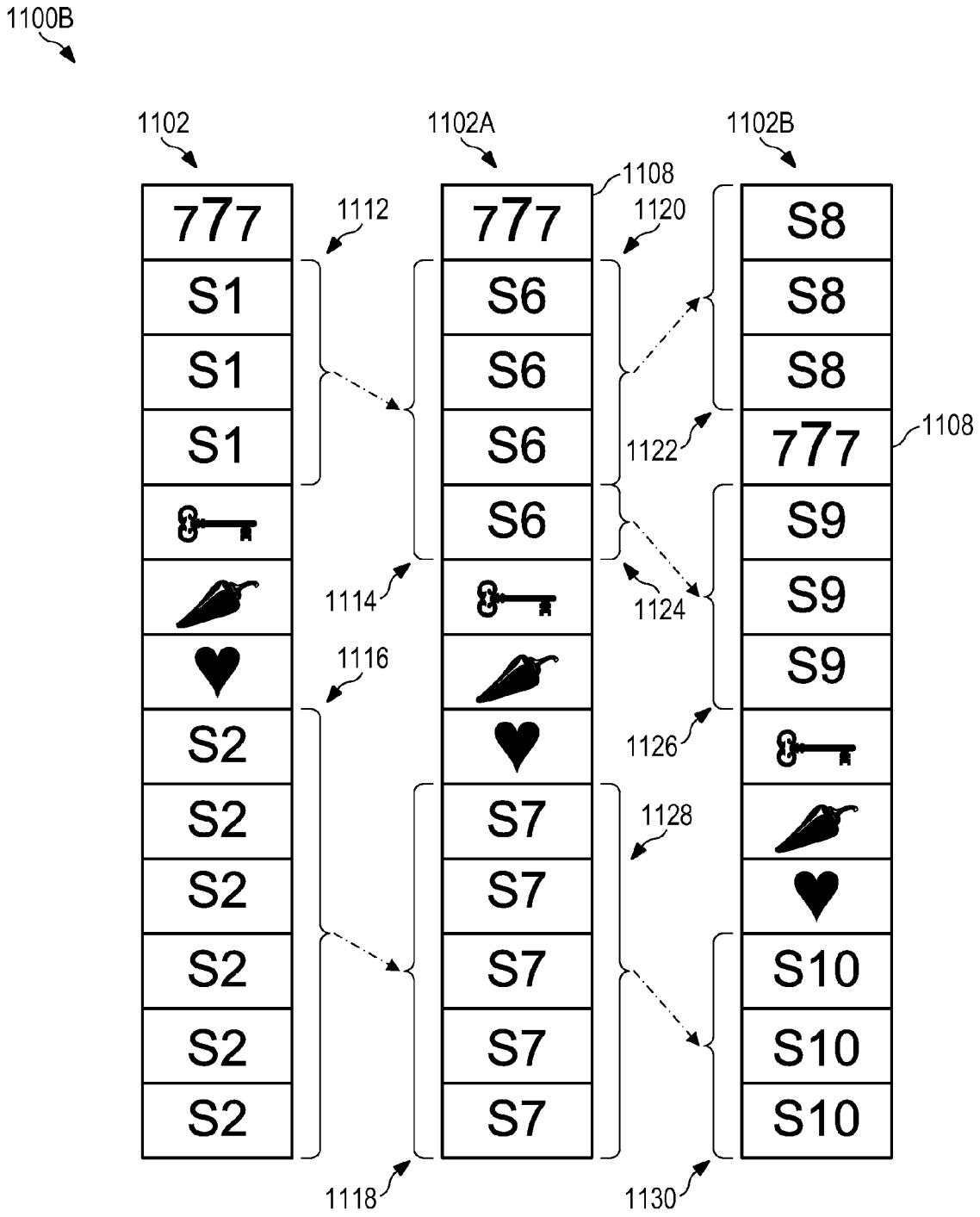
FIG. 11B is another illustration of stacking game play on a gaming device, according to one embodiment.
Figure 11C:
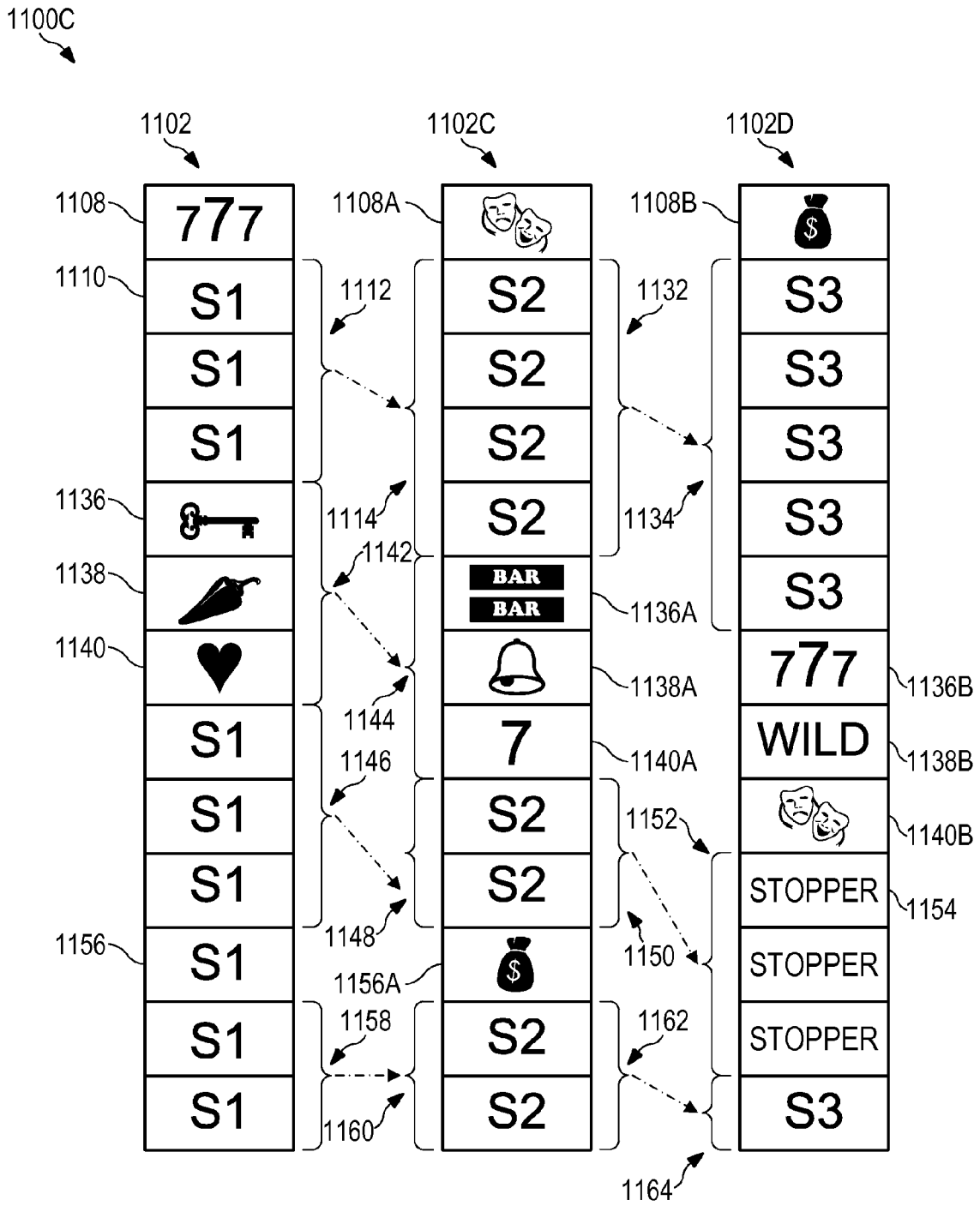
FIG. 11C is another illustration of stacking game play on a gaming device, according to one embodiment.

In FIG. 11A, another illustration of stacking game play on a gaming device is shown, according to one embodiment. In this example, the blank holding areas from FIGS. 6A-6C are being filed with symbols. In these examples shown in FIGS. 11A-C, the S1 symbol is placed in the first stack area, the S2 symbol is placed in the second stack area, the S3 symbol is placed in the third stack area, the S4 symbol is placed in the fourth stack area, and the S5 symbol is placed into the fifth stack area. In FIG. 11B, an example is shown that when the stacking area changes size and/or when the spin number changes (e.g., goes from spin 1 to spin 2 and then to spin 3 and then to spin N, etc.) the stacking symbols change from S1 to S6 and then from S6 to either S8 or S9. Further, symbol S2 changes to S7 and then S7 changes to S10. In FIG. 11C, the non-stacking symbols (e.g., reference numbers 1136, 1138, and 1140) from the previous spin may stay constant (e.g., stay non-stacking symbols from one spin to the next (e.g., from spin 1 to spin 2)). These symbols are still non-stacking symbols, however, they may dynamically changed (e.g., location changed and/or size changed) from one type of non-stacking symbols to another from the first spin to the second spin. Further, these non-stacking symbols may be shifted upward, downward, and/or to an adjacent column/reel. It should be noted that FIGS. 11A-11C may generate errors that need the correction procedure discussed in at least FIGS. 35A-35E, 37, 38, 39, 43C, 45E, 46, and 53.

Figure 12A:
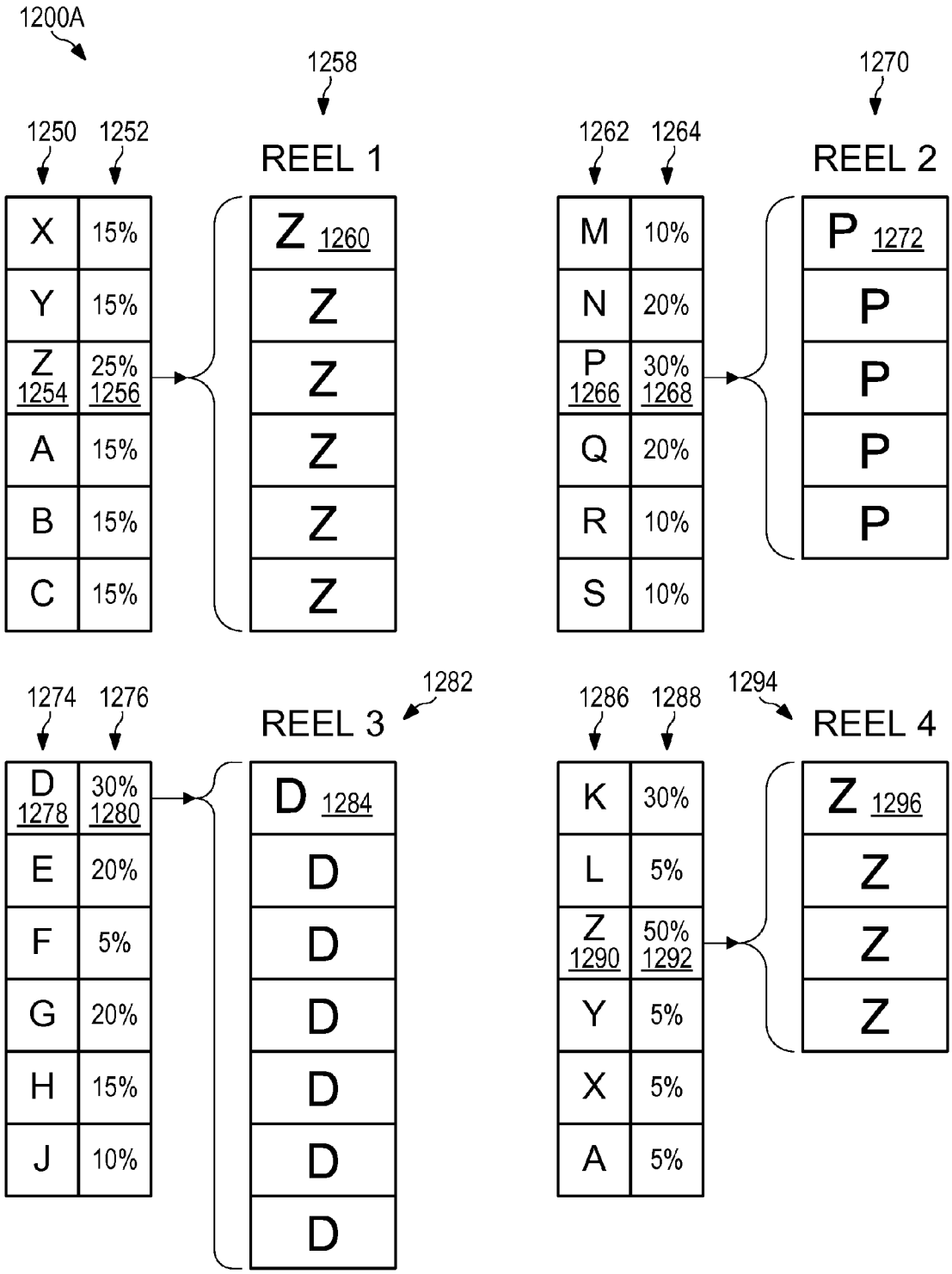
FIG. 12A is another illustration of stacking game play on a gaming device, according to one embodiment.

In FIG. 12A, another illustration of stacking game play on a gaming device is shown, according to one embodiment. In this example, the system, method, and/or device may determine a stack symbol for the first reel from a first plurality of symbols 1250. In one example, a first stack symbol 1254 (e.g., Z) may be selected. In one example, the weighting may be equal for each potential stacking symbol. In another example, the weighting for each symbol may be different. In this example, the X symbol had a 15% weighting, the Y symbol had a 15% weighting, the Z symbol had a 25% weighting, the A symbol had a 15% weighting, the B symbol had a 15% weighting, and the C symbol had a 15% weighting. Once the Z symbol is selected (reference number 1256) for a first reel (and/or a first set of one or more stacking areas one a first reel and/or one or more reels), the system, method, and/or device may determine the weighting of a plurality of potential stacking symbols for a second stack (and/or a second set of one or more stacking areas one a first reel and/or one or more reels).

In this example, the system, method, and/or device may determine a stack symbol for the second reel from a second plurality of symbols 1262. In should be noted that the symbols utilized for the first plurality of symbols 1250 and the symbols utilized for the second plurality of symbols 1262 may have no symbols in common, one or more symbols in common, and/or be related but not identical symbols (e.g., A, ACE, A' etc.). In one example, a second stack symbol 1266 (e.g., P) may be selected. In this example, the weighting for the P symbol may be modified based on the selection of the Z symbol for the first stack. In this example, the probability of the P being selected for the second reel was 30%. In this example, the P symbol has been selected as the second stacking symbol 1266 for the second reel.

In this example, the system, method, and/or device may determine the weighting of a plurality of potential stacking symbols for a third reel (and/or a third set of one or more stacking areas one a first reel and/or one or more reels). In this example, the system, method, and/or device may determine a stack symbol for the third reel from a third plurality of symbols 1274. In one example, a third stack symbol 1278 (e.g., D) may be selected.

In this example, the system, method, and/or device may determine the weighting of a plurality of potential stacking symbols for a fourth reel (and/or a fourth set of one or more stacking areas one a first reel and/or one or more reels). In this example, the system, method, and/or device may determine a stack symbol for the fourth reel from a fourth plurality of symbols 1286. In one example, a fourth stack symbol 1290 (e.g., Z) may be selected. In should be noted that fourth plurality of symbols 1286 had symbols in common with at least one other plurality of symbols (e.g., first plurality of symbols) utilized for selecting one or more stacking symbols.

Figure 12B:
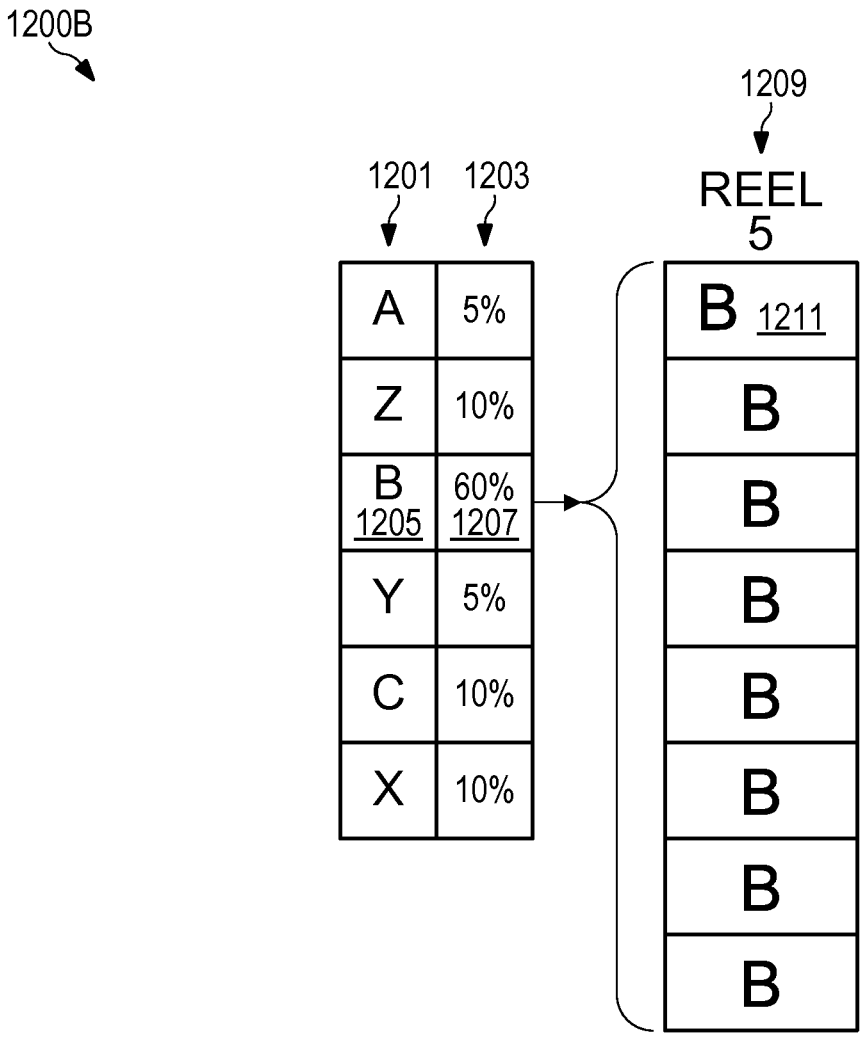
FIG. 12B is another illustration of stacking game play on a gaming device, according to one embodiment.

Further as seen in FIG. 12B, the system, method, and/or device may determine the weighting of a plurality of potential stacking symbols for an Nth stack. In this example, the probability of the B symbol being selected for the Nth stack has increased to 60% because of the previous selection of the B symbol and/or because of one or more blocking symbol selection and/or any other selections.

Figure 13A:
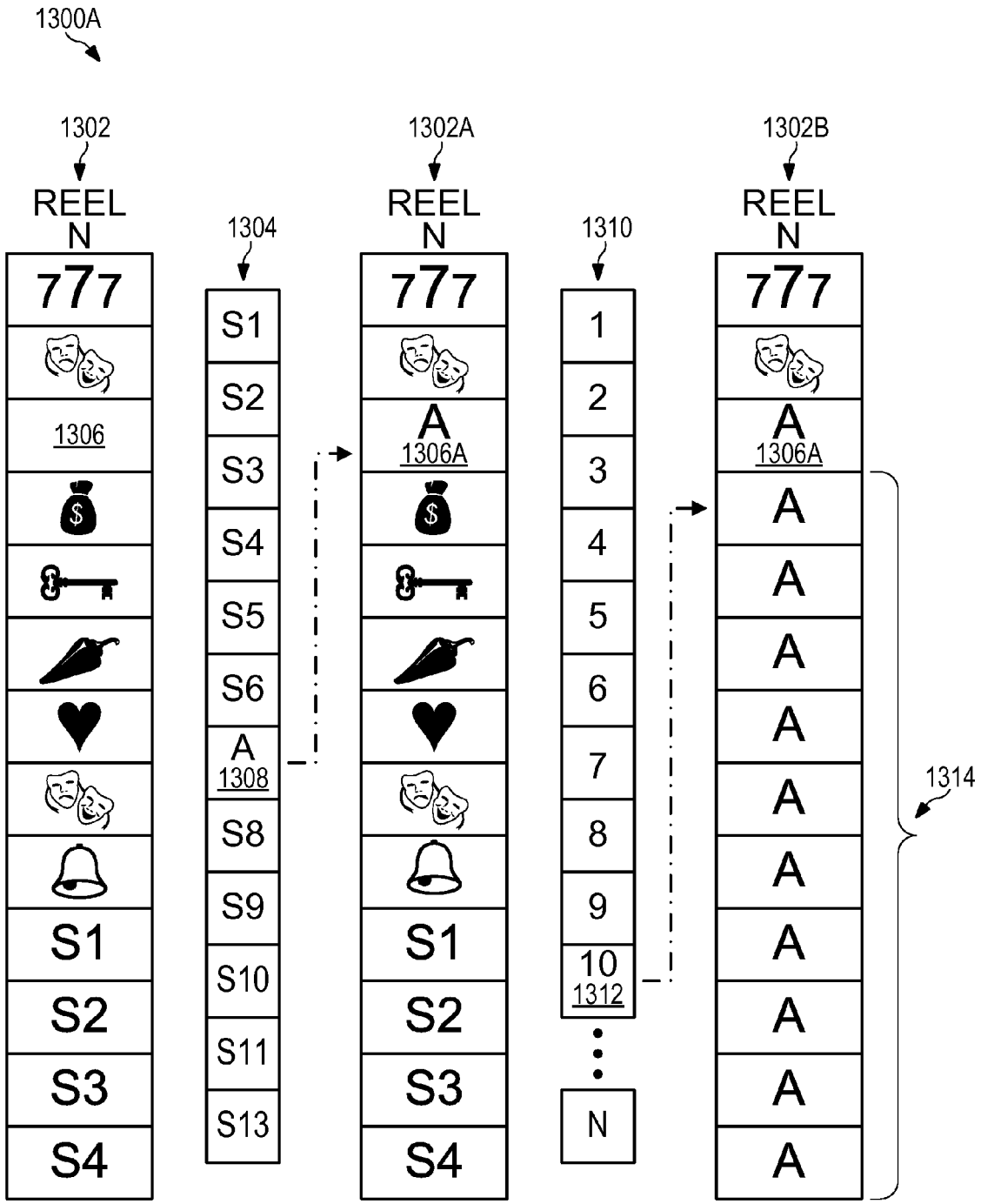
FIG. 13A is another illustration of stacking game play on a gaming device, according to one embodiment.

In FIG. 13A, another illustration of stacking game play on a gaming device is shown, according to one embodiment. In this example, an Nth reel 1302 may include an anchor symbol area 1306. Based on a symbol selection from a plurality of symbols 1304 on a look-up table, matrix, and/or other selection procedure, a first stacking symbol 1308 (e.g., an A) was selected. This first stacking symbol 1308 was placed into previously blanked out anchor symbol area 1306. Once the A symbol is placed into anchor symbol area 1306, then the system, device, and/or method may select a number (e.g., 1 to N) of occurrence of this stacking symbol from a look-up table, matrix, and/or other selection procedure (reference number 1310). In this example, the number 10 was selected. Therefore, 10 additional stacking A will be placed below the anchor symbol area 1306A. In should be noted that the selection of the symbol and the selection of the number of symbols may occur in any order and/or may occur at the same time. Further, the 10 additional stacking A may be placed above, below, and/or split up between the above and/or below option. In addition, the symbols may be placed on the sides and/or in any other pattern (e.g., a T shape, an L shape, an X shape, etc.). In this example, the 10 additional stacking symbols were placed below the anchor symbol 1306A in stacking area 1314.

Figure 13B:
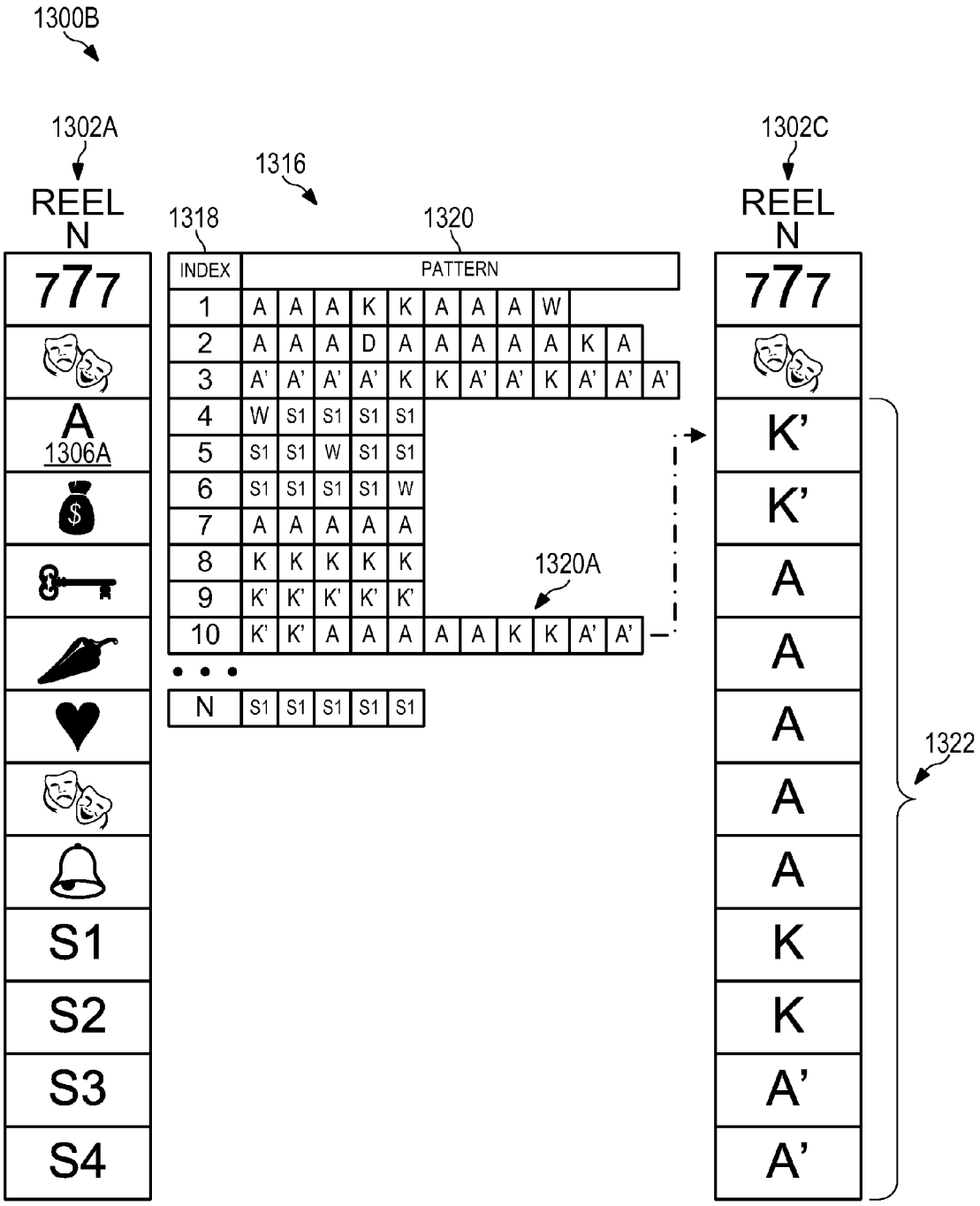
FIG. 13B is another illustration of stacking game play on a gaming device, according to one embodiment.

In FIG. 13B, another illustration of stacking game play on a gaming device is shown, according to one embodiment. In this example, an Nth reel 1302A may include an anchor symbol area 1306A. Based on a symbol selection from a plurality of patterns 1320 on a look-up table 1316, matrix, and/or other selection procedure, a tenth stacking pattern 1320A (e.g., K'K'AAAAAKKA'A') was selected. This tenth stacking pattern 1320A was placed into previously blanked out anchor symbol area 1306A. Once the pattern is placed into anchor symbol area 1306A, then the system, device, and/or method may select a number of other occurrences for other symbols via a look-up table, matrix, and/or other selection procedure.

Figure 13C:
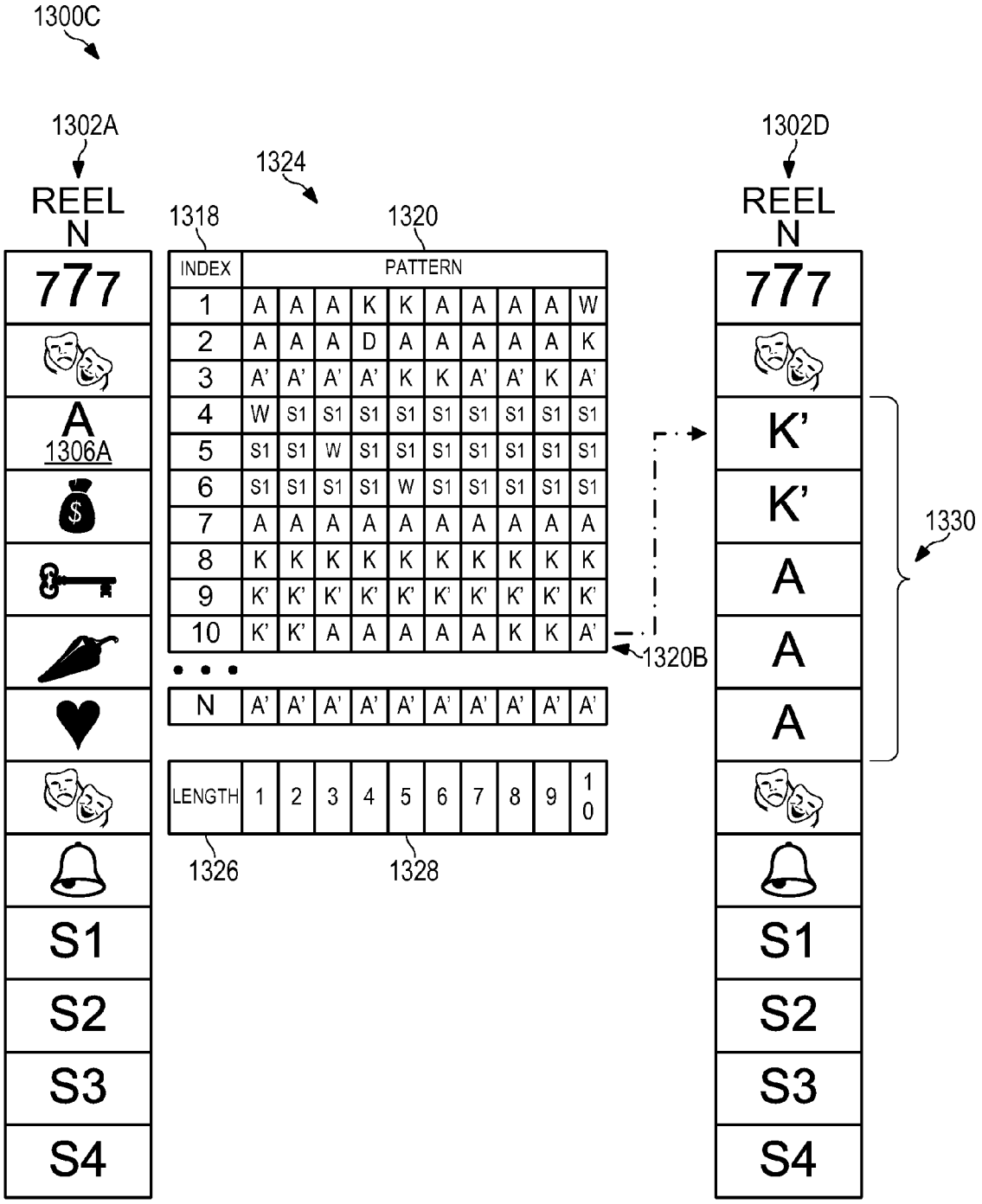
FIG. 13C is another illustration of stacking game play on a gaming device, according to one embodiment.

In FIG. 13C, another illustration of stacking game play on a gaming device is shown, according to one embodiment. In this example, an Nth reel 1302A may include an anchor symbol area 1306A. Based on a symbol selection from a plurality of patterns 1320 on a look-up table 1324, matrix, and/or other selection procedure, a first stacking pattern 1320B (e.g., K'K'AAAAAKKA'A') was selected. This tenth stacking pattern 1320B was placed into previously blanked out anchor symbol area 1306A. Once the pattern is placed into anchor symbol area 1306, then the system, device, and/or method may select a number of other occurrences of the pattern to keep. In this example, the number of 5 (e.g., reference number 1328) was selected on a number look-up table. Therefore, only the first 5 symbols from tenth stacking pattern 1320B will be utilized as can be seen by reference number 1330 (e.g., stacking area). Further, the pattern could move in any direction. Therefore, some of the symbols could move up while other move down and while other symbols move in a sideways direction and/or any other direction (e.g., an L shape, an S shape, an A shape, a T shape, an O shape, etc.).

Figure 13D:
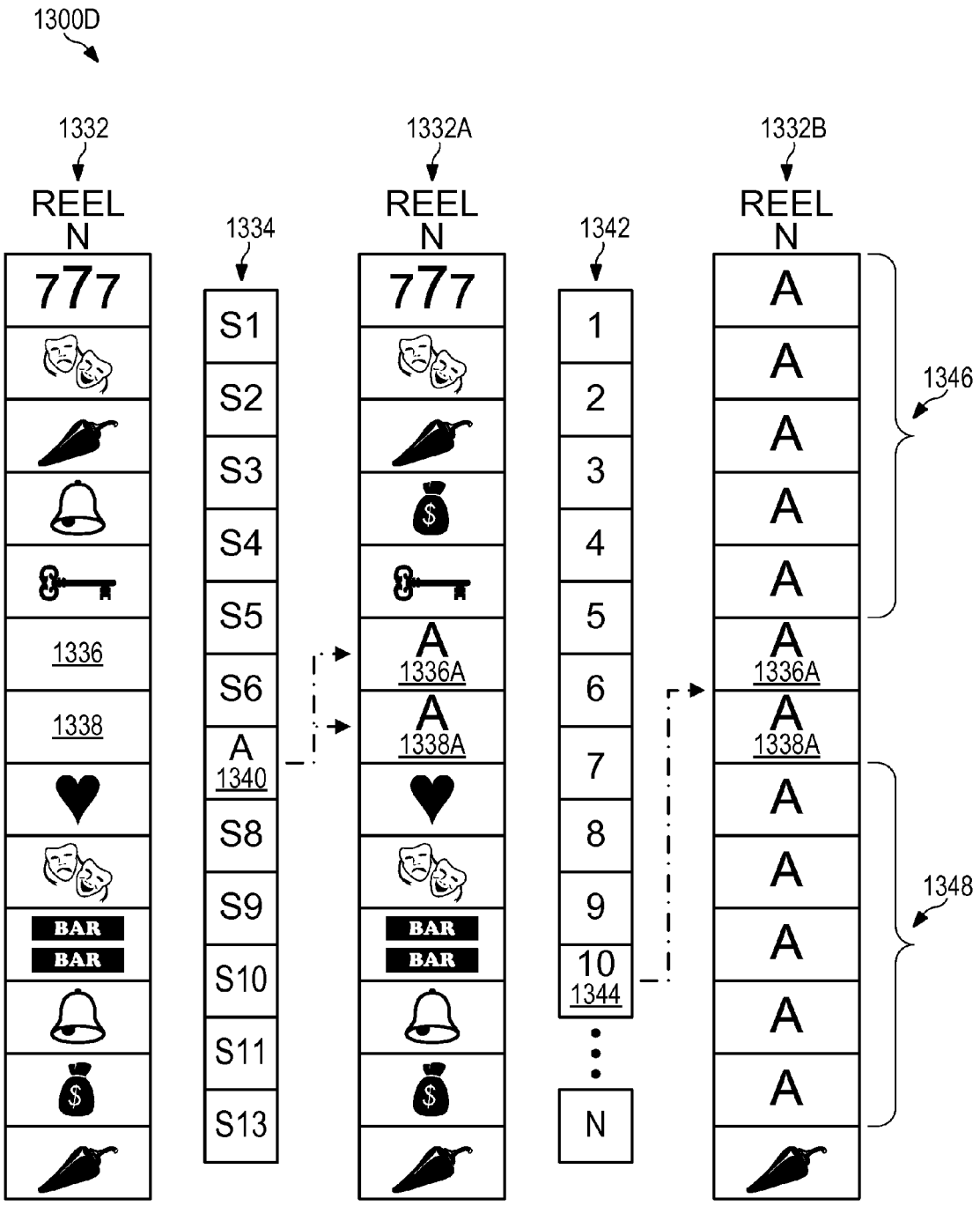
FIG. 13D is another illustration of stacking game play on a gaming device, according to one embodiment.
Figure 13E:
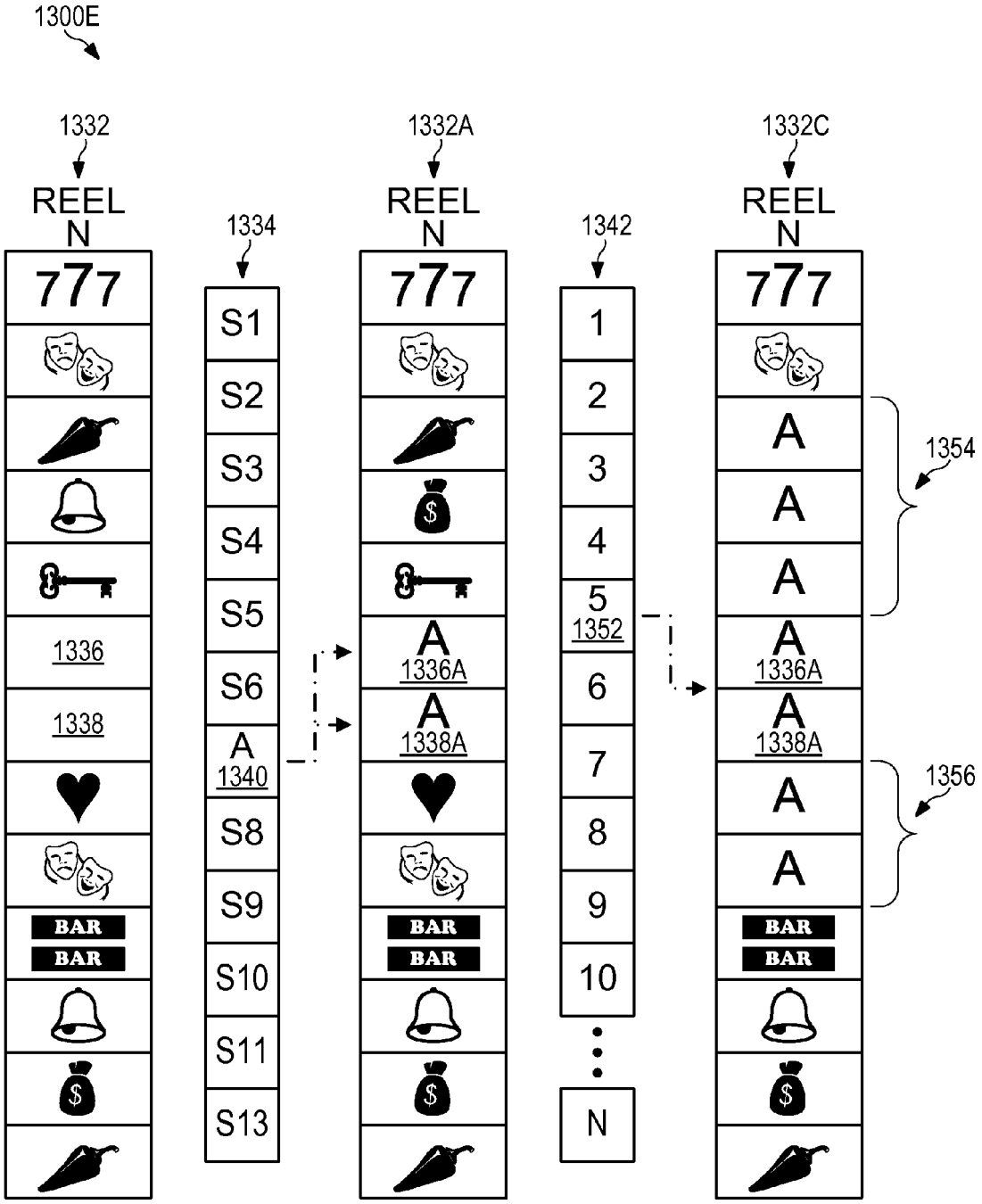
FIG. 13E is another illustration of stacking game play on a gaming device, according to one embodiment.

In FIG. 13D, another illustration of stacking game play on a gaming device is shown, according to one embodiment. In this example, a first anchor symbol area 1336 and an Nth anchor symbol area 1338 are shown (these anchor areas are shown next to each other for easy of illustration—however, these stacking areas may normally be separated by non-stacking areas). Once the symbols are selected for the first anchor symbol area 1336 and/or an Nth anchor symbol area 1338, then the system, device, and/or method may select how many stacking symbols to place around and/or in relationship to first anchor symbol area 1336 and an Nth anchor symbol area 1338. In this example, 10 stacking symbols where selected by the number look-up table 1342 and 5 were placed above the first anchor symbol area 1336A and 5 were placed below the Nth anchor symbol area 1338A (these anchors would normally be spaced apart and not adjacent to each other but for easy of illustration where shown next to each other). In FIG. 13E, 3 were placed above the first anchor symbol area 1336A and 2 were placed below the Nth anchor symbol area 1338A. It should be noted that any split between how many symbols go above one or more anchor symbol areas and how many symbols go below one or more anchor symbol areas may be utilized. Further, the symbols may be placed on the sides of (in other words in other reels) and/or in any other pattern (e.g., diagonal, T shaped, S shaped, O shaped, Z shaped, etc.). Further one or more symbol patterns and/or a portion of the one or more symbol patterns may be utilized. In various examples, a first stacking symbol (e.g., an A) may be placed in a first anchor position, a second stacking symbol (e.g., a King) may be placed in a second anchor position, and a Nth stacking symbol (e.g., a Race Car) may be placed in an Nth anchor position.

Figure 13F:
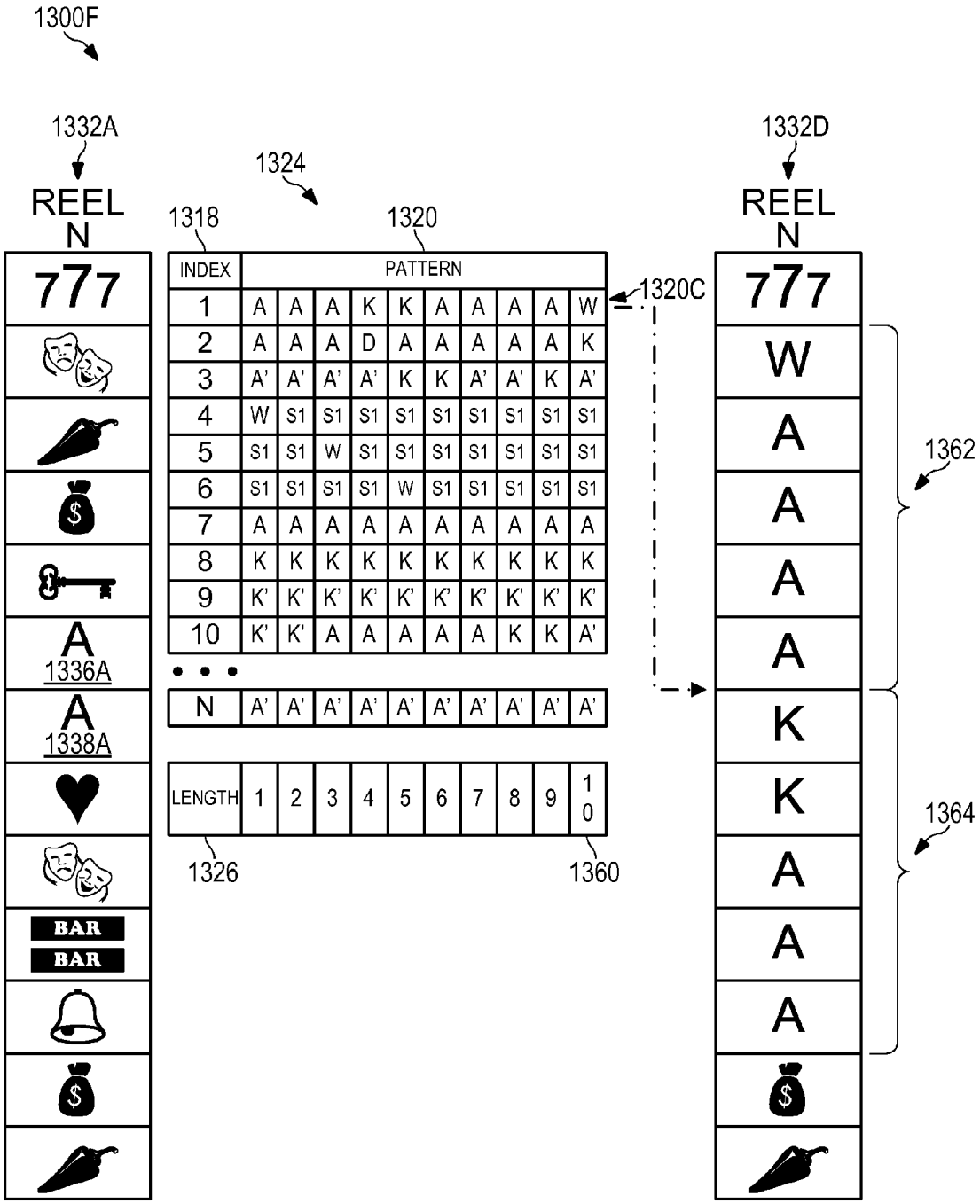
FIG. 13F is another illustration of stacking game play on a gaming device, according to one embodiment.
Figure 13G:
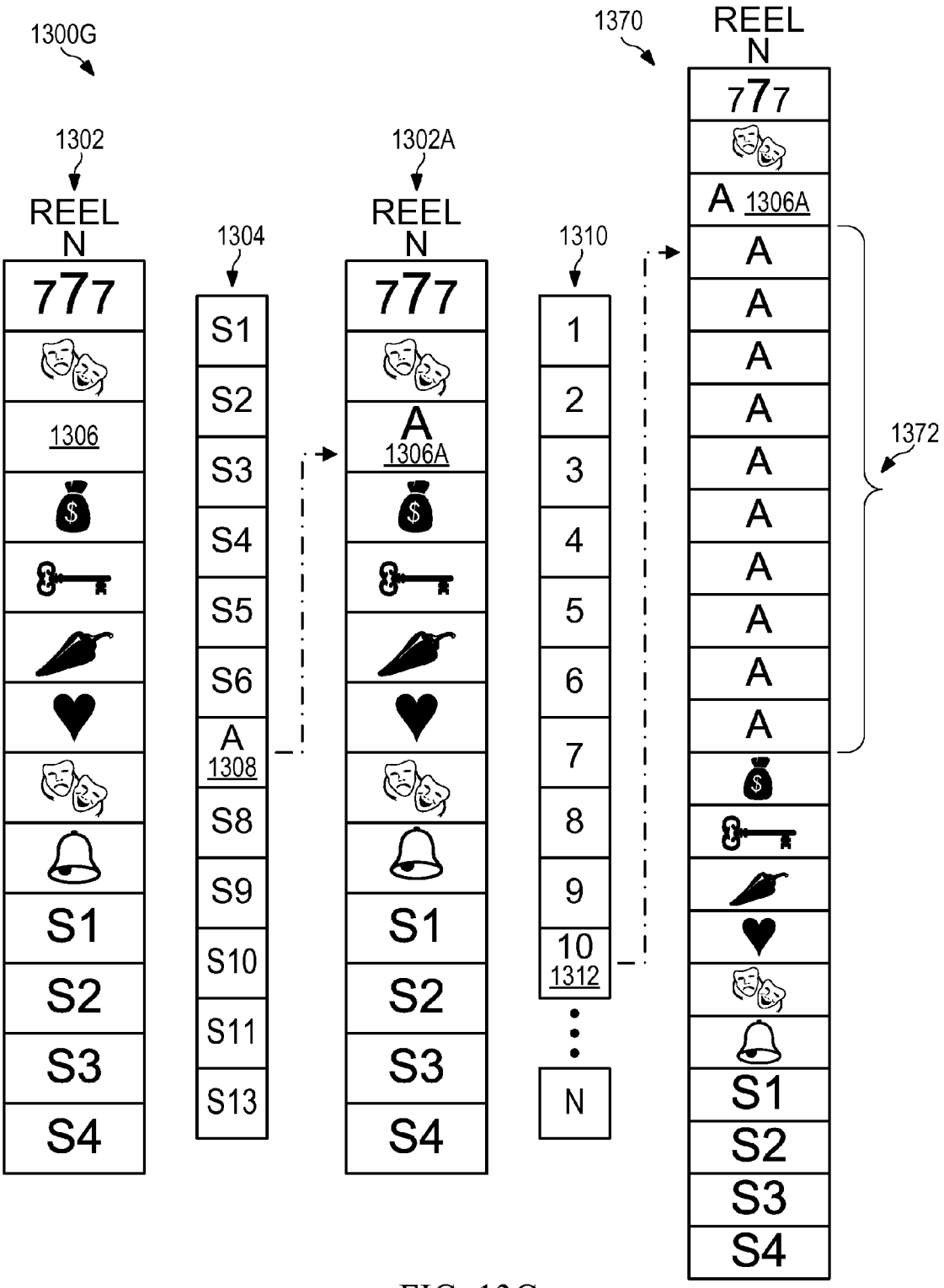
FIG. 13G is another illustration of stacking game play on a gaming device, according to one embodiment.

In FIG. 13F, another illustration of stacking game play on a gaming device is shown, according to one embodiment. In this example, a first symbol pattern 1320C was selected and five symbols (e.g., WAAAA) where placed above first anchor symbol area while five symbols (e.g., KKAAA)

where placed below Nth anchor symbol area (it should be note that the pattern was read backwards and could be read in any order—forward, backward, even numbers first, odd numbers first, etc.). Further, this pattern could have been inserted into the reel which would have expanded the number of display areas on the expanded reel. In addition, one or more stacking symbols may be inserted into the reel which would have expanded the number of display areas on the expanded reel (e.g., from 256 to 275, etc.) as seen in FIG. 13G. In one example, a seventh pattern may be all the same symbol (e.g., an A).

Figure 13H:
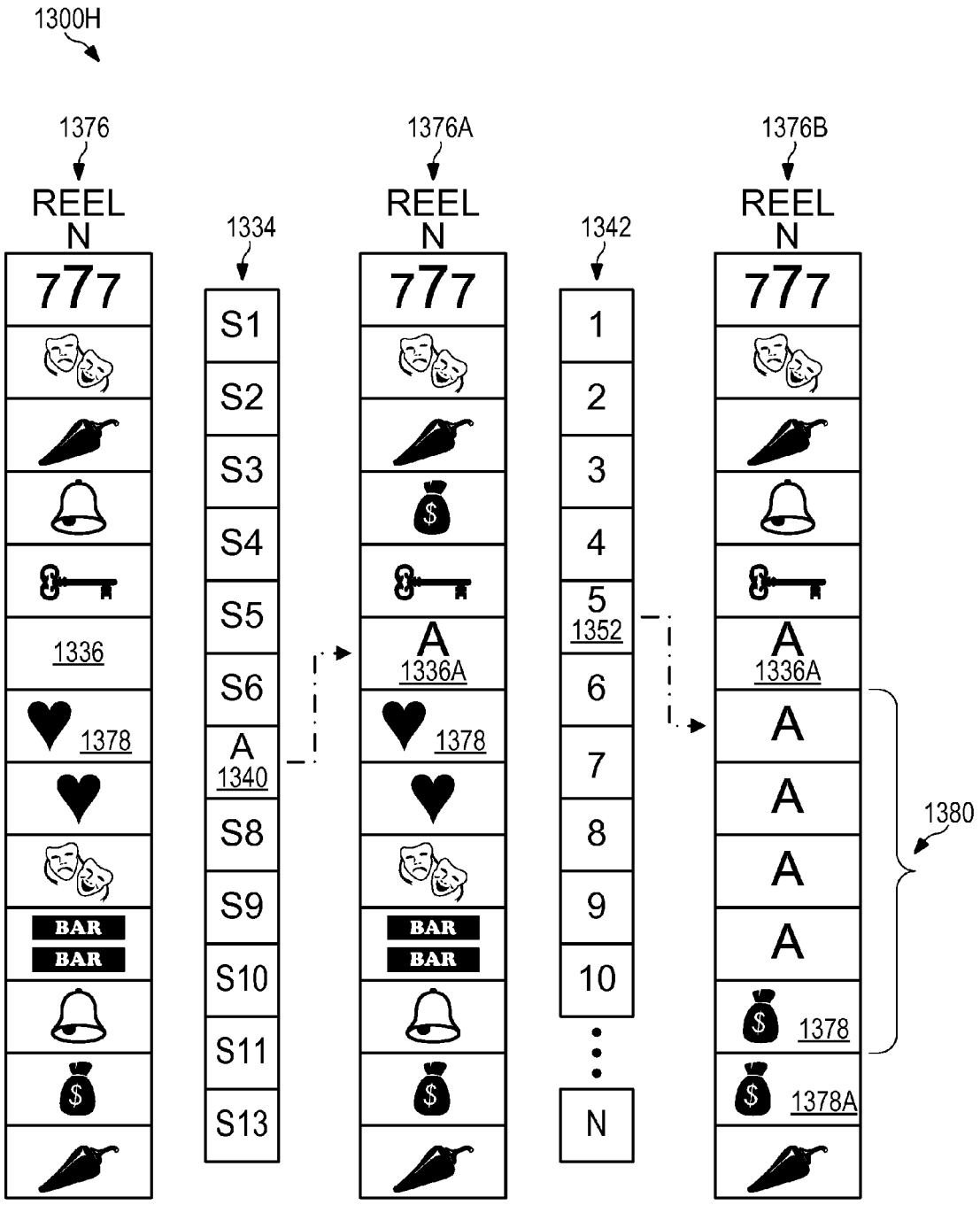
FIG. 13H is another illustration of stacking game play on a gaming device, according to one embodiment.

In FIG. 13H, another illustration of stacking game play on a gaming device is shown, according to one embodiment. In this example, the first anchor symbol area was filed with an A symbol and then 5 additional symbols (e.g., A) were selected. However, the last symbol 1378 in the 5 additional stacking symbols (e.g., A) was modified into another symbol based on the adjacent symbol 1378A. In this example, any symbol in adjacent symbol 1378A location will be modified so that the last symbol 1378 is the same symbol that is located in adjacent symbol 1378A.

Figure 13J:
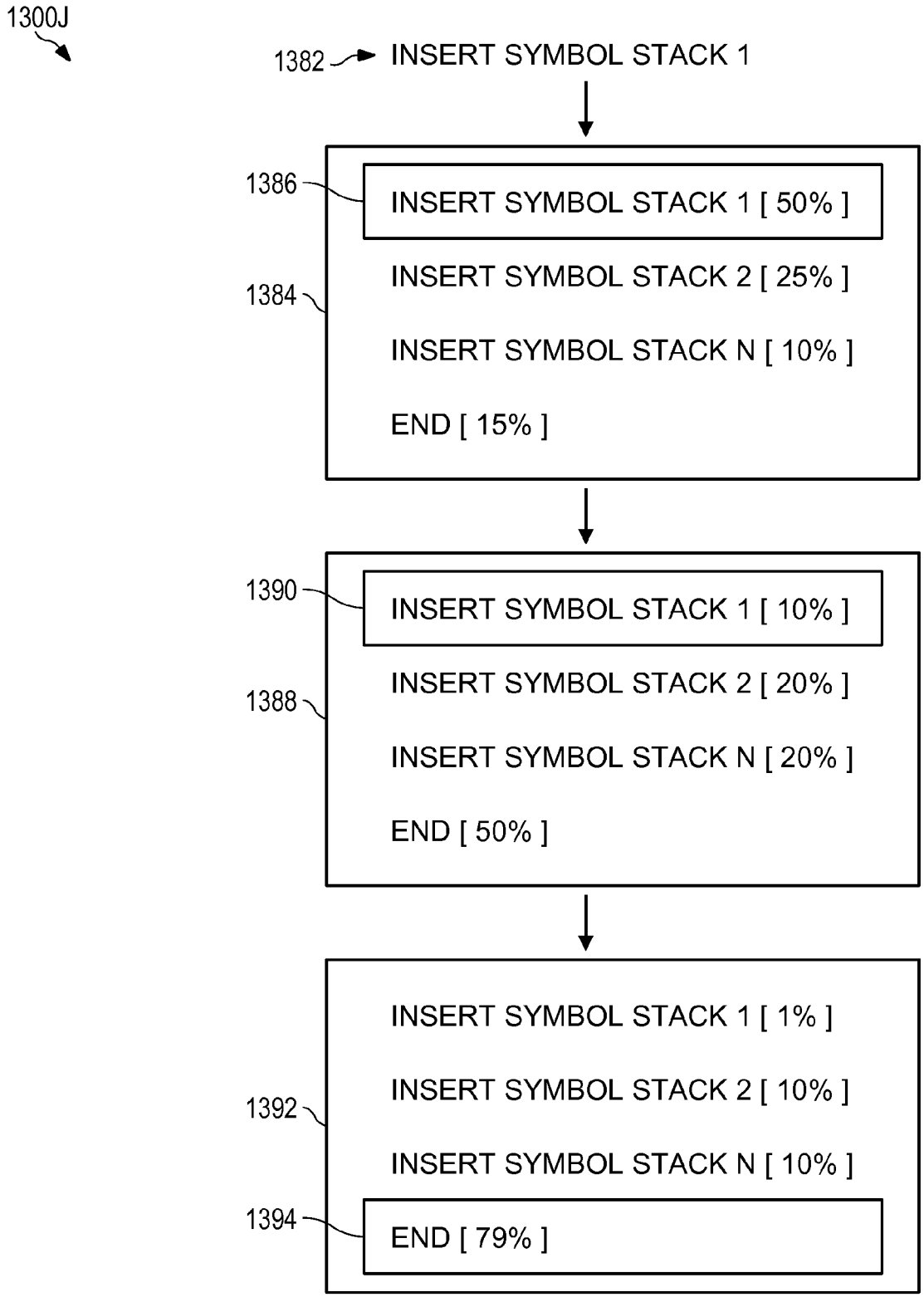
FIG. 13J is another illustration of stacking game play on a gaming device, according to one embodiment.

In FIG. 13J, another illustration of stacking game play on a gaming device is shown, according to one embodiment. In this example, an insert symbol stack 1 option was selected (step 1382). Once this selection was completed, then the system, device, and/or method may change the probabilities of various selections (e.g., insert symbol stack 1 (50%), insert symbol stack 2 (25%), insert symbol stack N (10%), and an end function (15%)). In this example, the system, device, and/or method has selected the insert symbol stack 1 option (step 1386). Based on one or more previous selections, the system, device, and/or method may change the probabilities of various selections (e.g., insert symbol stack 1 (10%), insert symbol stack 2 (20%), insert symbol stack N (20%), and an end function (50%)). In this example, the system, device, and/or method has selected the insert symbol stack 1 option (step 1390). Based on one or more previous selections, the system, device, and/or method may change the probabilities of various selections (e.g., insert symbol stack 1 (1%), insert symbol stack 2 (10%), insert symbol stack N (10%), and an end function (79%)). In this example, the system, device, and/or method may end the adding/inserting stack symbol and/or stacking symbols, and/or stacking patterns procedure. In various examples, the probabilities may change based on the determined winning and/or losing outcomes.

Figure 14A:
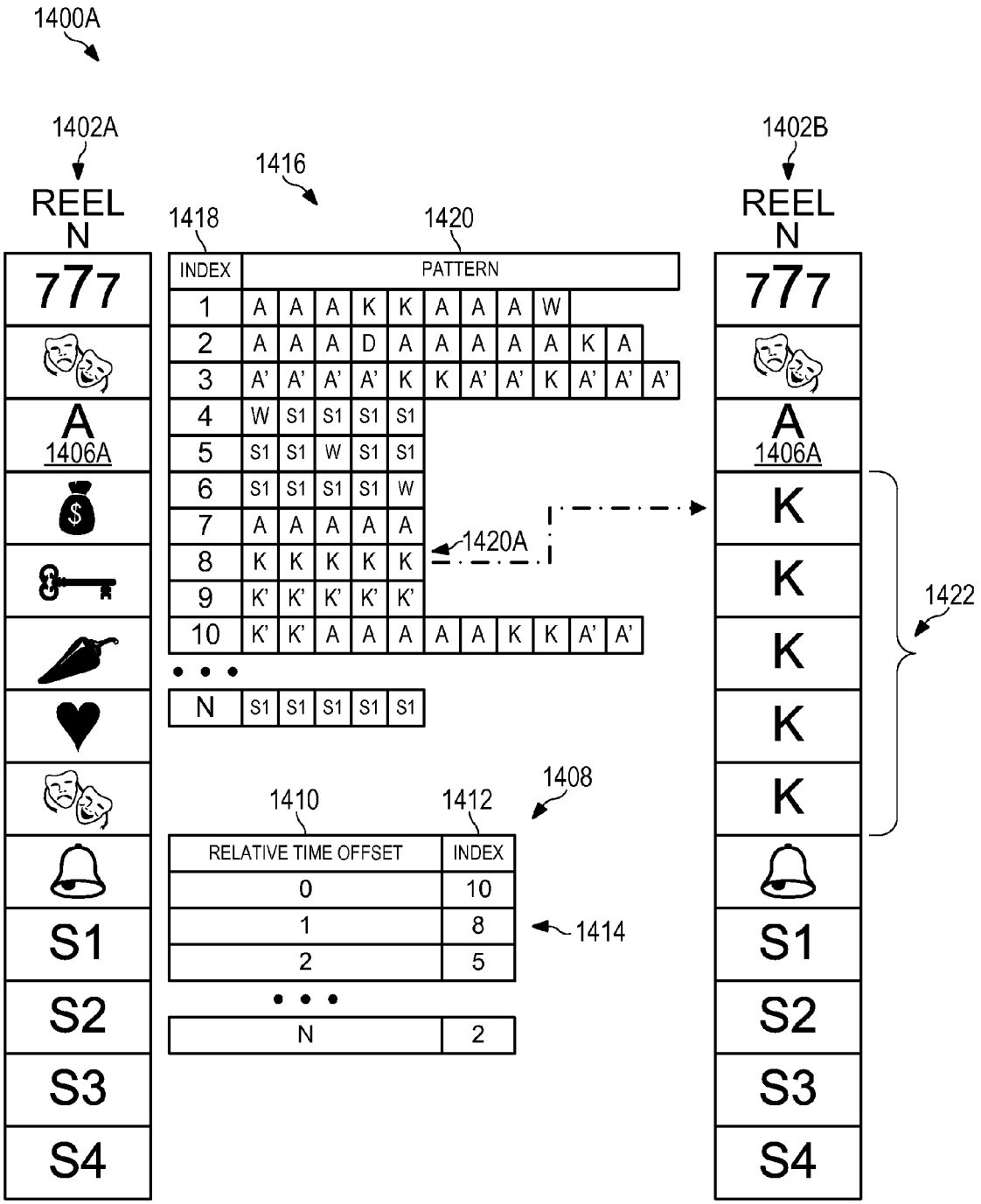
FIG. 14A is another illustration of stacking game play on a gaming device, according to one embodiment.

In FIG. 14A, another illustration of stacking game play on a gaming device is shown, according to one embodiment. In this example, one or more symbol pattern may be utilized with a relative time offset 1410.

Figure 14B:
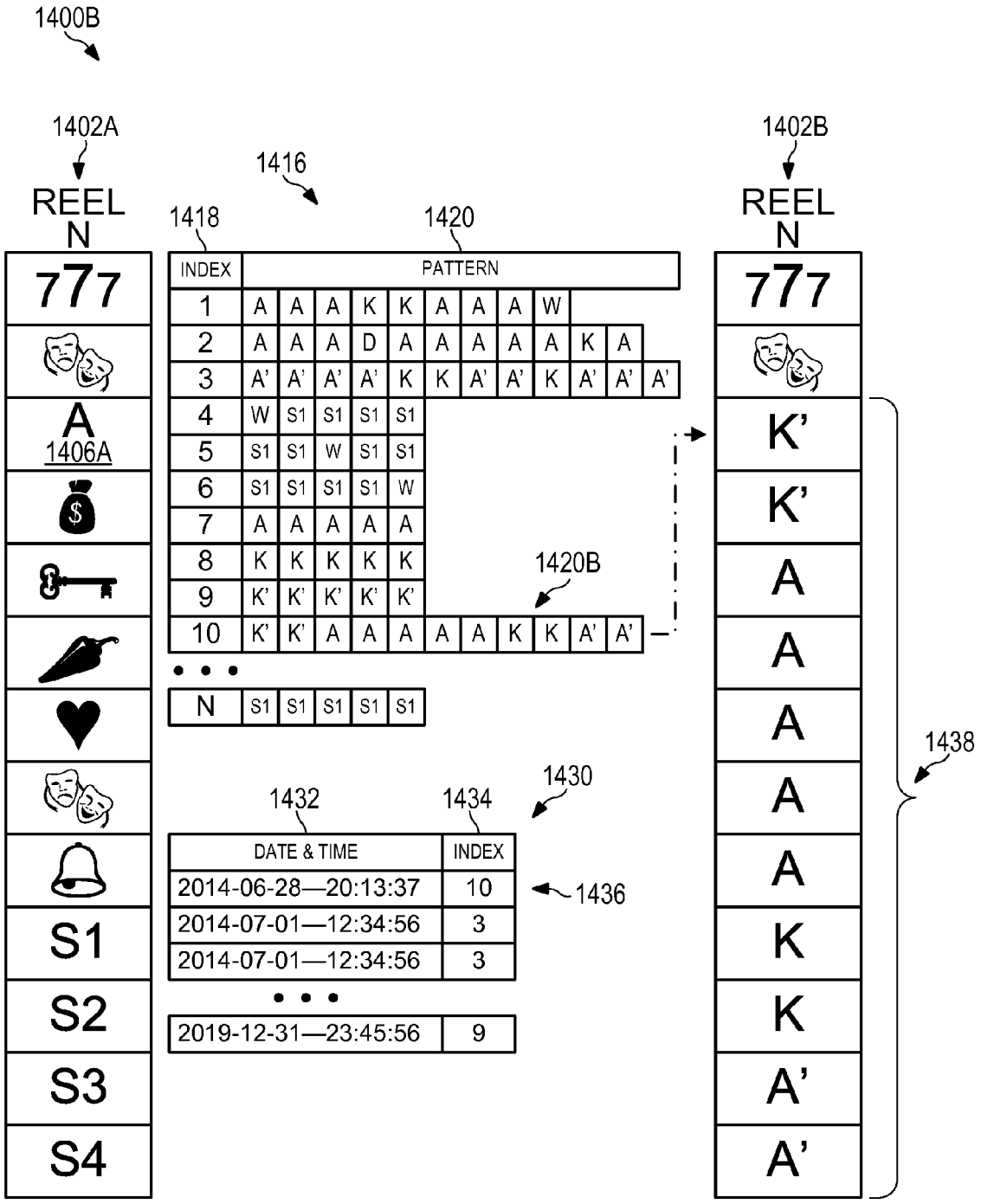
FIG. 14B is another illustration of stacking game play on a gaming device, according to one embodiment.
Figure 14C:
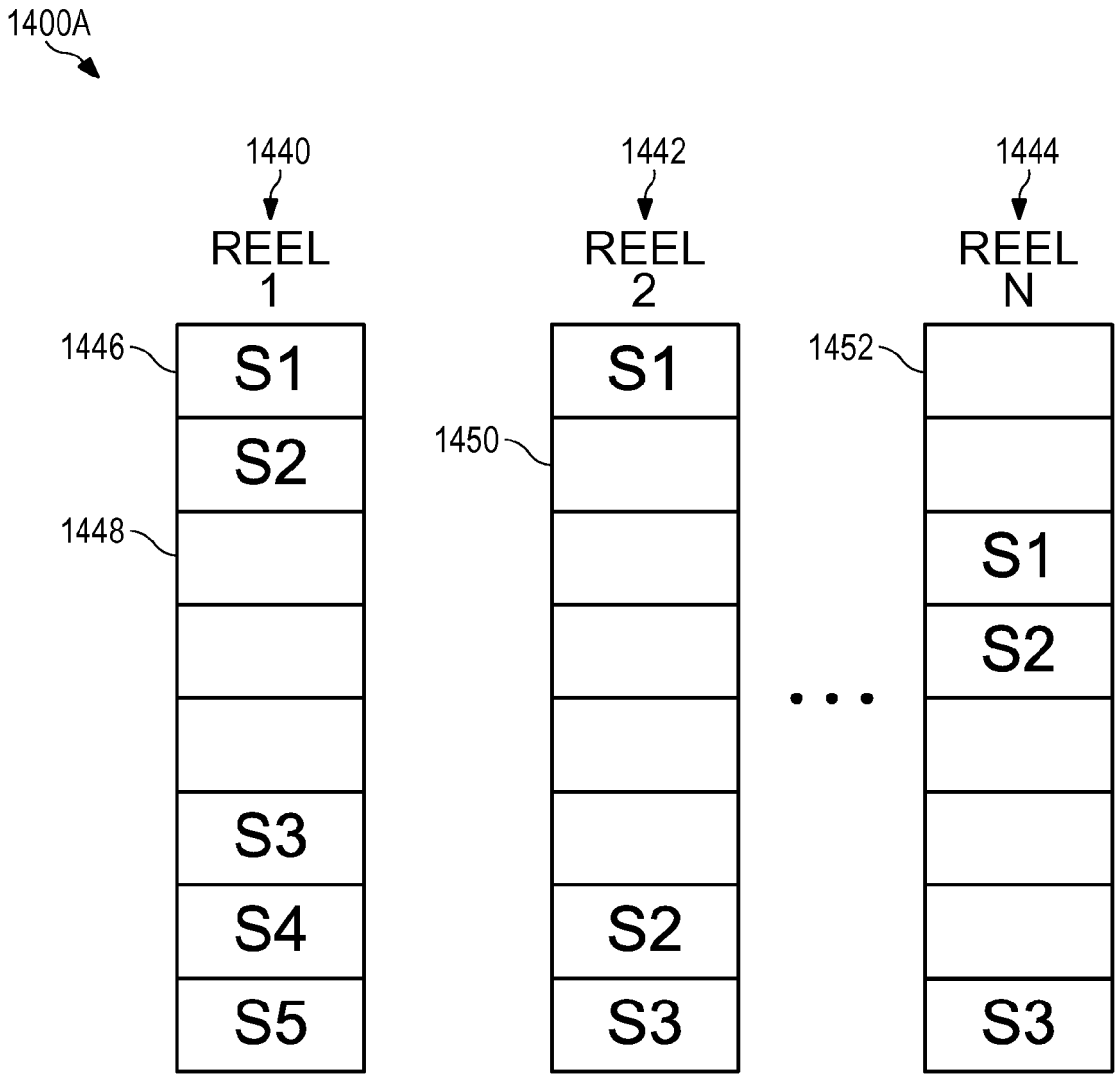
FIG. 14C is another illustration of stacking game play on a gaming device, according to one embodiment.
Figure 14D:
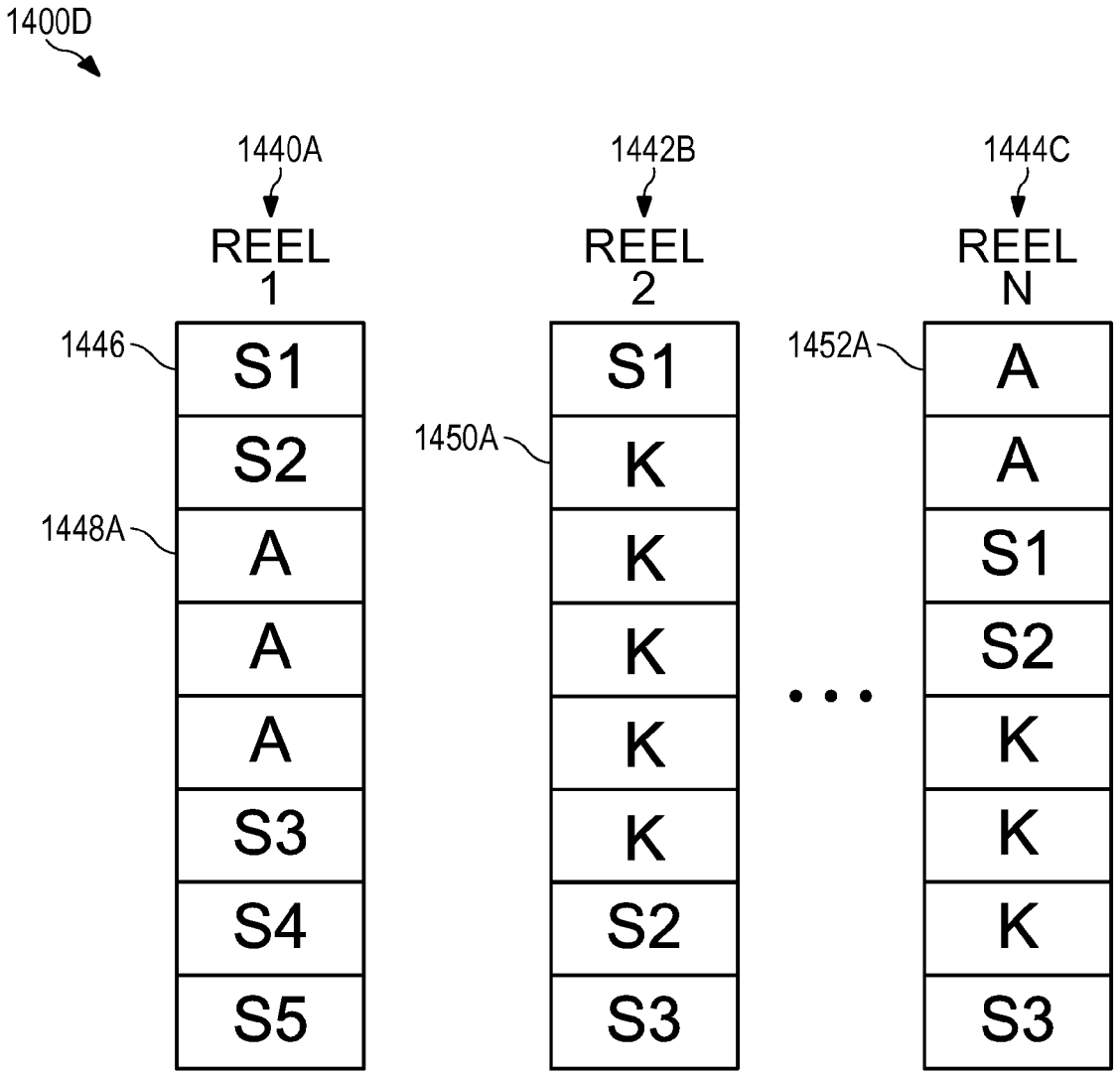
FIG. 14D is another illustration of stacking game play on a gaming device, according to one embodiment.

In FIG. 14B, another illustration of stacking game play on a gaming device is shown, according to one embodiment. In this example, the number of stacking symbols is dependent on the time and date of selection. For example, a selection occurring at 2014-06-28-20:13:37 would generate 10 stacking symbols (see reference number 1436). Therefore, the stacking symbols and/or the stacking symbol location and/or the number of stacking symbols is dependent on when a game play is initiated. These stacking symbols placed in various locations are shown in FIG. 14C and FIG. 14D. In FIG. 14C, a first stacking area 1448 on reel one 1440, a second stacking area 1450 on reel two 1442, a third stacking area 1452 on reel three 1444, and a fourth stacking area on reel three where generated and filed with stacking symbols (not shown) based on a selection occurring at 2014-06-28-20:13:37 where these stacking areas are shown as filed in FIG. 14D.

Figures 15A, 15B:
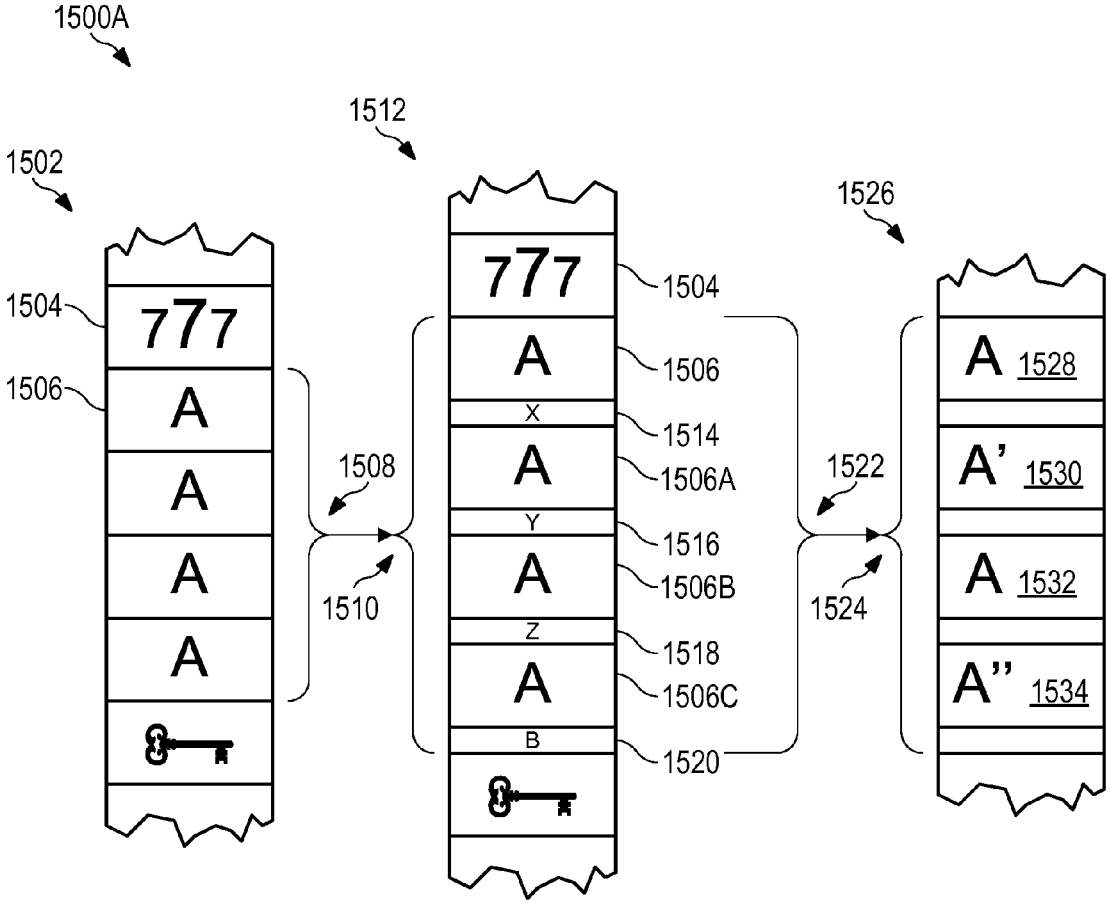
FIG. 15A is another illustration of stacking game play on a gaming device, according to one embodiment.
FIG. 15B is another illustration of stacking game play on a gaming device, according to one embodiment.

In FIG. 15A, another illustration of stacking game play on a gaming device is shown, according to one embodiment. In this example, instead of having a stacking area, there would be a primary symbol display area (e.g., 1506, 1506A, 1506B, and 1506C) and a sub-display area (e.g., 1514, 1516, 1518, and 1520) where the primary symbol display areas would be easily seen by the player whereas the sub-display area would not be easily seen by the player and may be placed into the border area between the primary symbol display areas. In this example, the primary symbol display areas may appear to show four aces in a row (e.g., stacked symbols); however, these would not be stacked symbols because an X would be in a first sub-display area 1514, a Y would be in a second sub-display area 1516, a Z would be in a third sub-display area 1518, and an B would be in a fourth sub-display area 1520. Therefore, no two adjacent symbols would be the same, similar, and/or identical symbols. Further, the simulated stacking area 1524 and/or 1510 may utilize a first symbol 1528, a first related by not identical symbol 1530, a second first symbol 1532, and a second related by not identical symbol 1534 (e.g., this would not be identical to any of these symbols).

In FIG. 15B, another illustration of stacking game play on a gaming device is shown, according to one embodiment. In this example, if the player received and/or if it was displayed on an active payline that three A were in a row, then the player would receive a 100 credit payout. Further, if a winning event occurs on an active payline and/or independent of a winning event occurring on an active payline, if three× (and/or any symbol combination can be utilized by the designers) occurs on a sub-display area in a row, then a credit reward may be implemented and/or a random bonus, and/or any other prize. In one example, when matching symbols and/or winning combination of symbols occur in the sub-display area a 100 credit prize may be won (and/or any other prize). Further, if a winning combination occurs on the sub-display area while a winning combination occurs on a non-sub-display area, then an enhanced prize may be won (e.g., a multiplier of the normal winning prize on the non-sub-display area, and/or free spins, and/or any other prize).

Figure 16:
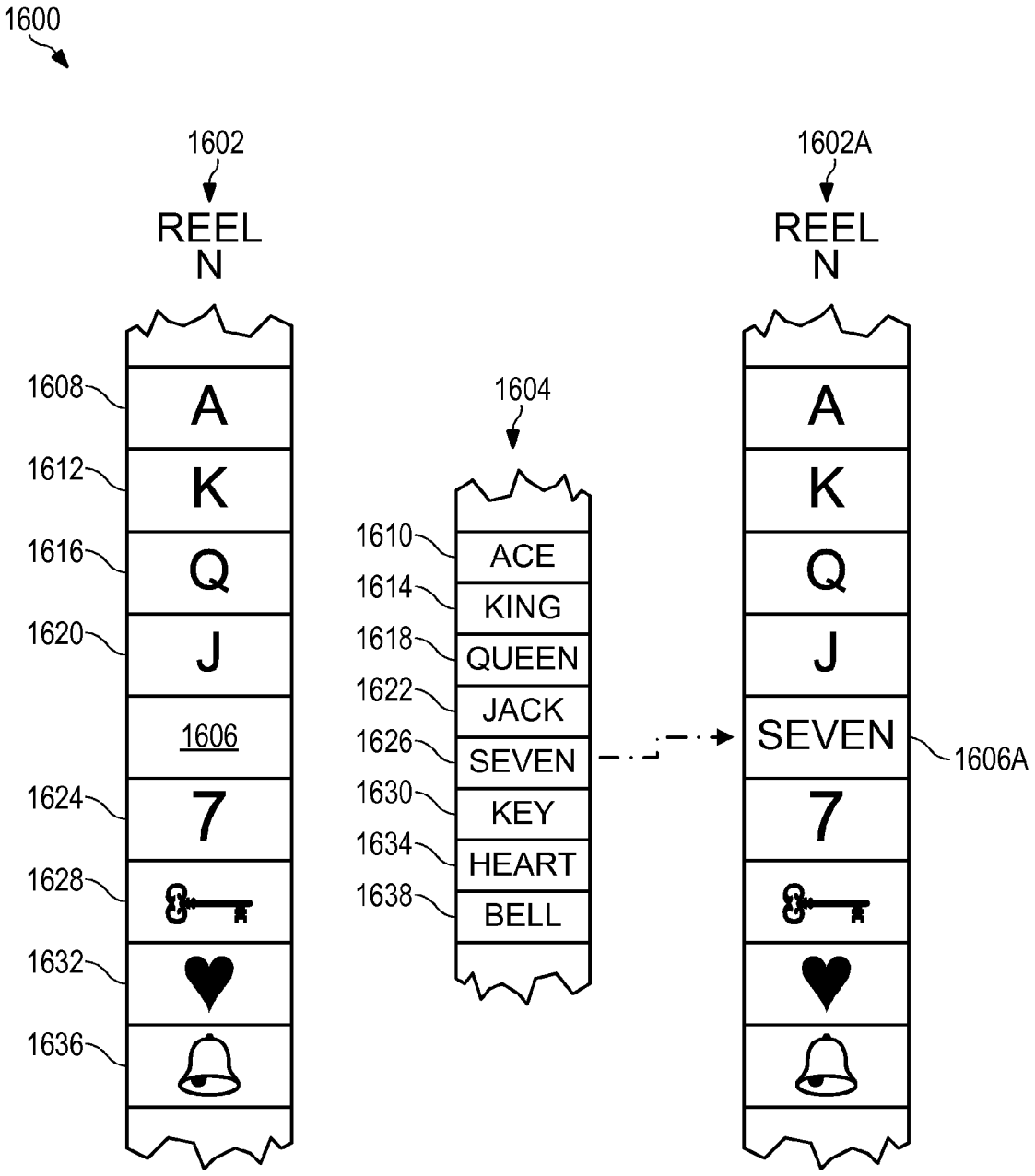
FIG. 16 is another illustration of stacking game play on a gaming device, according to one embodiment.

In FIG. 16, another illustration of stacking game play on a gaming device is shown, according to one embodiment. In this example, the plurality of symbols 1604 which can be utilized for a stacking symbol are related to (and/or not related to) the plurality of symbols utilized for Reel N. However, these stacking symbols are not identical (e.g., 7 versus a SEVEN, 7 versus 7', 7 versus 7*, etc.). For example, during a first type of game play a stack of 7s (e.g., first symbol) may be placed at reel positions 1-10 for a first spin and then a stack of 7s (e.g., first symbol) may be placed at reel positions 1-10 for a second spin. With this disclosure, a stack of 7s (e.g., first symbol) may be placed at reel positions 1-10 for a first spin and then a stack of SEVENs (e.g., second symbol which is not identical to the first symbol but may be related) may be placed at reel positions 1-10 for a second spin. In another example, a stack of 7s may be placed at reel positions 1-10 for a first spin and then a stack of alternating aces may be placed at reel positions 1-10 (e.g., A, ACE, A, ACE, A, ACE, etc.). Therefore, the stack of Aces would not have adjacent identical symbols. For clarity, adjacent identical symbols would be A, A, A, or ACE, ACE, ACE and not A, ACE, A.

Figure 17:
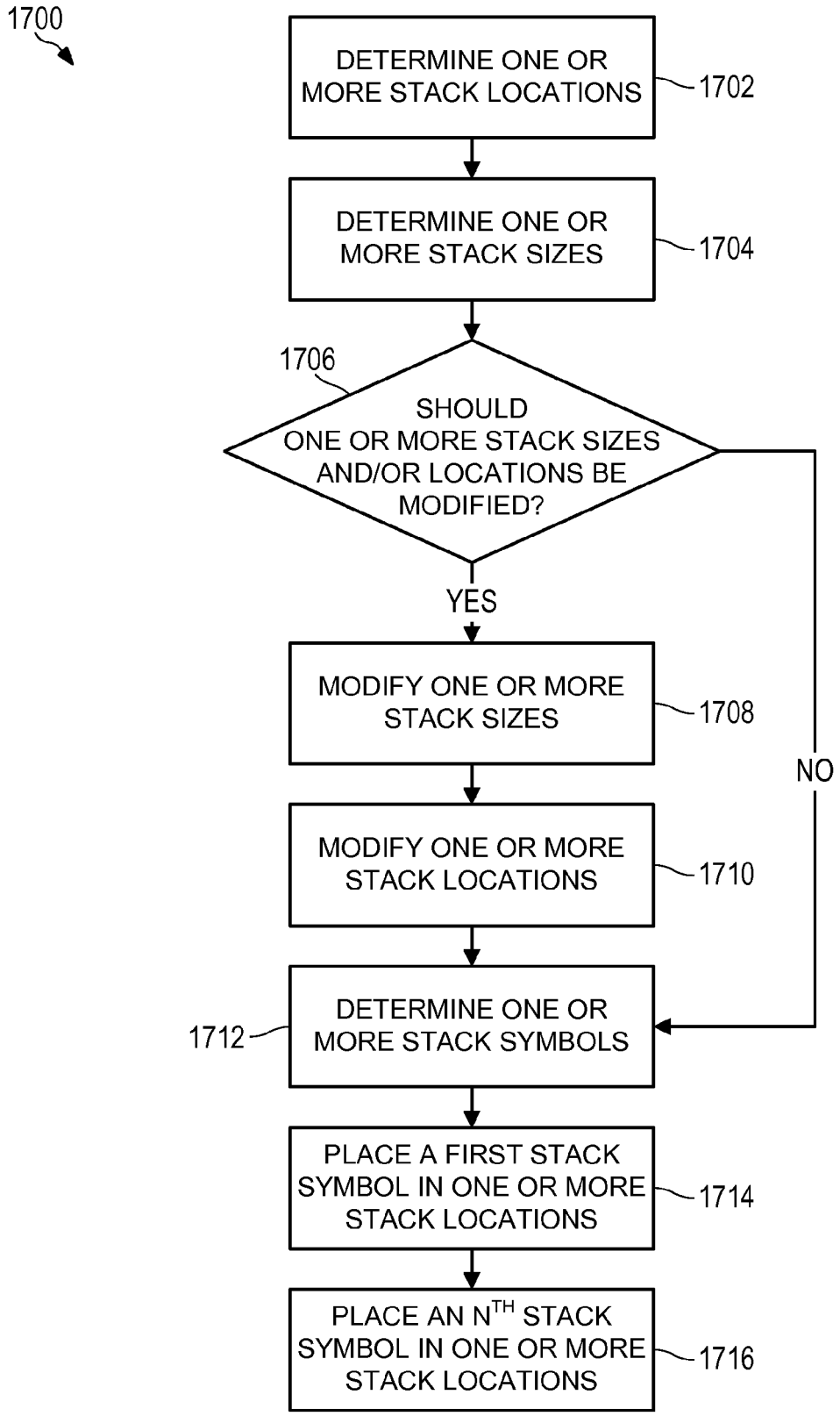
FIG. 17 is a game play flow diagram, according to one embodiment.

In FIG. 17, a game play flow diagram is shown, according to one embodiment. The method may include determining one or more stack locations (step 1702). The method may include determining one or more stack sizes (step 1704). The method may include one or more processors determining whether one or more stack sizes and/or stack locations should be modified (step 1706). If one or more stack sizes and/or stack locations should be modified, then the method may modify one or more stack sizes (step 1708) and/or modify one or more stack locations (step 1710). Once these modifications are completed and/or no modifications were necessary, then the method may determine one or more stack symbols (step 1712). The method may place a first stack symbol (e.g., an ACE) in one or more stack locations (step 1714). The method may place an Nth stack symbol (e.g., a King) in one or more stack locations (step 1716). For example, when the method determines whether one or more stack sizes and/or stack locations should be modified which may be based on having more than one overlaying symbols (and/or just one overlapping symbol) in a first stacking area during a first spin to the first stacking area during a second spin. For example, during a first spin reel positions 1-5 all have an S1 symbol located in these reel positions (e.g., 1-5). During a second potential spin, reel positions 1-5 may all have an S2 symbol located in these reel positions (e.g., 1-5) which would cause an error and need to be modified. Therefore, the S2 symbols would be moved so that there is no overlaying positions (and/or no more than one overlaying position. In this example, the S2 symbols may be located in reel positions 6-10. In another example, the S2 symbols may be located in reel positions 5-9 so that only one symbol overlays and therefore no stacking area would overlay because one symbol cannot be a stack. In another example, during a first spin reel positions 1-5 all have an S1 symbol located in these reel positions (e.g., 1-5). During a second potential spin, reel positions 4-8 may all have an S2 symbol located in these reel positions (e.g., 4-8). Since reel positions 4 and 5 had stacking symbols located in them during a first spin, this would cause an error if different stacking symbols (e.g., S1 to S2) where located in this area (e.g., reel positions 4-5). Therefore, the S2 stack may be moved to reel positions 6-10 and/or any other locations that do not cause overlaying stacking symbols where the stacking symbols are different from a first spin to a second spin.

Figure 18:
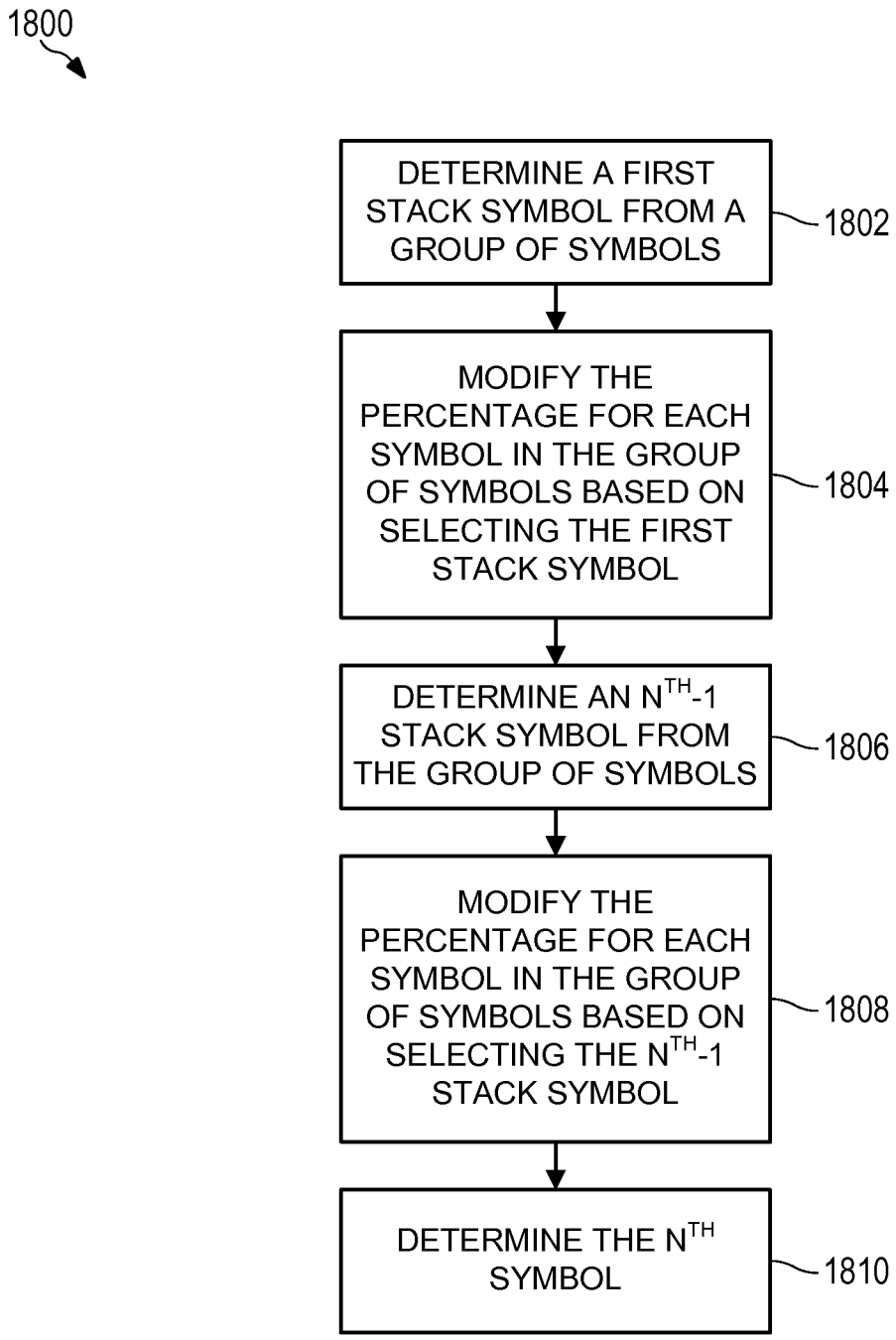
FIG. 18 is a game play flow diagram, according to one embodiment.

In FIG. 18, a game play flow diagram is shown, according to one embodiment. The method may include determining a first stack symbol from a group of symbols (step 1802). The method may include modifying the percentage for each symbol in the group of symbols based on the selecting of the first stack symbol (step 1804). The method may include determining an Nth minus 1 stack symbol from the group of symbols (step 1806). The method may include modifying the percentages for each symbol in the group of symbols based on the selecting of the Nth minus 1 stack symbol (step 1808). The method may then select the Nth symbol (step 1810). In one example, a first stacking symbol is selected from a plurality of potential stacking symbols where each potential stacking symbol had a 10 percentage chance of being selected. Once the first stacking symbol was selected as S1, then a second stacking symbol is selected from the plurality of potential stacking symbols where each potential stacking symbol may have the same 10 percentage chance of being selected. However, in this example, the percentage for selecting S1 (the same symbol as first stacking symbol) has increased to 30 percent while S2-S6 decreased to 5 percent and S7-S10 increased to 11.25 percent. In another example, S2-S10 decreased to 7.78 percent selection chance. In these example, the selection of S1 (the same symbol) for the first stacking symbol and the second stacking symbol adds excitement to the game play because blocks of the same symbol are shown to the player in the first two reels (and/or any other reel placement). In another example, the percentage that S1 is going to be selected may increase for the third stacking symbol in a similar manner as shown above for the second stacking symbol, which would typically generate a prize based on three like symbols being located in the first three reels. In another example, the percentage that S1 is going to be selected may decrease for the third stacking (and/or the fourth stacking symbol and/or the Nth stacking symbol) to minimize any awards generated by game play (see FIGS. 8A-8D).

Figure 19:
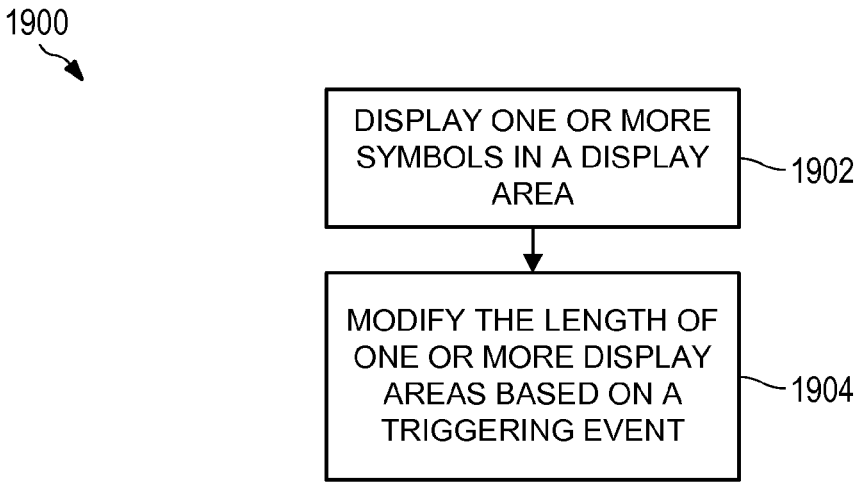
FIG. 19 is a flow diagram for game play, according to one embodiment.

In FIG. 19, a flow diagram for game play is shown, according to one embodiment. The method may include displaying one or more symbols in one or more display areas (step 1902). The method may include modifying the length of one or more display areas based on a triggering event (step 1904)—See FIG. 9E. For example as seen in FIG. 9E, a display area may include a first reel 942, a second reel 944, an expandable third reel 946, a fourth reel 948, and an Nth reel 950. In this example, expandable third reel 946 has the same amount of symbol areas (e.g., 5 units) as first reel 942, second reel 944, fourth reel 948, and Nth reel 950. However, based on one or more triggering events (e.g., special symbols be displayed, randomly, time of day, and/or any other criteria disclosed in this disclosure and/or any combination thereof) expandable third reel 946 may expand into 6 units, 7 units, 8, units, . . . 1000 units, and/or any other amount. Further, based on one or more triggering events (e.g., special symbols be displayed, randomly, time of day, and/or any other criteria disclosed in this disclosure and/or any combination thereof) expandable third reel 946 may decrease into 4 units, 3 units, 2, units, and/or 1 unit, and/or any other amount. It should be noted that any reel may expand and/or multiply reels may expand.

Figure 20:
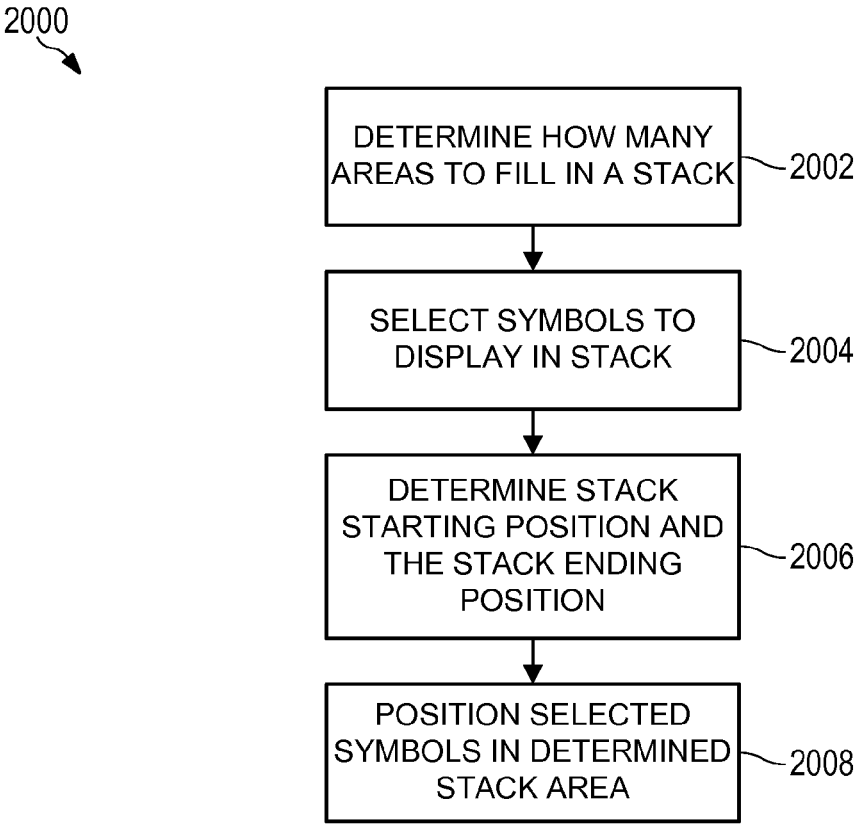
FIG. 20 is a flow diagram for game play, according to one embodiment.

In FIG. 20, a flow diagram for game play is shown, according to one embodiment. The method may include determining how many areas to fill in a stack (step 2002). The method may include selecting symbols to display in a stack (step 2004). The method may include determining a stack starting position and a stack ending position (step 2006). The method may include positioning the selected symbols in the determined stack areas (step 2008). The system, device, and/or method may determine a stack starting position (e.g., reel position 1) and a stacking ending position (e.g., reel position 4). In one example, the system, device, and/or method may determine that a specific number of squares (e.g., 4) are going to be utilized for a stacking formation (it should be noted that any number 0 to N may be utilized and are within the scope of this disclosure). Once the number of squares is determined, then a starting position and an ending position are determined. In this example, the starting position is reel position 1 and the ending position is reel position 4. After the number of squares is determined and the starting reel position and the ending reel position is determined, then the stacking symbol may be determined. In one example, six symbols (e.g., X, Y, Z, A, B, and C) may be utilized as stacking symbols. However, any number of symbols from 0 to N may be utilized as potential stacking symbols. In one example, each symbol has a percentage probability of being selected (any percentage may be utilized). In this example, the X, Y, A, B, C symbols all have a 15% chance of being selected. Whereas, the Z symbol has a 25% chance of being selected. In this example, the Z is selected and utilized as the stacking symbols for the 4 square area starting at reel position 1 and ending at reel position 4. Further, all the symbols may have different percentages, the same percentages, some same percentages, some different percentages, and/or any combination of percentages. It should be noted that any order for the steps may be utilized.

Figure 21:
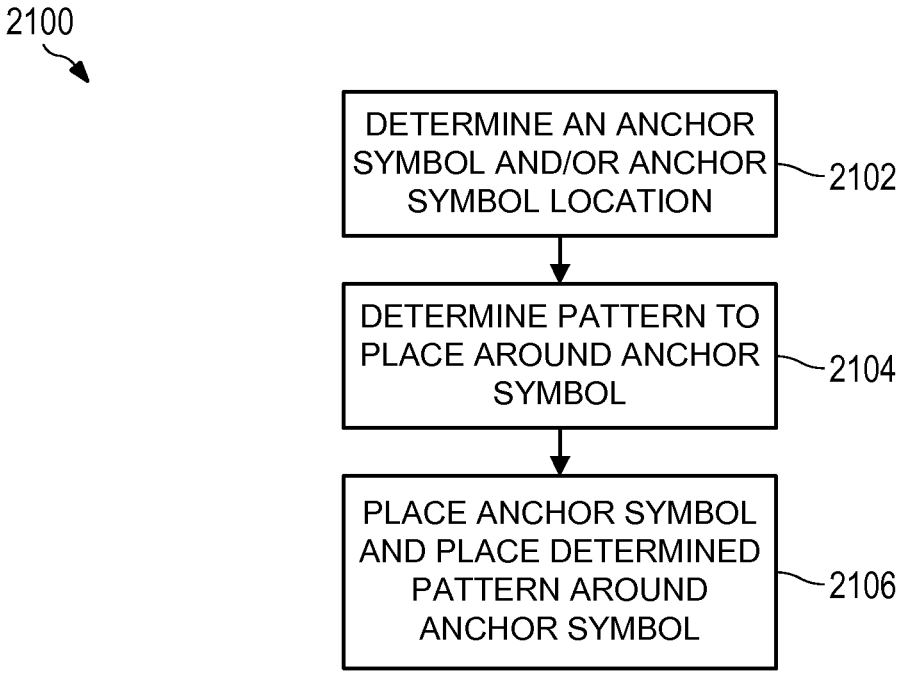
FIG. 21 is a flow diagram for game play, according to one embodiment.

In FIG. 21, a flow diagram for game play is shown, according to one embodiment. The method may include determining an anchor symbol and/or an anchor symbol location (step 2102). The method may include determining a pattern to place around the anchor symbol and/or anchor symbol location (step 2104). The method may include placing the anchor symbol in the anchor symbol location and/or placing the determined pattern around the anchor symbol and/or the anchor symbol location (step 2106). In one example shown in FIG. 14A, the method may determine an anchor position 1406A (e.g., location with A symbol in it) and then determine one or more patterns to utilize. In this example, an eighth selected pattern 1420A is utilized. This selected pattern (e.g., K, K, K, K, K) may be placed before the anchor position 1406A, after the anchor position 1406A (as shown in FIG. 14A), or split up to be placed before and after the anchor position 1406A (in other words placed around the anchor position 1406A)—See FIG. 13B).

Figure 22:
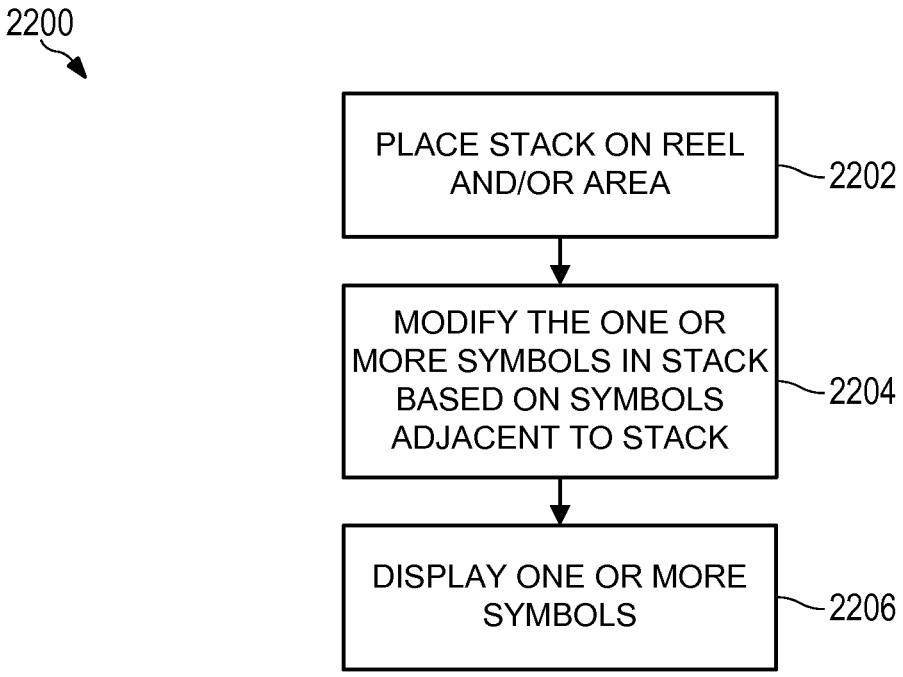
FIG. 22 is a game play flow diagram, according to one embodiment.

In FIG. 22, a game play flow diagram is shown, according to one embodiment. The method may include placing a stack on a reel and/or an area (step 2202). The method may include modifying the one or more symbols in the stack based on symbols adjacent to the stack (step 2204). The method may include displaying one or more symbols (step 2206). In this example, one or more stacking symbols is located next to a similar symbol which causes a first stacking area with a first stacking symbol during a first spin to be located in the same position (e.g., causes an overlay of more than one symbol and/or any overlap at all) as a second stacking area with a second stacking symbol on the next spin. For example, there is an A symbol located at reel position 6 for a first spin and reel positions 1-5 are filled with an A symbol for a stacking feature functionality which creates a stack of A located in reels positions 1-6. During a next spin (e.g., spin 2), the A located in reel position 6 is changed to a K symbol and a K symbol is randomly placed in reel position 5. This would cause a mini stacking area of two K symbols located in reel positions 5 and 6 which would cause an error because a first stacking area with a first stacking symbol on spin 1 would overlap a second stacking area with a second stacking symbol on spin 2 and need to be corrected. Therefore, at least one of the K would be changed and/or the mini-stack of K symbols would be moved to start at reel position 7 and/or any other modification which removed the overlapping error condition. In one example, one reel position (e.g., reel position 6) may have a one symbol overlap between a first spin and a second spin; however, in this example, one symbol may not be considered a stack so that no error occurs—in other words, one symbol cannot be a stack because it takes at least two symbols to create a stacking effect.

Figure 23:
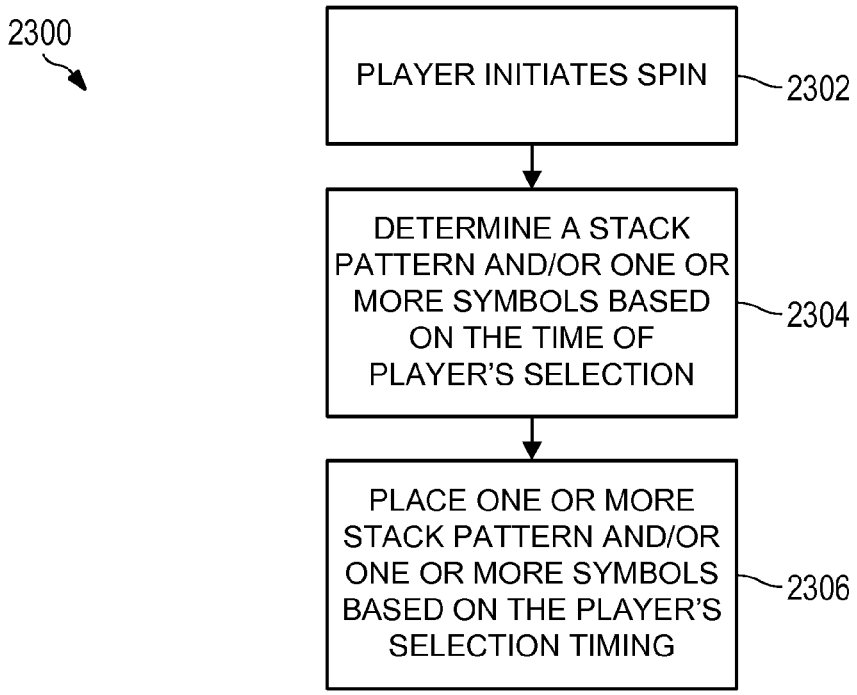
FIG. 23 is a game play flow diagram, according to one embodiment.

In FIG. 23, a game play flow diagram is shown, according to one embodiment. The method may include the player initiating the spin (step 2302). The method may include determining a stack pattern and/or one or more symbols based on the time of the player's selection (step 2304). The method may include placing one or more stack patterns and/or one or more symbols based on the player's selection timing (step 2306). In one example shown in FIGS. 14A-14D, a selection occurring at 2014-06-28-20:13:37 would generate 10 stacking symbols. Therefore, the stacking symbols and/or the stacking symbol location and/or the number of stacking symbols is dependent on when a game play is initiated. These stacking symbols placed in various locations are shown in FIG. 14C and FIG. 14D—assuming 14 stacking symbols. In FIG. 14C, a first stacking area 1448 on reel one, a second stacking area 1450 on reel two, a third stacking area 1452 on reel three, and a fourth stacking area on reel three where generated and filed with stacking symbols (not shown) based on a selection occurring at 2014-06-28-20:13:37 where these stacking areas are shown as filed in FIG. 14D.

Figure 24:
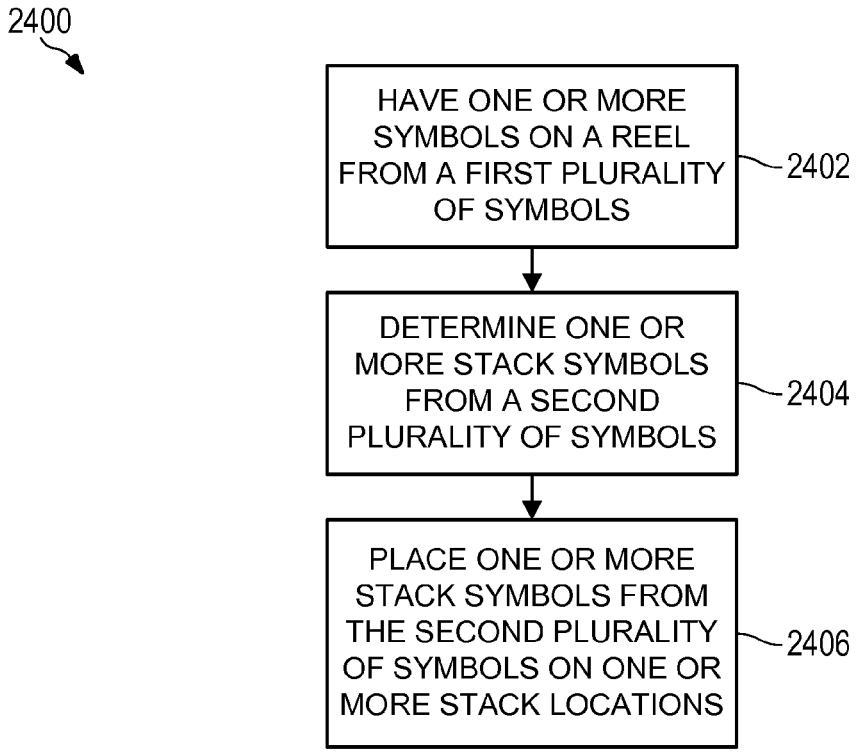
FIG. 24 is a flow diagram for game play, according to one embodiment.

In FIG. 24, a flow diagram for game play is shown, according to one embodiment. The method may include having one or more symbols on a reel from a first plurality of symbols (step 2402). The method may include determining one or more stack symbols from a second plurality of symbols (step 2404). The method may include placing one or more stacking symbols from the second plurality of symbols on one or more stacking locations (step 2406). In examples shown in FIGS. 12A-12B, the system, method, and/or device may determine a stack symbol for the first reel from a first plurality of symbols 1250. In one example, a first stack symbol 1254 (e.g., Z) may be selected. In one example, the weighting may be equal for each potential stacking symbol. In another example, the weighting for each symbol may be different. In this example, the X symbol had a 15% weighting, the Y symbol had a 15% weighting, the Z symbol had a 25% weighting, the A symbol had a 15% weighting, the B symbol had a 15% weighting, and the C symbol had a 15% weighting. Once the Z symbol is selected (reference number 1256) for a first reel, the system, method, and/or device may determine the weighting of a plurality of potential stacking symbols for a second stack.

In this example, the system, method, and/or device may determine a stack symbol for the second reel from a second plurality of symbols 1262. In should be noted that the symbols utilized for the first plurality of symbols 1250 and the symbols utilized for the second plurality of symbols 1262 may have no symbols in common, one or more symbols in common, and/or be related but not identical symbols (e.g., A, ACE, A' etc.). In one example, a second stack symbol 1266 (e.g., P) may be selected. In this example, the weighting for the P symbol may be modified based on the selection of the Z symbol for the first stack. In this example, the probability of the P being selected for the second reel was 30%. In this example, the P symbol has been selected as the second stacking symbol 1266 for the second reel.

In this example, the system, method, and/or device may determine the weighting of a plurality of potential stacking symbols for a third reel. In this example, the system, method, and/or device may determine a stack symbol for the third reel from a third plurality of symbols 1274. In one example, a third stack symbol 1278 (e.g., D) may be selected.

In this example, the system, method, and/or device may determine the weighting of a plurality of potential stacking symbols for a fourth reel. In this example, the system, method, and/or device may determine a stack symbol for the fourth reel from a fourth plurality of symbols 1286. In one example, a fourth stack symbol 1292 (e.g., Z) may be selected. In should be noted that fourth plurality of symbols 1286 had symbols in common with at least one other plurality of symbols (e.g., first plurality of symbols) utilized for selecting one or more stacking symbols.

Further as seen in FIG. 12B, the system, method, and/or device may determine the weighting of a plurality of potential stacking symbols for an Nth stack. In this example, the probability of the B symbol being selected for the Nth stack has increased to 60% because of the previous selection of the B symbol and/or because of one or more blocking symbol selection and/or other selections.

Figure 25:
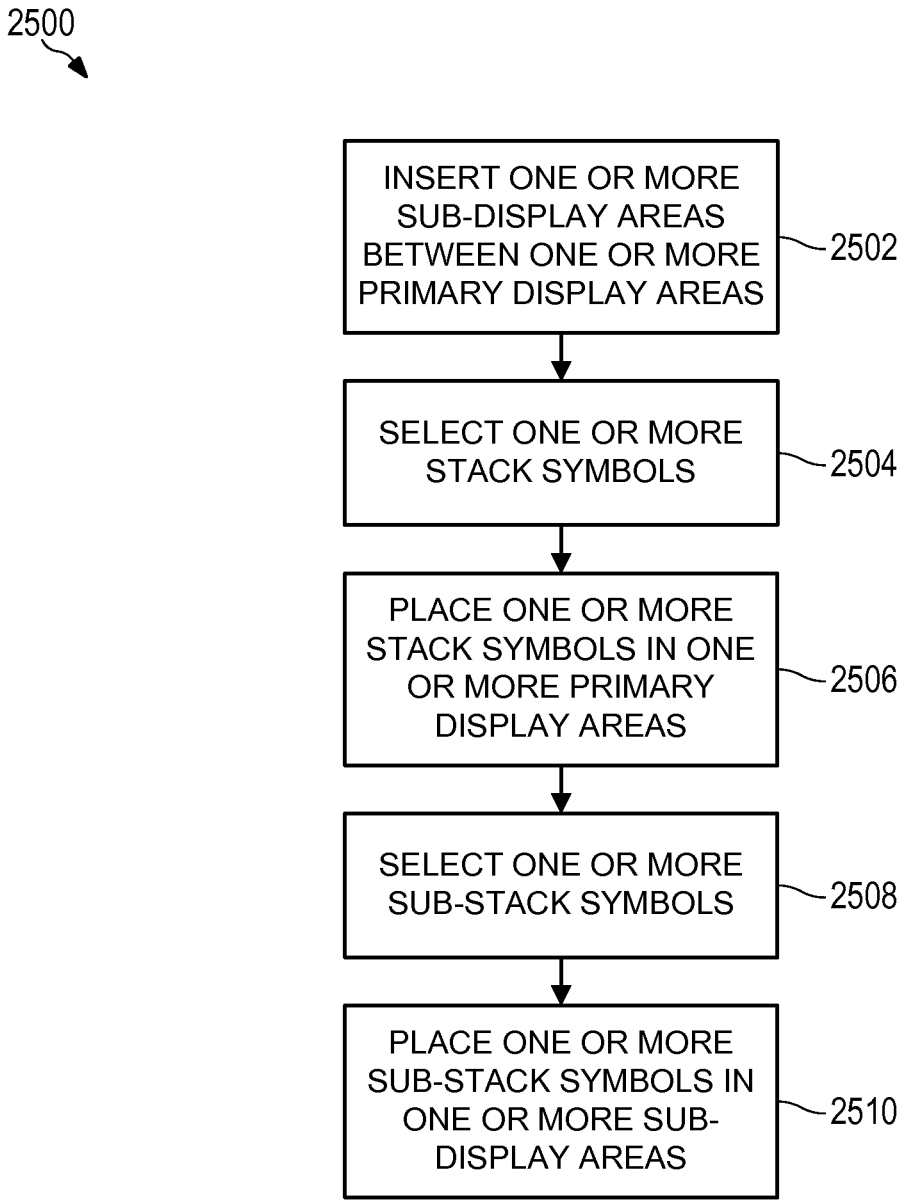
FIG. 25 is a flow diagram for game play, according to one embodiment.

In FIG. 25, a flow diagram for game play is shown, according to one embodiment. The method may include inserting one or more sub-display areas between one or more primary display areas (step 2502). The method may include selecting one or more stack symbols (step 2504). The method may include placing one or more stack symbols in one or more primary display areas (step 2506). The method may include selecting one or more sub-stack symbols (step 2508). The method may include placing one or more sub-stack symbols in one or more sub-display areas (step 2510). One or more payouts may be determined based on the display areas, the sub-display areas, and/or any interaction between a first sub-display area to an Nth sub-display area, a first display area to a Nth display area, a first sub-display area to an Nth display area, and/or a first display area to an Nth sub-display area, and/or any combination of sub-display areas and display areas. In various examples shown in FIGS. 15A-15B, instead of having a stacking area 1506, there would be a primary symbol display area (e.g., 1506, 1506A, 1506B, and 1506C) and a sub-display area (e.g., 1514, 1516, 1518, and 1520) where the primary symbol display areas would be easily seen by the player whereas the sub-display area would not be easily seen by the player and would be placed into the border area between the primary symbol display areas. In this example, the primary symbol display areas may appear to show four aces in a row (e.g., stacked symbols); however, these would not be stacked symbols because an X would be in a first sub-display area 1514, a Y would be in a second sub-display area 1516, a Z would be in a third sub-display area 1518, and an B would be in a fourth sub-display area 1520. Therefore, no two adjacent symbols would be the same, similar, and/or identical symbols. Further, the simulated stacking area 1524 and/or 1510 may utilize a first symbol 1528 (e.g., A), a first related by not identical symbol 1530 (e.g., A'), a second first symbol 1532 (e.g., another A), and a second related by not identical symbol 1534 (e.g., A"—this would not be identical to any of these symbols).

In this example, if the player received and/or if it was displayed on an active payline that three A were in a row, then the player would receive a 100 credit payout. Further, if a winning event occurs on an active payline and/or independent of a winning event occurring on an active payline, if three× (and/or any symbol combination can be utilized by the designers) occurs on a sub-display area in a row, then a credit reward may be implemented and/or a random bonus, and/or any other prize.

Figure 26:
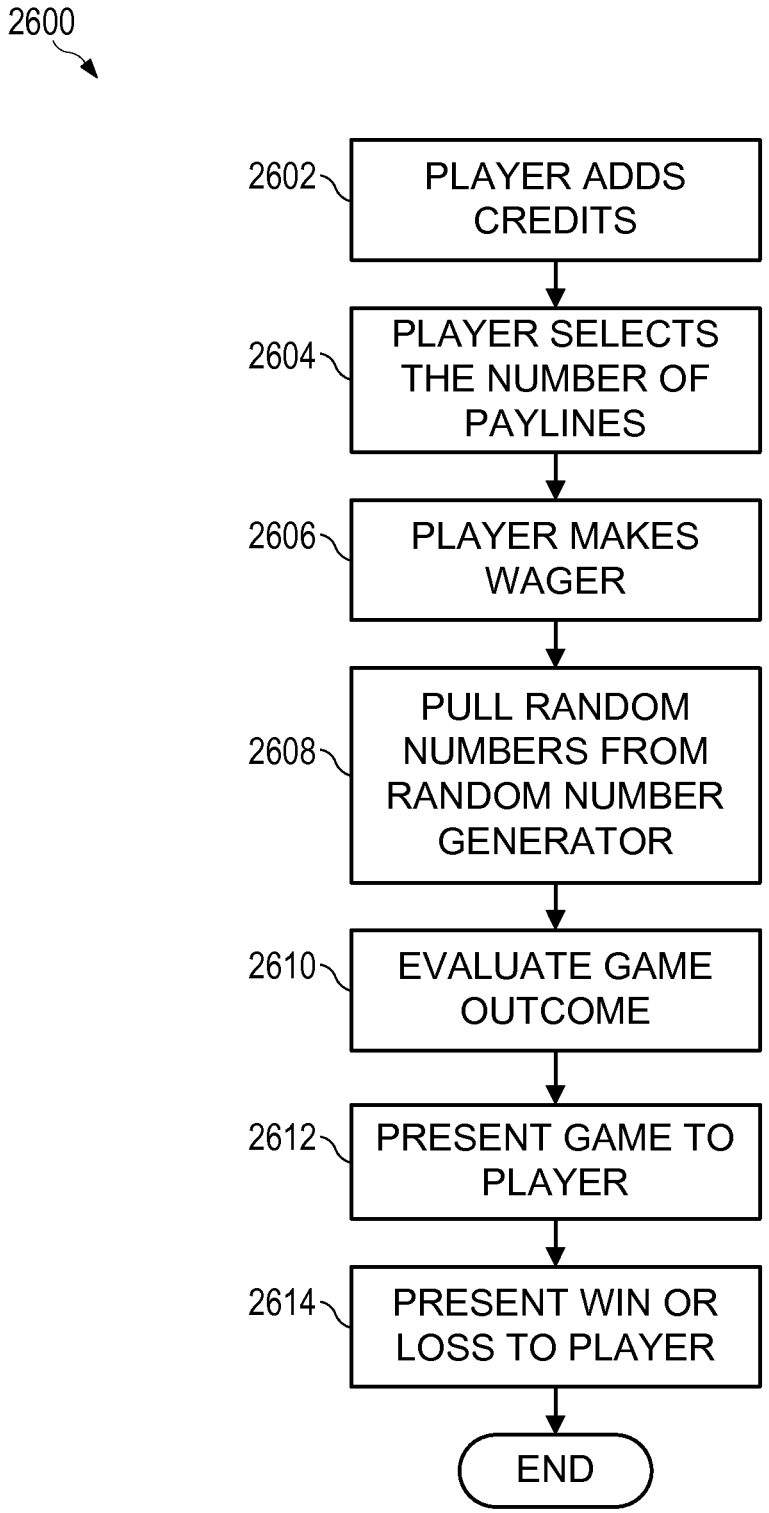
FIG. 26 is a flow diagram for game play, according to one embodiment.

In FIG. 26, a process flowchart of one example of a primary game play 2600 on an electronic gaming system is shown, according to one embodiment. The method may include the step of a player adding credit to the electronic gaming system (step 2602). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 2604, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 2606, the player makes a wager on the game. In one embodiment, the wager may be a multiple of the number of paylines selected at step 2604. In another embodiment, the wager may not be a multiple of the number of paylines selected at step 2604. In a further embodiment, the wager may include a side-wager (e.g., ante bet), which may, in one example of such an embodiment, be used to make the player eligible to be awarded the extra functionality discussed above. It should be appreciated that in some embodiments, the order of steps 2604 and 2606 may not be critical, and so for example, a player can select the wager they wish to place, and then select the number of paylines they want it applied to, and that these embodiments are expressly contemplated as being within the scope of the present disclosure.

Continuing to step 2608, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 2610 and 2612, the gaming system utilizes the random numbers pulled at step 2608 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 2614, the win or loss outcome may be identified for the player. In one embodiment, this step can include additional messaging, which provides information related to the win or loss, such as why the player won or lost. In another embodiment, this step can include identification of the amount of any award earned by the player.

Figure 27:
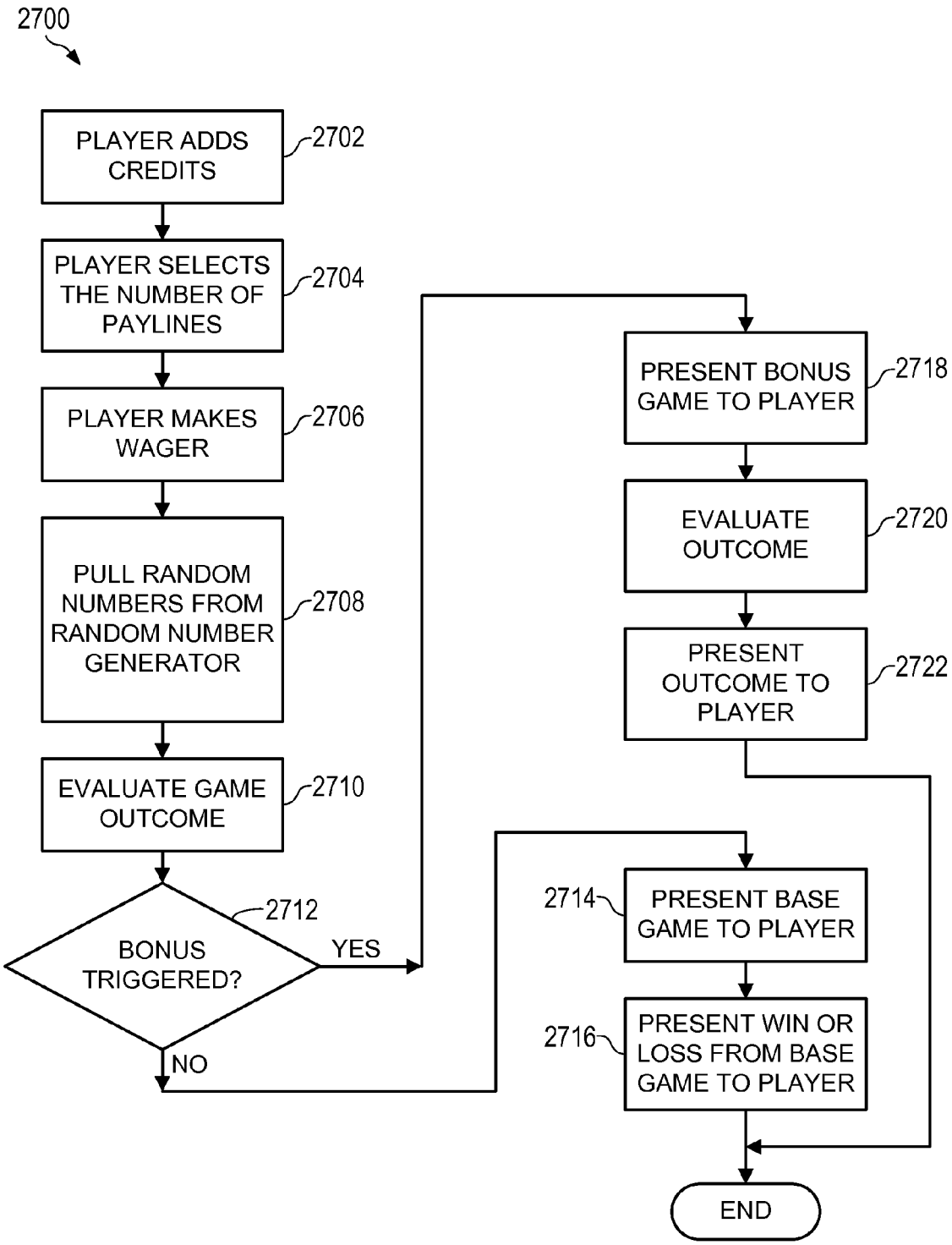
FIG. 27 is a flow diagram for game play, according to one embodiment.

FIG. 27 is a process flowchart of one example of a combined primary and secondary game play 2700 on an electronic gaming system, according to one embodiment. The method may include the step of a player adding credit to the electronic gaming system (step 2702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 2704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 2706, the player makes a wager on the game. In one embodiment, the wager may be a multiple of the number of paylines selected at step 2704. In another embodiment, the wager may not be a multiple of the number of paylines selected at step 2704. In a further embodiment, the wager may include a side-wager, which may, in one example of such an embodiment, be used to make the player eligible to be awarded the extra functionality discussed above. It should be appreciated that in some embodiments, the order of steps 2704 and 2706 may not be critical, and so for example, a player can select the wager they wish to place, and then select the number of paylines they want it applied to, and that these embodiments may be expressly contemplated as being within the scope of the present disclosure.

Continuing to step 2708, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 2710, the gaming system utilizes the random numbers pulled at step 2708 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 2712, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the 2nd, 3rd and 4th reel. In another example, the bonus game may be triggered if matching symbols are displayed on the 1st, 2nd and 3rd reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 2714, where the base game may be fully presented to the player. As discussed above, the orders of step 2710, 2712, and 2714 can be changed without affecting the novel concepts disclosed herein.

At step 2716, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 2712 that a bonus or secondary game was triggered, then process 2700 continues to step 2718, where the secondary game may be presented to the player. As discussed above, there are numerous ways to present the secondary or bonus game to the player.

At steps 2720 and 2722, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 2700 ending after step 2722, the process continues to step 2714 so as to finalize the primary game outcome presentation to the player.

In one example, a patron of a game may want to take a break and come back on any machine on the floor and continue with the same game play and/or game configuration. Once a patron decides to take a break he/she activates the persistent game play feature using some action similar to a button activation which may record the persisting information including the game title, the denomination, pay lines, credit per lines, his current credits, any other bonus information, and/or any progressive information. In one example, after recording this information the device, system, and/or method may generate a unique number and/or any other information which identifies the state recorded which may be printed on a receipt and/or stored on a magnetic card based on the current setup. This may be further secured by providing an additional PIN number displayed which is required to be used to bring back the game state. Further, once he/she goes back to play, the machine may have an option to restore his/her session. Once the receipt and/or card is fed in the device, the system may validate the unique number or grid and optionally the PIN and/or biometric information and bring back and/or restore and/or load the previous game with the persisted title, denomination, payline, credit per line data, and/or the current available credits. This will enable the patron to continue to play from the prior saved state where he/she broke and/or stopped playing in the previous session.

In another example, the paytable may be transferred from the EGM to another device (e.g., mobile device, etc.). Further, jurisdictional information may be utilized to modify the saved persistent game play function. For example, a player may move from one jurisdiction to another which may require that the saved persistent game play be modified. In one example, a player may move from Las Vegas to Atlantic City which would require that the game configuration be modified.

In one example, a player tracking can be combined with a persistent game card to form a player tracking/persistent game card. In one example, the EGM may generate a greater number of random numbers (e.g., RNG) than would be needed for the persistent game play to ensure that enough gaming outcomes are transferred from the EGM to the mobile device. In this example, random numbers from 1-1000 may be generated for a stacking game play player which may be utilized on the mobile device while a second player playing on the EGM may start with random number 1001. In another example, bonuses, additional credits, additional spins, and/or any other reward may be utilized to entice a player to transfer game play to their mobile device and continue playing instead of not playing during their break (e.g., lunch, etc.).

In one embodiment, the electronic gaming device may include a plurality of reels. The plurality of reels includes one or more areas. The electronic gaming device may include a memory where the memory includes one or more persistent game play modules. The electronic gaming device may include a processor where the processor may generate one or more symbols to be located in the one or more areas. The processor may generate one or more persistent game play data and to transfer the one or more persistent game play data.

In another example, the processor may generate a ticket which includes at least one of the one or more persistent game play data. Further, the processor may restart game play at a saved state based on at least one of the one or more persistent game play data. In addition, the processor may transfer at least one of the one or more persistent game play data to a magnetic card. In another example, the processor may restart game play at a predetermined phase based on at least one of the one or more persistent game play data. Further, the processor may transfer at least one of the one or more persistent game play data to a mobile device. In addition, the processor may initiate game play with a saved configuration based on at least one of the one or more persistent game play data. In one example, the processor may transfer game play data to a mobile device where the mobile device is configured to initiate a gaming session based on the transferred game play data. In addition, the processor may place the electronic gaming device into a reserved state based on the transferred persistent game play data. Further, the processor may initiate a warning based on reserved state becoming unreserved within a predetermined time period.

In another embodiment, a method of providing game play via an electronic mobile device may include generating via one or more processors one or more persistent game play data and transferring via the one or more processors the one or more persistent game play data.

The method may also include generating a ticket which includes at least one of the one or more persistent game play data; restarting game play at a saved state based on at least one of the one or more persistent game play data; transferring at least one of the one or more persistent game play data to a magnetic card; restarting game play at a predetermined phase based on at least one of the one or more persistent game play data; and/or transferring at least one of the one or more persistent game play data to a mobile device.

In another embodiment, the electronic gaming system may include a server including a server processor and a server memory. The system may include a display device including a plurality of reels where the plurality of reels includes one or more areas. The server memory includes one or more persistent game play structures and the server processor may generate one or more symbols to be located in the one or more areas. The server processor may generate one or more persistent game play data and to transfer the one or more persistent game play data.

Further, the server processor may generate a ticket which includes at least one of the one or more persistent game play data. In addition, the server processor may transfer at least one of the one or more persistent game play data to a magnetic card. The server processor may transfer at least one of the one or more persistent game play data to a mobile device.

In a typical symbol replacement game, one symbol per reel is chosen to replace pre-designated portions on some or all of the game reels. The pre-designated portion does not change in length, although in some specific cases it may change in location.

In one embodiment, the methodology for symbol replacement is different. It first chooses a set of symbols to appear on each reel—{symbol 1, symbol 2, symbol 3, symbol 4, symbol 5} appearing on {reel 1, reel 2, reel 3, reel 4, reel 5}, where the symbols may or may not be identical; then it determines how many of each symbols is replaced on each reel. The manner of which symbols, how many spots, and where on the reel the symbols are placed may vary in implementation (see below for details).

In one specific example, each symbol may replace from 20 to 50 symbols on the reel, in increments of 5. Any number of symbols (e.g., 0 to N) and/or any number of increments (e.g., 1 to N) may be utilized. The decision of which symbols to use and how many symbols to replace are made dependently based upon a random drawing of a weighted table or independently thereof. For example, a subset of the table might look like:

M2 M2 M2 M2 M2 30 30 40 30 20 with probability 1%;

M2 M2 M2 M2 M2 20 20 20 20 50 with probability 1%; and

M1 F5 WW WW M1 50 20 50 20 50 with probability 5%.

In this example, the first entry replaces reel 1 with M2, reel 2 with M2, reel 3 with M2, reel 4 with M2 and reel 5 with M2. If this entry is picked, then 30 symbols are replaced on reel 1, 2 and 4, 40 symbols on reel 3 and 20 symbols on reel 5.

Similarly if the second entry is selected, the same symbols are used for the replacement on the same reels, but 20 symbols are replaced on reels 1 through 4 and 50 on the last reel. Finally, if the third entry is selected, then 50 symbols of M1 are replaced on reel 1, 20 symbols of F5 are replaced on reel 2, 50 symbols of WW are replaced on reel 3, 20 symbols of WW are replaced on reel 4 and 50 symbols of M1 are replaced on reel 5.

Variations and Implementations—Performing the dynamically-sized symbol replacements can be done in a variety of manners, some of which are beneficial from a design and player entertainment stand point. For example, a portion of one or more reels may be designated as a "dead spot" meaning there is no symbol that is placed in that area until the player presses spin. When he presses spin, the dead area is propagated by one symbol on one or more reels. Different reels may have different symbols assigned to them. In addition, this symbol stack may randomly extend into adjacent symbol(s). For example, when a player presses the spin button, it is determined that reel 1 will have one dead spot replaced with an Ace symbol, and in addition, the next 10 symbols adjacent to the dead spot are overwritten to become Aces.

In another example, a method may be implemented which involves a second reel strip spinning "over" the typical reel strips. The reel strip's effective length is identical to the standard reel's length and is transparent except a certain number of symbols are chosen to become a particular symbol. In another example, the length of the reel strip may be a portion of the standard reel strip. If it so happens, when the over-reel and standard reel both spin, the over-reel lands partially or entirely above the standard reel in the visible window, the symbols on the over-reel take precedence and evaluation occurs with those symbols. It is important to note that all reels may have an over-reel, or only a subset of reels may have an over-reel. Game design specifications would determine which reels would have an over-reel.

In another example, the method determines the symbol and a random number of symbols to append to the end of a reel strip, or some other location within the reel. The end result of this is the reel strip length will vary from spin-to-spin. Several different symbols (e.g., first stacking symbol, second stacking symbol, . . . , nth stacking symbol) may be utilized and one or more stack lengths may be chosen and varied for different reels. In one example, a generalization implementation selects multiple places to insert a multiple stacks of varying sizes. In a specific implementation, the system, device, and/or method may use existing symbols on the reel strip to place a stack. For instance, suppose 2 stacks of 10 Ace symbols will be inserted into reel 1. Rather than randomly select a location, the 2 stacks will each be placed adjacent to an existing Ace, making it appear as though the stack is effectively at least 1 symbol longer.

In another specific implementation, the system, device, and/or method may involve stacks moving in predictable, well-defined patterns, rather than being placed randomly. In this embodiment, the system, device, and/or method may select where the patterns will be placed which gives the math designers predictability and may ease the difficulty of calculations.

In another example, the method may be to use a virtual reel strip where each stop position has a weight related to it. The larger the weight for the stop position in relation to the total sum of weights, the higher the probability it is that this stop position is chosen. In this embodiment, the actual number of physical stops of the replacement stack is fixed, and the weight of each symbol varies to effectively manipulate the probability it will land in the visible window.

Figure 28:
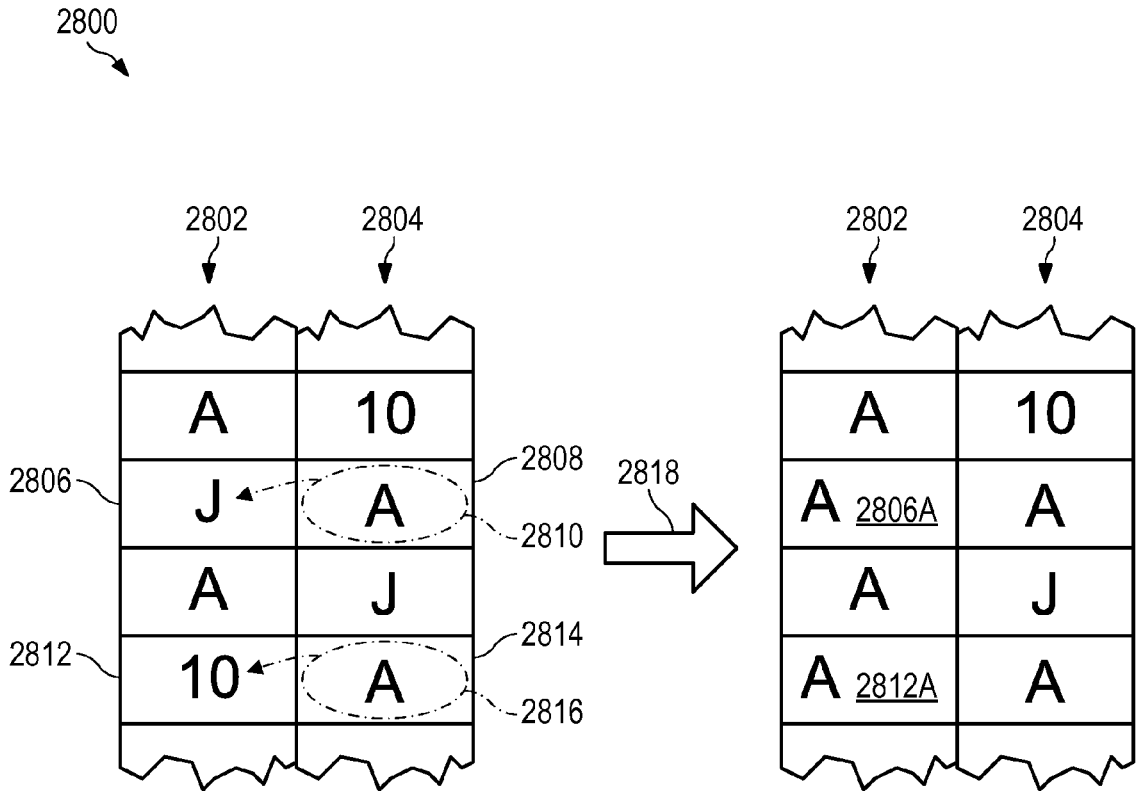
FIG. 28 is another illustration of stacking game play on a gaming device, according to one embodiment.

In FIG. 28, another illustration of stacking game play on a gaming device is shown, according to one embodiment. In this example, a first reel 2802 includes an A, J, A, 10 pattern. Where, a second reel 2804 includes a 10, A, J, A pattern. In this example, the two A from second reel 2804 are moved to the first reel 2804 to form a simulated stacking symbol configuration (see 2806A and 2812A) (e.g., simulated four A symbols). In this example, the movement would be confirmed to be initiated in a bonus game and/or formulated as a third spin. Therefore, in one example, during a first spin column 2802 may have four K symbols and then during a second spin column 2802 would have the A, J, A, 10 symbols which is not a stack but then during a third spin, bonus spin, and/or any other function the two A symbols in column 2804 would move over to column 2802 to form four A symbols but this would be on a third spin.

In one example, the system, device, and/or method may implement a first spin, a second spin, and a third spin. However, to the player the first spin looks like a first spin but second spin and third spin are combined and look like just a second spin to the player.

Figure 29:
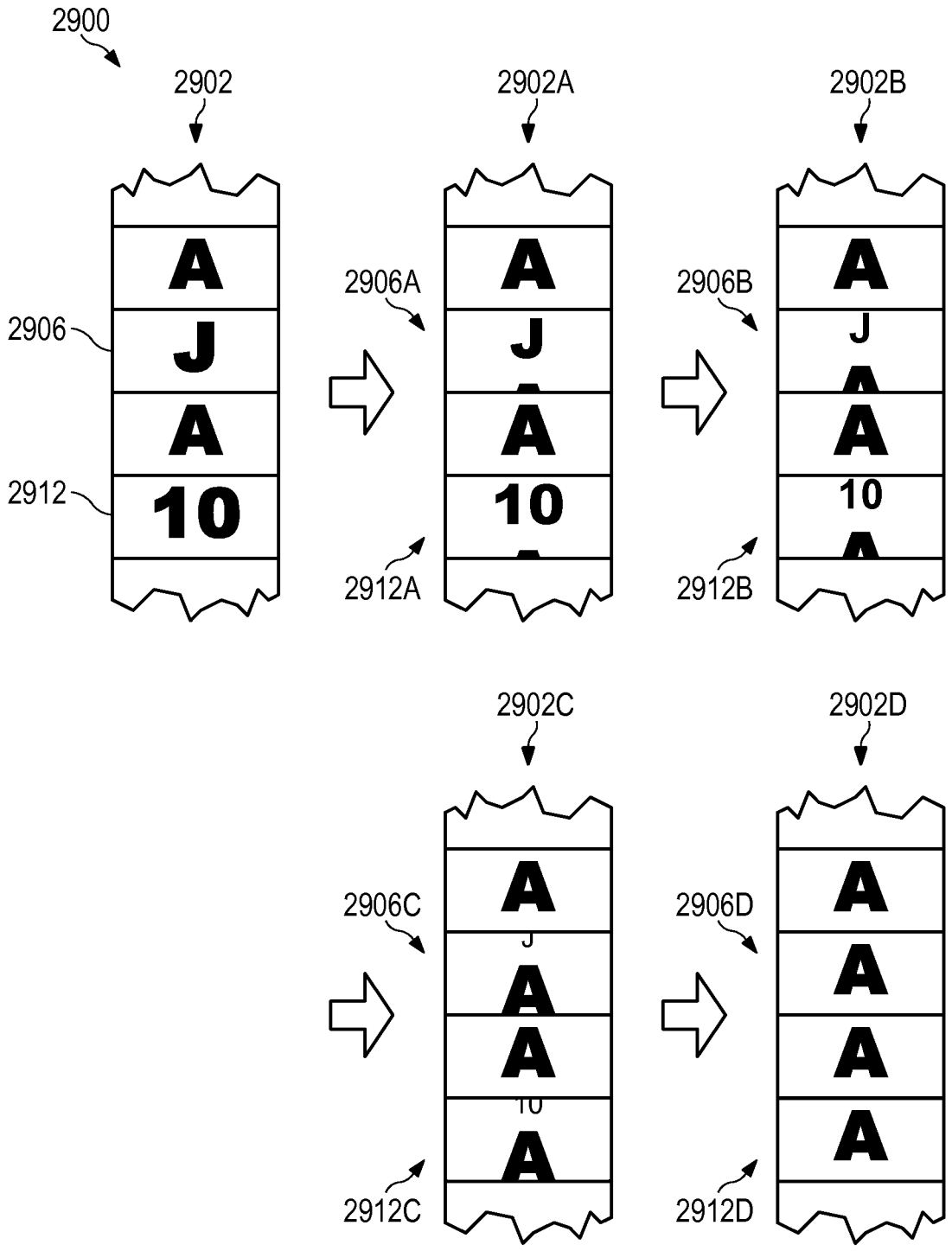
FIG. 29 is another illustration of stacking game play on a gaming device, according to one embodiment.

In FIG. 29, another illustration of stacking game play on a gaming device is shown, according to one embodiment. In this example, a first reel 2902 includes an A, J, A, 10 pattern. On this A, J, A, 10 pattern, the J and 10 symbols disappear and/or dissolve. Based on this disappearance, the second A symbol (e.g., 2906A-2906D) is moved up to replace the J and a third A symbol (e.g., 2912A-2912D) may be moved up to replace the 10 symbol to form a simulated stacking symbol configuration. In this example, the movement would be initiated in a bonus game and/or formulated as a third spin. Therefore, in one example, during a first spin column 2902 may have four K symbols and then during a second spin column 2802 would have the A, J, A, 10 symbols which is not a stack but then during a third spin, bonus spin, and/or any other function the J symbol and the 10 symbol dissolve and the two A symbols in a column (see reference numbers 2902A-2902D) would move and/or appear in/to column 2902D to form four A symbols but this would be on a third spin and/or a non-spin feature.

Figure 30A:
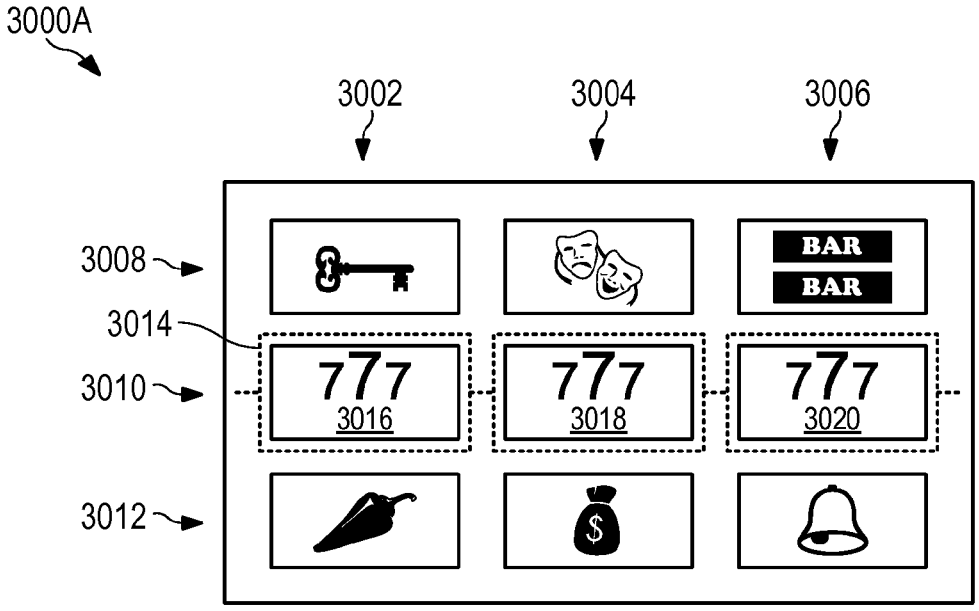
FIG. 30A is another illustration of stacking game play on a gaming device, according to one embodiment.

In FIG. 30A, another illustration of stacking game play on a gaming device is shown, according to one embodiment. In this example, a first display column 3002, a second display column 3004, and a third display column 3006 where a first overlay reel 3014 is utilized to form simulated stacking symbols.

Figure 30B:
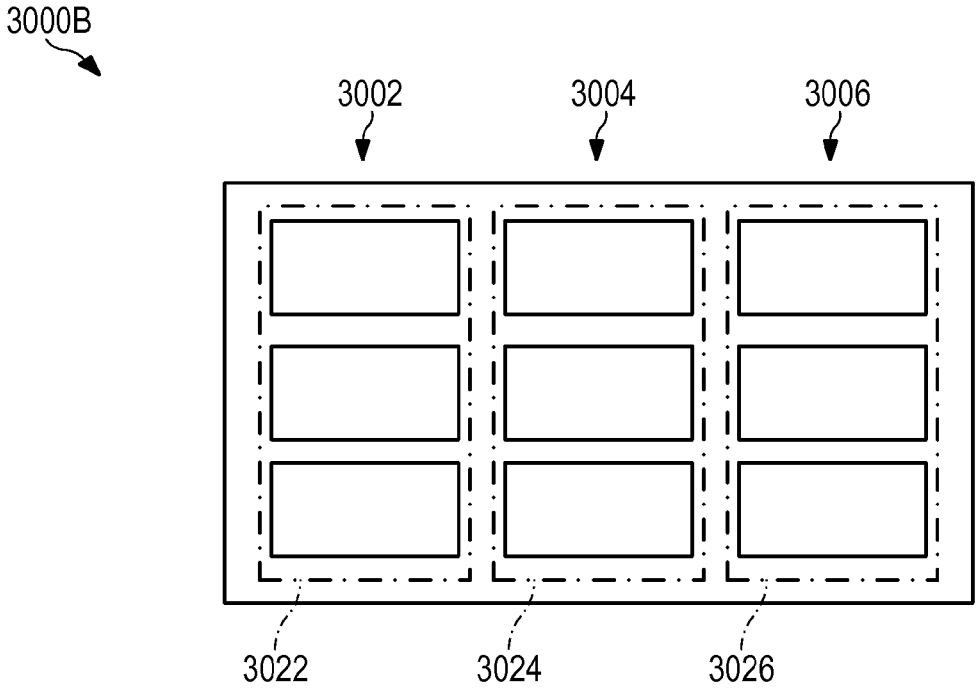
FIG. 30B is another illustration of stacking game play on a gaming device, according to one embodiment.

In FIG. 30B, another illustration of stacking game play on a gaming device is shown, according to one embodiment. In one example, first display column 3002, second display column 3004, third display column 3006 may be overlaid with a first overlay display column 3022, a second overlay display column 3024, and a third overlay display column 3026.

Figure 30C:
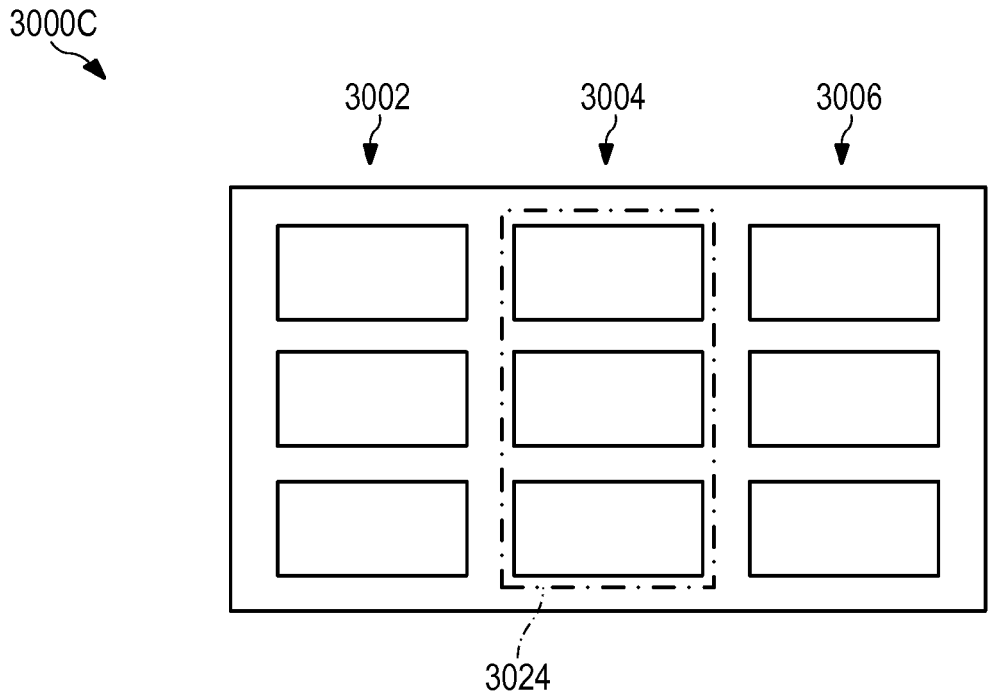
FIG. 30C is another illustration of stacking game play on a gaming device, according to one embodiment.

In FIG. 30C, another illustration of stacking game play on a gaming device is shown, according to one embodiment. In one example, second display column 3004 may be overlaid with second overlay display column 3024.

Figure 30D:
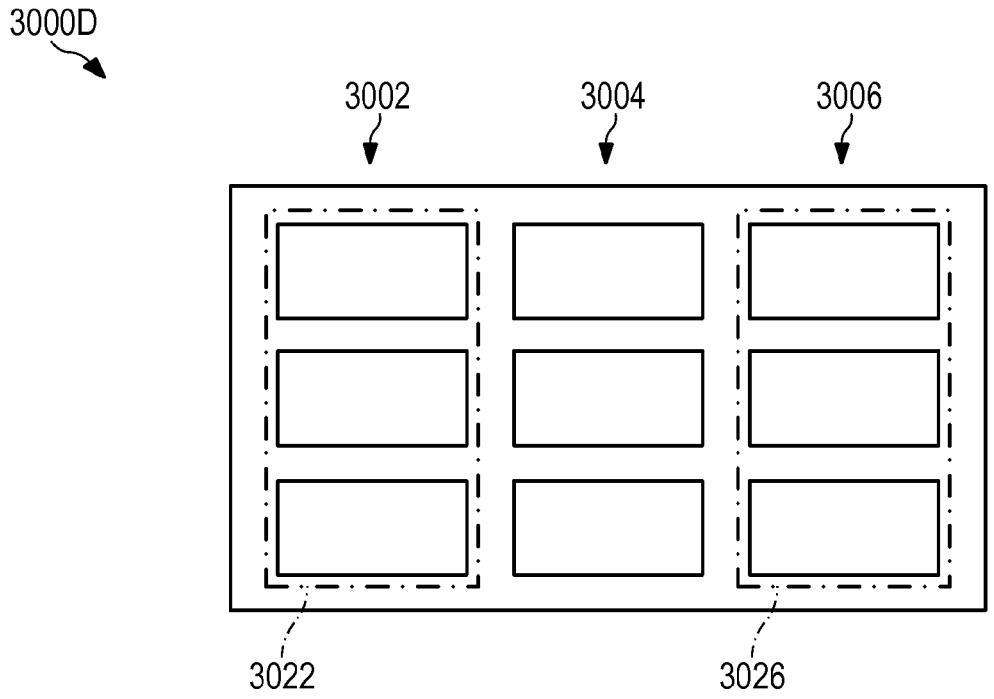
FIG. 30D is another illustration of stacking game play on a gaming device, according to one embodiment.

In FIG. 30D, another illustration of stacking game play on a gaming device is shown, according to one embodiment. In this example, first display column 3002 and third display column 3006 may be overlaid with first overlay display column 3022 and third overlay display column 3026.

Figure 30E:
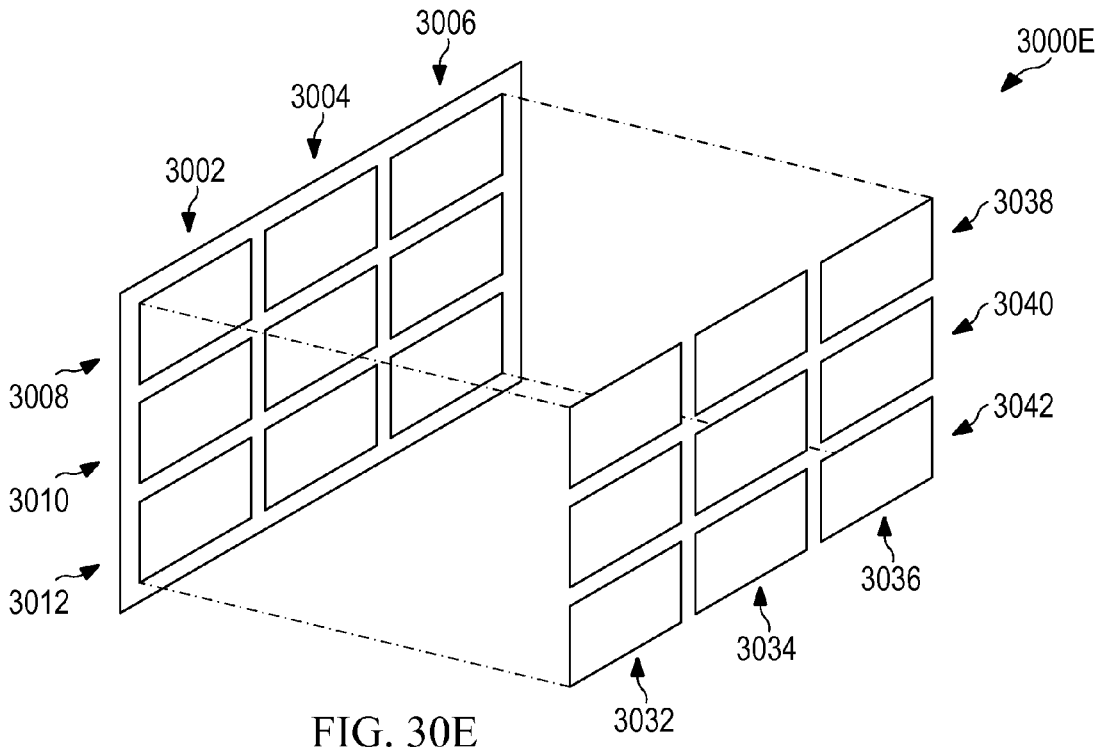
FIG. 30E is another illustration of stacking game play on a gaming device, according to one embodiment.

In FIG. 30E, another illustration of stacking game play on a gaming device is shown, according to one embodiment. One or more overlay display areas (e.g., 3032, 3034, 3036, 3038, 3040, and 3042) may be utilized with one or more primary display areas (e.g., columns and rows—3002, 3004, 3006, 3008, 3010, and 3012).

Figure 30F:
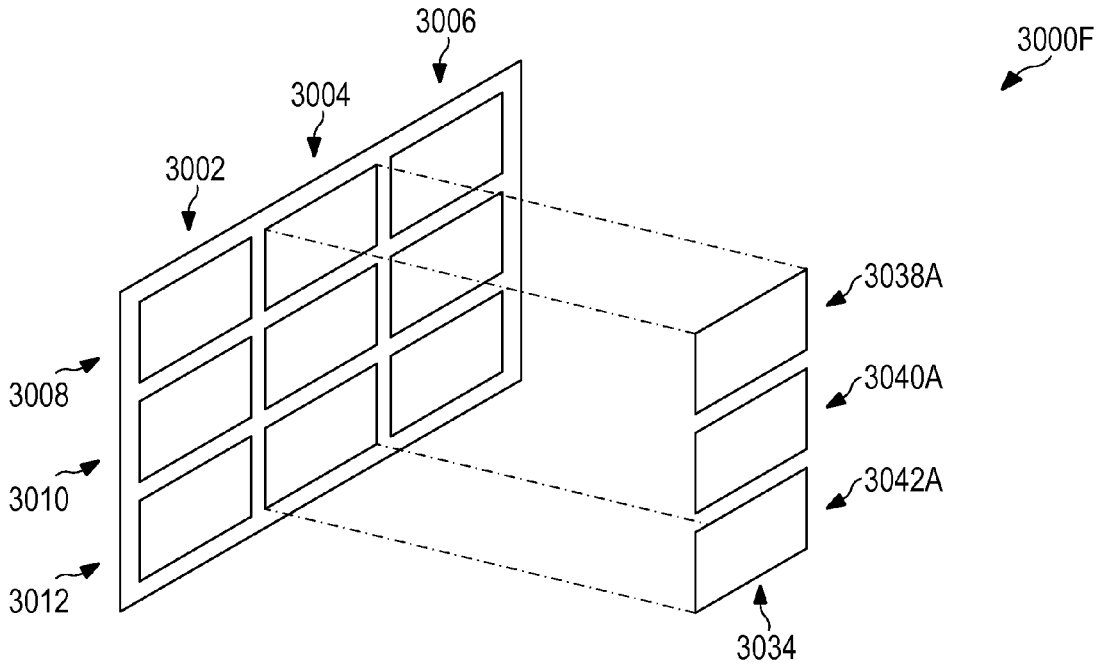
FIG. 30F is another illustration of stacking game play on a gaming device, according to one embodiment.

In FIG. 30F, another illustration of stacking game play on a gaming device is shown, according to one embodiment. In this example, only overlay display areas (e.g., 3038A, 3040A, and 3042A) are utilized.

Figure 30G:
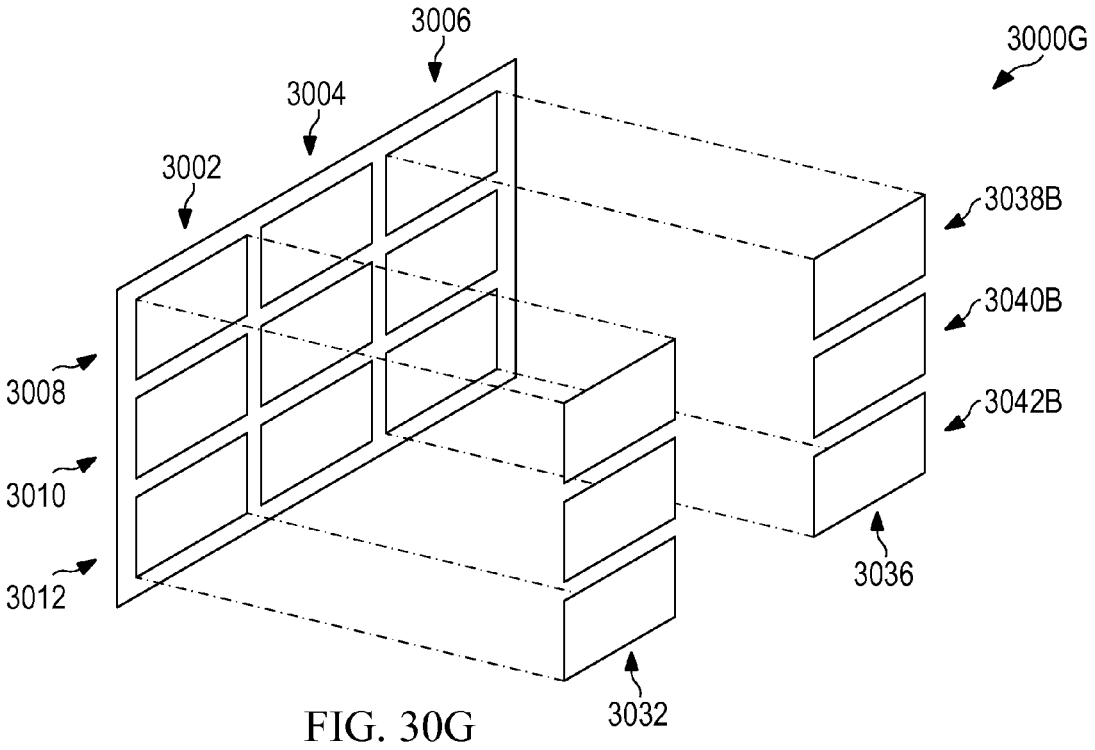
FIG. 30G is another illustration of stacking game play on a gaming device, according to one embodiment.

In FIG. 30G, another illustration of stacking game play on a gaming device is shown, according to one embodiment. In this example, only overlay display areas 3032 for first column and/or one or more areas (e.g., 3038B, 3040B, and 3042B) in third column may be utilized.

Figure 30H:
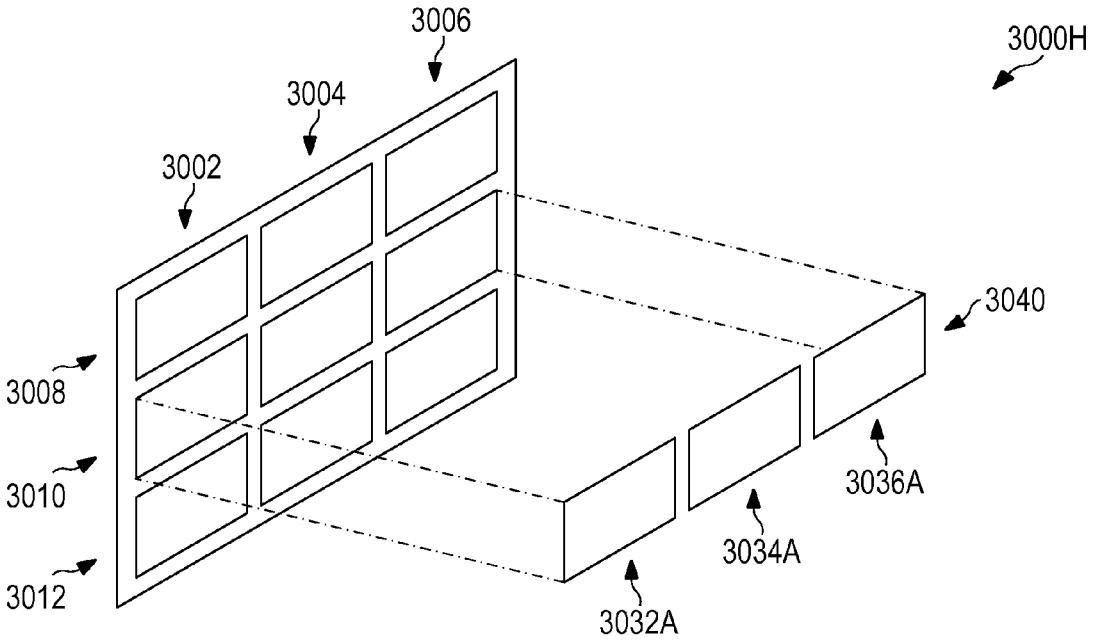
FIG. 30H is another illustration of stacking game play on a gaming device, according to one embodiment.

In FIG. 30H, another illustration of stacking game play on a gaming device, according to one embodiment. In this example, only overlay display areas for second row (e.g., 3032A, 3034A, 3036A-3040) may be utilized.

Figure 30J:
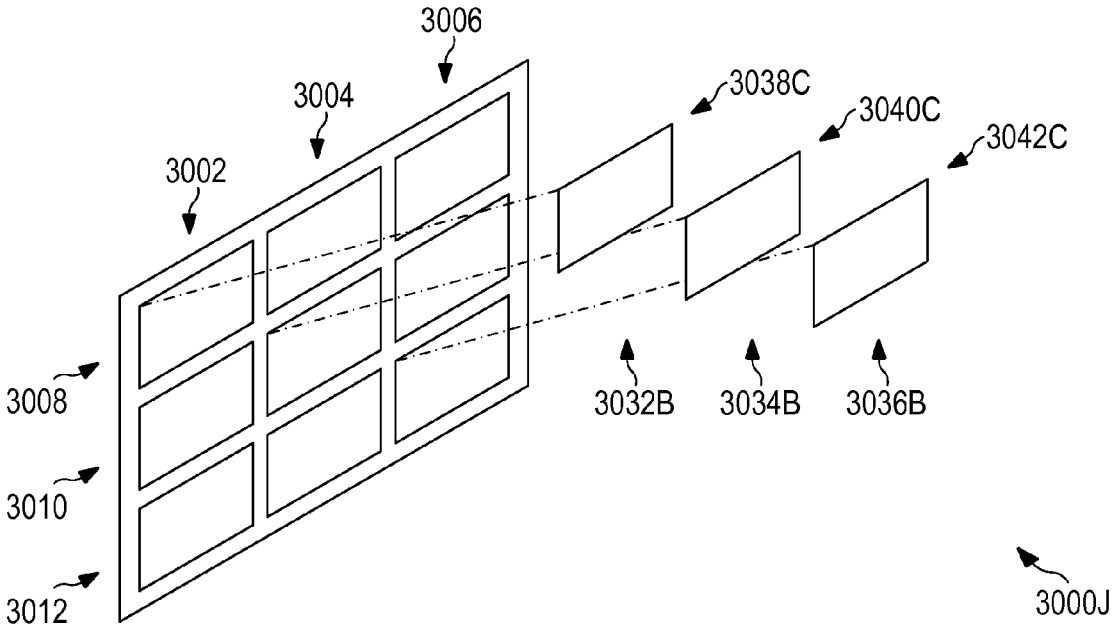
FIG. 30J is another illustration of stacking game play on a gaming device, according to one embodiment.

In FIG. 30J, another illustration of stacking game play on a gaming device is shown, according to one embodiment. In this example, only overlay display areas for a diagonal section (e.g., 3038C, 3040C, and 3042C) may be utilized.

Figure 30K:
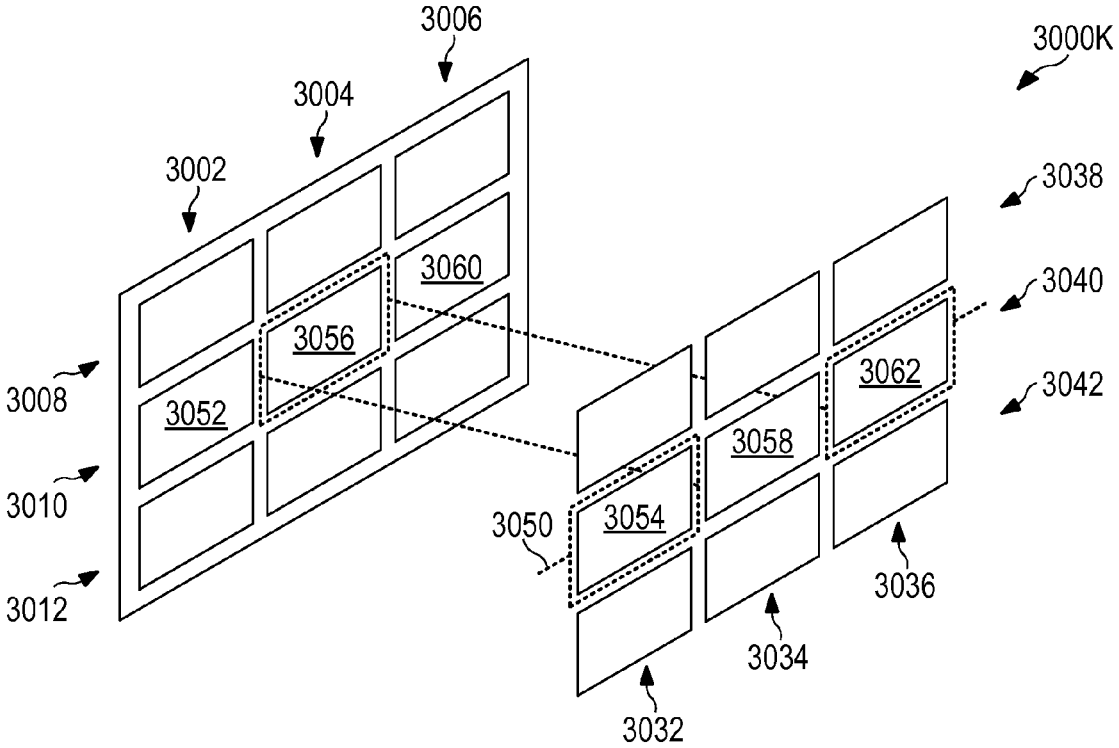
FIG. 30K is another illustration of stacking game play on a gaming device, according to one embodiment.

In FIG. 30K, another illustration of stacking game play on a gaming device is shown, according to one embodiment. In this example, only one overlay display area 3062 may be utilized.

Figure 31A:
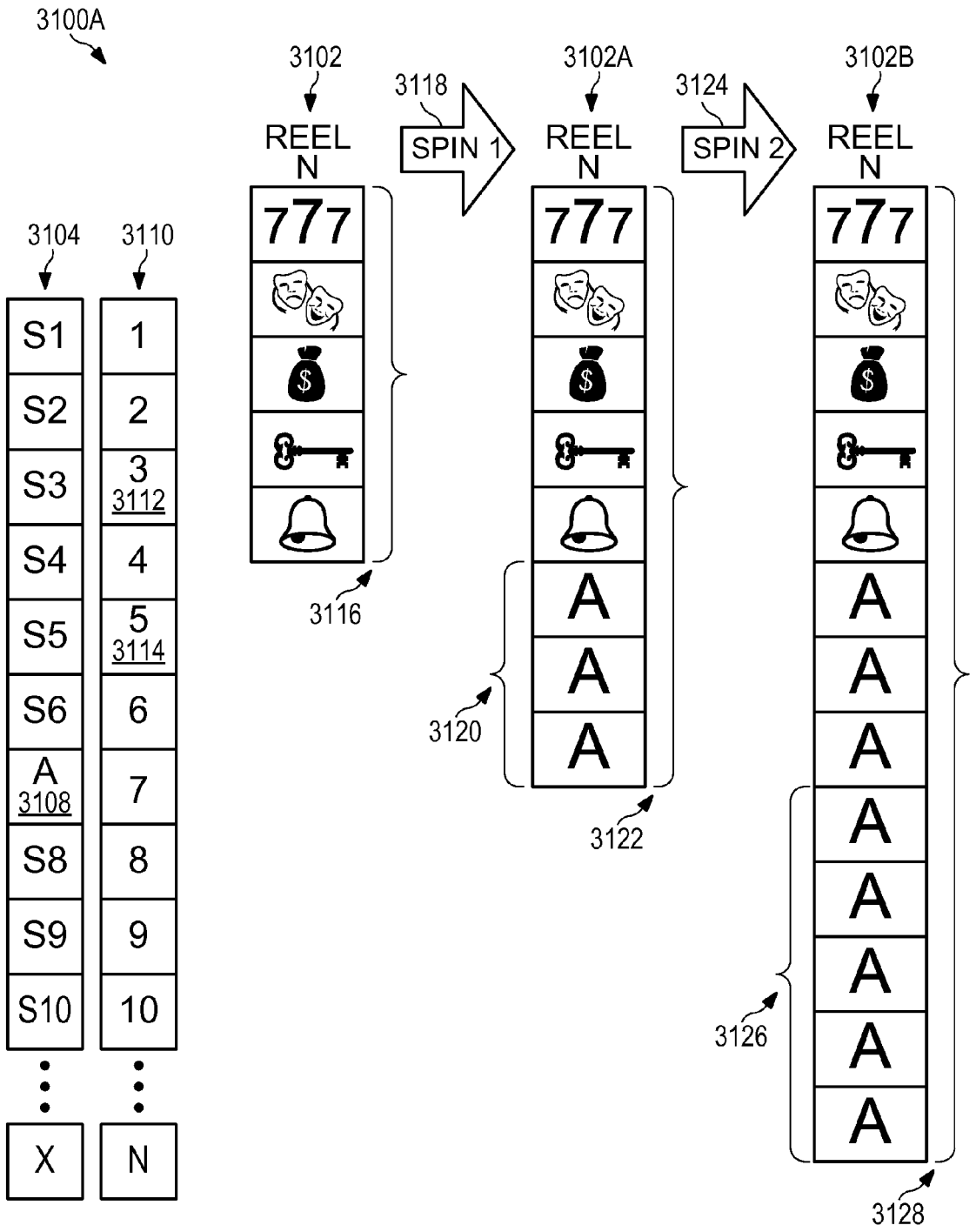
FIG. 31A is another illustration of stacking game play on a gaming device, according to one embodiment.

In FIG. 31A, another illustration of stacking game play on a gaming device is shown, according to one embodiment. In this example, a first stacking symbol 3108 was selected with a first number of symbols 3112 (e.g., 3) and a second number of symbols 3114 (e.g., 5) which are placed in a first stack area 3120 and an Nth stack area 3126 (see also FIG. 31B and FIG. 32).

In one example, a first reel 3102 may include a first symbol (e.g., 777), a second symbol (e.g., a mask), a third symbol (e.g., a money bag), a fourth symbol (e.g., a key), and a fifth symbol (e.g., a bell). In this example, during a first spin the symbol selected (first stacking symbol 3108) was inserted after a group of symbols 3116 (which included first symbol, second symbol, third symbol, fourth symbol, and fifth symbol). In this example, because the first number of symbols 3112 was three, there were three A symbols inserted after the group of symbols 3116 for a first spin where the three A symbols create a first stack 3120. During a second spin, a second stack 3126 was inserted after first stack 3120. The second stack 3126 includes 5 A symbols because the second number of symbols 3114 was a 5.

Figure 31B:
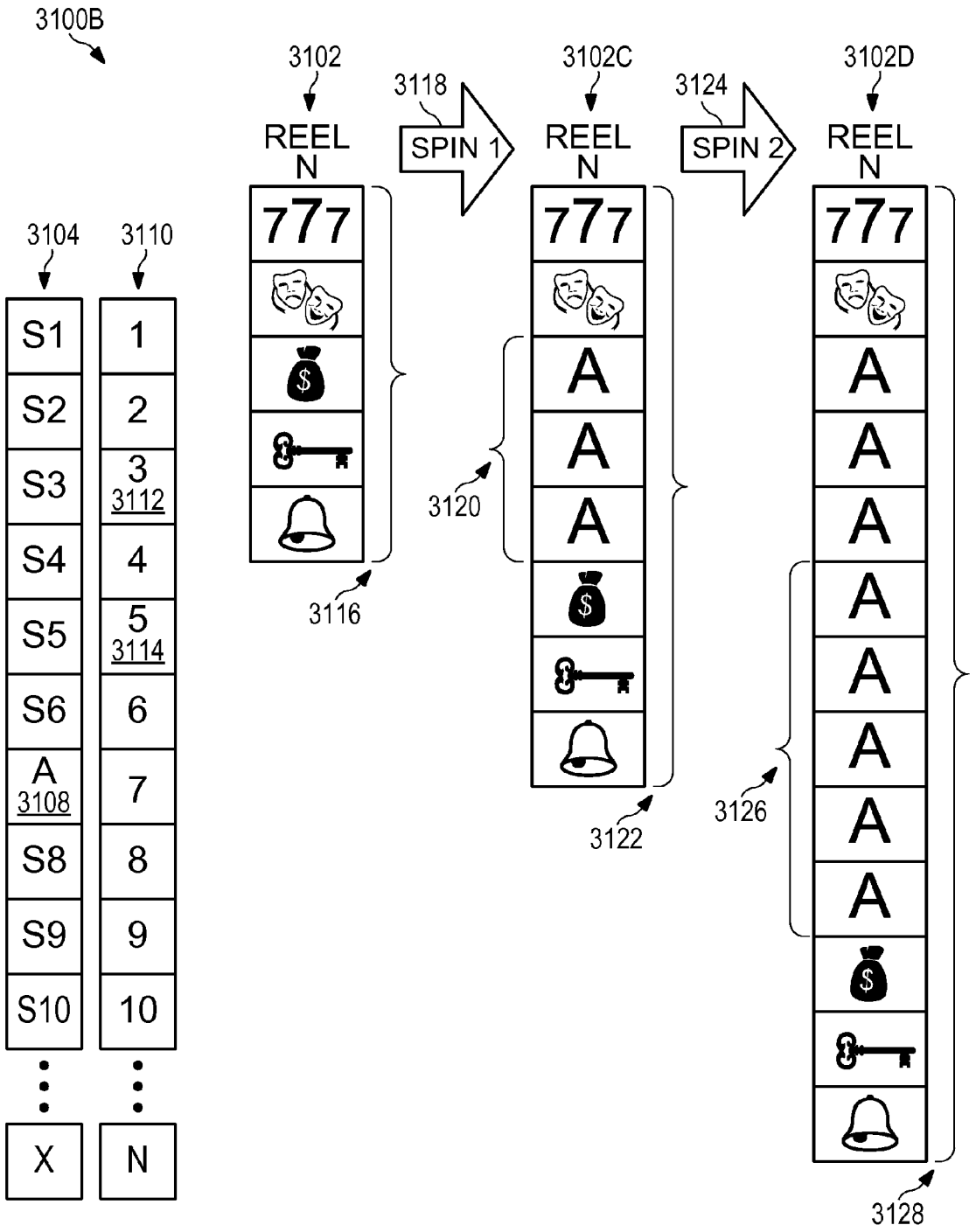
FIG. 31B is another illustration of stacking game play on a gaming device, according to one embodiment.

In another example shown in FIG. 31B, the first stack 3120 was inserted between second symbol (e.g., a mask) and a third symbol (e.g., a money bag). The first stack 3120 (e.g., three A symbols) was displayed between second symbol (e.g., a mask) and a third symbol (e.g., a money bag) during a first spin. In another example, the second stack 3126 was inserted after the first stack 3120 during a second spin. In various examples, the first stack 3120 and second stack 3126 and/or any other stacking area may be inserted before any symbol and/or any stacking area and/or in any other reel locations.

Figure 32:
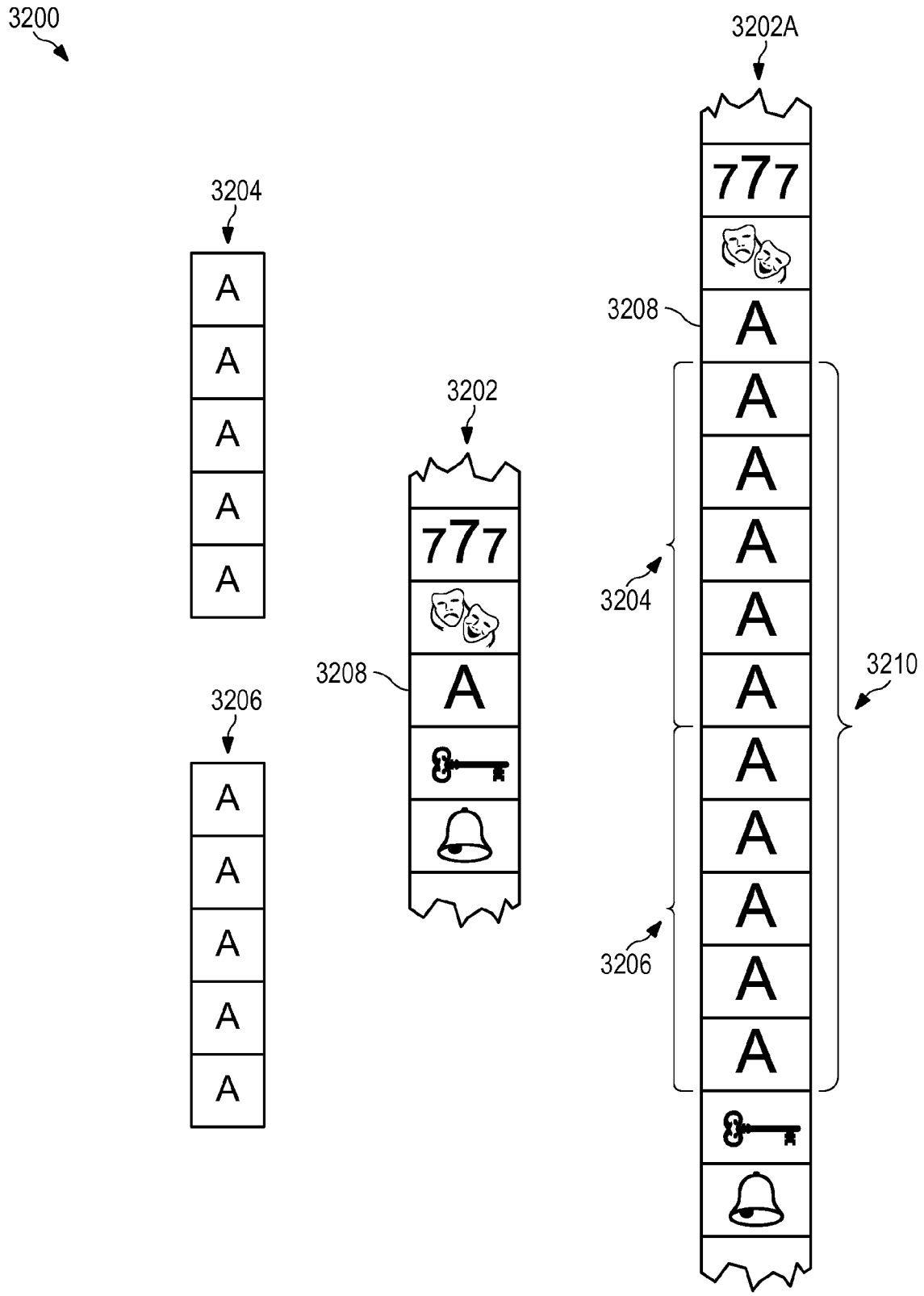
FIG. 32 is another illustration of stacking game play on a gaming device, according to one embodiment.

In another example shown in FIG. 32, an anchoring area 3208 may be utilized where a first stack 3204 and a second stack 3206 are inserted after the anchoring area 3208 to form a super stacking area 3210. Further, first stack 3204, second stack 3206, and/or any other stacking formation may be inserted before, after, and/or around the anchoring area 3208. In one example, during the second spin the K in the overlap positions would cause an error which may be corrected by the various procedure disclosed in this document.

Figure 33:
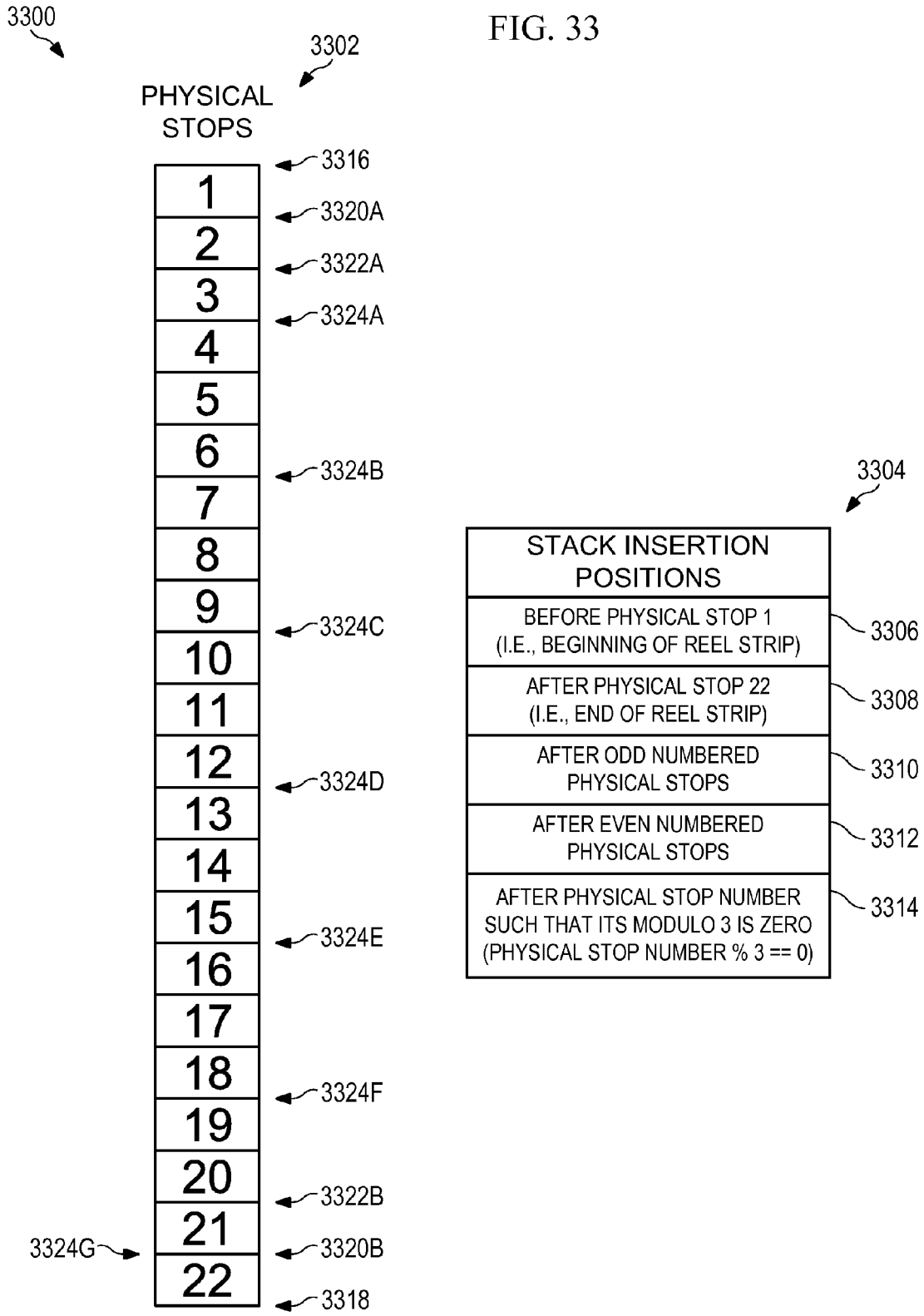
FIG. 33 is another illustration of stacking game play on a gaming device, according to one embodiment.

In FIG. 33, another illustration of stacking game play on a gaming device is shown, according to one embodiment. In this example, various stacking symbol insertion options are shown (see FIG. 34). In one example, one or more stacking formations (e.g., A, A, A; K, K, K, K; A, A, A, A, K, K; or any other formation) may be inserted before a reel strip 3302 at a position before a first reel stop 3316 (see reference number 3306. In another example, one or more stacking formations (e.g., A, A, A; K, K, K, K; A, A, A, A, K, K; or any other formation) may be inserted after the reel strip 3302 at a position after a last reel stop 3318. In another example, one or more stacking formations (e.g., A, A, A; K, K, K, K; A, A, A, A, K, K; or any other formation) may be inserted after (and/or before) an odd numbered physical stop (e.g., 1, 3, 5, 7, etc.). In addition, one or more stacking formations (e.g., A, A, A; K, K, K, K; A, A, A, A, K, K; or any other formation) may be inserted after (and/or before) an even numbered physical stop (e.g., 2, 4, 6, 8, etc.).

In various examples, the system, device, and/or method may insert one or more stacking formations and/or structures before a first reel stop (e.g., either physical and/or virtual reel stop), after the last reel stop, at one or more predetermined reel stops (e.g., reel position 10, reel position 20, and reel position 82 for a first spin and then reel position 22, reel position 34, reel position 51, and reel position 303 for the second spin . . . etc.), at one or more randomly determined reel stops (e.g., a first random number determines that reel position 4, reel position 59, reel position 88, and reel position 202 will be utilized for a first spin and then a second random number determines that reel position 12, reel position 33, reel position 69, reel position 91, reel position 107, and reel position 189 will be utilized for a second spin . . . etc.).

Figure 34:
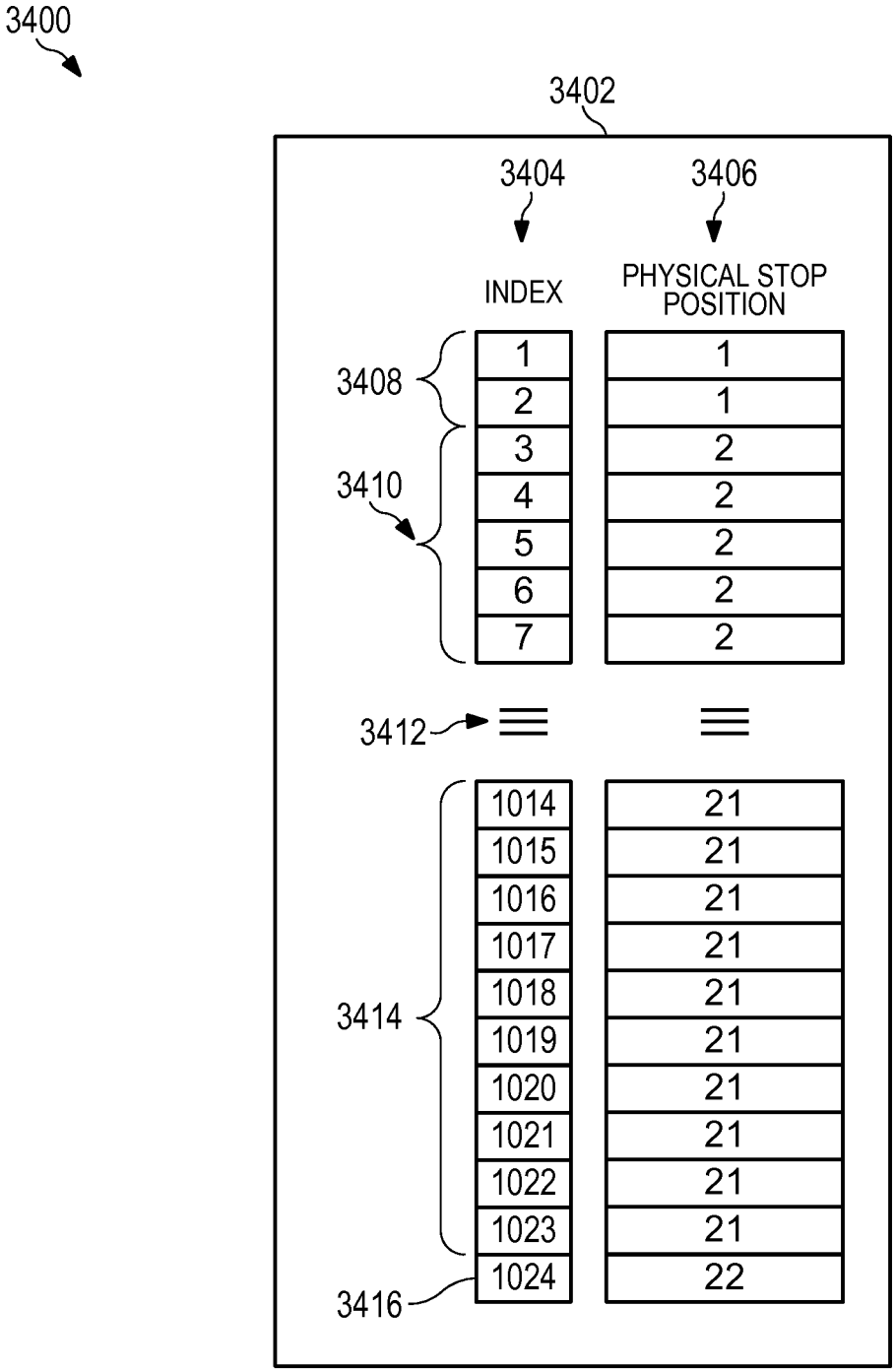
FIG. 34 is another illustration of stacking game play on a gaming device, according to one embodiment.

In FIG. 34, one or more indexes (reference number 3404) may be utilized to generate one or more insertion points for one or more stacking formations. Further, an index may be utilized to generate which stacking formation to be utilized for insertion. In various examples, one or more indexes may be utilized with one or more pattern which may be inserted in one or more reel positions (e.g., either physical or virtual and/or both). For example, a 1014 index may indicate that at reel position 21 (either before or after) that a pattern including A, A, A, K, K, K, A, A, A, A, A, and A should be inserted.

In one example, the system, method, and/or device may select one or more symbols from a plurality of symbols to utilize as a stacking symbol. In one example, there may be a first stacking area (e.g., Q,Q,Q), a second stacking area (e.g., A,K,Q,J), and a third stacking area (e.g., 10,10,10,10, 10) which were filled by utilizing a random selection procedure (e.g., A,K,Q,J,10). In one example, for a first spin the first stacking area and the third stacking area were filled with similar, like, and/or identical symbols whereas, the second stacking area was filled with dissimilar symbols. In one example, for a second spin, the first stack area was not filled with identical symbols (e.g., A,Q,J) because the first stack area was utilized to stack like, similar, and/or identical symbols in a first spin. Further for the second spin, the second stack area was filed with similar, like, and/or identical symbols (e.g., J,J,J,J) because second stack area was not filled with similar, like, and/or identical symbols during a first spin. In addition for the second spin, the third stack area (and/or nth stack area) was not filed with identical symbols (e.g., A,K,Q,J) because the third stack area (and/or the nth stack area) was utilized to stack like, similar, and/or identical symbols in a first spin.

In one example during a third spin (and/or an Nth spin), the first stack area was filled with identical symbols (e.g., A, A, A) because first stack area was not filled with similar, like, and/or identical symbols during a second spin. In addition for third spin, the second stack area not filled with identical symbols (e.g., Q, J, 10, K) because the second stack area was utilized to stack like, similar, and/or identical symbols in a second spin. Whereas, the third stacking area was filled with identical symbols (e.g., K, K, K, K) during a third spin because third stacking area was not filled with identical symbols during spin 2.

Figure 35A:
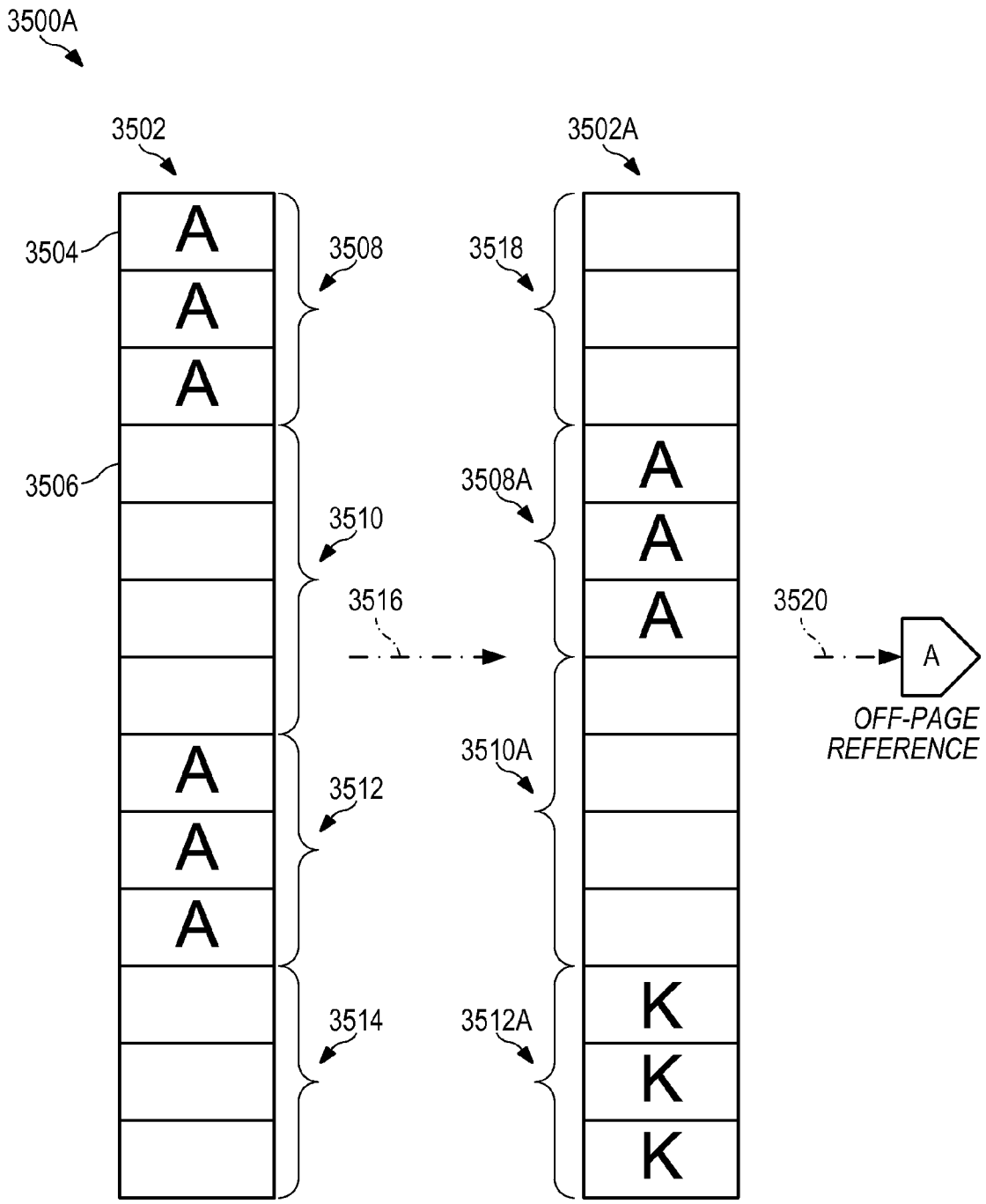
FIG. 35A is another illustration of stacking game play on a gaming device, according to one embodiment.

In one example shown in FIG. 35A, a first reel 3502 may include a first stacking area 3508, a second stacking area 3510, a third stacking area 3512, and an Nth stacking area 3514. In this example, first stacking area 3508 may include three A symbols and third stacking area 3512 may include three A symbols. In this example, second stacking area 3510 and Nth stacking area 3514 may include no stacking symbols. During the second spin, the three A symbols in first stacking area 3508 may be shifted down three reel positions. Further, the three A symbols in the third stacking area 3512 may be shifted down three reel positions. In another example, the first stacking area 3508 and the third stacking area 3512 may be turned on and utilized for a first spin to include the stacking symbols. Further, the second stacking area 3510 and the Nth stacking area 3514 may be turned off and not utilized for a first spin and therefore do not contain any stacking symbols. During a second spin, the first stacking area 3508 and the third stacking area 3512 may be turned off and not utilized (no stacking symbols placed in these locations). Further, the second stacking area 3510 and the Nth stacking area 3514 may be turned on and stacking symbols placed in these areas. In one example, the stacking symbol may vary from a first stacking symbol (e.g., A) to a second stacking symbol (e.g., B) to an Nth stacking symbol (e.g., C).

In another example, the system, method, and/or device may select one or more symbols from a plurality of symbols to utilize as a stacking symbol. In this example, during a first spin a first stack area displays four stacking symbols (e.g., Q,Q,Q,Q) in a first location and a second stack area displays four stacking symbols (e.g., K,K,K,K) in a second location. A stacking area A1 and a stacking area 2A are filled with non-stacking symbols.

Figure 35B:
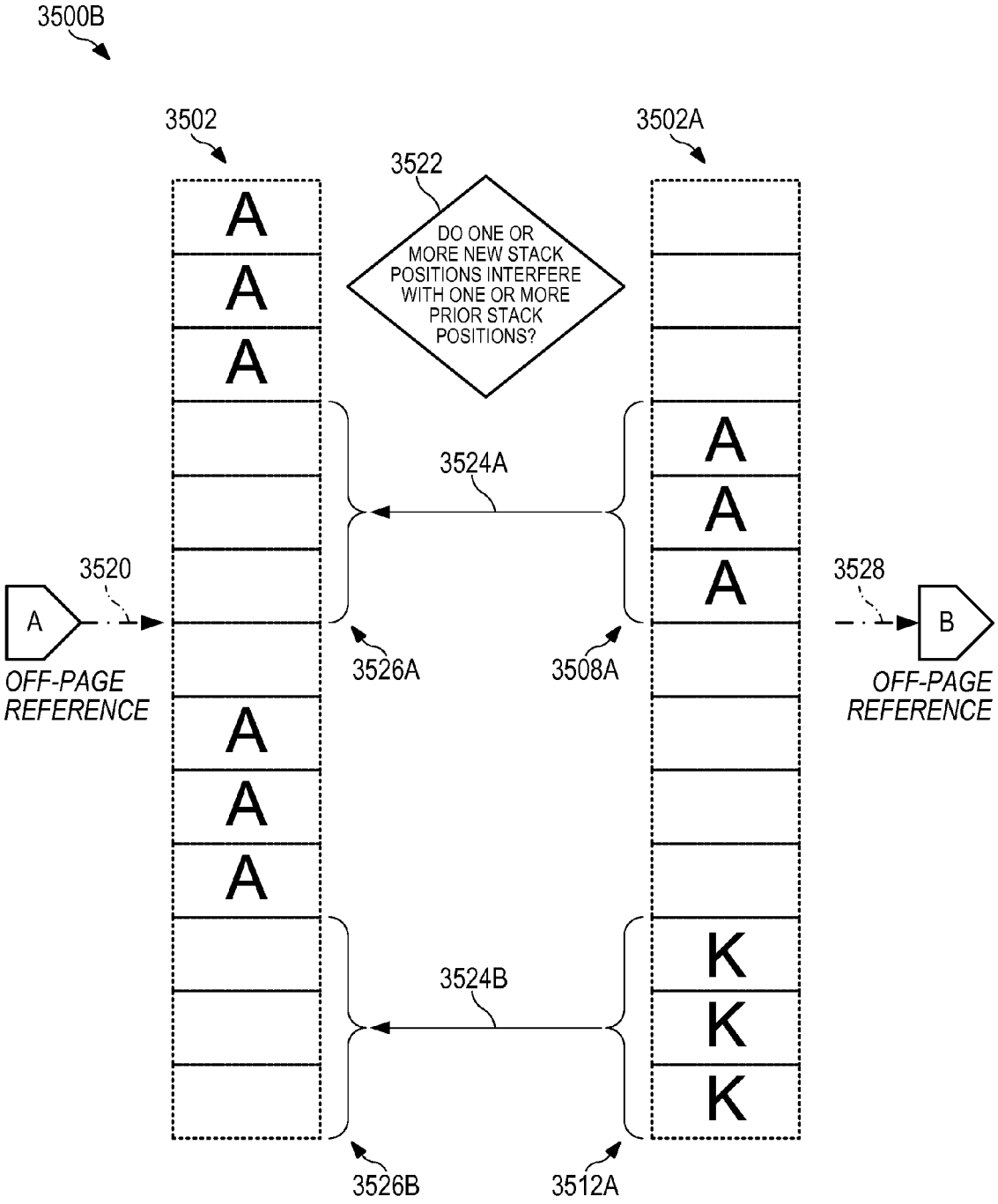
FIG. 35B is another illustration of stacking game play on a gaming device, according to one embodiment.

In FIG. 35B, another illustration of stacking game play on a gaming device is shown, according to one embodiment. At the initiation of game play for a second spin (e.g., and/or before and/or after initiation of the second spin), the first stack and the second stack are shifted by an amount of spaces that will enable the first stack and the second stack (and/or an Nth stack) to be located in positions where no other stacking area was located during the first spin. This may depend on a utilization of a first stacking symbol for a first spin and a second stacking symbol utilized for a second spin. In cases, where the stacking symbols do not change for a first spin to a second spin, no overlapping error occurs because there is no overlapping areas from a first spin to a second spin where the stacking symbols are different. In one example, there may be a validation step to ensure that there is no overlay between a first stack area for a second spin and any other stack area for the first spin. In other words, if two stacking symbols were in reel locations 154 and 155 and three stacking symbols were in reel locations 100, 101, and 102 for a first spin, there would be no stacking symbols in reel locations 100, 101, 102, 154, and 155 for the second spin (but could be if the same stacking symbol is used). In the alternative, there could be one stacking symbol in any of these reel locations but there could not be two or more adjacent symbols in any of these locations.

In another example during a third spin, the first stack and the second stack may go back to the locations utilized for the first spin as long as no other stacking symbols where placed in these locations. In one example, no symbols could be placed in these locations for a second spin, therefore, by moving first stack and the second stack back there could not be any stacking overlay from spin 2 to spin 3 based on no stacking overlay occurring between spin 1 and spin 2.

In another example, a check step is performed to ensure that there is no overlaying stacking symbols from a first spin to a second spin. In this example, a first check step 3524A examines where a first stacking area 3508A is located during a second spin compared to what symbols where placed on these reel positions during a first spin. If there are no overlaying stacking symbols in the first reel area 3526A, then there is no error and the system, device, and/or method may continue. If there are overlaying stacking symbols in the first reel area 3526A, then an error has occurred and the first stacking area 3508A must be moved and/or modified so that there is no overlaying stacking symbols. This may depend on whether different stacking symbols where utilized for the same area for a first spin and a second spin. Overlaying stacking symbols means that during a first spin at a certain reel positions (e.g., 1-5) there are a first stacking symbol (e.g., A) and then during a second spin at one or more (and/or two or more) second stacking symbol (e.g., K) is located in one or more of the same reel positions (e.g., 1-5). It should be noted that the first stacking symbol must be different than the second stacking symbol. If the first stacking symbol (e.g., A) is the same as the second stacking symbol (e.g., A), then there is no error.

In another example, a second check step 3524B (up to an Nth checking step) examines where a second stacking area 3512A (up to an Nth stacking area) is located during a second spin compared to what symbols where placed on these reel positions during a first spin. If there are no overlaying stacking symbols in the second reel area 3512A for a second spin, then there is no error and the system, device, and/or method may continue. If there are overlaying stacking symbols in the second reel area 3526B for the second spin, then an error has occurred and the second stacking area 3512A must be moved and/or modified so that there are no overlaying stacking symbols. Overlaying stacking symbols means that during a first spin at a certain reel positions (e.g., 1-5) there is a first stacking symbol (e.g., A) located in reel positions 1-5 and then during a second spin at one or more (and/or two or more) second stacking symbols (e.g., K) are located in one or more of the same reel positions (e.g., 1-5). For example, reel positions 4-5 which were moved to reel positions 6-7. It should be noted that the first stacking symbol must be different than the second symbol. If the first stacking symbol (e.g., A) is the same as the second stacking symbol (e.g., A), then there is no error.

Figure 35C:
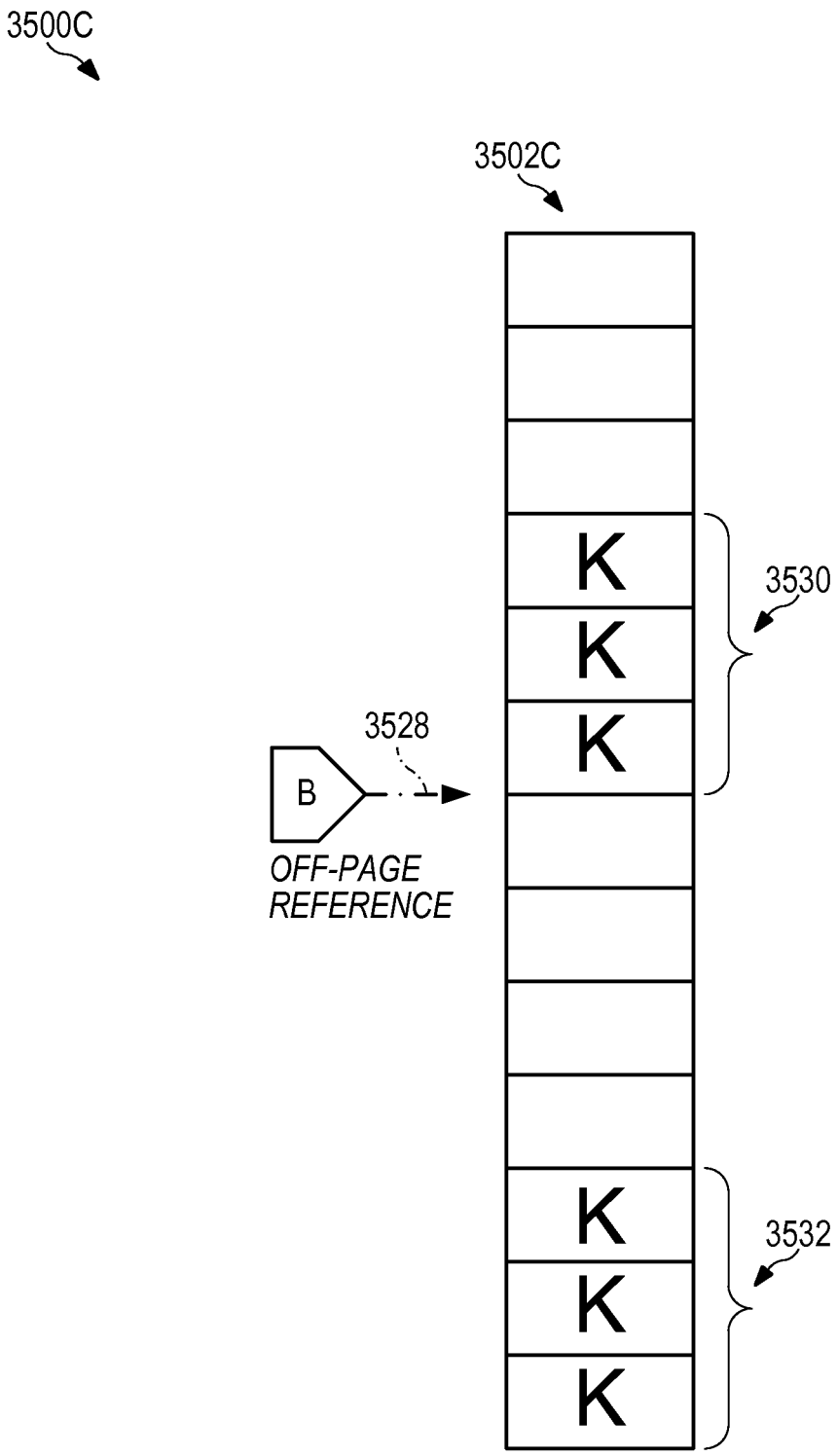
FIG. 35C is another illustration of stacking game play on a gaming device, according to one embodiment.

In FIG. 35C, another illustration of stacking game play on a gaming device is shown, according to one embodiment. In this example, the system, method, and/or device may select one or more symbols from a plurality of symbols to utilize as a stacking symbol. In this example, a first stacking area (e.g., stack 1—3530) may include three stacking symbols (e.g., K, K, K) and a second stacking area (e.g., stack 2—3532) may include three stacking symbols (e.g., K, K, K) during a first spin. After the first spin, the system, device, and/or method may shift stack 1 (3530) and stack 2 (3532) down while checking to make sure that no stacks from spin 1 were in the shifted locations for stack 1 (3530) and stack 2 (3532).

Figure 35D:
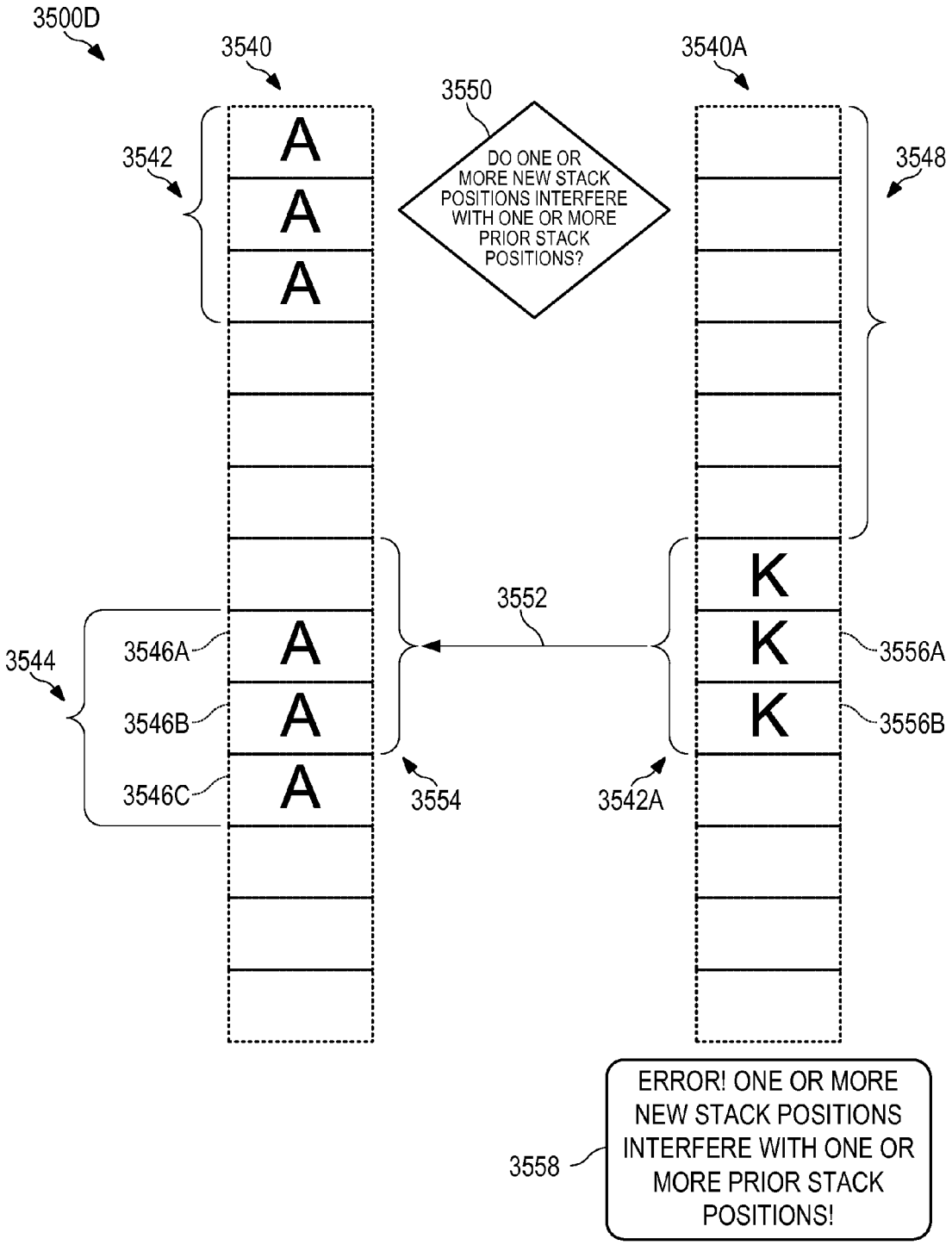
FIG. 35D is another illustration of stacking game play on a gaming device, according to one embodiment.

In FIG. 35D, another illustration of stacking game play on a gaming device is shown, according to one embodiment. In this example, the system, method, and/or device may select one or more symbols from a plurality of symbols to utilize as a stacking symbol. In this example, during the check step it was determined that stack 1 (3542—A, A, A) was moved to stack 3 (3542A—K, K, K) location for spin 1 (which conflicts with stack 2—3544—A, A, A). It may be determined that it was the entire position of stack 2 and/or a portion thereof (in this case, the last two kings (e.g., K). If this occurs, an error message may occur and/or the system, device, and/or method may determine if stack 1 (3542—A, A, A) is in a location of a previous stack on the first spin. If the answer is yes, then stack 3 may be moved to a new location where there is no stack overlay from spin 1 to spin 2. If the answer is no, then the method may continue and check the next stack location and/or initiate spin 2.

Figure 35E:
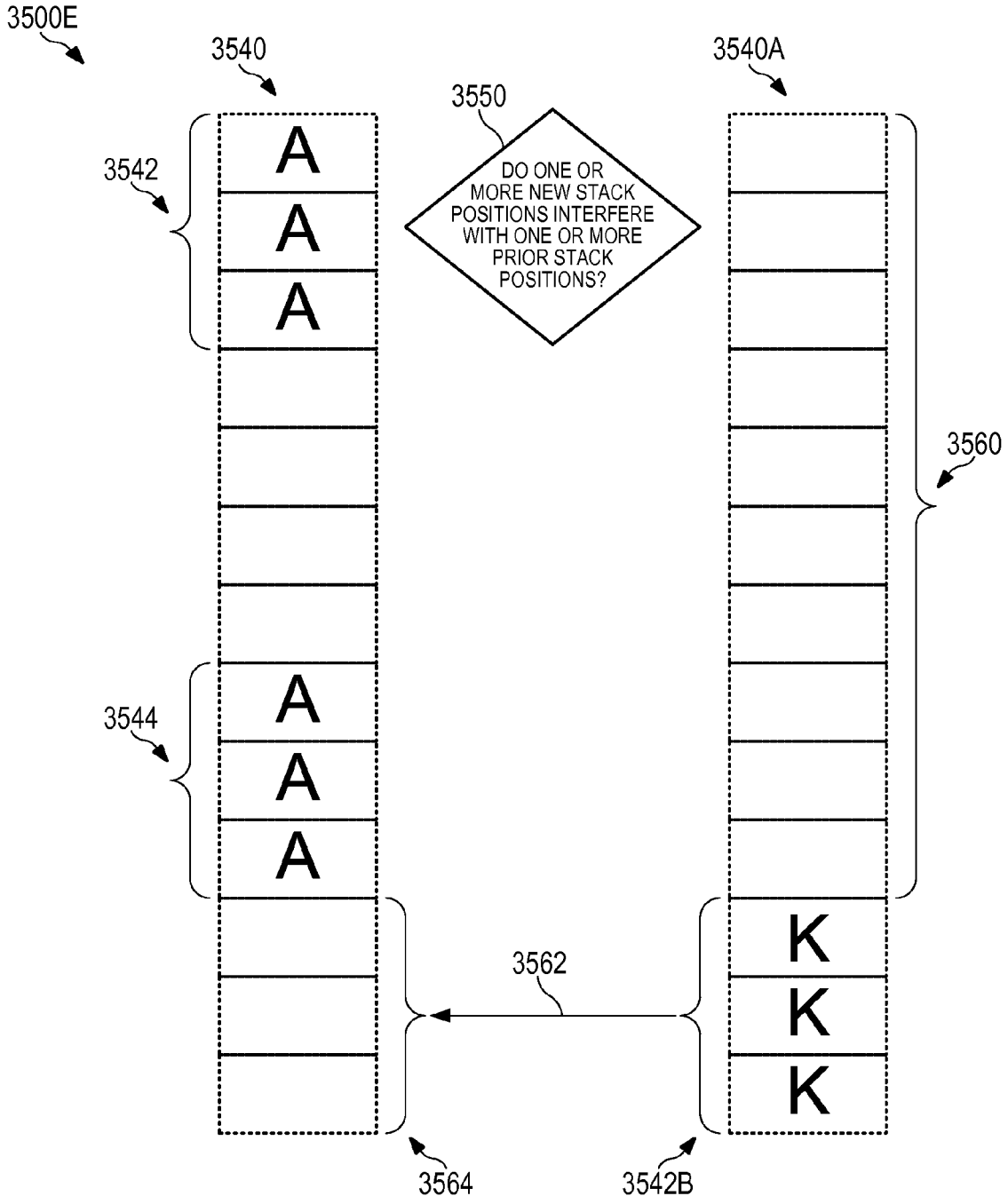
FIG. 35E is another illustration of stacking game play on a gaming device, according to one embodiment.

In another example shown in FIG. 35E, a third check step 3562 examines a fourth stacking area 3542B location during a second spin compared to what symbols where placed on these reel positions during a first spin. If there are no overlaying stacking symbols in fourth stacking area 3542B, then there is no error and the system, device, and/or method may continue. If there are overlaying stacking symbols in fourth stacking area 3542B, then an error has occurred and fourth stacking area 3542B must be moved and/or modified so that there are no overlaying stacking symbols. Overlaying stacking symbols means that during a first spin at a certain reel positions (e.g., 1-5) there are first stacking symbols (e.g., A) and then during a second spin at one or more (and/or two or more) second stacking symbol (e.g., K) is located in one or more of the same reel positions (e.g., 1-5). It should be noted that the first stacking symbol must be different than the second symbol. If the first stacking symbol (e.g., A) is the same as the second stacking symbol (e.g., A), then there is no error.

Figure 35F:
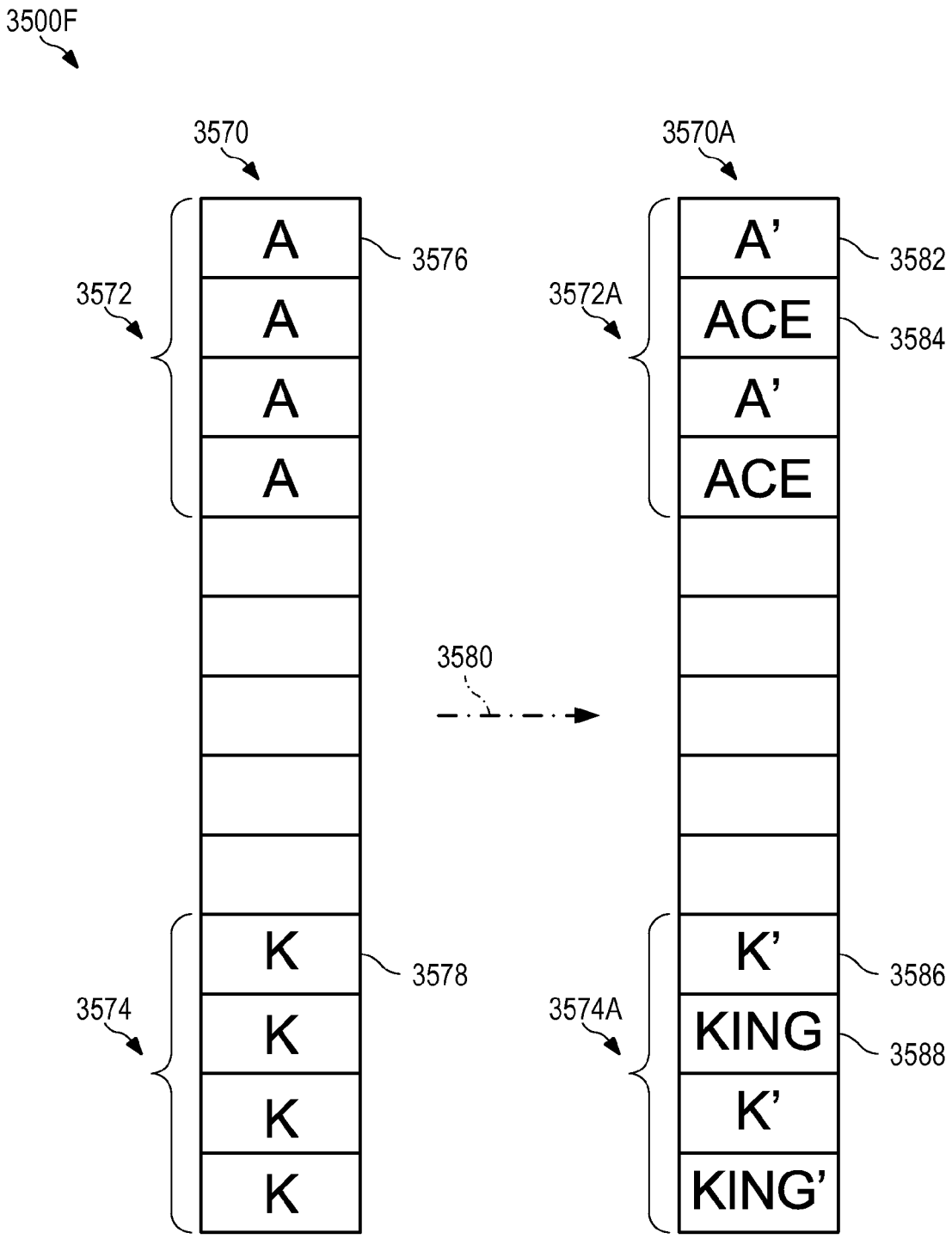
FIG. 35F is another illustration of stacking game play on a gaming device, according to one embodiment.

In FIG. 35F, another illustration of stacking game play on a gaming device is shown, according to one embodiment. In this example, the system, method, and/or device may select one or more symbols from a plurality of symbols to utilize as a stacking symbol. In this example, a first stacking area 3572 may include four stacking symbols (e.g., A, A, A, A) and a Nth stacking area 3574 may include four stacking symbols (e.g., K, K, K, K) during a first spin. To eliminate any repeating stacking symbols in the first stacking area and/or the second stacking area during a second spin, the symbols in the first stacking area may be modified so that they are not identical but are related. For example, the first stacking area may now include an A, ACE, A, ACE symbols which are related but are not identical and are not stacking symbols for a second spin. Whereas, the second stacking area may now include a K, KING, K', and KING' symbols.

Figure 36A:
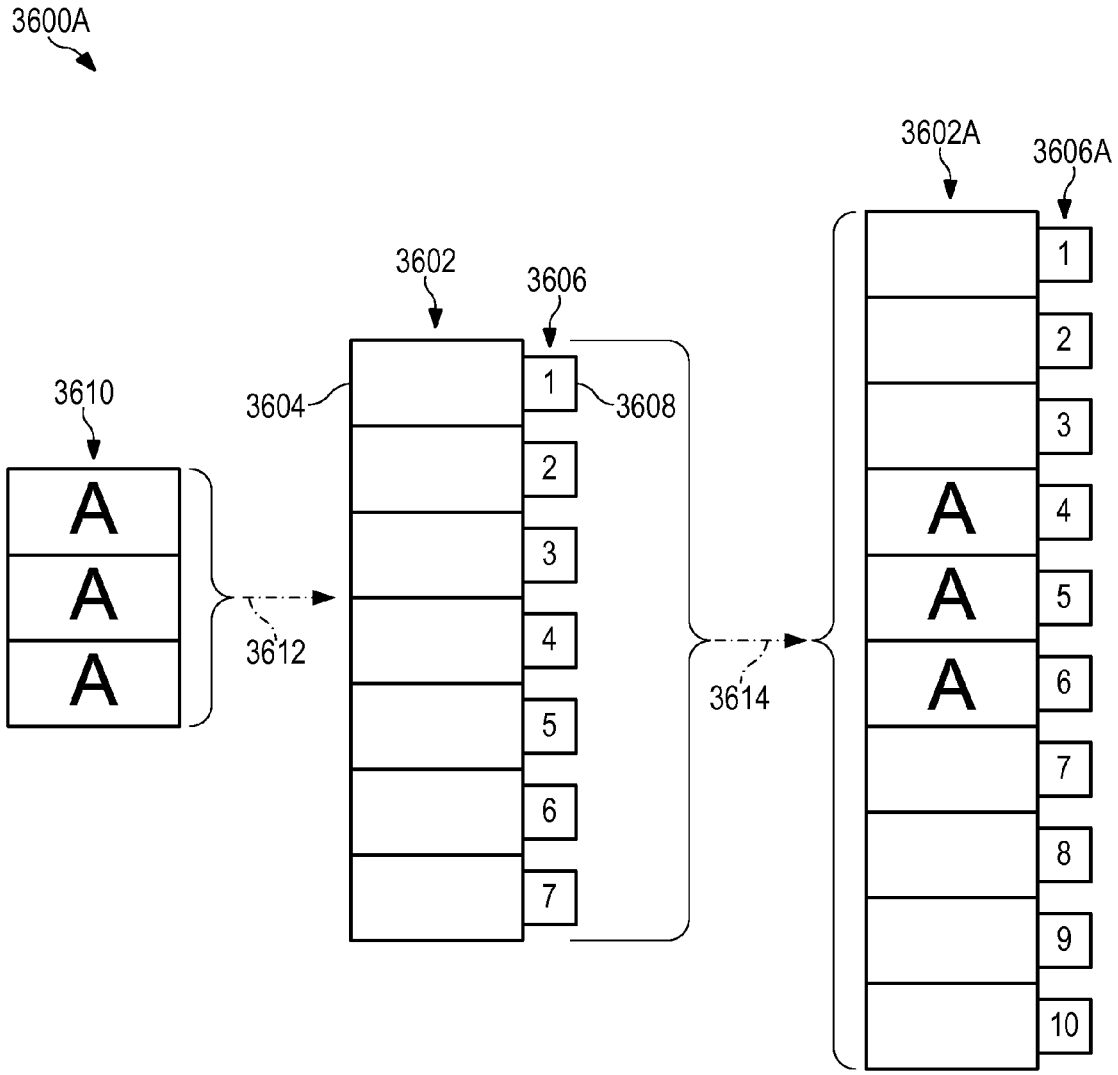
FIG. 36A is another illustration of stacking game play on a gaming device, according to one embodiment.

In FIG. 36A, another illustration of stacking game play on a gaming device is shown, according to one embodiment. In this example, a portion of the reel area is shown with 7 reel positions (e.g., 1-7). In this example, the system, device, and/or method may determine that a stack of three symbols should be inserted after reel position 3 but before reel position 4. The system, device, and/or method may check to see if the start position for the inserted stack, the end position of the inserted stack, and/or any other position for the inserted stack was part of a stack on the previous spin. If one or more of the potential locational positions for the inserted stack has a common position (e.g., one position in common) with a stack from the last spin (e.g., the answer was yes), then the system, device, and/or method may modify the inserted stack so that the modified inserted stack does not include any previous stack locations and/or one or more new locations may be selected for the inserted stack and/or the same stacking symbol from the previous spin may be utilized. These new locations would need to be validated to ensure that there are no common positions for the inserted stack and any stack from the previous spin (assuming different stacking symbols being utilized in the same stacking areas from a first spin to a second spin). In an alternative embodiment, the inserted stack may be allowed to have one common position with a stack from the previous spin. If there are no common positions for the inserted stack and any stack on the most recent spin, then the system, device, and/or method may insert/locate/display/utilize the inserted stack in the next spin.

It should be noted that the system, device, and/or method may determine the number of stacks to insert, the number of symbols for each inserted stack, the locations of one or more stacks, the symbol and/or symbols utilized for each stack, a stacking pattern, and/or any other data relating to the stacking areas and/or stacking symbols.

In this example, during a first spin, three stacking symbols (e.g., A, A, A) have been inserted and now occupy reel position locations 4, 5, and 6 respectfully. After the first spin, these three stacking symbols (e.g., A, A, A) are removed and a new location for insertion is determined. In this example, the insertion was selected to be after reel stop position 7. The system, device, and/or method may determine that an Ace symbol should be utilized and that 5 symbols should be utilized, which may be selected via one or more random selection methods (e.g., a look-up table, a multi-dimensional matrix, etc.). In this example, the system, device, and/or method may validate the stacking area position by determining whether any stacking symbol where located in any of these positions on the previous spin (e.g., spin 1). If one or more stacking symbols for spin 1 were in one or more of these inserted stacking symbol positions for spin 2, then the system, device, and/or method may modify the new inserted stacking symbol positions, the number of stacking symbols, and/or any other criteria to ensure that the new inserted stacking symbols positions do not overlay with any (and/or only one symbol location) previous stacking symbol positions unless the same stacking symbol from the previous spin is utilized for the subsequent spin.

In one example, the reel may include a base reel area and an extended reel area. In one example, a first game play may include a first stacking area (e.g., where stacking symbols are positioned) at a first location and a second stacking area at a second location which are both located in a base reel area. Further, an extended reel area may include a third added stack (e.g., the third added stack is generated and inserted in the reel playing area in the extended reel area), a fourth added stack, and/or an Nth added stack. During a first spin, a base reel area may include a first stacking area (e.g., where stacking symbols are positioned) at a first location; a second stacking area at a second location; and/or an Nth stacking area located on the base reel area while the extended reel area may include a third added stack (e.g., the third added stack is generated and inserted in the reel playing area in the extended reel area); a fourth added stack, and/or an Nth added stack.

During a second spin, the extended reel area may be removed and/or left blank while non-stacking symbols may be located in the first location and the second location. The first stacking area may be relocated and/or moved to a third position (e.g., 1A location) and the second stacking area may be relocated and/or moved to a fourth position (e.g., 2A location) within the base reel area. In another example, the extended reel area may be utilized to insert one or more stacking areas with a check step to verify that the new one or more inserted stacks is not in a locational position where one or more stacking symbols where located during the previous spin.

During a third spin, a base reel area may include a first stacking area (e.g., where stacking symbols are positioned) at a first location; a second stacking area at a second location; and/or an Nth stacking area located on the base reel area while the extended reel area may include a third added stack (e.g., the third added stack is generated and inserted in the reel playing area in the extended reel area); a fourth added stack, and/or an Nth added stack.

In these examples and/or all of the examples disclosed in this disclosure, a validation step and/or check step may be implemented which verifies that a stack utilized for the current spin is not in a location where one or more stacking symbols from the previous spin where located.

Figure 36B:
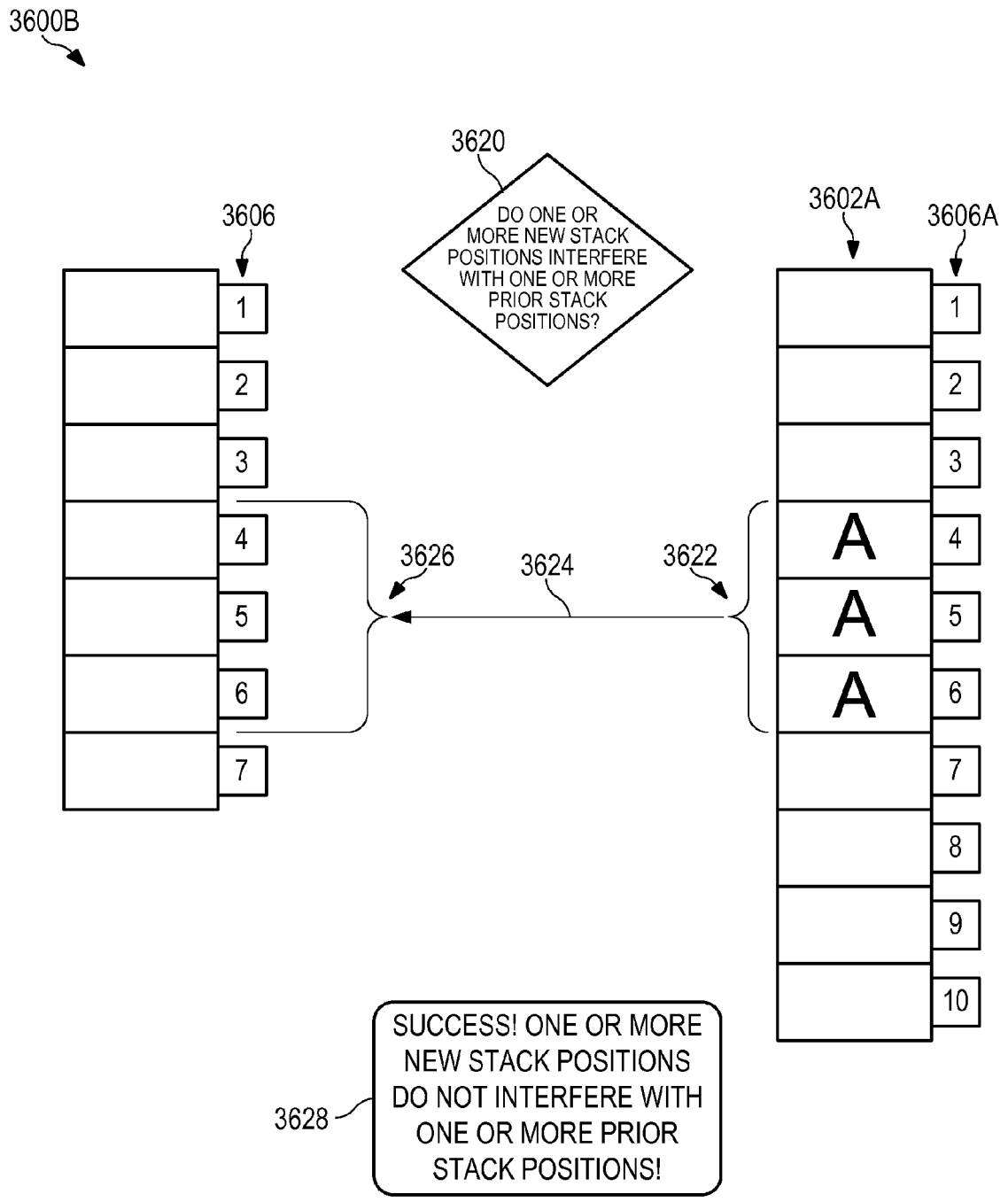
FIG. 36B is another illustration of stacking game play on a gaming device, according to one embodiment.

In another example shown in FIG. 36B, the three A symbols were placed after reel position 3. These three A symbols formed a stacking area 3622. In one example, a check step 3624 was initiated to confirm that there were no stacking symbols located in reel positions 4-6 during the first spin and/or base spin—if there were no stacking symbols located in reel positions 4-6, then the method may continue without any errors. In another example, the check step 3624 was initiated to confirm that there were no different stacking symbols located in reel positions 4-6 during the first spin and/or base spin. For example, if there were A located in reel positions 4-6, then there would be no error because the same stacking symbols were utilized in reel positions 4-6 during both the first spin and the second spin. For example, the method may determine whether one or more new stacking positions interfere (e.g., overlay, overlapping, etc.) with one or more prior stacking positions. Further, the method may determine that there has been success when one or more stacking positions do not interfere with one or more prior stacking positions.

Figure 36C:
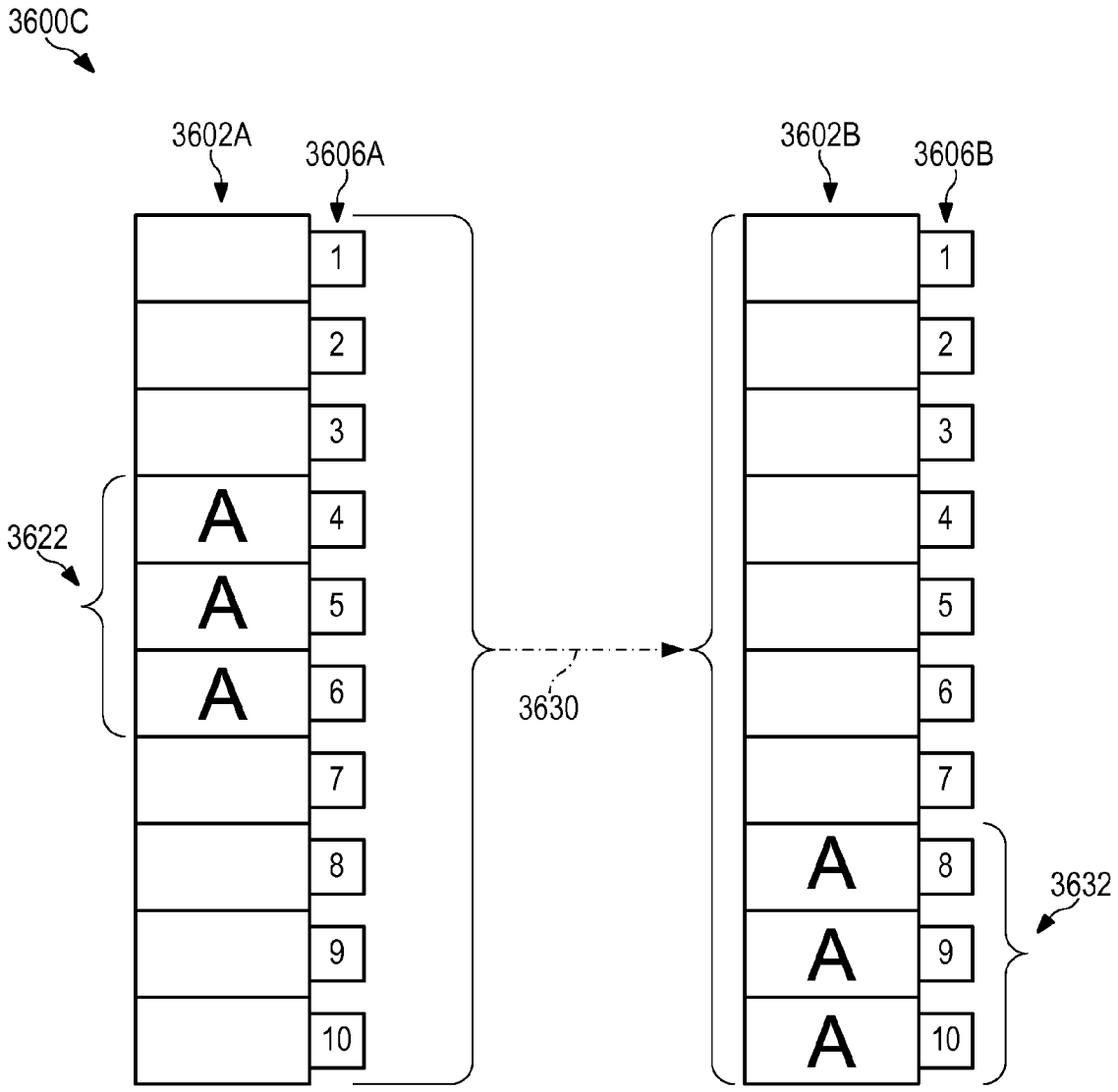
FIG. 36C is another illustration of stacking game play on a gaming device, according to one embodiment.

In another example shown in FIG. 36C, during a first spin the reel 3602A may have a first stacking area 3622 located at reel positions 4-6 but during a second spin the reel 3602B may have a second stacking area 3632 located at reel positions 8-10.

Figure 36D:
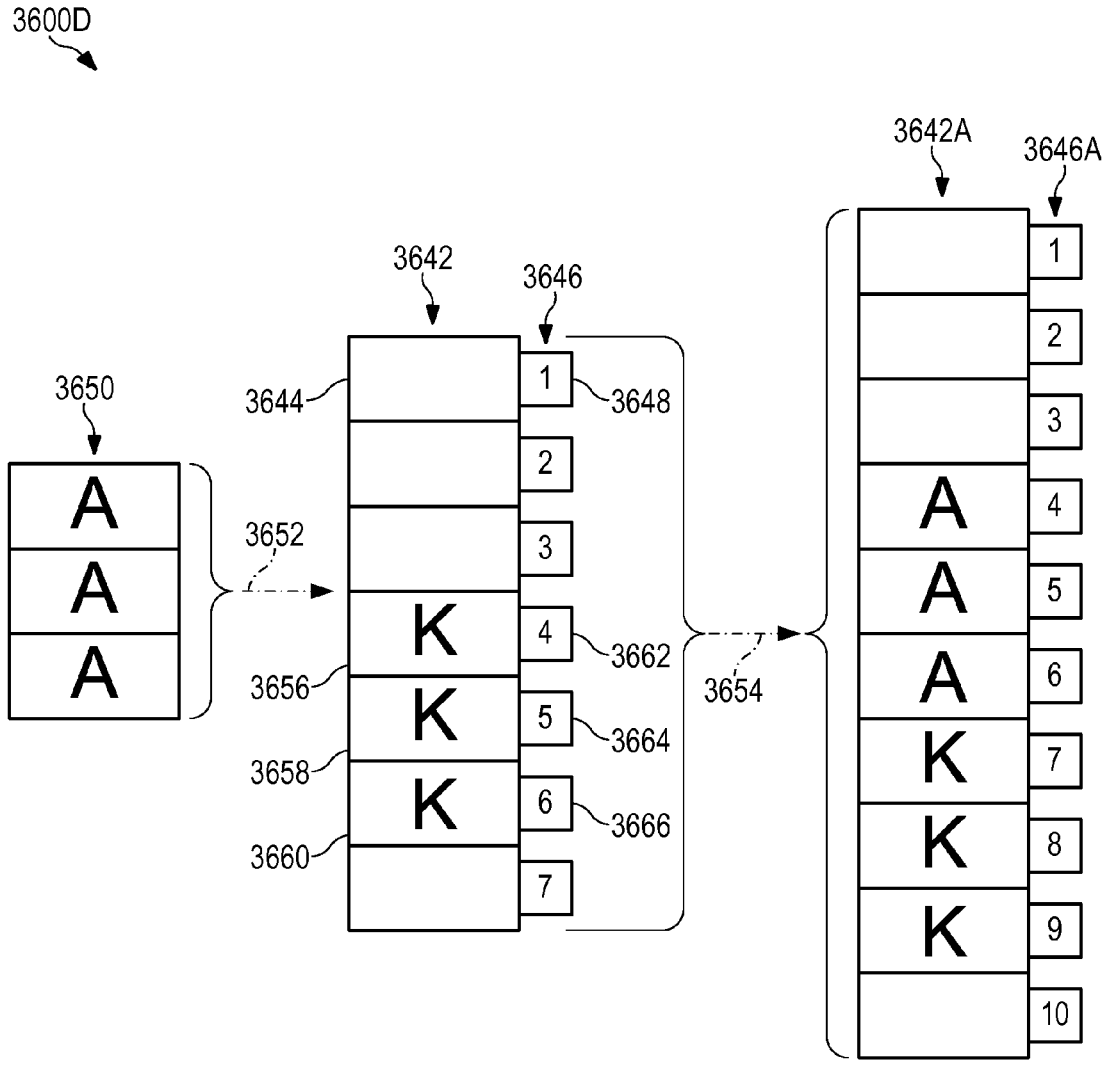
FIG. 36D is another illustration of stacking game play on a gaming device, according to one embodiment.
Figure 36E:
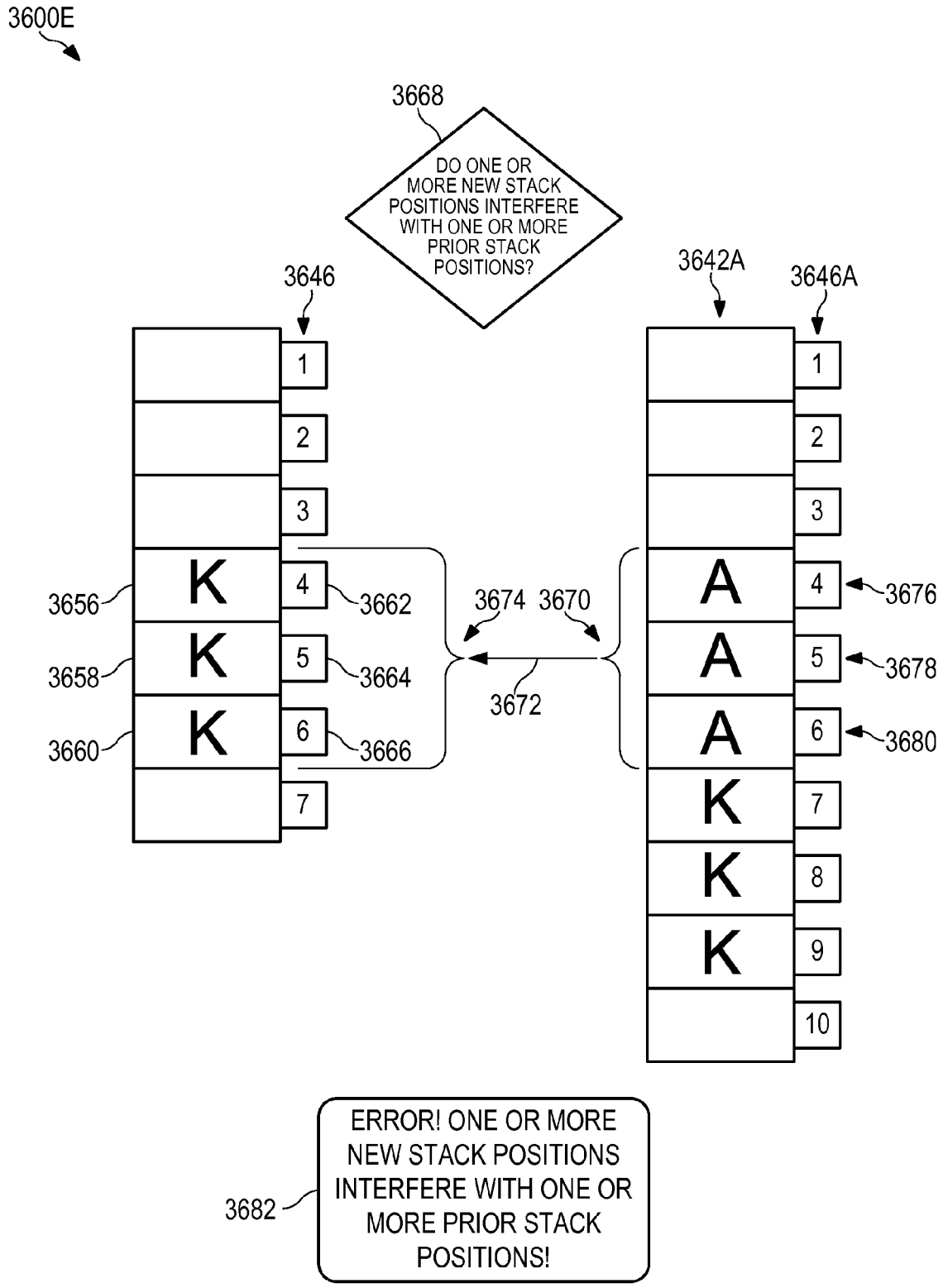
FIG. 36E is another illustration of stacking game play on a gaming device, according to one embodiment.
Figure 36F:
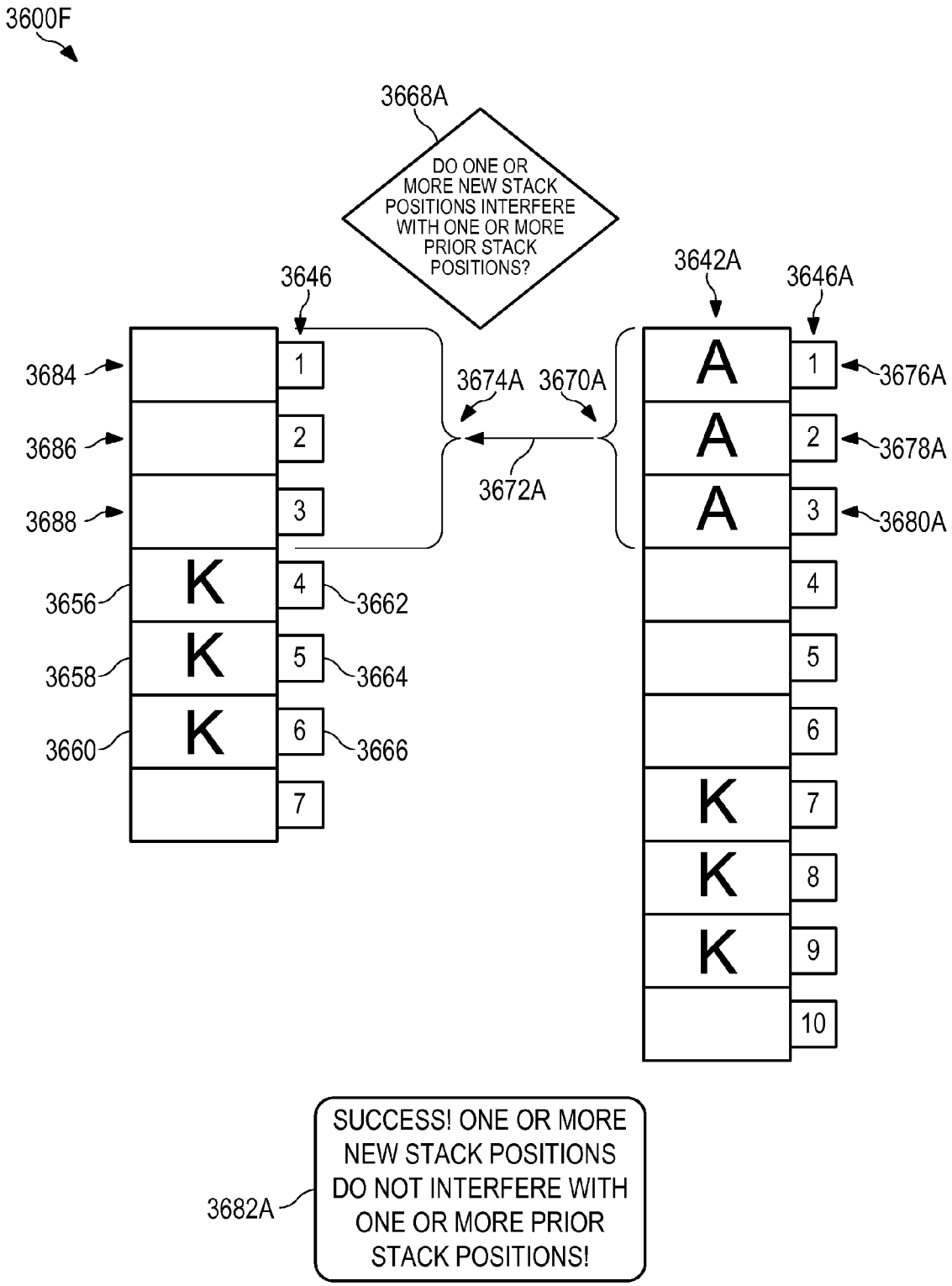
FIG. 36F is another illustration of stacking game play on a gaming device, according to one embodiment.

In another example shown in FIG. 36D, during a first spin the reel 3642 includes a first stacking formation (e.g., K, K, K) located at reel positions 4-6. In this example, the first stacking formation (e.g., K, K, K) was moved down to reel positions 7-9 and a second stacking formation (e.g., A, A, A) may be inserted into reel positions 4-6. In another example shown in FIG. 36E, a check step 3672 is implemented which indicates that an error has occurred. In this example, the three A symbol formation (second stacking formation) utilized in spin 2 overlays with the first stacking formation (e.g., K, K, K). Therefore, an error has occurred because there is a first stacking formation located at a first position during a first spin which overlays with a second stacking formation located at a second position during a second spin. There are two problems which are that two different stacking symbols were utilized during a first spin to a second spin. The second problem is that these different stacking symbols are located in overlaying positions from first spin to second spin.

In this example, this error may be fixed by moving the second stacking formation (e.g., A, A, A) to reel positions 1-3 which would have no overlaying positions between the first spin to the second spin. Further, one or more stacking symbols may be changed so that no overlapping areas with different symbols from a first spin to a second spin occurs.

Figure 36G:
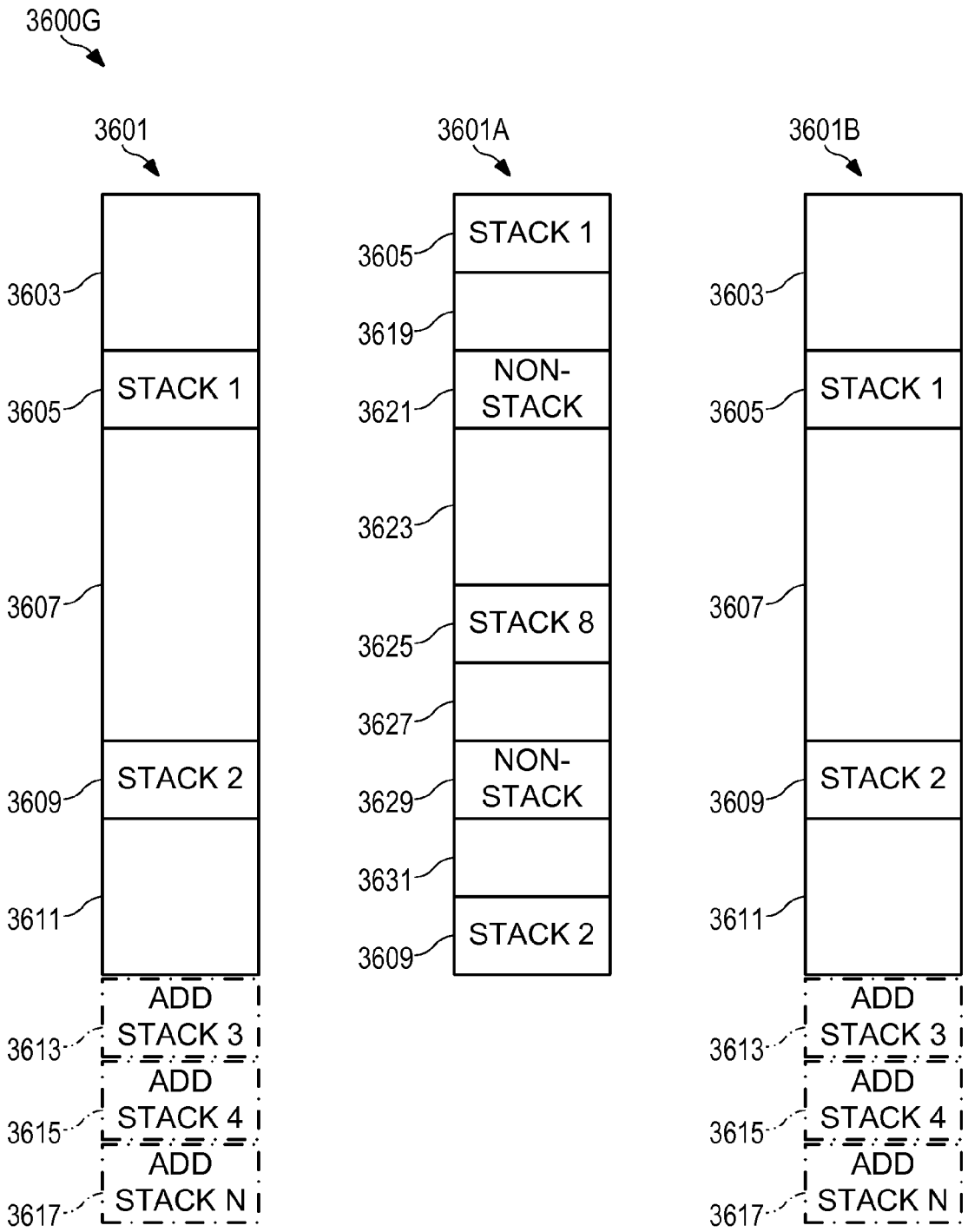
FIG. 36G is another illustration of stacking game play on a gaming device, according to one embodiment.

In another example shown in FIG. 36G, another illustration of stacking game play on a gaming device is shown, according to one embodiment. In this example, the reel may include a base reel area and an extended reel area. In one example, a first game play may include a first stacking area 3605 (e.g., where stacking symbols are positioned) at a first location and a second stacking area 3609 at a second location which are both located in a base reel area. Further, an extended reel area (3613, 3615, and 3617) may include a third added stack 3613 (e.g., the third added stack is generated and inserted in the reel playing area in the extended reel area), a fourth added stack 3615, and/or an Nth added stack 3617. Further, the base reel area may include a first non-stacking area 3603, a second non-stacking area 3607, and an Nth non-stacking area 3611. During a first spin, a base reel area may include a first stacking area 3605 (e.g., where stacking symbols are positioned) at a first location; a second stacking area 3609 at a second location; and/or an Nth stacking area (not shown) located on the base reel area while the extended reel area may include a third added stack 3613 (e.g., the third added stack is generated and inserted in the reel playing area in the extended reel area); a fourth added stack 3615, and/or an Nth added stack 3617.

During a second spin, the extended reel area may be removed and/or left blank while non-stacking symbols may be located in the first location and the second location. The first stacking area 3605 may be relocated and/or moved to a new position and the second stacking area 3609 may be relocated and/or moved to a new position within the base reel area. Further, a third stacking area 3625 may be located in a position that does not overlap any reel positions that the first stacking area 3605 and the second stacking area 3609 utilized during the first spin. In another example, the extended reel area may be utilized to insert one or more stacking areas with a check step to verify that the new one or more inserted stacks is not in a locational position where one or more stacking symbols where located during the previous spin.

During a third spin, a base reel area may include a first stacking area 3605 (e.g., where stacking symbols are positioned) at a first location (e.g., same as used during the first spin); a second stacking area 3609 at a second location; and/or an Nth stacking area located on the base reel area while the extended reel area may include a third added stack 3613 (e.g., the third added stack is generated and inserted in the reel playing area in the extended reel area); a fourth added stack 3615, and/or an Nth added stack 3617. In one example, reference areas 3603, 3607, and 3611 have non-stacking symbols, such as, S1, S2, S3, etc. located in their respective areas. In other words, in these areas 3603, 3607, and 3611 do not have two adjacent symbols which are identical.

In these examples and/or all of the examples disclosed in this disclosure, a validation step and/or check step may be implemented which verifies that a stack utilized for the current spin is not in a location where one or more stacking symbols from the previous spin where located.

Figure 37:
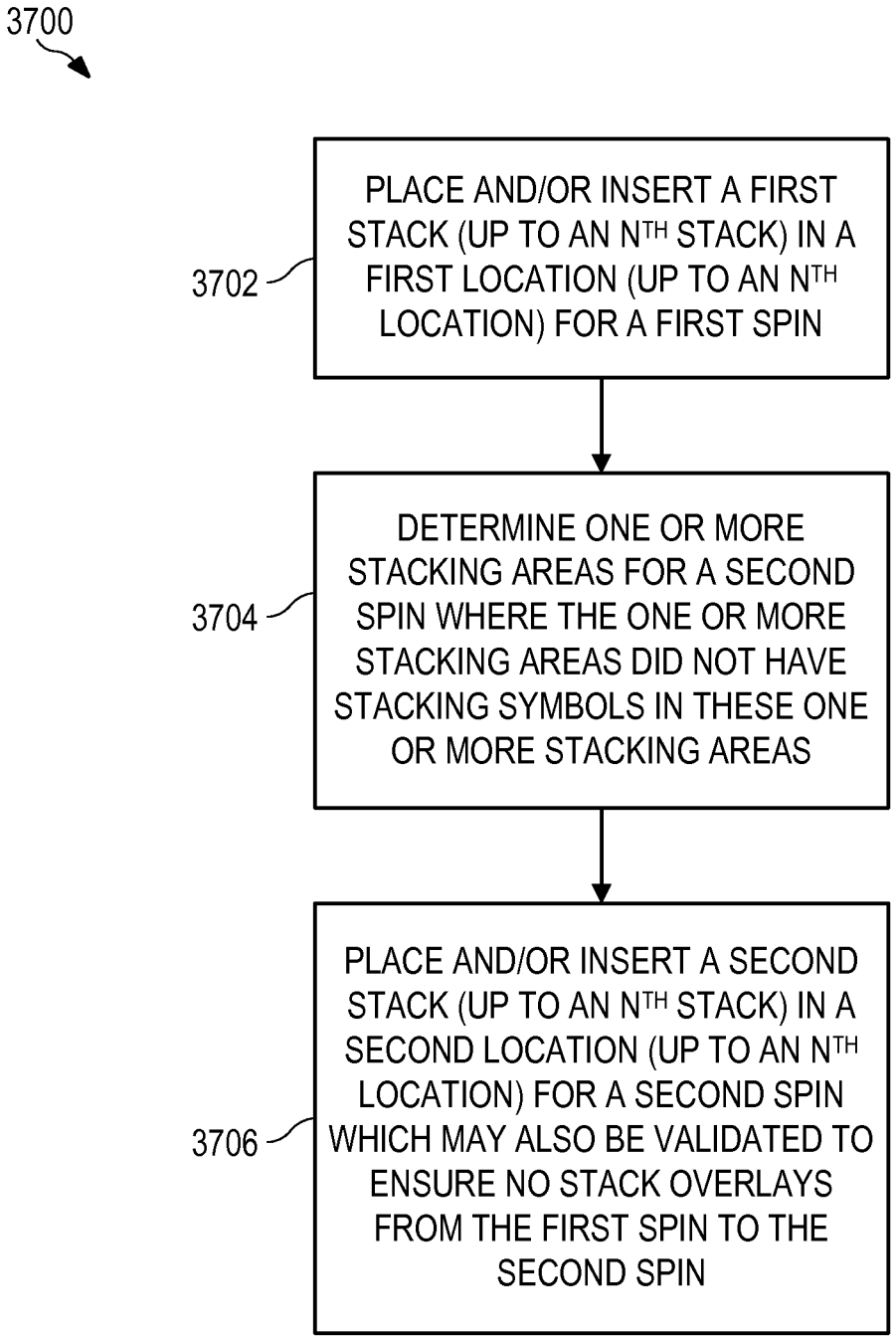
FIG. 37 is a flow diagram for game play, according to one embodiment.

In FIG. 37, a game play flow diagram is shown, according to one embodiment. The method may include placing and/or inserting a first stack (and/or up to an Nth stack) in a first location (and/or up to an Nth location) for a first spin (step 3702). The method may include determining one or more stacking areas for a second spin where the one or more stacking areas did not have stacking symbols in these one or more stacking areas during a first spin when the stacking symbols changed (step 3704). The method may include placing and/or inserting a second stack (and/or up to an Nth stack) in a second location (and/or up to an Nth location) for a second spin which may also be validated to ensure that no stack overlays have occurred from the first spin to the second spin (step 3706).

In one example, a first stacking area (e.g., 4 units) may be inserted/placed at reel positions 4-7, a second stacking area (e.g., 10 units) may be inserted/placed at reel positions 20-29, and a third stacking area (e.g., 5 units) may be inserted/placed at reel positions 100-104 for a first spin. The system, device, and/or method may then determine where to place/insert stacking areas for a second spin that do not overlap with the stacking areas utilized during the first spin. For example, if four A symbols were utilized for the first stacking area, then no stacking symbols which are different than the A symbol may be utilized for reel positions 4-7 during a second spin. In another example, if 10 K symbols were utilized for the second stacking area, then no stacking symbols which are different than the K symbol may be utilized for reel positions 20-29. However, the K symbol may be utilized for reel positions 20-29 during the second spin without an error occurring because the stacking symbol would not have changed. In other words, the K for a first spin remained constant and stayed as a K for a second spin.

Figure 38:
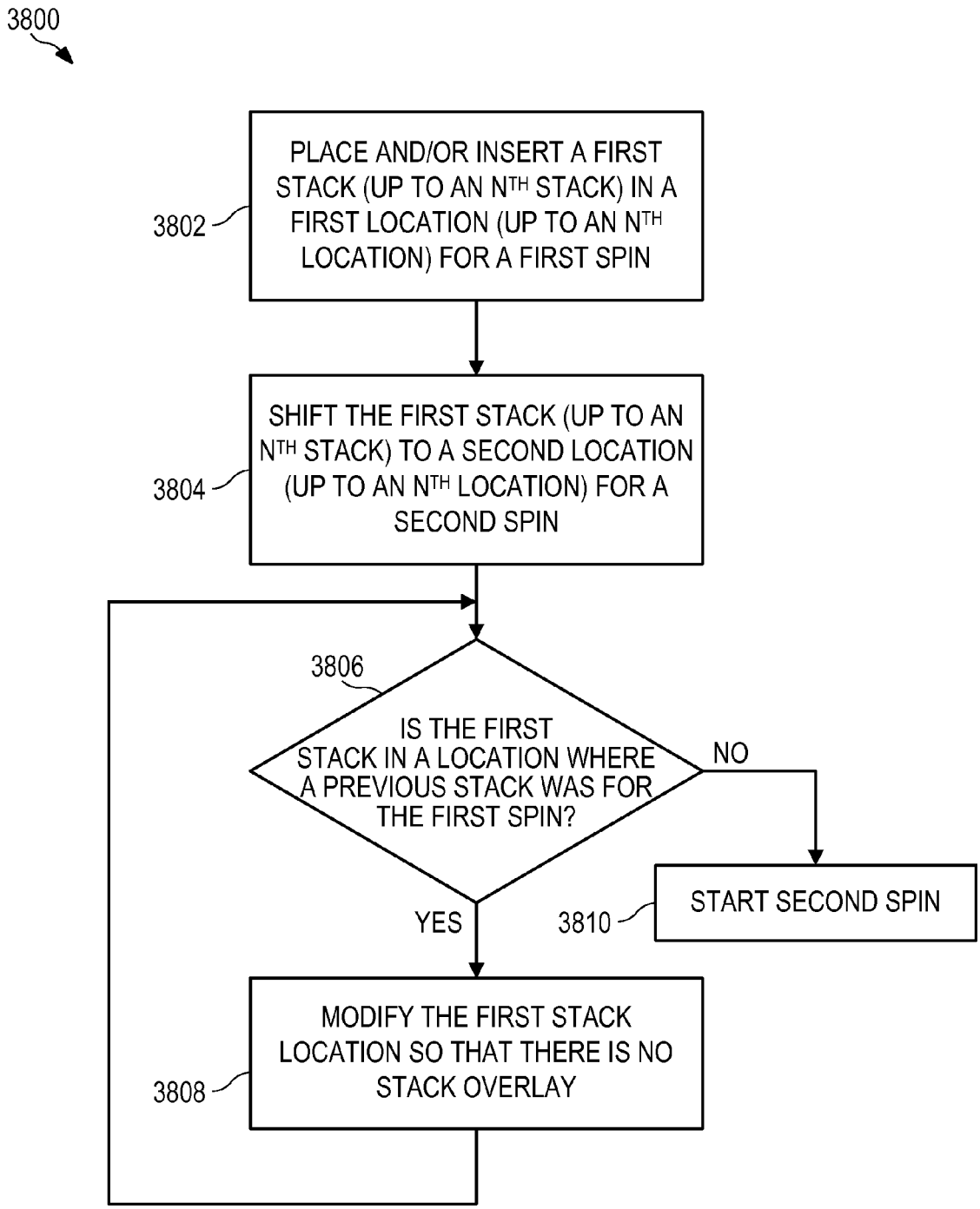
FIG. 38 is a flow diagram for game play, according to one embodiment.

In FIG. 38, a game play flow diagram is shown, according to one embodiment. The method may include placing and/or inserting a first stack (and/or up to an Nth stack) in a first location (and/or up to an Nth location) for a first spin (step 3802). The method may include shifting the first stack (and/or up to an Nth stack) to a second location (and/or up to an Nth location) for a second spin (step 3804). The method may include one or more processors determining whether the first stack with a first stacking symbol is in a location where a previous stack with a second and/or a different stacking symbol was for the first spin (step 3806). If the answer is no, then the method may start a second spin (step 3810). If the answer is yes, then the method may modify the moved first stack location for the second spin so that there is no stack overlay (step 3808).

In one example, a first stack (e.g., 3 Aces—A, A, A) may be located in reel positions 4, 5, and 6; a second stack (e.g., 5 Kings—K, K, K, K, K) may be located in reel positions 20, 21, 22, 23, and 24; a third stack (e.g., Ten 10—10, 10, 10, 10, 10, 10, 10, 10, 10, 10) may be located in reel positions 100, 101, 102, 103, 104, 105, 106, 107, 108, and 109; and an Nth stack (e.g., 6 Queens—Q, Q, Q, Q, Q, Q) may be located in reel positions 50, 51, 52, 53, 54, and 55 for a first spin. Further for this example, first stack (e.g., 3 Aces—A, A, A) may be shifted to reel positions 98, 99, and 100; a second stack (e.g., 5 Kings—K, K, K, K, K) may be shifted to reel positions 108, 109, 110, 111, and 112; a third stack (e.g., Ten 10—10, 10, 10, 10, 10, 10, 10, 10, 10, 10) may be shifted to reel positions 5, 6, 7, 8, 9, 10, 11, 12, 13, and 14; and an Nth stack (e.g., 6 Queens—Q, Q, Q, Q, Q, Q) may be shifted to reel positions 18, 19, 20, 21, 22, and 23 for a second spin. In this example, all of these shifting operations results in an error (four errors in total) because all of the stacks (e.g., first stack, second stack, third stack, and Nth stack) are located in positions for the second spin which overlap with stacking areas utilized for the first spin.

For example, a first error occurred because the first stack (e.g., 3 Aces—A, A, A) was shifted to reel positions 98, 99, and 100 for a second spin but reel position 100 was utilized for third stack (e.g., Ten 10—10, 10, 10, 10, 10, 10, 10, 10, 10, 10 located at in reel positions 100, 101, 102, 103, 104, 105, 106, 107, 108, and 109) for the first spin. Therefore, this error needs to be corrected. In various examples, this correction may be implemented via moving the first stack, shortening the first stack, inserting symbols to remove the overlapping areas, changing the symbols, and/or any combination thereof. Further, the first stack may be expanded depending on any other modification made to first stack. In this example, to correct this error, first stack was shortened to 2 Aces (e.g., A, A) which are located in reel positions 98 and 99. Based on this modification, there are no longer any overlapping stacking positions for first stack from the first spin to the second spin. It should be noted that an overlay of one unit (e.g., on stacking area) may not generate an error if one unit is not considered a stacking area in and of itself. In another example, the error may be corrected by transforming one or more of the stacking symbols used for the second spin into compliant symbols (e.g., first stacking symbol used for first spin, non-stacking symbols, etc.).

For example, a second error occurred because the second stack (e.g., 5 Kings—K, K, K, K, K) was shifted to reel positions 108, 109, 110, 111, and 112 for a second spin but reel positions 108 and 109 were utilized for third stack (e.g., Ten 10—10, 10, 10, 10, 10, 10, 10, 10, 10, 10, 10 located at in reel positions 100, 101, 102, 103, 104, 105, 106, 107, 108, and 109) for the first spin. Therefore, this error needs to be corrected. In various examples, this correction may be implemented via moving the second stack, shortening the second stack, inserting symbols to remove the overlapping areas, changing the stacking symbols, and/or any combination thereof. Further, the second stack may be expanded depending on any other modification made to second stack. In this example, to correct this error, second stack was moved by two reel positions and expanded by five units (now a total of 10 stacking symbols from 5 stacking symbols for the first spin) which are now located in reel positions 110, 111, 112, 113, 114, 115, 116, 117, 118, and 119. Based on this modification, there are no longer any overlapping stacking positions for second stack from the first spin to the second spin.

For example, a third error occurred because the third stack (e.g., Ten 10—10, 10, 10, 10, 10, 10, 10, 10, 10, 10, 10) was shifted to reel positions 5, 6, 7, 8, 9, 10, 11, 12, 13, and 14 for a second spin but reel positions 5 and 6 were utilized for first stack (e.g., 3 Aces—A, A, A located at reel positions 4, 5, and 6) for the first spin. Therefore, this error needs to be corrected. In various examples, this correction may be implemented via moving the third stack, shortening the third stack, inserting symbols to remove the overlapping areas, changing the stacking symbols, and/or any combination thereof. Further, the third stack may be expanded depending on any other modification made to third stack. In this example, to correct this error, third stack was moved by two reel positions which are now located in reel positions 7, 8, 9, 10, 11, 12, 13, 14, 15, and 16. Based on this modification, there are no longer any overlapping stacking positions for third stack from the first spin to the second spin.

For example, a fourth error occurred because the Nth stack (e.g., 6 Queens—Q, Q, Q, Q, Q, Q) was shifted to reel positions 18, 19, 20, 21, 22, and 23 for a second spin but reel positions 20, 21, 22, and 23 were utilized for second stack (e.g., 5 Kings—K, K, K, K, K located at reel positions 20, 21, 22, 23, and 24) for the first spin. Therefore, this error needs to be corrected. In various examples, this correction may be implemented via moving the Nth stack, shortening the Nth stack, inserting symbols to remove the overlapping areas, changing the stacking symbols, and/or any combination thereof. Further, the Nth stack may be expanded depending on any other modification made to Nth stack. In this example, to correct this error, symbols in Nth stack were modified to be the stacking symbols previously present (for first spin) in these reel positions. For example, reel positions 18 and 19 contain Queen symbols but reel positions 20, 21, 22, and 23 are modified to contain King symbols which were the symbols present for the first spin in these areas—therefore, the symbols in these areas did not change from the first spin to the second spin which removes this error. In addition, a Q may be position in reel position 20 to eliminate the error because one symbol in a location may not be considered a stacking area. Based on this modification, there are no longer any overlapping stacking positions for third stack from the first spin to the second spin.

Figure 39:
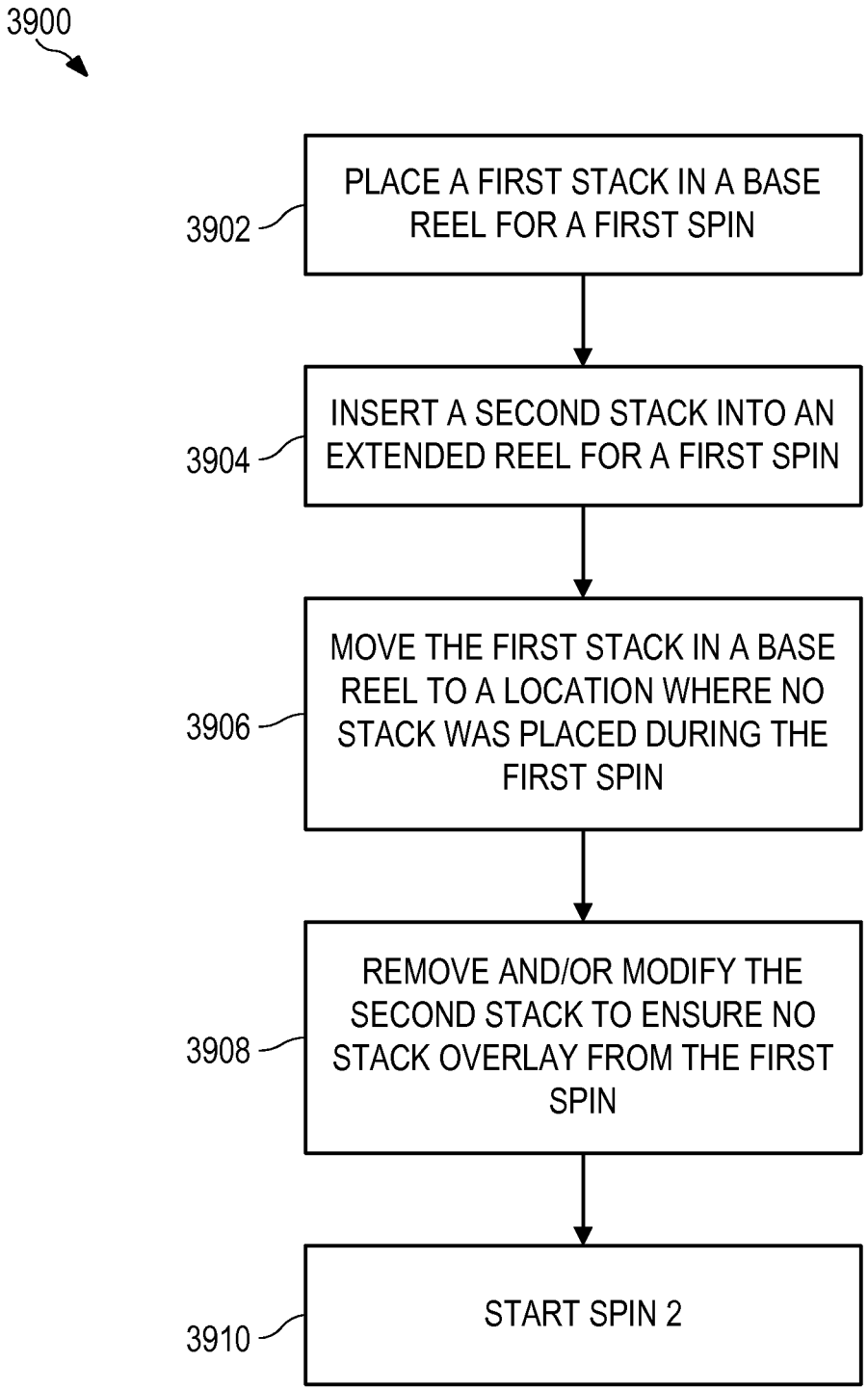
FIG. 39 is a flow diagram for game play, according to one embodiment.

In FIG. 39, a game play flow diagram is shown, according to one embodiment. The method may include placing a first stack in a base reel for a first spin (step 3902). The method may include inserting a second stack into an extended reel area for a first spin (step 3904). The method may include moving the first stack in a base reel to a location where no stack was placed during the first spin (step 3906). The method may include removing and/or modifying the second stack to ensure no stack overlay from the first spin (step 3908). The method may start the second spin (step 3910). The method may have also included starting the first spin.

For example, a base reel may have reel positions from reel position 1 to reel position 200. Further, the extended reel area may have reel positions from reel position 201 to reel position N. In one example, a first base reel stack of a first symbol (e.g., Aces) may be positioned starting at reel position 50 and ending at reel position 80 within the base reel for a first spin. Further, a first extended reel stack of a second symbol (e.g., Kings) may be positioned starting at reel position 201 and ending at reel position 220 within extended reel for the first spin. For a second reel spin, first base reel stack of the first symbol (e.g., Aces) may be positioned at a starting reel position 180 and ending at reel position 200 within base reel while the first extended reel stack of a first symbol (e.g., the Kings where changed to Aces) may be positioned starting at reel position 201 and ending at reel position 200 within extended reel for the second spin. In this example, an error has occurred because reel positions 201-220 now have a different stacking symbols overlapping from a first spin to a second spin. Therefore, via a checking procedure, the first extended reel stack of the first symbol may be moved to start a reel position 221 and end at reel position 240. Further, any other procedure (e.g., move, change size, insert symbols, change symbols, etc.) for eliminating the overlapping symbols (different stacking symbols from one spin to the next spin) may be utilized. However, if it were Kings, there may be no errors.

Figure 40A:
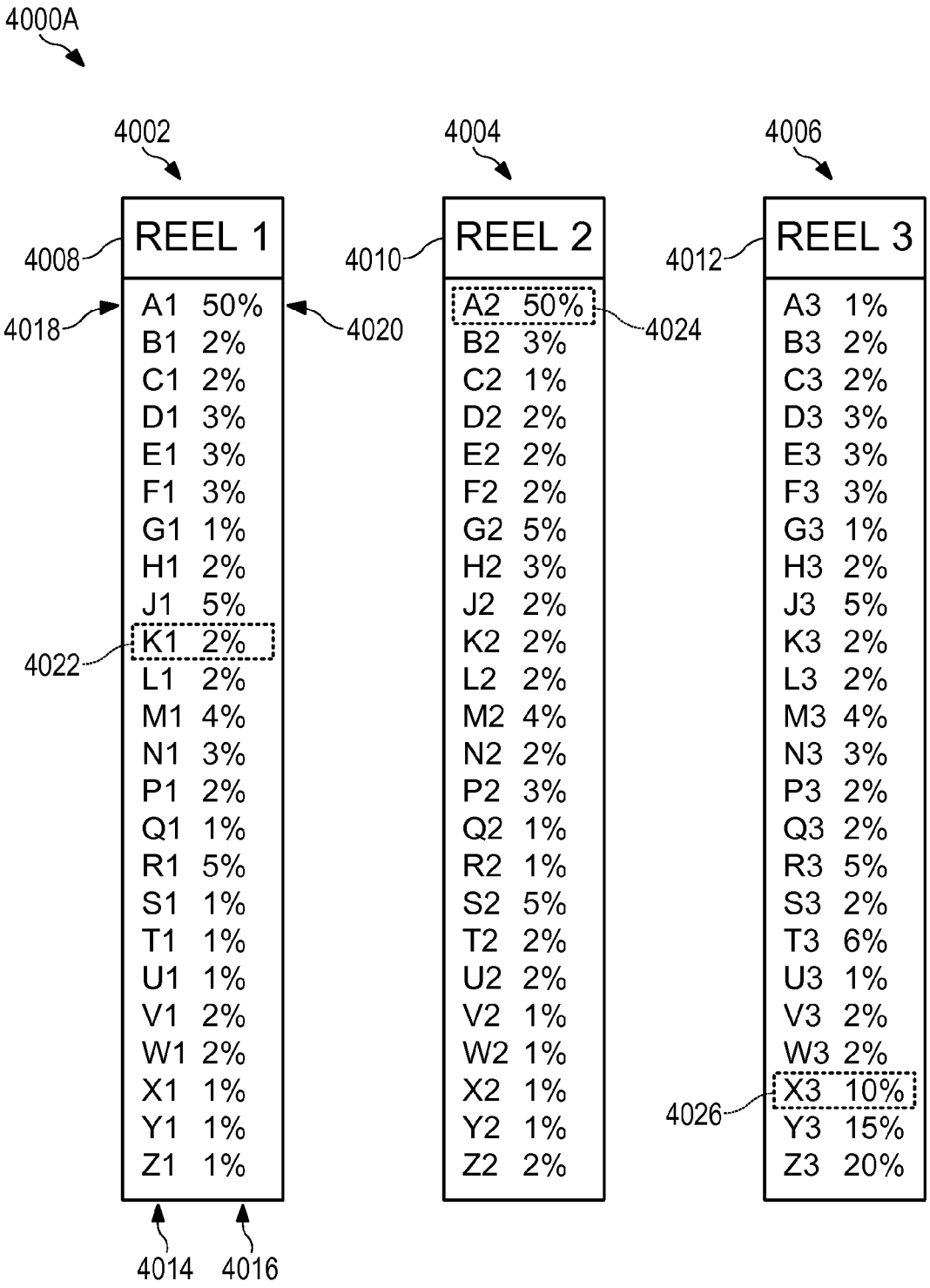
FIG. 40A is another illustration of stacking game play on a gaming device, according to one embodiment.

FIG. 40A shows a first reel 4002, a second reel 4004, and a third reel 4006 (and/or up to an Nth reel). In one example, first reel 4002 has a first plurality of symbols 4018 with a first plurality of selection probabilities 4020. In this example, any one (and/or more than one) of the first plurality of symbols 4018 may be selected for one or more stacking areas and/or stacking functions on and/or for first reel 4002. Further, second reel 4004 has a second plurality of symbols (e.g., A2 to Z2) with a second plurality of selection probabilities. In this example, any one (and/or more than one) of the second plurality of symbols may be selected for one or more stacking areas and/or stacking functions on and/or for second reel 4004. Further, third reel 4006 has a third plurality of symbols (e.g., A3 to Z3) with a third plurality of selection probabilities. In this example, any one (and/or more than one) of the third plurality of symbols may be selected for one or more stacking areas and/or stacking functions on and/or for third reel 4006. In one example shown in FIG. 40A, the selection of one or more stacking symbols for first reel 4002 is independent of the selection of one or more stacking symbols for second reel 4004 and/or third reel 406 (and/or Nth reel). Further, the selection of one or more stacking symbols for second reel 4004 is independent of the selection of one or more stacking symbols for first reel 4002 and/or third reel 406 (and/or Nth reel). In addition, the selection of one or more stacking symbols for third reel 4006 (and/or Nth reel) is independent of the selection of one or more stacking symbols for second reel 4004 and/or first reel 4002 (and/or Nth reel and/or third reel 4006). In this example, a first stacking symbol 4022 was selected for one or more stacking areas in first reel 4002 while independently a second stacking symbol 4024 was selected for one or more stacking areas in second reel 4004 while independently a third stacking symbol 4026 was selected for one or more stacking areas in third reel 4006 (and/or Nth reel). This selection procedure may be based on random selection (e.g., Random Number Generator, etc.), a predetermined pattern, any combination of a random selection and a predetermined pattern, any other selection methodology, and/or any combination thereof.

Figure 40B:
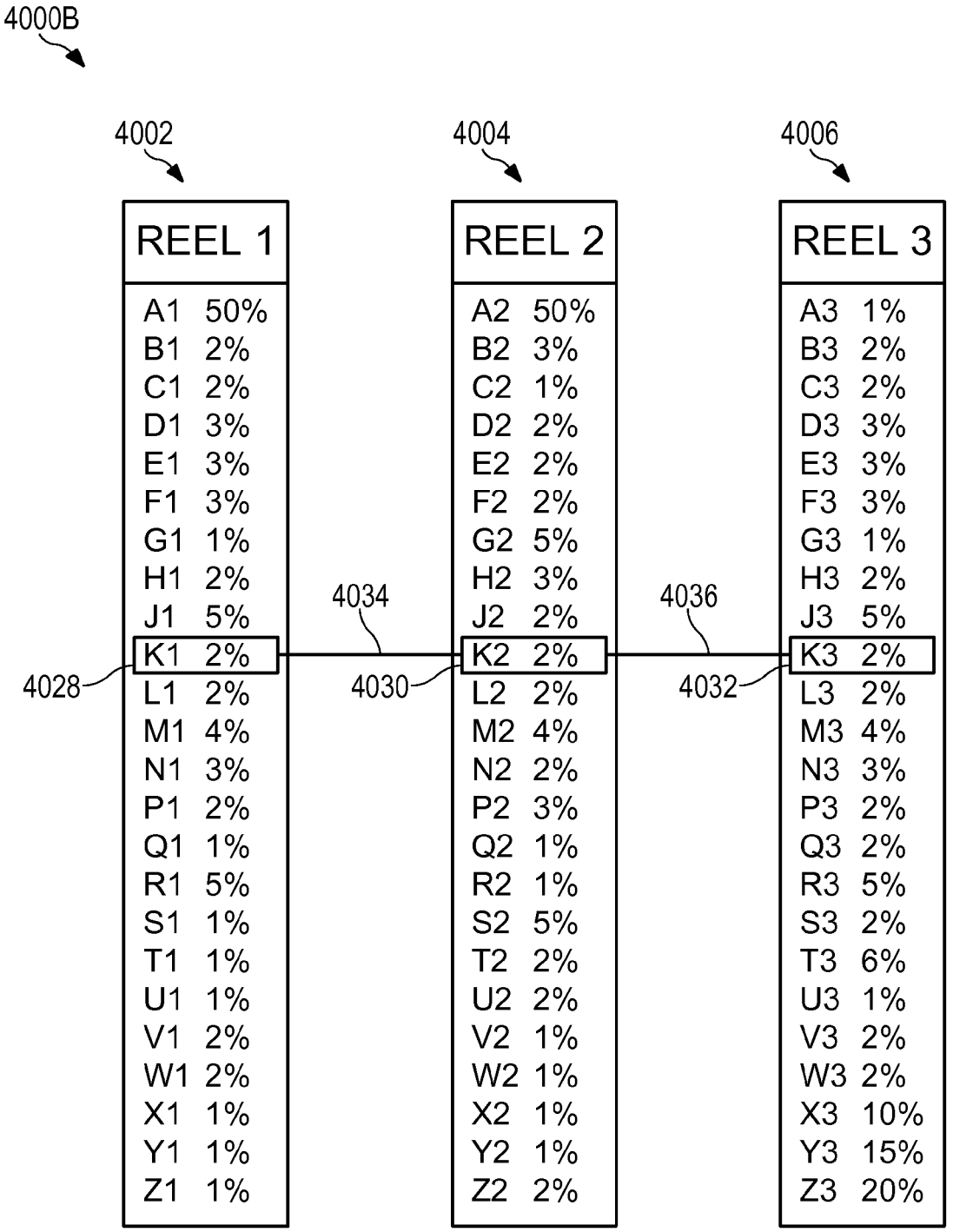
FIG. 40B is another illustration of stacking game play on a gaming device, according to one embodiment.

In another example shown in FIG. 40B, a first stacking symbol 4028 was selected for one or more stacking areas in first reel 4002 while dependently (based on the selection made for the first reel 4002—see reference number 4034) a second stacking symbol 4030 was selected for one or more stacking areas in second reel 4004 while dependently (based on the selection made for second reel 4004 and/or the selection may for first reel 4002—see reference number 4036) a third stacking symbol 4032 was selected for one or more stacking areas in third reel 4006 (and/or Nth reel). This selection procedure may be based on random selection (e.g., Random Number Generator, etc.), a predetermined pattern, any combination of a random selection and a predetermined pattern, any other selection methodology, and/or any combination thereof.

Figure 40C:
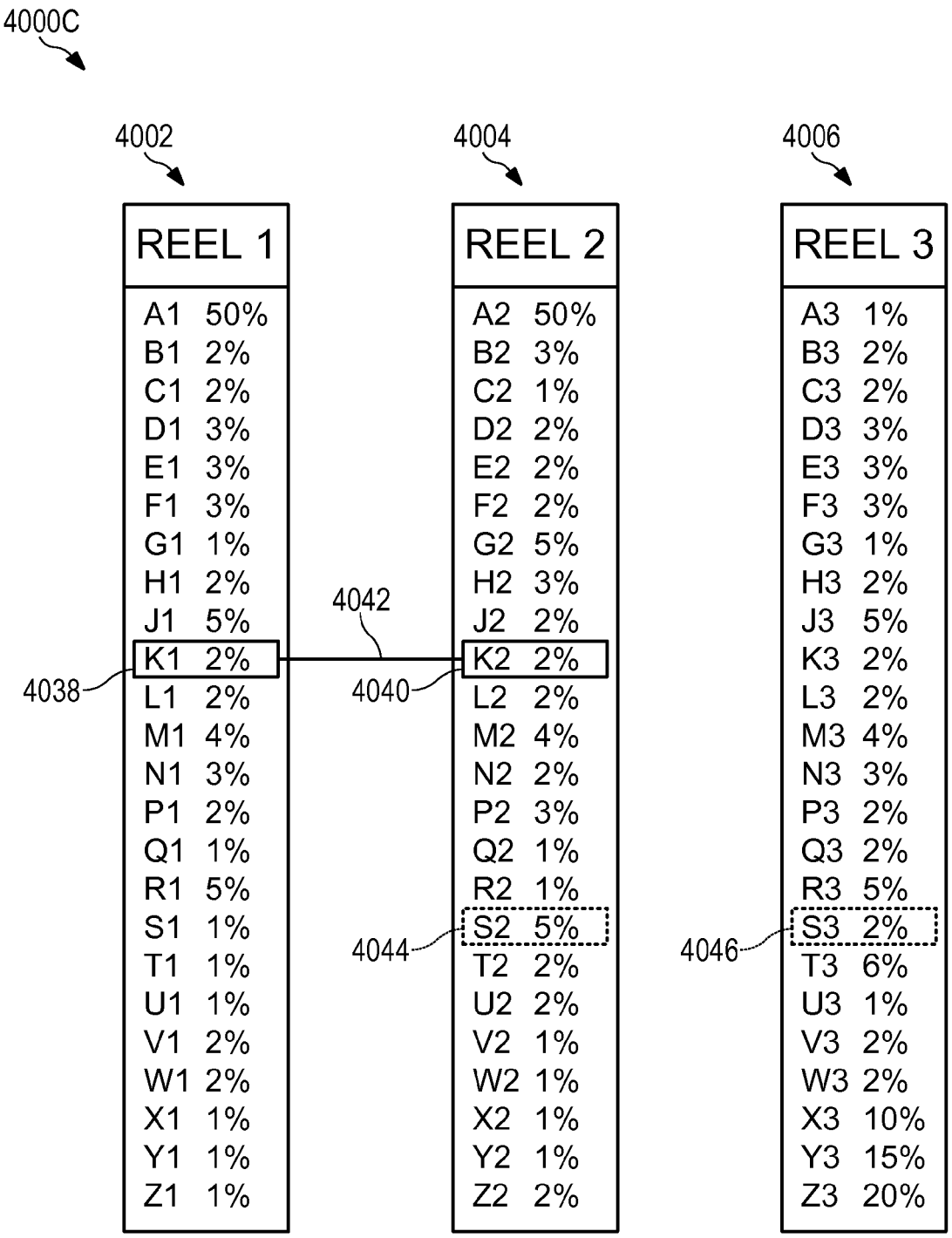
FIG. 40C is another illustration of stacking game play on a gaming device, according to one embodiment.

In another example shown in FIG. 40C, a first stacking symbol 4038 was selected for one or more stacking areas in first reel 4002 while dependently (based on the selection made for the first reel 4002—see reference number 4042) a second stacking symbol 4040 was selected for one or more stacking areas in second reel 4004 while independently (not based on the selection made for second reel 4004 and/or the selection may for first reel 4002) a third stacking symbol 4046 was selected for one or more stacking areas in third reel 4006 (and/or Nth reel). This selection procedure may be based on random selection (e.g., Random Number Generator, etc.), a predetermined pattern, any combination of a random selection and a predetermined pattern, any other selection methodology, and/or any combination thereof. It should be noted that first reel 4002, second reel 4004, third reel 4006, and/or nth reel selections may be made independent of each other, dependent on each other, some selections may be independent while other selections may be dependent, and/or the order of independence and/or dependence may be in any order (e.g., first to Nth, second to first to Nth, Nth to third to first to second, etc.).

Figure 41A:
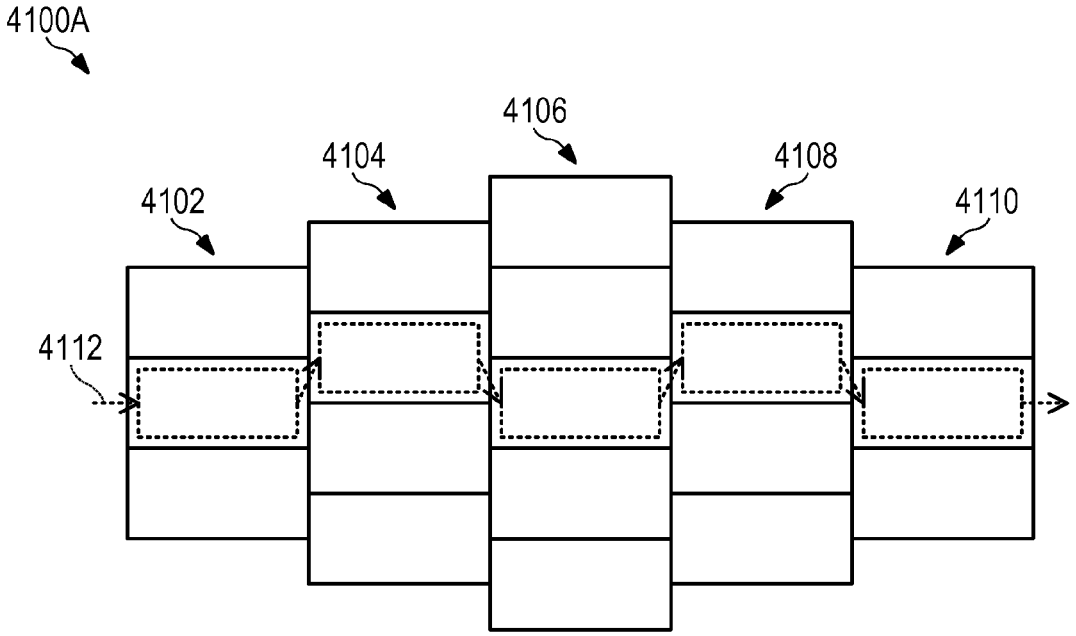
FIG. 41A is another illustration of stacking game play on a gaming device, according to one embodiment.

In FIG. 41A, a payline structure is shown, according to one embodiment. In one example, a first display area 4102 is three units long, a second display area 4104 is four units long, a third display area 4106 is five units long, a fourth display area 4108 is four units long, and an Nth display area is three units long. In this example, a first payline 4112 generates and/or determines payouts (e.g., winning combinations) which are read from left to right (see arrows).

Figure 41B:
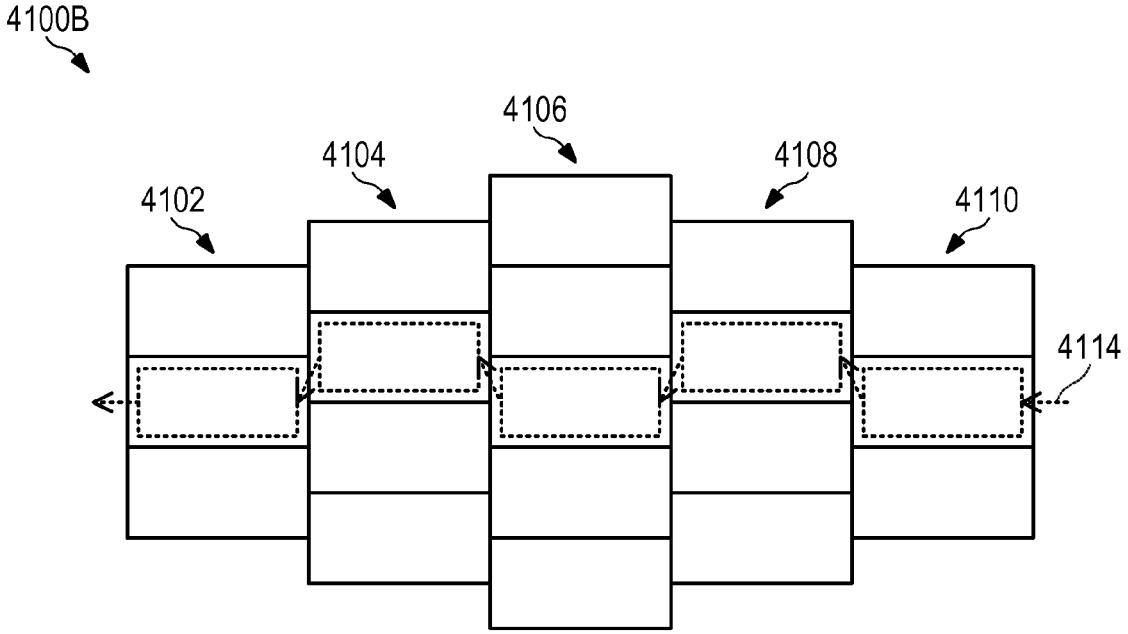
FIG. 41B is another illustration of stacking game play on a gaming device, according to one embodiment.
Figure 41C:
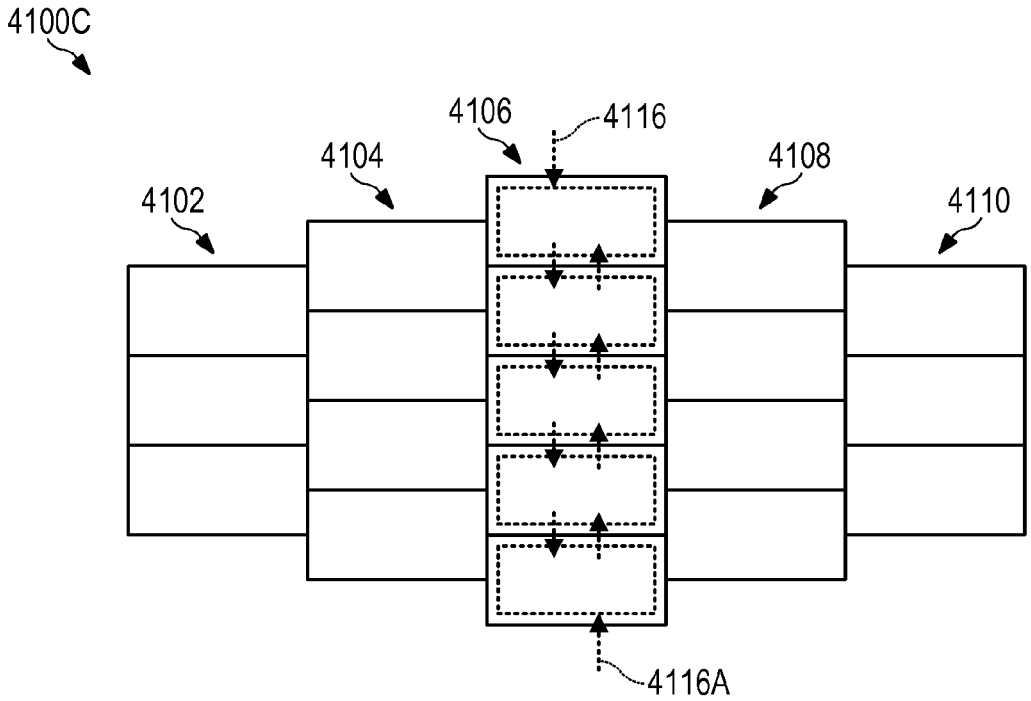
FIG. 41C is another illustration of stacking game play on a gaming device, according to one embodiment.
Figure 41D:
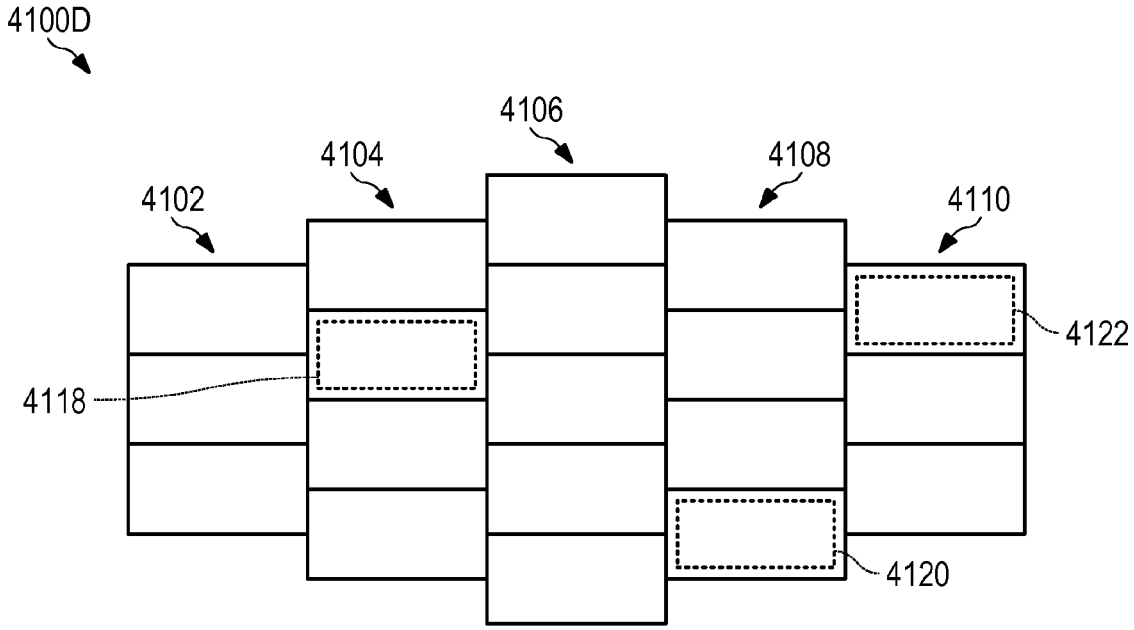
FIG. 41D is another illustration of stacking game play on a gaming device, according to one embodiment.
Figure 41E:
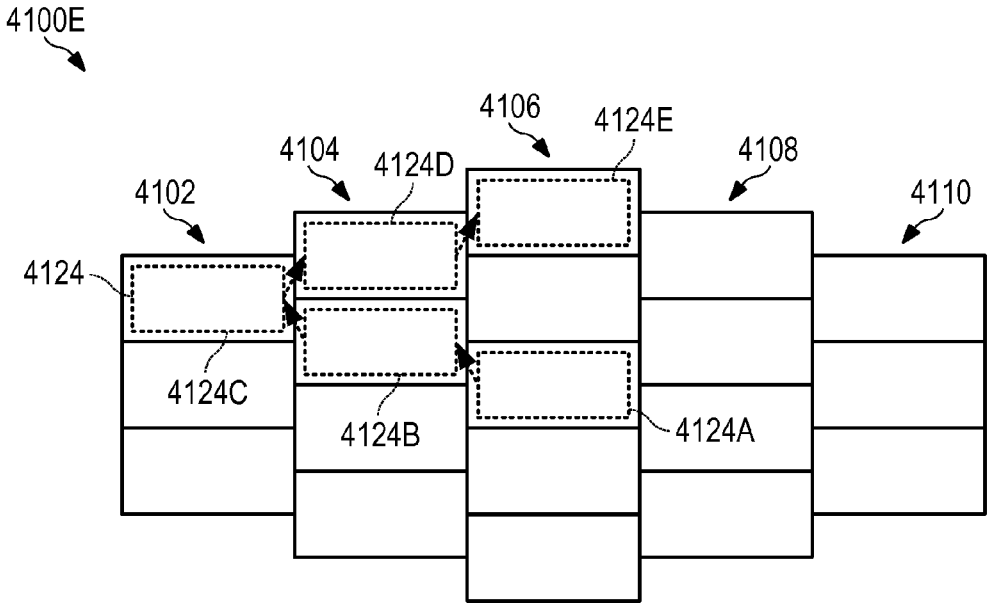
FIG. 41E is another illustration of stacking game play on a gaming device, according to one embodiment.
Figure 41F:
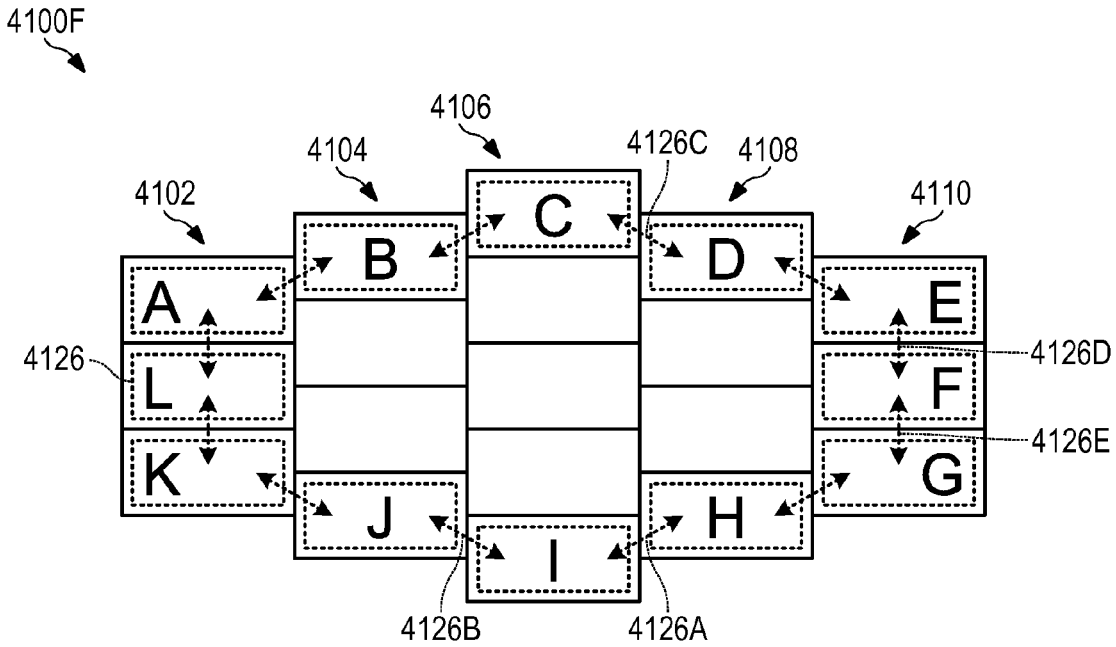
FIG. 41F is another illustration of stacking game play on a gaming device, according to one embodiment.
Figure 41G:
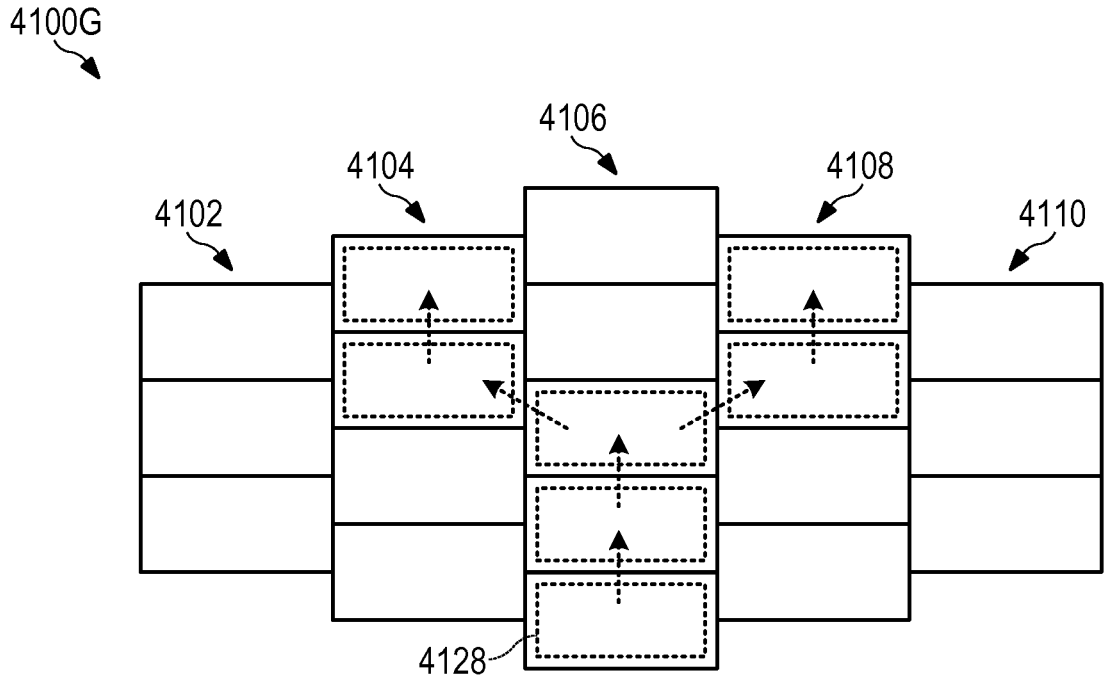
FIG. 41G is another illustration of stacking game play on a gaming device, according to one embodiment.

In another example shown in FIG. 41B, a second payline 4114 generates and/or determines payouts (e.g., winning combinations) which are read from right to left (see arrows). In another example shown in FIG. 41C, a third payline 4116 generates and/or determines payouts (e.g., winning combinations) vertically down a column (and/or one or more columns) and/or vertically up a column 4116A (see arrows). In another example shown in FIG. 41D, one or more processors generates and/or determines payouts (e.g., winning combinations) that are independent of any paylines (e.g., reference numbers 4118, 4120, and 4122). In another example shown in FIG. 41E, a fourth payline 4124 generates and/or determines payouts (e.g., winning combinations) by following a first path where the first path moves from a first position 4124A, to a second position 4124B, to a third position 4124C, to a fourth position 4124D, and then to an Nth position 4124E (see arrows). It should be noted that any movement pattern (e.g., up by any number, right by any number, down by any number, left by any number, and/or any combination thereof may be utilized). Further, the path may generate payouts by moving right to left, left to right, up to down, down to up, right to down, left to down, right to up, left to up, up to right, up to left, etc. For example as shown in FIG. 41F, a first payline movement 4126A goes from up and to the right (e.g., from I to H). In another example, a second payline movement 4126B goes from the left and then up (e.g., from I to J). In another example, a third payline movement 4126C goes from the right and down (e.g., from C to D). In another example, a fourth payline movement 4126D goes down (e.g., from E to F). Further, a fifth payline movement 4126E goes up (e.g., from G to F). In another example shown in FIG. 41G, a T-shaped payline 4128 may be utilized. In this example, the payouts may be generated by following the T-Shaped structure upwardly. In this example, payouts may be generated by filling out the entire T-Shaped structure, the left side of the T-Shaped structure, the right side of the T-shaped structure, and/or any portion of the structure. Other shapes may also be utilized, such as, a U, a Z, an A, an S, a V, an R, a D, an E, a F, a H, an I, an L, an M, an N, etc.

It should be noted that any of these payline structures shown in FIGS. 41A to 41G can be combined.

Figure 42A:
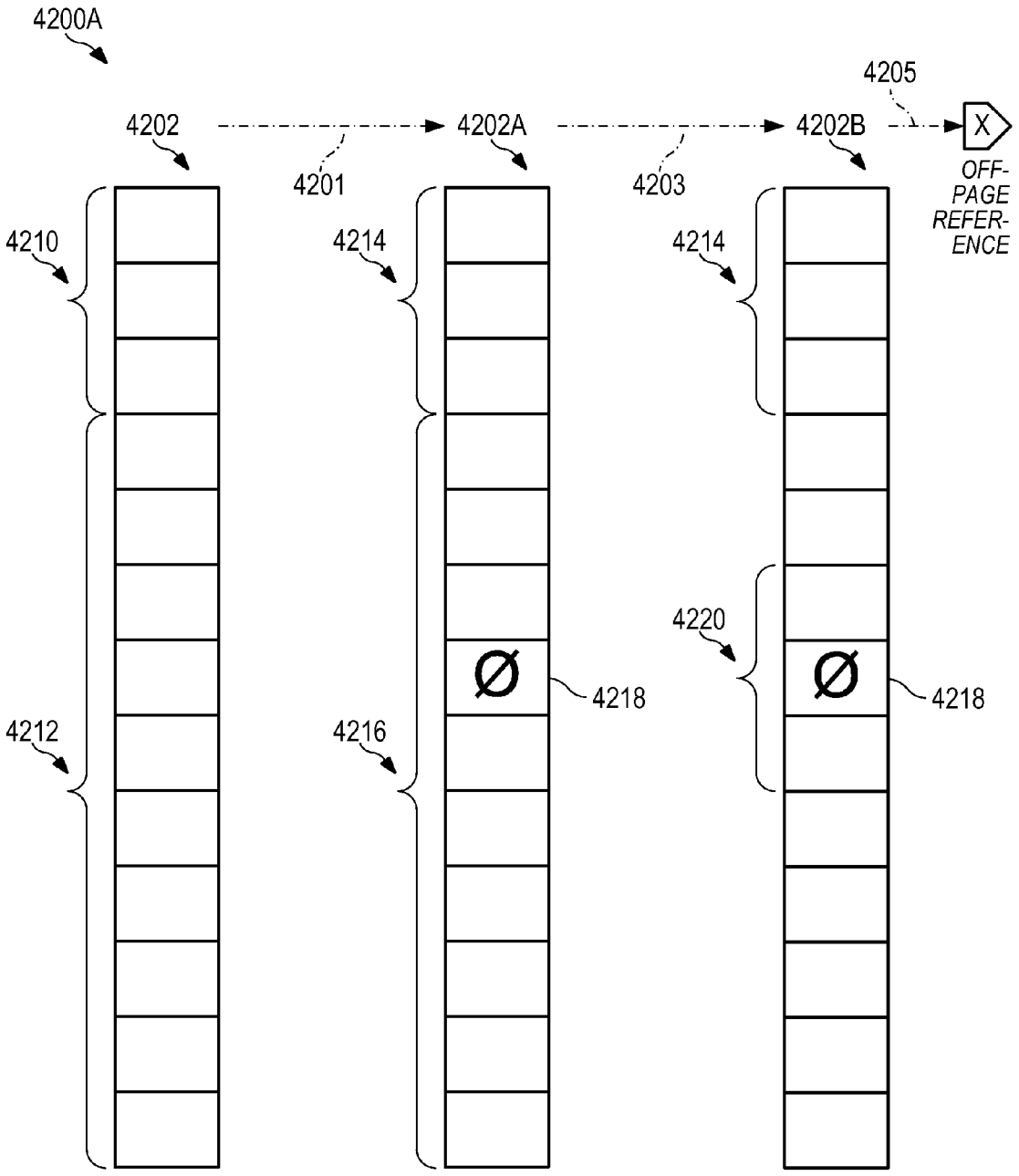
FIG. 42A is another illustration of stacking game play on a gaming device, according to one embodiment.

In FIG. 42A, an illustration of a stacking procedure is shown, according to one embodiment. In this example, an illustration 4200A of a reel spinning two times (e.g., a first reel spin 4202, a second reel spin 4202A part A, and a second reel spin 4202B Part B) is shown. During the first reel spin 4202, a first spin stacking symbol area 4210 consists of N number of stacking symbol areas (e.g., reel positions), which for this example is three. Further, during the first reel spin 4202, a first spin non-stacking symbol area 4212 is utilized for non-stacked symbol in N number of reel positions.

After the reel spins for the first time, then during the second reel spin 4202A (Part A), the first spin stacking symbol area 4210 is transformed into a second spin non-stacking symbol area 4214 where no stacking symbols are allowed to be located or only the same stacking symbol from the first spin are allowed to be positioned there. Further, one reel position in the previous non-stacking symbol area 4212 is selected to be an anchoring position 4218 for the second spin. This anchoring position 4218 is utilized to determine the center of a stacking symbol area which will be utilized for the stacking area during the second spin. In this example, a potential stacking symbol area 4216 may be the reel positions not occupied by stacking symbol during the previous spin. Further, during the second reel spin 4202A (Part—4202B), a second spin stacking symbol area 4220 is generated around anchor position 4218. In this example, second spin stacking symbol area 4220 is three units in length. However, any number may be utilized from 2 to N. In one example, once second spin stacking symbol area 4220 is created it may be checked to verify that there are no overlapping areas with first spin stacking symbol area 4210 where the stacking symbols changed from a first spin to a second spin.

In another example, once second spin stacking symbol area 4220 is created it may be checked to verify that there are no overlapping areas with different stacking symbols from the stacking symbols utilized for first spin stacking symbol area 4210. For example, if three Aces were utilized as stacking symbols in first spin stacking symbol area 4210 and thirteen Aces were utilized as stacking symbols in second spin stacking area 4220 which would mean that three Aces would be placed in second spin non-stacking symbol area 4214, then the system, device, and method would not generate an error because the stacking symbols located in the first three reel positions (e.g., first spin stacking symbol area 4210 for spin 1 and non-stacking symbol area 4214 for spin 2) utilize the same stacking symbol (e.g., an Ace) from a first spin to a second spin which is allowed. It should be noted that in these examples, only when a stacking symbol changes from spin to spin and is located in the same reel positions that an error occurs.

Figure 42B:
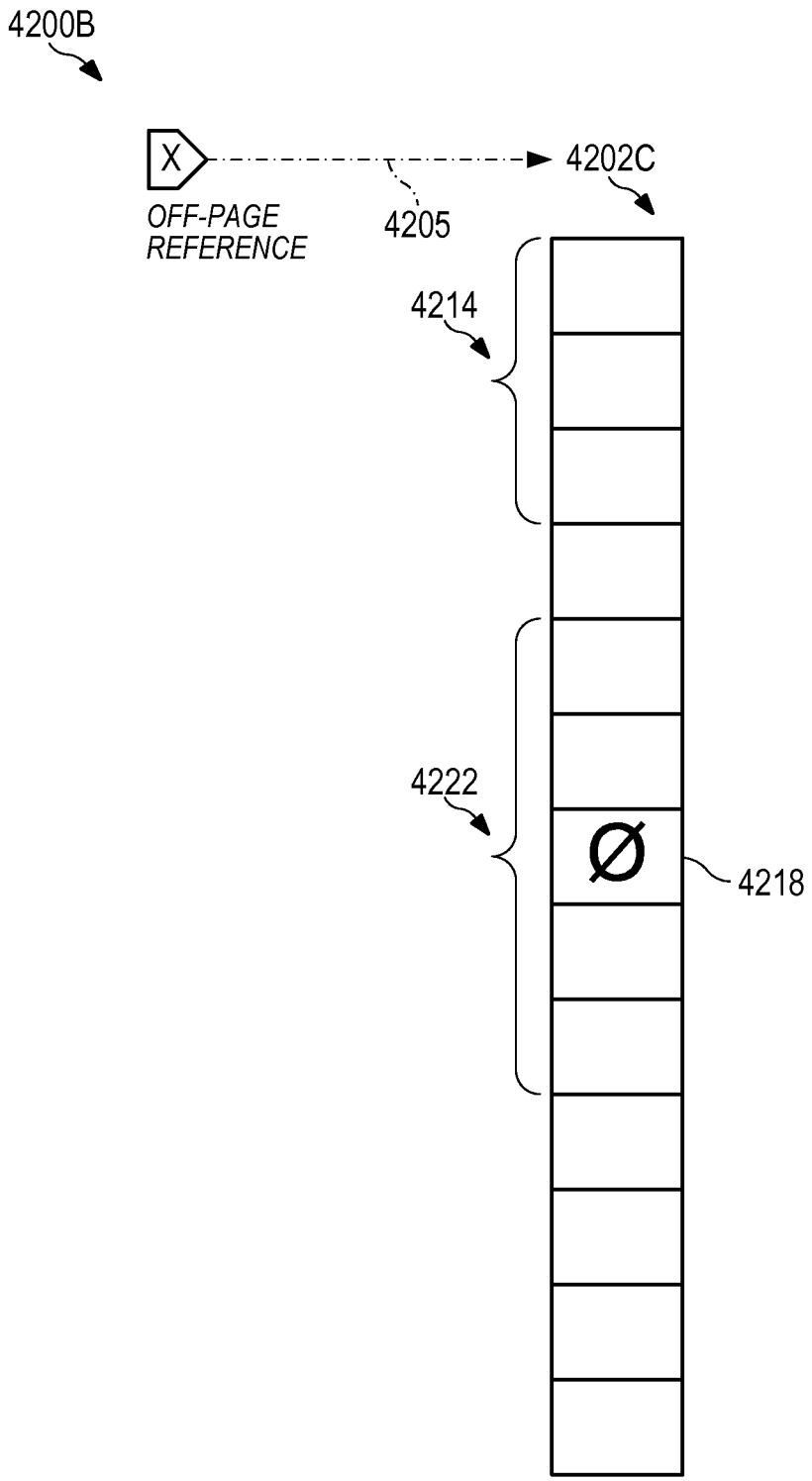
FIG. 42B is another illustration of stacking game play on a gaming device, according to one embodiment.

Further as seen in FIG. 42B, after the reel spins for the first time, then during the second reel spin 4202C, the first spin stacking symbol area 4210 is transformed into second spin non-stacking symbol area 4214 where no stacking symbols are allowed to be located unless they are the same (e.g., unchanged) stacking symbols. Further, one reel position in the previous non-stacking symbol area 4212 is selected to be anchoring position 4218 for the second spin. This anchoring position 4218 is utilized to determine the center of a stacking symbol area which will be utilized for the stacking area during the second spin. In this example, a potential stacking symbol area 4216 may be the reel positions not occupied by stacking symbol during the previous spin. Further, during the second reel spin 4202C, a second spin stacking symbol area 4222 is generated around anchor position 4218. In this example, second spin stacking symbol area 4222 is five units in length. However, any number may be utilized from 2 to N. In one example, once second spin stacking symbol area 4222 is created it may be checked to verify that there are no overlapping areas with first spin stacking symbol area 4210.

In another example, the second reel spin 4202C could be a third reel spin 4202C where second spin stacking symbol area 4220 is expanded into 5 units with the same stacking symbols utilized for both the second spin and the third spin.

Figure 42C:
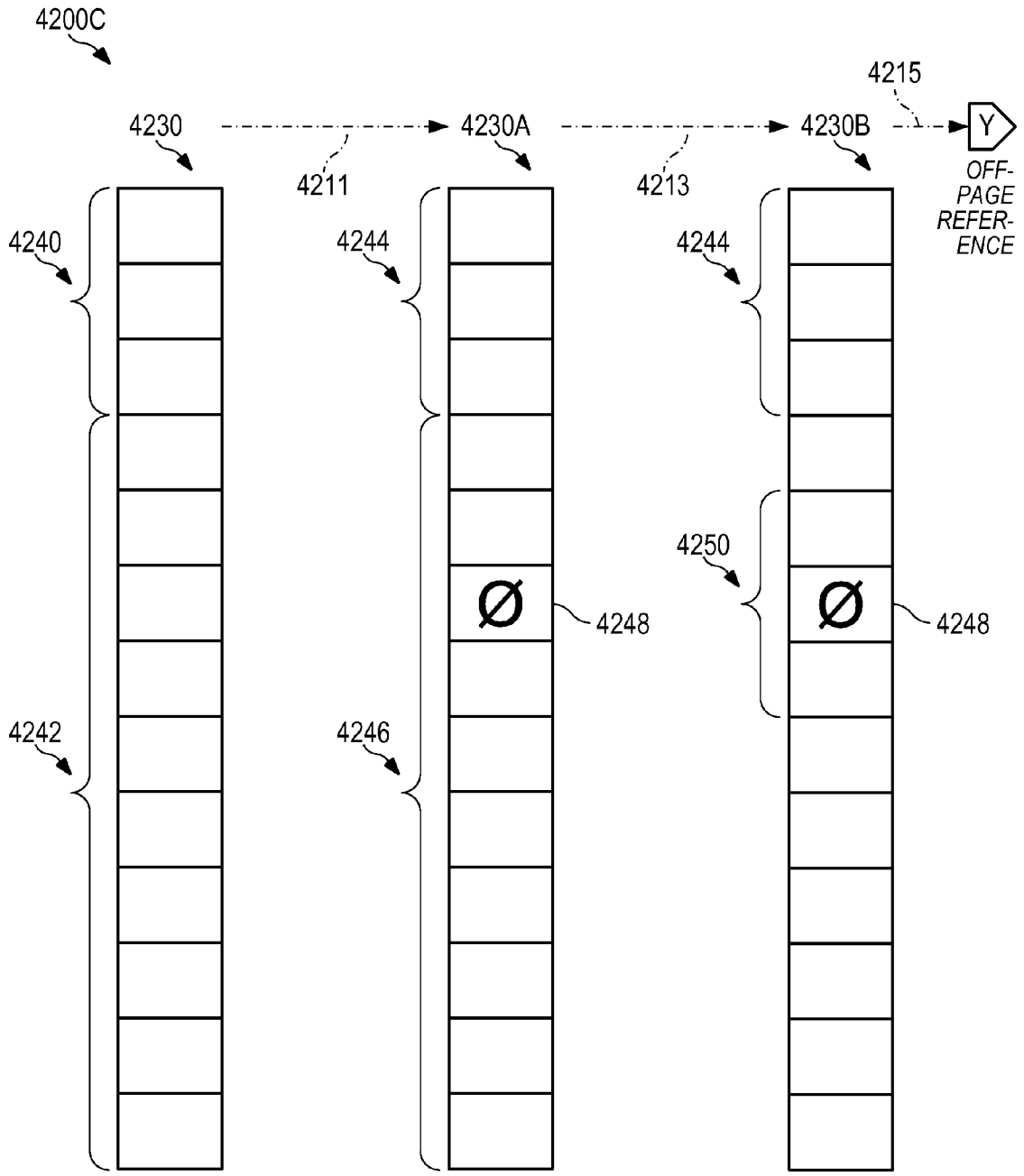
FIG. 42C is another illustration of stacking game play on a gaming device, according to one embodiment.

In FIG. 42C, a stacking illustration is shown, according to one embodiment. In this example, a first spin utilizes a first spin stacking area 4240 and a first spin non-stacking area 4242. During a first spin, first spin stacking area 4240 may have like symbols (e.g., A, A, A) in all of the reel positions with first spin stacking area 4240 while non-stacking symbols (e.g., K, Q, J, 10, K, J, 10, Q, 10, J) may be located in the reel positions associated with first spin non-stacking area 4242. During a first example of a second spin shown in reference number 4230A and 4230B, the first spin stacking area 4240 turns into a second spin non-stacking symbol area 4244 while a second spin stacking area 4250 is generated around an anchor point 4248 within a potential second spin stacking area 4246.

Figure 42D:
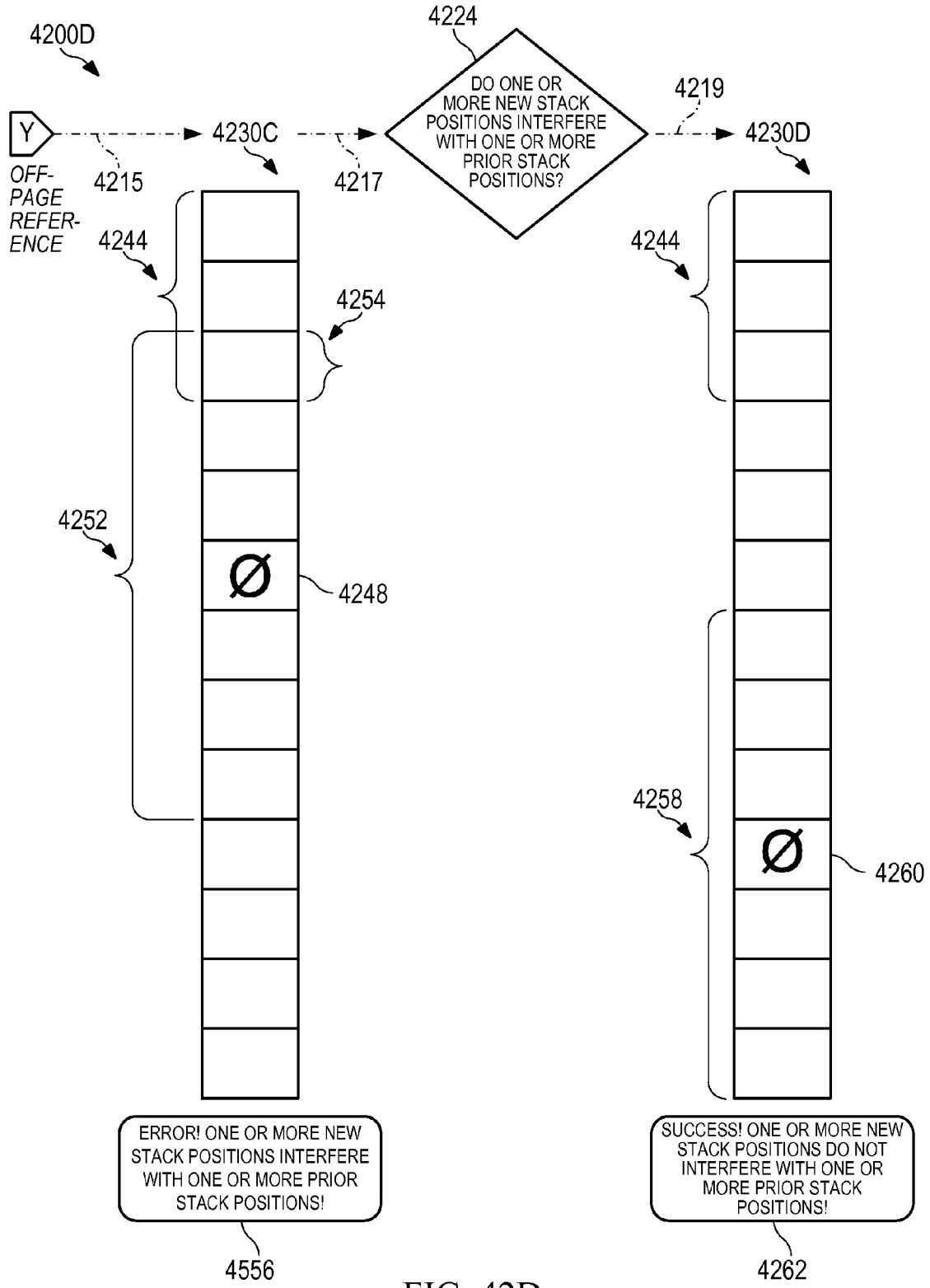
FIG. 42D is another illustration of stacking game play on a gaming device, according to one embodiment.

In other example for the second spin shown in FIG. 42D, the first spin stacking area 4240 turns into second spin non-stacking symbol area 4244 while a second spin non-compliant stacking area 4252 is generated around an anchor point 4248 within a potential second spin stacking area 4246. In this example, an error message 4556 has occurred because second spin non-compliant stacking area 4252 has an overlapping unit 4254 between second spin non-compliant stacking area 4252 and first spin stacking area 4240 (and/or second spin non-stacking symbol area 4244—Please note that in this example first spin stacking area 4240 and second spin non-stacking symbol area 4244 are the same area. However, this does not have to be the case). In this example, based on a first stacking symbol being utilized for a first spin and a second stacking symbol (which is different than the first stacking symbol) being utilized for a second spin an error has occurred. However, if the same stacking symbol was utilized for the first spin and the second spin, then no error would have occurred.

In this example, the second spin non-compliant stacking area 4252 was moved to a second spin compliant stacking area 4258 around new anchor position 4260 which removed this error function and/or message. Further, the error could have been eliminated by decreasing the size of second spin non-compliant stacking area 4252 to eliminate the overlapping unit 4254. In addition, overlapping unit 4254 could have had the stacking symbol utilized during first spin insert into it and utilized for the second spin to remove the error. In addition, overlapping unit 4254 could have had a non-stacking symbol utilized for the second spin to remove the error.

Figure 43A:
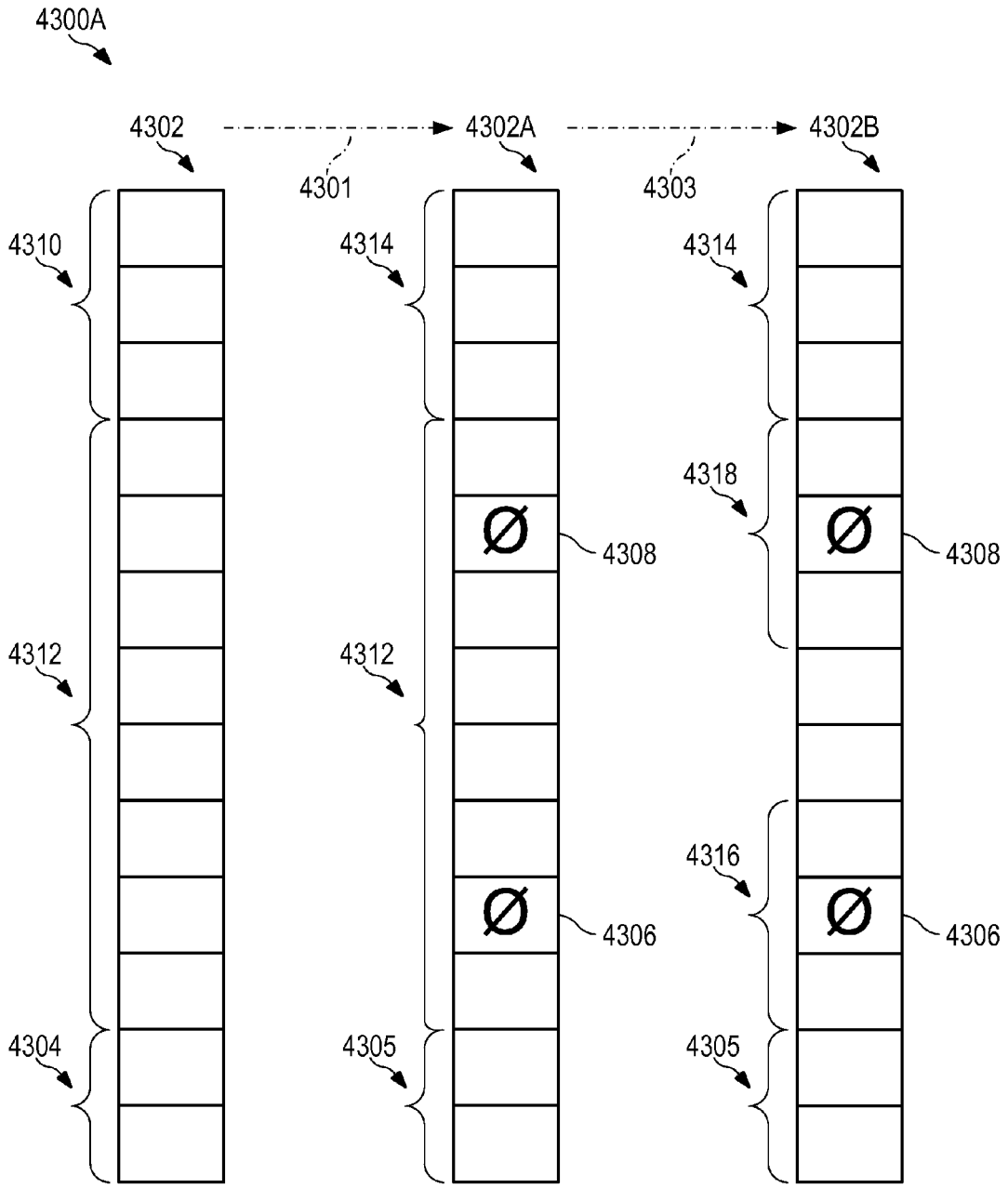
FIG. 43A is another illustration of stacking game play on a gaming device, according to one embodiment.

In FIG. 43A, illustrates a stacking symbol procedure with more than one anchoring positions, according to one embodiment. In one example, a first spin stacking area 4310 and a second first spin area 4304 are utilized to place stacking symbols in first spin stacking area 4310 and a second first spin area 4304 for a first spin. In one example, the same stacking symbol (e.g., Ace) is utilized for both first spin stacking area 4310 and second first spin area 4304. In another example, a first stacking symbol (e.g., Ace) is utilized for first spin stacking area 4310 while a second stacking symbol (e.g., King) is utilized in second first spin stacking area 4304. Further, a non-stacking symbol area 4312 is utilized to display non-stacking symbols during a first spin.

In a second spin shown in reference number 4302A and 4302B, first spin stacking area 4310 is converted into first second spin non-stacking symbol area 4314 while second first spin area 4304 is converted into second second spin non-stacking symbol area 4305. In this example, both first second spin non-stacking symbol area 4314 while second first spin area 4304 is converted into second second spin non-stacking symbol area 4305 may not have stacking symbols located in their respective areas unless the stacking symbol is the same stacking symbol utilized in the previous spin (e.g., first spin).

In this example, a first anchoring position 4306 and a second anchoring position 4308 may be utilized to generate a first second spin stacking area 4316 relating to first anchoring position 4306 while a second second spin stacking area 4318 relating to second anchoring position 4308 is generated. In this example, first second spin stacking area 4316 is 3 units in length and second second spin stacking area 4318 is also 3 units in length. However, any number of units from 2 to N could be utilized.

It should be noted that the stacking areas may be generated without an anchoring position and/or any other centering position being determined.

Figure 43B:
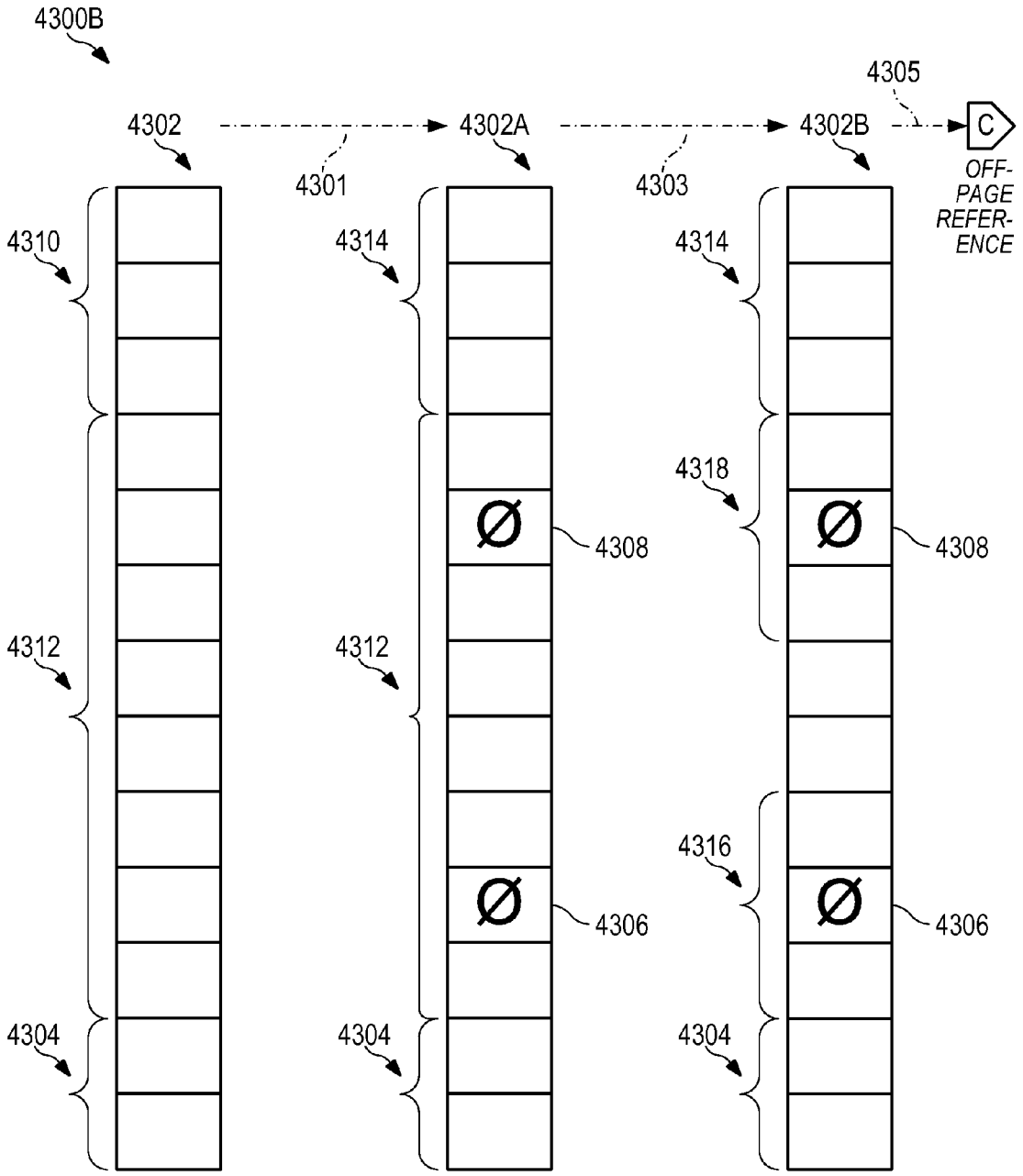
FIG. 43B is another illustration of stacking game play on a gaming device, according to one embodiment.
Figure 43C:
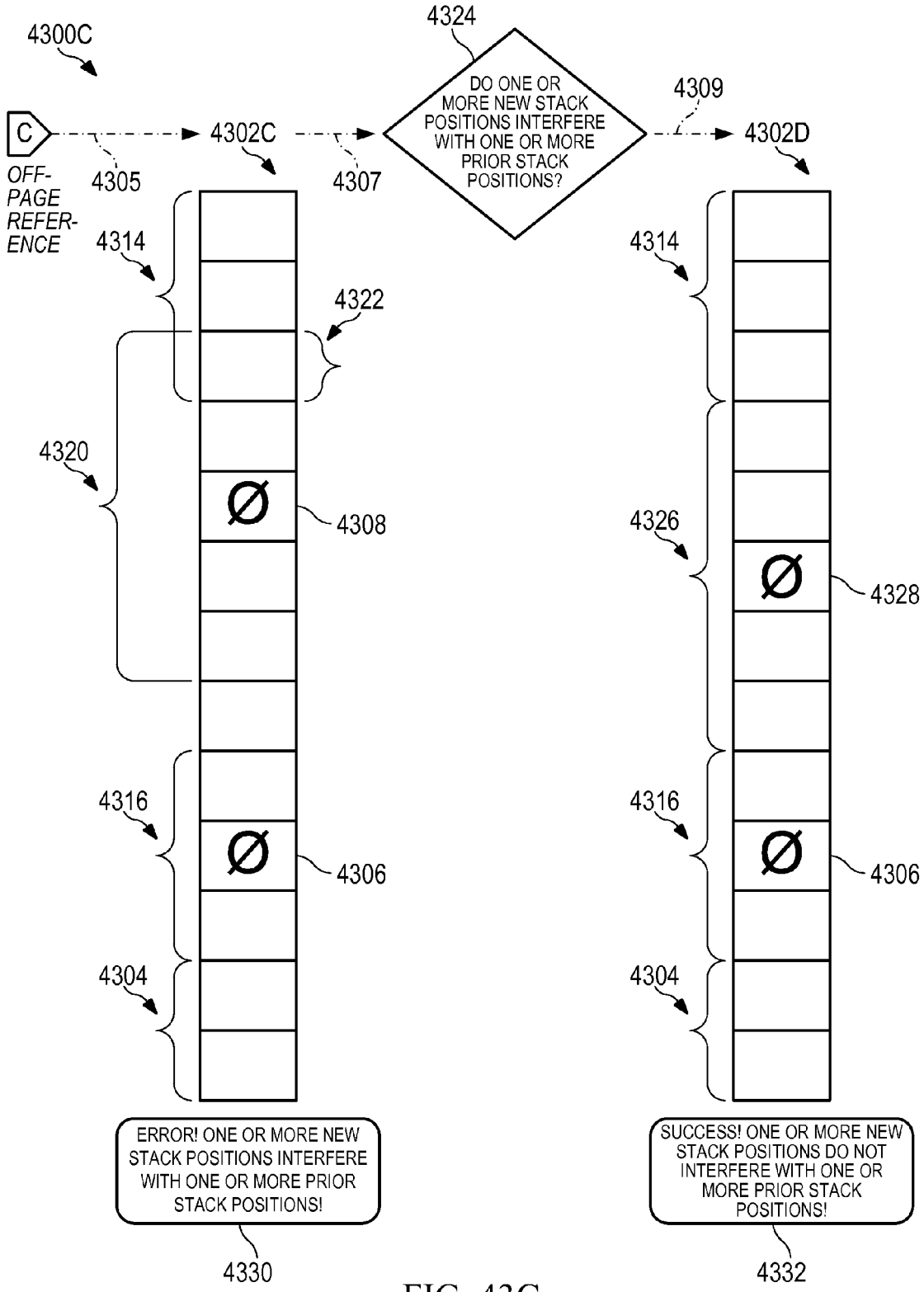
FIG. 43C is another illustration of stacking game play on a gaming device, according to one embodiment.

As seen in FIGS. 43B and 43C, if one or more stacking areas are located in an area where stacking symbols where located on the previous spin, an error message and/or function is initiated. In this example, a second spin non-compliant stacking symbol area 4320 is generated because an overlapping position 4322 is generated between second spin non-compliant stacking symbol area 4320 and first spin stacking symbol area 4310 which was the same area as first second spin non-stacking symbol area 4314 in this example. To correct this error, the system, device, and method moves second spin non-compliant stacking symbol area 4320 down one unit to eliminate the overlapping position 4322 which is shown in second spin compliant stacking symbol area 4326. Further, the error could have been eliminated by decreasing the size of second spin non-compliant stacking area 4320 to eliminate the overlapping unit 4322. In addition, overlapping unit 4322 could have had the stacking symbol utilized during first spin insert into it and utilized for the second spin to remove the error because then the same stacking symbol would be utilized for the area in both the first spin and the second spin. In addition, overlapping unit 4322 could have had a non-stacking symbol utilized for the second spin to remove the error. In addition, it should be noted that overlapping unit 4322 may be any number from 1 to N.

Figure 44:
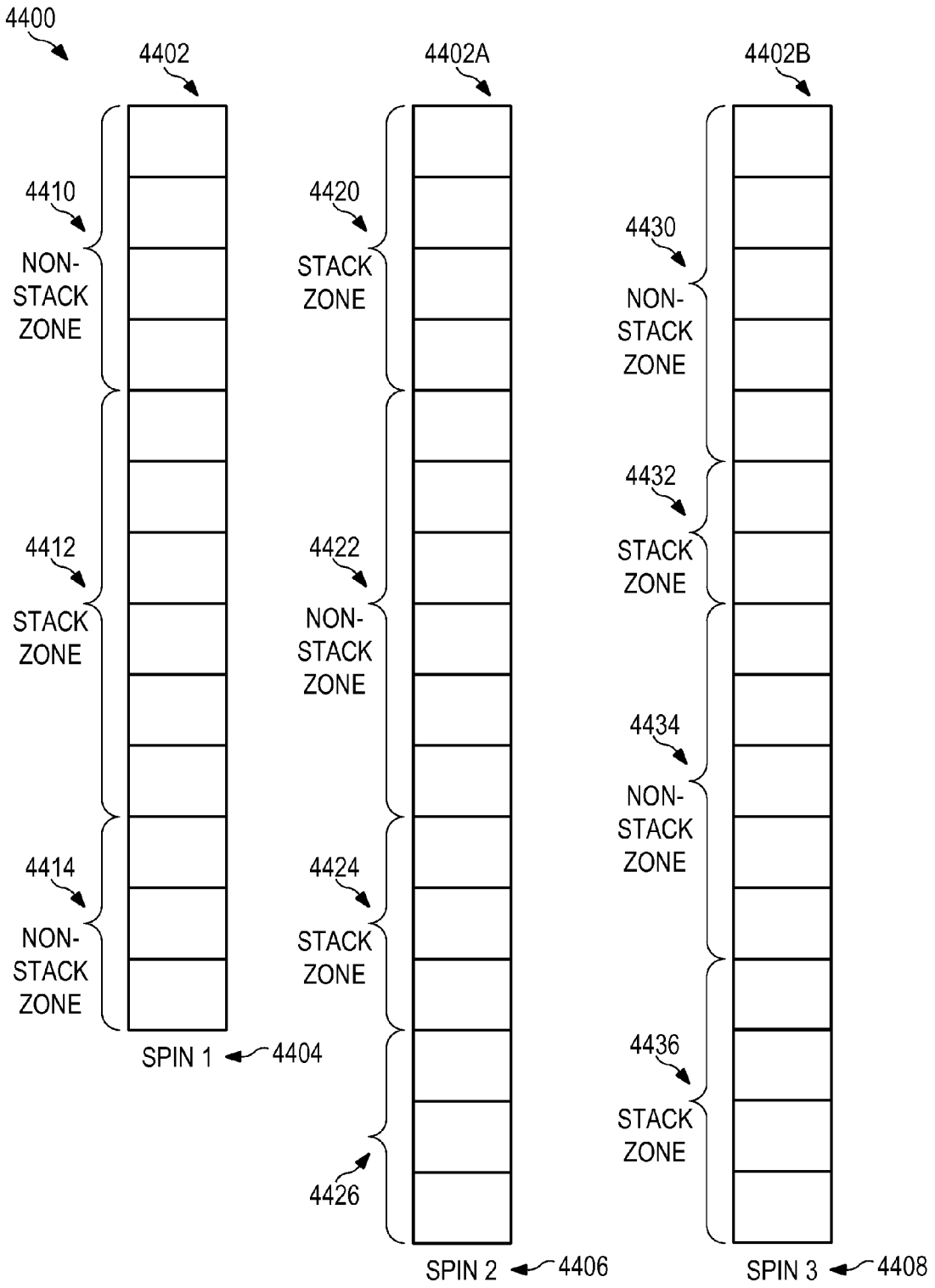
FIG. 44 is another illustration of stacking game play on a gaming device, according to one embodiment.

In FIG. 44, an illustration of a stacking game play is shown, according to one embodiment. In one example, an illustration 4400 may show a first spin of a first reel 4402, a second spin of the first reel 4402A, and a third spin of the first reel 4402B (up to an Nth spin). In this example, for a first spin of a first reel (up to an Nth reel) there are three zones relating to the stacking feature. It should be noted that any number of zones that relate to a stacking feature may be utilized from 0 to N. In this example, the three zones are a first non-stacking zone 4410, a first stacking zone 4412, and a second non-stacking zone 4414. There may be 0 to N stacking zones utilized in various examples while there may be 0 to N non-stacking zones utilized. For example, there may be 0 stacking zones and a plurality of non-stacking zones (e.g., 5, 10, 50, 100, etc.). In another example, there may be 10 stacking zones and zero non-stacking zones. In another example, there may be 20 stacking zones and 5 non-stacking zones. In another example, there may be 30 stacking zones and 50 non-stacking zone. In another example, there may be 5 stacking zones and 8 non-stacking zones. In addition, there may be zones that are not relating to stacking at all (e.g., non-stacking symbol zones, wild zones, scatter zones, multiplier zones, credit zones, presentation zones, etc.).

In this example, there are three zones (e.g., first non-stacking zone 4410, first stacking zone 4412, and second non-stacking zone 4414). In the first non-stacking zone 4410 and the second non-stacking zone 4414 no stacking symbols are allowed to form stacking formation in these zones. This may be because these zones where stacking zones on the previous spin. Further, the first stacking zone 4412 allows stacking symbols to form stacking formations. This may be because this zone was a non-stacking zone on the previous spin. In one example, all of these zones are in a base reel as opposed to an extended reel.

For a second spin of the first reel 4402A, first non-stacking zone 4410 from the first spin transforms into a first stacking zone for the second spin 4420 (This may be because this zone was a non-stacking zone on the previous spin), while first stacking zone 4412 from the first spin transforms into a first non-stacking zone for the second spin 4422 (This may be because this zone was a stacking zone on the previous spin), and second non-stacking zone 4414 from the first spin transforms into a second stacking zone for the second spin 4424 (This may be because this zone was a non-stacking zone on the previous spin). In addition, an extended reel section 4426 has been added which may be utilized as either a second non-stacking zone for the second spin or a third stacking zone for the second spin.

For a third spin of the first reel 4402B, first stacking zone from the second spin 4420 transforms into a first non-stacking zone for the third spin 4430 (This may be because this zone was a stacking zone on the previous spin or it could be a stacking zone that utilizes the same stacking symbol from a first spin to a second spin), while first non-stacking zone from the second spin 4422 transforms into a first stacking zone for the third spin 4432 (This may be because this zone was a non-stacking zone on the previous spin), and second stacking zone from the second spin 4424 transforms into a second non-stacking zone for the third spin 4434 (This may be because this zone was a stacking zone on the previous spin). In addition, an extended reel section 4436 may be utilized as either a second non-stacking zone for the second spin or a third stacking zone for the third spin (in this case it is a second stacking zone for third spin).

It should be noted that the zone sizes and shapes can vary from spin to spin. Further, there may be an overlapping cell when the transformation between a stacking and non-stacking area occurs. This may be handled by having only one stacking symbol overlapping between spins and/or corrected by changing the symbol so that a first stacking symbol does not overlap with a second stacking symbol from a first spin to a second spin. Further, a one symbol overlapping may be acceptable because one symbol does not form a stack per se.

Figure 45A:
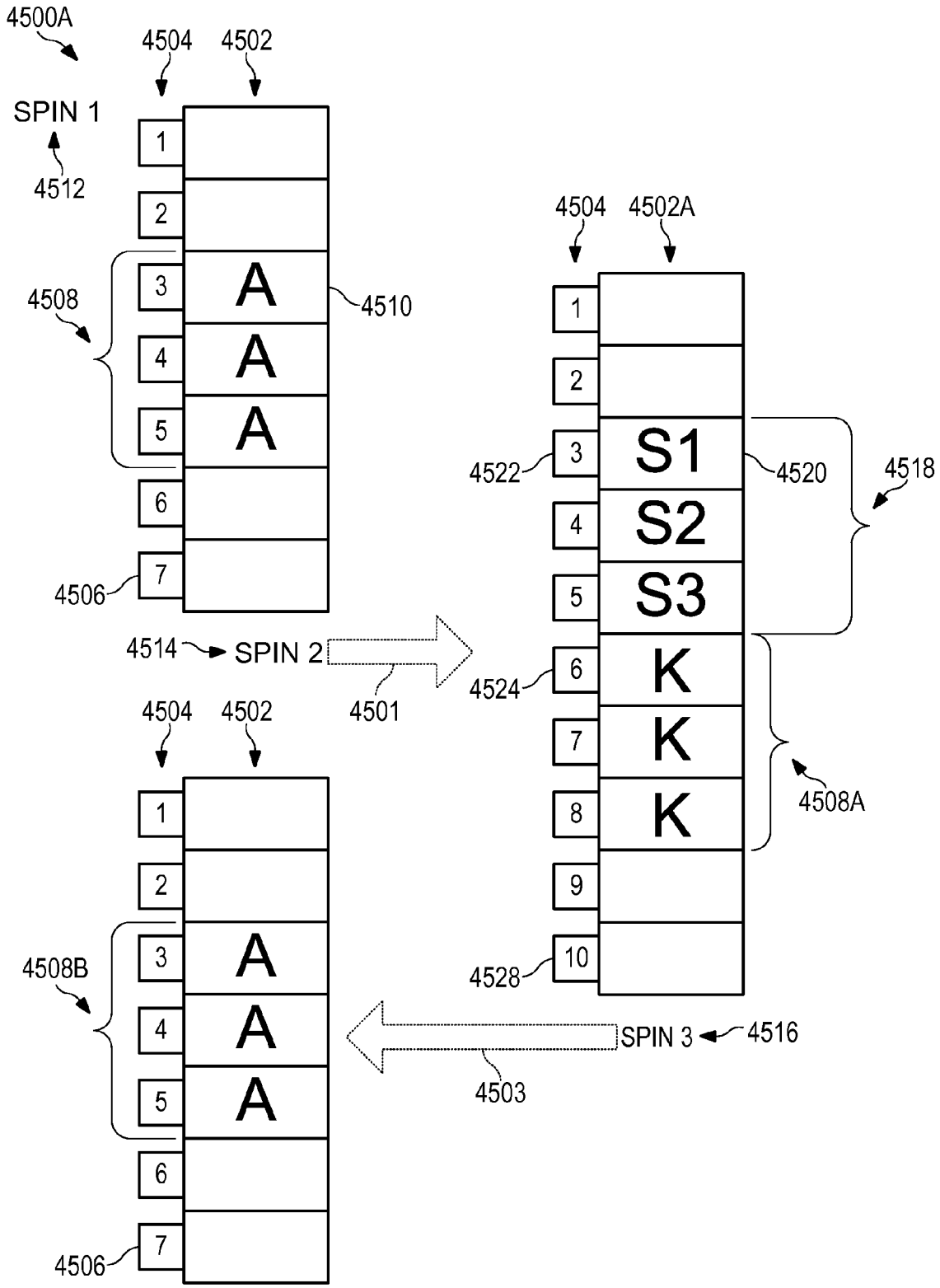
FIG. 45A is another illustration of stacking game play on a gaming device, according to one embodiment.

In FIG. 45A, another illustration of stacking symbol game play is shown, according to one embodiment. In this example, a reel 4502 has seven reel position which are a first reel position (e.g., the 1 in the box 4506), a second reel position (e.g., the 2 in the box 4506), a third reel position (e.g., the 3 in the box 4506), a fourth reel position (e.g., the 4 in the box 4506), a fifth reel position (e.g., the 5 in the box 4506), a sixth reel position (e.g., the 6 in the box 4506), and a seventh reel position (e.g., the 7 in the box 4506). In this example, a stacking area 4508 includes the third reel position, the fourth reel position, and the fifth reel position and is 3 units in length and filled with a first stacking symbol 4510 (e.g., an Ace in all three units—A, A, A) is utilized for a first spin 4512.

In one example, the system, device, and/or method may insert an inserted symbol area 4518 that starts at the beginning position (reference number 4522 for the third reel position) for the stacking area 4508 and is the same number of units as the stacking area 4508 (in this example 3 units). It should be noted that the number of units may be greater than and/or less than the units utilized for the stacking area 4508. In this example, the inserted symbol area 4518 is filed with non-stacking symbols 4520 (e.g., S1, S2, S3, etc.) for a second spin and stacking area 4508 from the first spin has moved to a second stacking area 4508A with a second stacking symbol (e.g., King—K, K, K). In this example, second stacking area 4508 starts at a sixth reel position (e.g., the 6 in the box—reference number 4524). In this example, there are no errors because even though the stacking symbol has changed (e.g., going from an Ace to a King), there is no overlap between the stacking area 4508 used for the first spin and second stacking area 4508A used for the second spin.

In addition, the system, device, and/or method may remove the inserted symbol area 4518 utilized in the second spin for a third spin 4514. In this example, third stacking area 4508B utilized for third spin is in the same location (e.g., reel positions 3-5) as where utilized for stacking area 4508 for first spin. However, any area may be utilized and this area was utilized for easy of illustrations. In this example, there are no errors because even though the stacking symbol has changed (e.g., going from a King to an Ace), there is no overlap between the third stacking area 4508B used for the third spin and second stacking area 4508A used for the second spin.

Figure 45B:
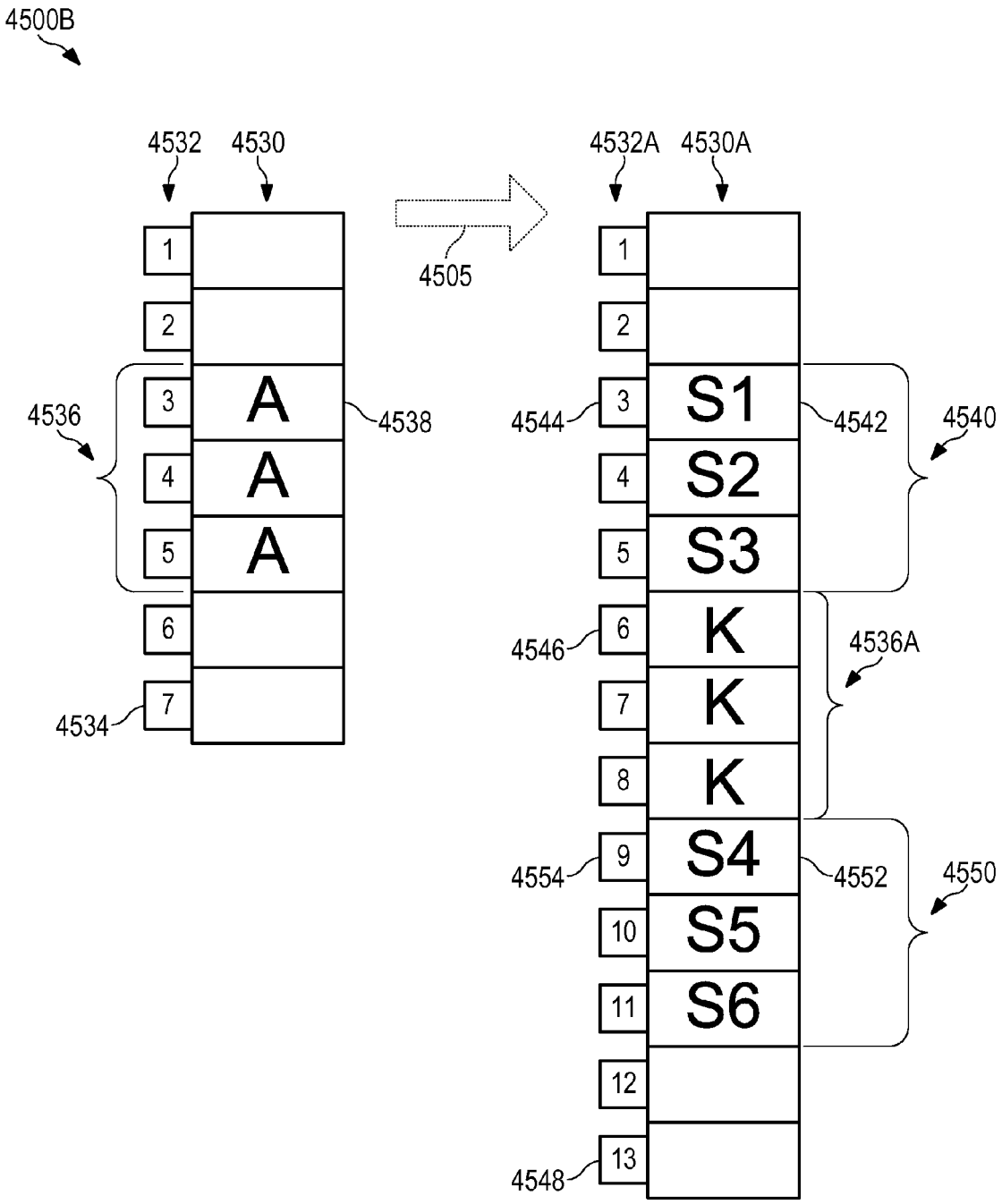
FIG. 45B is another illustration of stacking game play on a gaming device, according to one embodiment.

In FIG. 45B, another illustration of stacking symbol game play is shown, according to one embodiment. In this example, a reel 4530 has seven reel position which are a first reel position (e.g., the 1 in the box 4534), a second reel position (e.g., the 2 in the box 4534), a third reel position (e.g., the 3 in the box 4534), a fourth reel position (e.g., the 4 in the box 4534), a fifth reel position (e.g., the 5 in the box 4534), a sixth reel position (e.g., the 6 in the box 4534), and a seventh reel position (e.g., the 7 in the box 4534). In this example, a stacking area 4536 includes the third reel position, the fourth reel position, and the fifth reel position and is 3 units in length and filled with a first stacking symbol 4538 (e.g., an Ace in all three units—A, A, A) is utilized for a first spin.

In one example, the system, device, and/or method may insert a first inserted symbol area 4540 that starts at the beginning position (reference number 4544 for the third reel position) for the stacking area 4536 and is the same number of units as the stacking area 4536 (in this example 3 units). It should be noted that the number of units may be greater than and/or less than the units utilized for the stacking area 4536. Further, a second inserted symbol area 4550 may be inserted. This second inserted symbol area 4550 may be utilized as a buffer against a second stacking area (not shown) which was utilized for a first spin to ensure that there is not stacking symbol overlap between the first spin and the second spin when the stacking symbols are different stacking symbols utilized for the first spin as compared to the second spin. In this example, the first inserted symbol area 4540 is filed with non-stacking symbols 4542 (e.g., S1, S2, S3, etc.) for a second spin and stacking area 4536 from the first spin has moved to a second stacking area 4536A with a second stacking symbol (e.g., King—K, K, K). In addition, second inserted symbol area 4550 is filed with non-stacking symbols 4552 (e.g., S4, S5, S6, etc.). In this example, second stacking area 4536A starts at a sixth reel position (e.g., the 6 in the box—reference number 4546) and ends at eighth reel position (e.g., the 8 in the box). In this example, there are no errors because even though the stacking symbol has changed (e.g., going from an Ace to a King), there is no overlap between the stacking area 4536 used for the first spin and second stacking area 4536A used for the second spin.

Figure 45C:
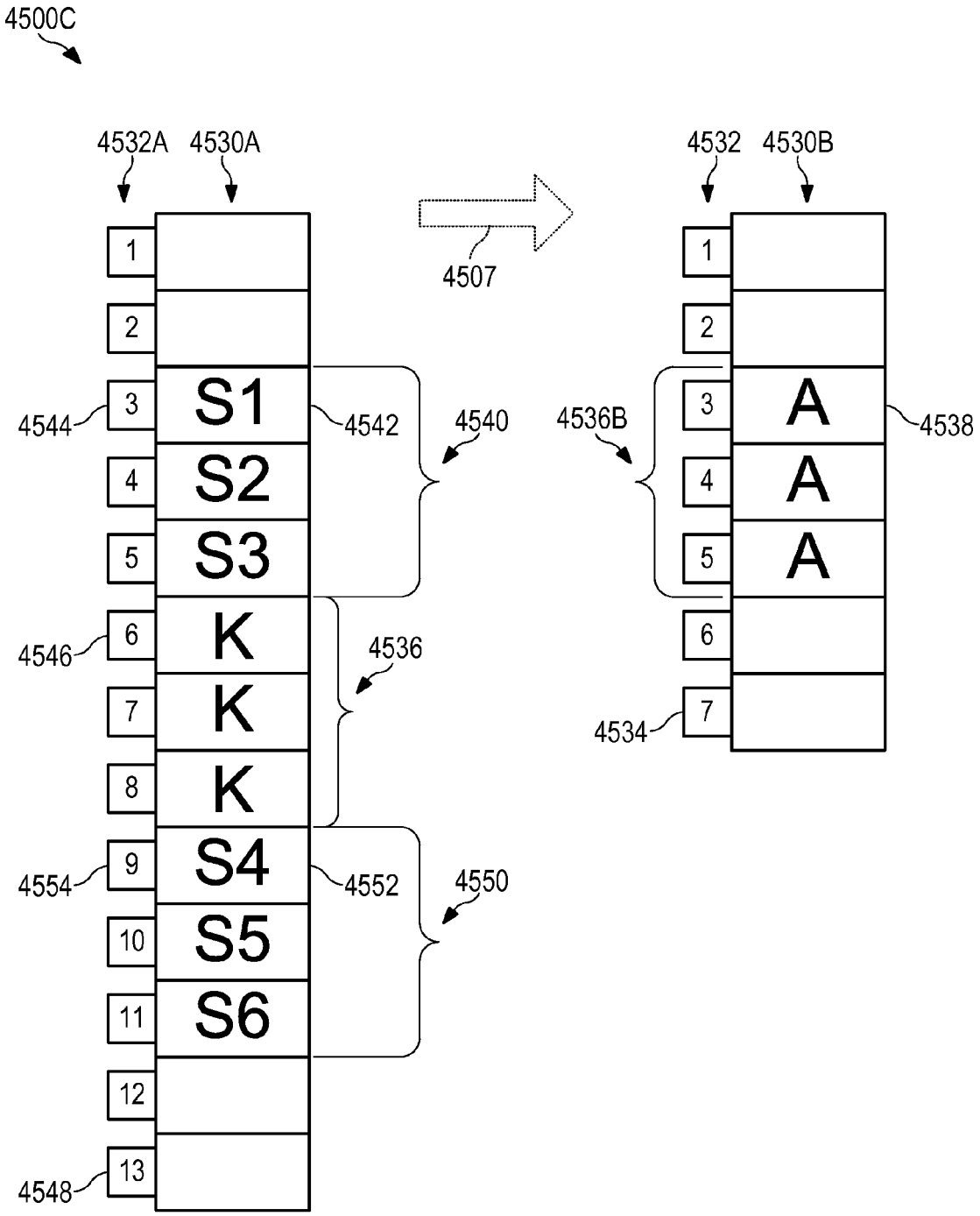
FIG. 45C is another illustration of stacking game play on a gaming device, according to one embodiment.

In addition as shown in FIG. 45C, the system, device, and/or method may remove the first inserted symbol area 4540 and/or the second inserted symbol area 4550 utilized in the first spin so that the first inserted symbol area 4540 and/or the second inserted symbol area 4550 are not utilized for a third spin 4507. In this example, third stacking area 4536B utilized for third spin is in the same location (e.g., reel positions 3-5) as where utilized for stacking area 4508 for first spin (see FIG. 45A). However, any area may be utilized and this area was utilized for easy of illustrations. In this example, there are no errors because even though the stacking symbol has changed (e.g., going from a King to an Ace), there is no overlap between the second stacking area 4536A used for the second spin and third stacking area 4536B used for the third spin.

Figure 45D:
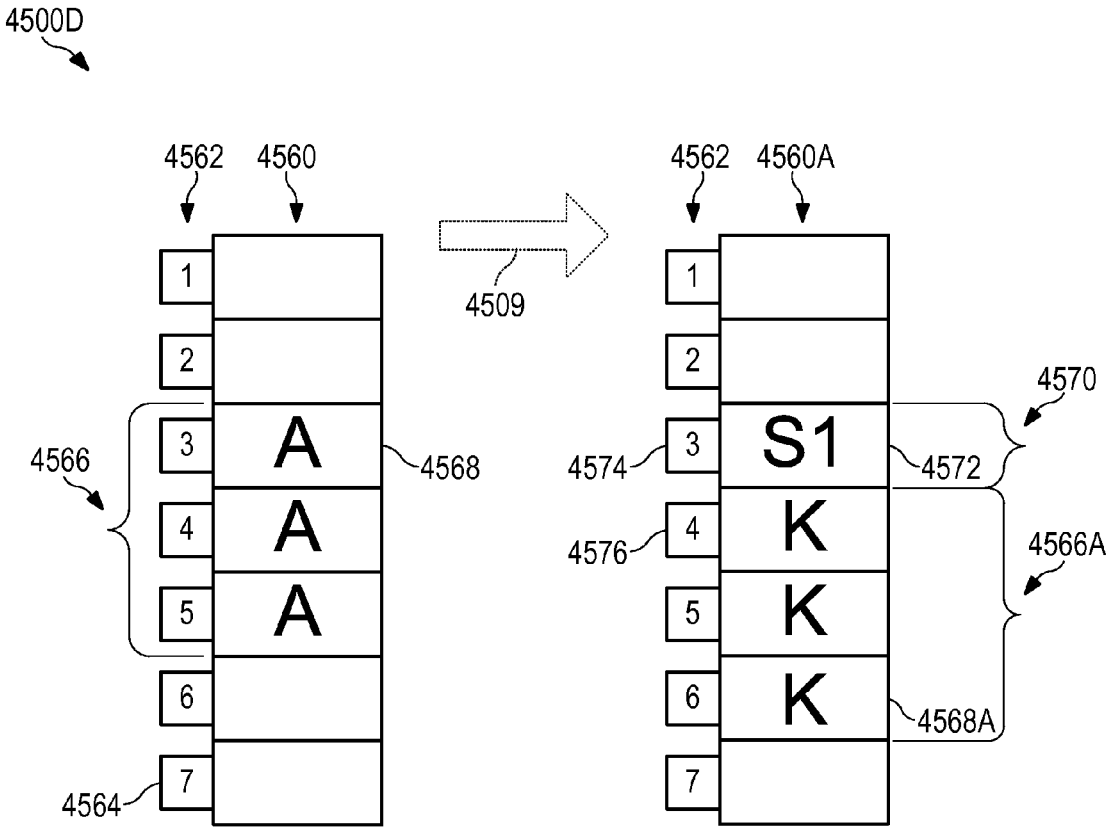
FIG. 45D is another illustration of stacking game play on a gaming device, according to one embodiment.

In FIG. 45D, another illustration of stacking symbol game play is shown, according to one embodiment. In this example, an error has occurred between a first spin of a reel 4560 and a second spin of the reel 4560A. During a first spin, a first spin stacking area 4566 had a first stacking symbol 4568 (e.g., an Ace—A, A, A) used in all 3 units and occupied reel positions 3-5. In this example, an insert symbol area 4570 used for the second spin of the reel 4560A has a non-stacking symbol (e.g., S1) in it and is 1 unit long. Further, a second spin stacking area 4566A had a second stacking symbol 4568A (e.g., a King—K, K, K) used in all 3 units and occupied reel positions 4-6. In this example, there are two overlapping stacking positions (e.g., reel positions 4 and 5) between the stacking area (e.g., first spin stacking area 4566) utilized for the first spin and the stacking area (e.g., second spin stacking area 4566A utilized for the second spin) and the stacking symbol utilized for the first spin (A) is different than the stacking symbol (K) utilized for the second spin—Therefore, an error has occurred.

Figure 45E:
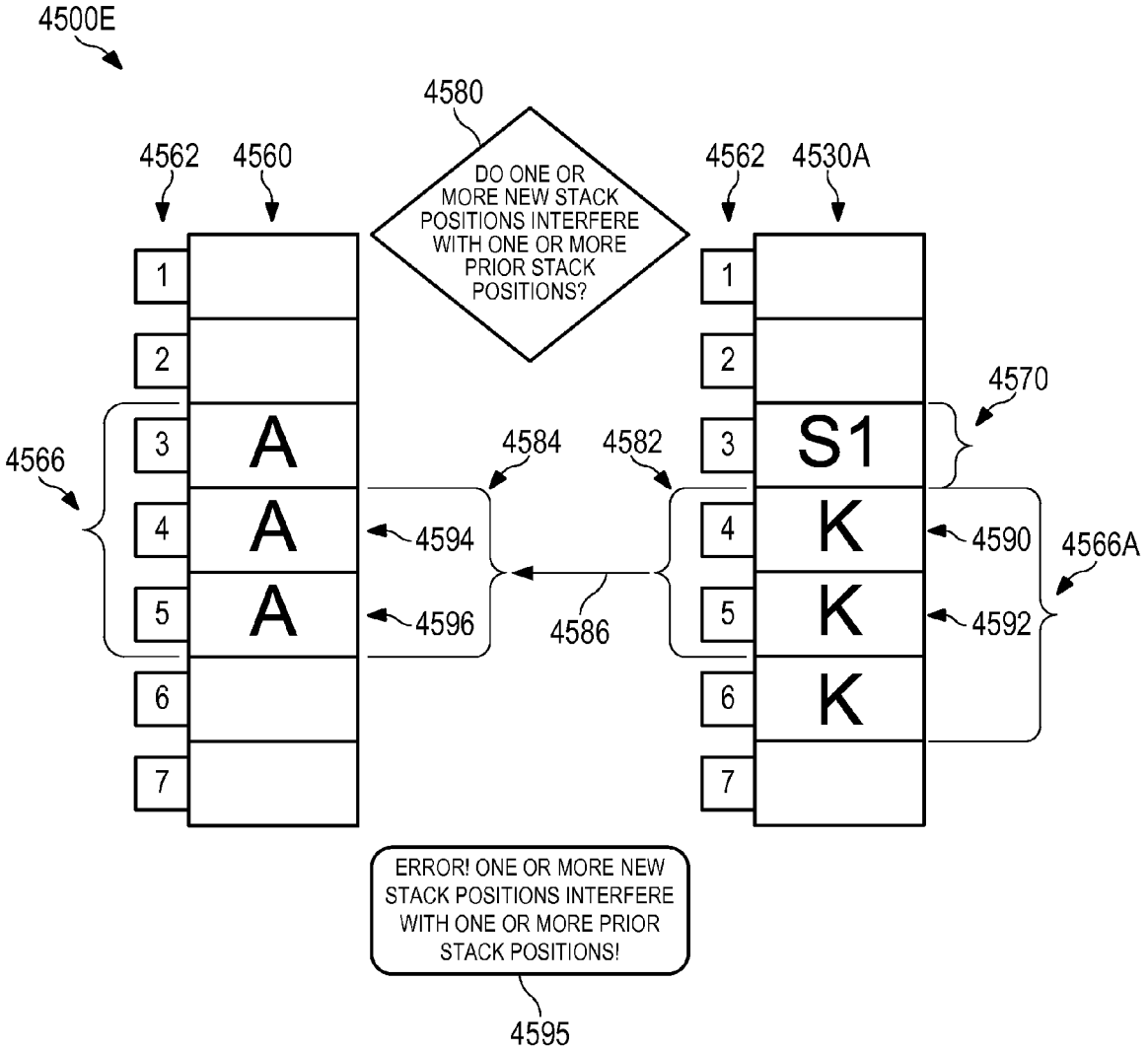
FIG. 45E is another illustration of stacking game play on a gaming device, according to one embodiment.

Further in this example shown in FIG. 45E, an error message and/or function is initiated because a first first spin stacking reel position 4594 used with a first stacking symbol for the first spin overlaps with a first second spin non-compliant stacking reel position 4590 used with a second stacking symbol for the second spin (where the first stacking symbol and the second stacking symbol are different symbols). Further, a second first spin stacking reel position 4596 used with a first stacking symbol for the first spin overlaps with a second second spin non-compliant stacking reel position 4592 used with a second stacking symbol for the second spin (where the first stacking symbol and the second stacking symbol are different symbols). This error can be corrected by replacing the second stacking symbol with the first stacking symbol so that the same stacking symbol is utilized for both a first spin and a second spin. This error can be corrected by moving the second non-compliant stacking are 4566A to a location that creates no overlapping positions between the stacking areas utilized for the first spin and the stacking areas utilized for a second spin. This error can be correct by changing the symbols in the non-compliant positions to non-stacking symbol. Any of these remedies may be combined.

Figure 46:
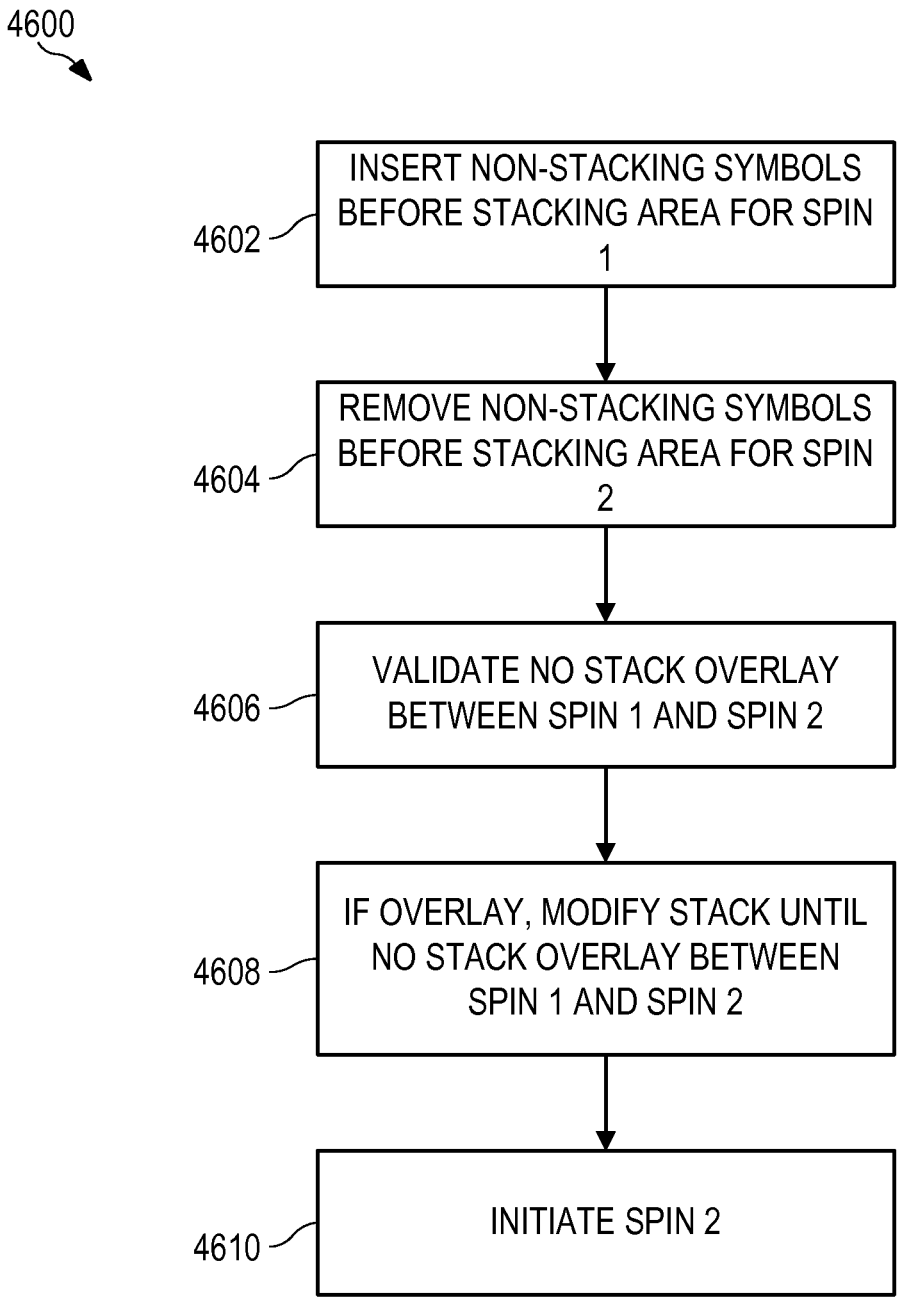
FIG. 46 is a flow diagram for game play, according to one embodiment.

In FIG. 46, a game play flow diagram is shown, according to one embodiment. In one example, the method may include one or more processors inserting non-stacking symbols before a stacking area utilized for a first spin (step 4602). The method may include completing the first spin. The method may include removing non-stacking symbols before a stacking area for a second spin (step 4604). The method may include validating that no stacking symbols are overlaid between spin 1 and spin 2 (step 4606). The method may include one or more processors determining if there is an overlay and if there is an overlay modifying one or more stacking symbol areas until there are no stacking overlays between spin 1 and spin 2 (step 4608). The method may include initiating spin 2.

In one example utilizing as a starting point a first spin, the system, device, and/or method generates, places, and/or displays a first stacking area have from 2 to N stacking symbol reel positions which utilize a first stacking symbol as the stacking symbol for each reel position. For clarity, the first stacking symbol reel positions will be assumed to be 10 units in length starting at reel position 100 and ending at reel position 109. In this example, an insert symbol area is inserted after the first spin is completed so that it can be used for the second spin of the reel. The inserted symbol area has non-stacking symbols (e.g., S1, S2, S3, etc.) located in one or more reel positions located inside of the inserted symbol area and for clarity purposes is 5 units long.

Further, the system, device, and/or method generates, places, and/or displays a second stacking area have from 2 to N stacking symbol reel positions which utilize a second stacking symbol (which is different than the first stacking symbol utilized for the first spin) as the stacking symbol for each reel position. For clarity, the second stacking symbol reel positions will be assumed to be 10 units in length starting at reel position 105 and ending at reel position 114 (because inserting the non-stacking symbols has moved the starting position from 100 to 105 and the ending position from 109 to 114—In other words, 5 units). In this example, there are five overlapping stacking positions (e.g., reel reel positions 105 to 109) between the first stacking area utilized for the first spin and the second stacking area utilized for the second spin and since the stacking symbol utilized for the first spin (e.g., first stacking symbol) is different than the stacking symbol utilized for the second spin (e.g., second stacking symbol), an error has occurred.

Figure 47:
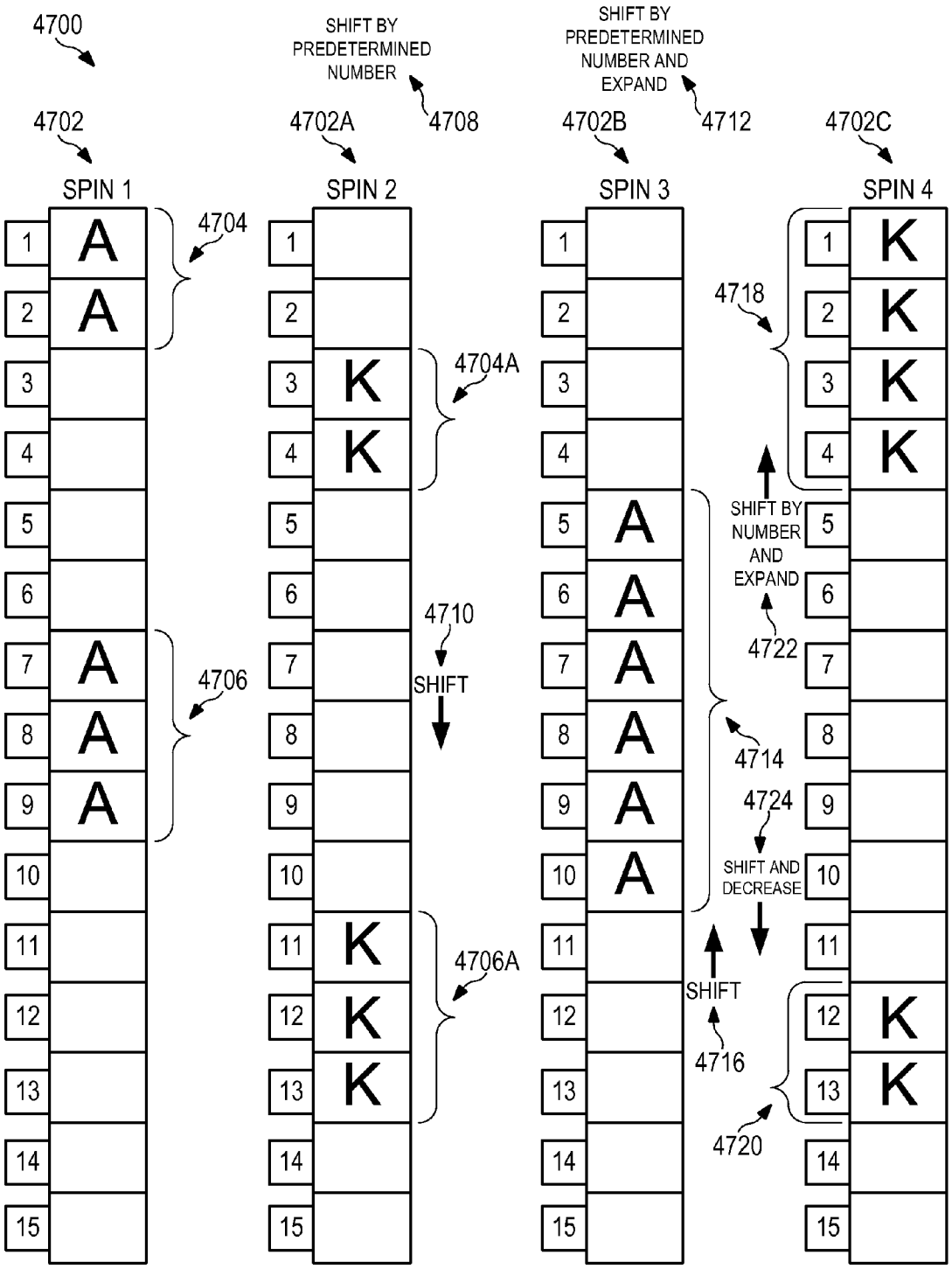
FIG. 47 is another illustration of stacking game play on a gaming device, according to one embodiment.

In FIG. 47, an illustration of a stacking game play is shown, according to one embodiment. A first image 4700 may include a reel that is utilized for a first spin 4702, a second spin 4702A, a third spin 4702B, and a fourth spin 4702C (and/or an Nth spin). For illustration and clarity purposes, the reel is shown with 15 reel positions (e.g., 1 to 15). However, any number of reel positions (e.g., 1-N) can be utilized. During first spin 4702, the reel may include a first stacking area 4704, a second stacking area 4706, and non-stacking areas (e.g., reel positions 3, 4, 5, 6, 10, 11, 12, 13, 14, and 15). In this example, first stacking area 4704 may be at reel positions 1 and 2 (e.g., 2 units long), while second stacking area 4706 may be at reel positions 7, 8, and 9 (e.g., 3 units long). In this example, both first stacking area 4704 and second stacking area 4706 utilized a first stacking symbol (e.g., An Ace). Further in this example, the first stacking area 4704A was shifted by a first predetermined number (e.g., 2 units down) of reel positions for second spin 4702A while the second stacking area 4706A was shifted by a second predetermined number (e.g., 4 units down) of reel positions for second spin 4702A. In another example, the first stacking area 4704A was shifted a third predetermined number (e.g., 2 units down) of reel positions for third spin 4702B and first stacking area 4704A was expanded by a first predetermined number (e.g., 1 unit) for third spin 4702B while the second stacking area 4706A was shifted by a fourth predetermined number (e.g., 3 units up) and could have expanded (but did not in this illustration) by a second predetermined number (e.g., 1-N) of reel positions for third spin 4702B. Further, the stacking symbol could have changed. However, any number of units may be utilized to expand one or more stacking areas. By the shifting of first stacking area 4704A and second stacking area 4706A, an extended stack 4714 was formed. Extended stack 4714 is 6 units long and located at reel positions 5-10 and utilizes first stacking symbol (e.g., an Ace). In another example, the first stacking area 4718 was shifted a fifth predetermined number (e.g., 4 units up) of reel positions for fourth spin 4702C and first stacking area 4718 was expanded by a third predetermined number (e.g., 1 unit) for fourth spin 4702C while the second stacking area 4720 was shifted by a fourth predetermined number (e.g., 3 units down) and decreased by a sixth predetermined number (e.g., 2 units) of reel positions for fourth spin 4702C (Note: The stacking symbol may also change). However, any number of units may be utilized to expand and/or decrease one or more stacking areas. These stacking areas may utilize a second stacking symbol (e.g., a King). In the examples shown in FIG. 47, there were no errors because there were no overlapping stacking reel positions from spin-to-spin. For example, for a first spin there were stacking symbols utilized in reel positions 1-2 and 7-9 while for a second spin there were stacking symbols utilized in reel positions 3-4 and 11-13.

Figure 48:
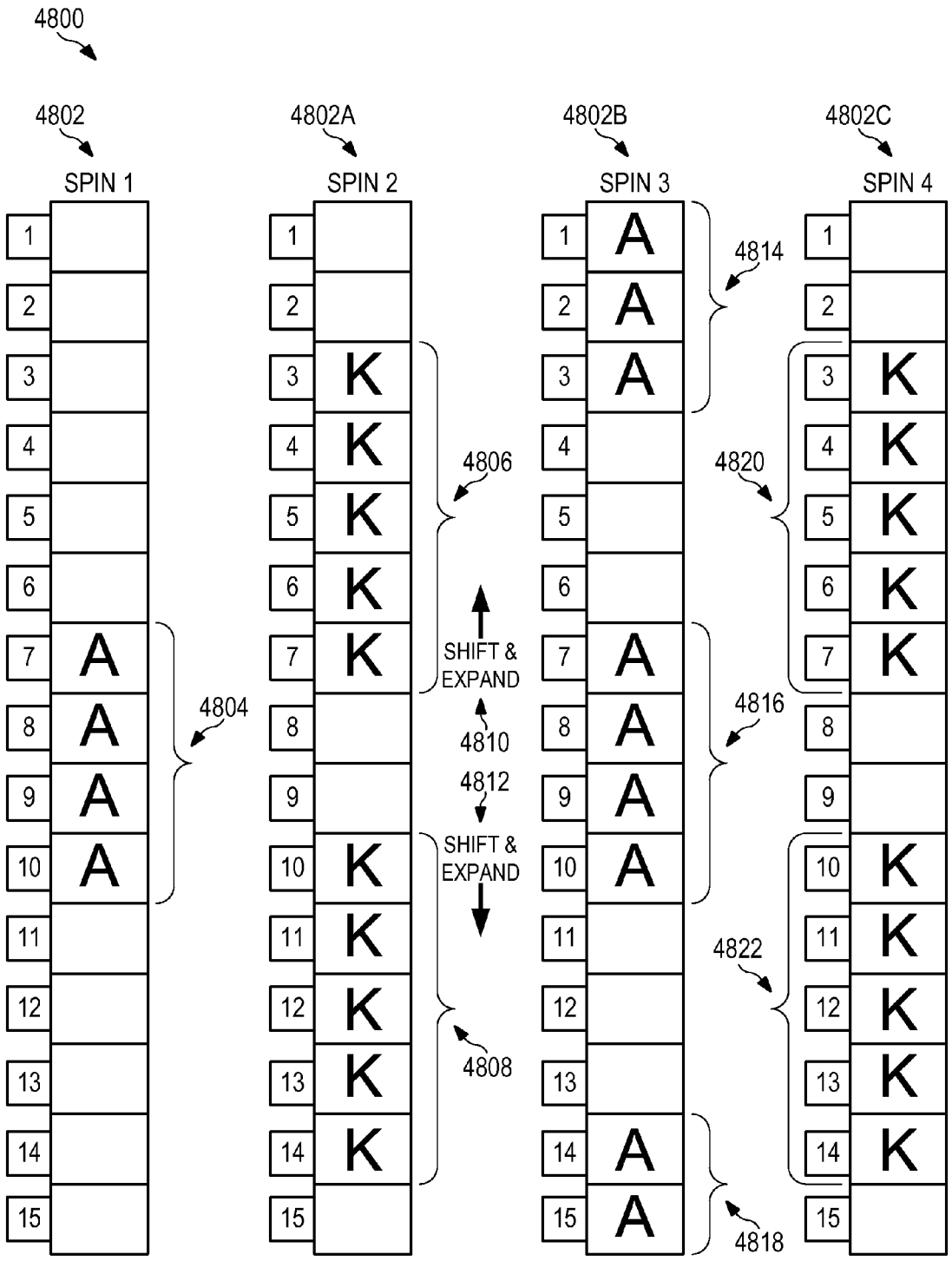
FIG. 48 is another illustration of stacking game play on a gaming device, according to one embodiment.

In FIG. 48, a stacking area game play illustration is show, according to one embodiment. A second image 4800 may include a reel which is shown for a first spin 4802, a second spin 4802A, a third spin 4802B, and a fourth spin 4802C (and/or Nth spin). In this example, a first stacking area 4804 is utilized with a first stacking symbol (e.g., an Ace) for a first spin 4802. The first stacking area 4804 is divided into two stacks, shifted up, shifted down, and expanded for a second spin 4802A. In this example, first stacking area 4804 becomes a second stacking area 4806 (shifted up by 4 units and expanded by 3 units and changed stacking symbol) and a third stacking area 4808 (shifted down by 1 unit and expanded by 3 units) for second spin 4802A and changed stacking symbol. In this example, an error message may not be initiated and/or an error procedure may not be initiated because there is only one overlapping reel position for both the second stacking area 4806 (e.g., reel position 7) from first spin 4802 to second spin 4802A (when comparing the second stacking area 4806 to first stacking area 4804) and the third stacking area 4808 (e.g., reel position 10) from first spin 4802 to second spin 4802A (when comparing the third stacking area 4808 to first stacking area 4804). This may be because one symbol in one reel position may not be considered a stacking symbol. Therefore, it may require two or more symbols in two or more adjacent reel positions for an error to occur.

Figure 49:
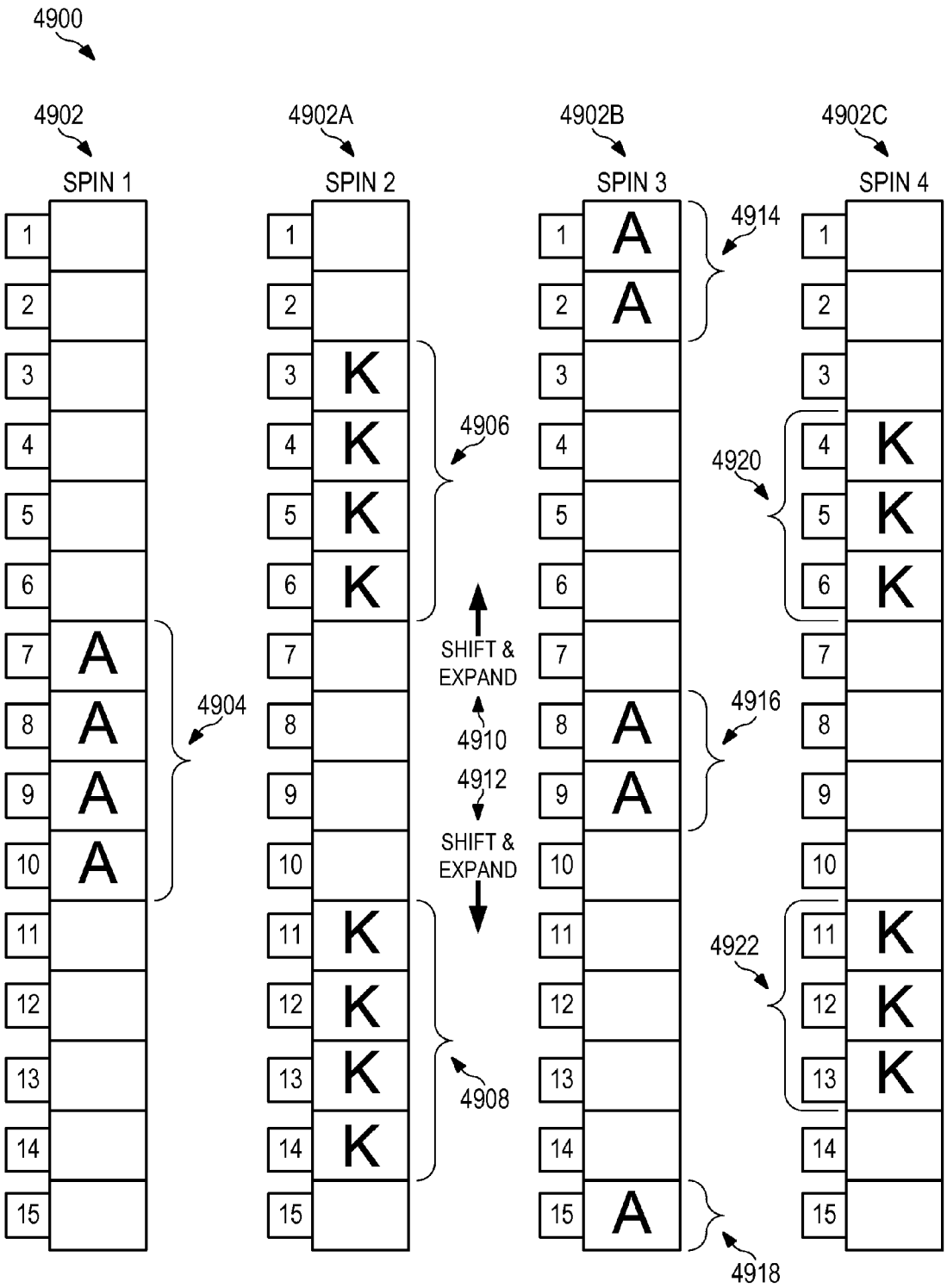
FIG. 49 is another illustration of stacking game play on a gaming device, according to one embodiment.

Further in another example, an error message may be initiated and/or an error procedure may be initiated because there is one overlapping reel position for both the second stacking area 4806 (e.g., reel position 7) from first spin 4802 to second spin 4802A (when comparing the second stacking area 4806 with a first stacking symbol (e.g., an Ace) to first stacking area 4804 with a second stacking symbol (e.g., a King)) and the third stacking area 4808 (e.g., reel position 10) from first spin 4802 to second spin 4802A (when comparing the third stacking area 4808 to first stacking area 4804). In these examples, the error may be corrected by changing the stacking symbol, moving the stacking symbol, moving the stacking area, any other error correcting method disclosed in this disclosure, and/or any combination thereof. In one example shown in FIG. 49, one or more stacking areas have been moved and/or shrunk to correct these errors.

Further, the second stacking area 4806 may be shifted up by 2 units and decreased in size by 2 units to form a fourth stacking area 4814 for third spin 4802B. In addition, a fifth stacking area 4816 may be created for a third spin 4802B. In addition, the third stacking area 4808 may be shifted down by 3 units and decreased in size by 3 units to form sixth stacking area 4818 for third spin 4802B. Further, the fourth stacking area 4814 has shifted downward by 2 units and been increased in size by 3 units to form seventh stacking area 4820 while the sixth stacking area 4818 has shifted upward by 4 units and been increased in size by 3 units to form eighth stacking area 4822 while fifth stacking area has been eliminated and/or removed.

Figure 50:
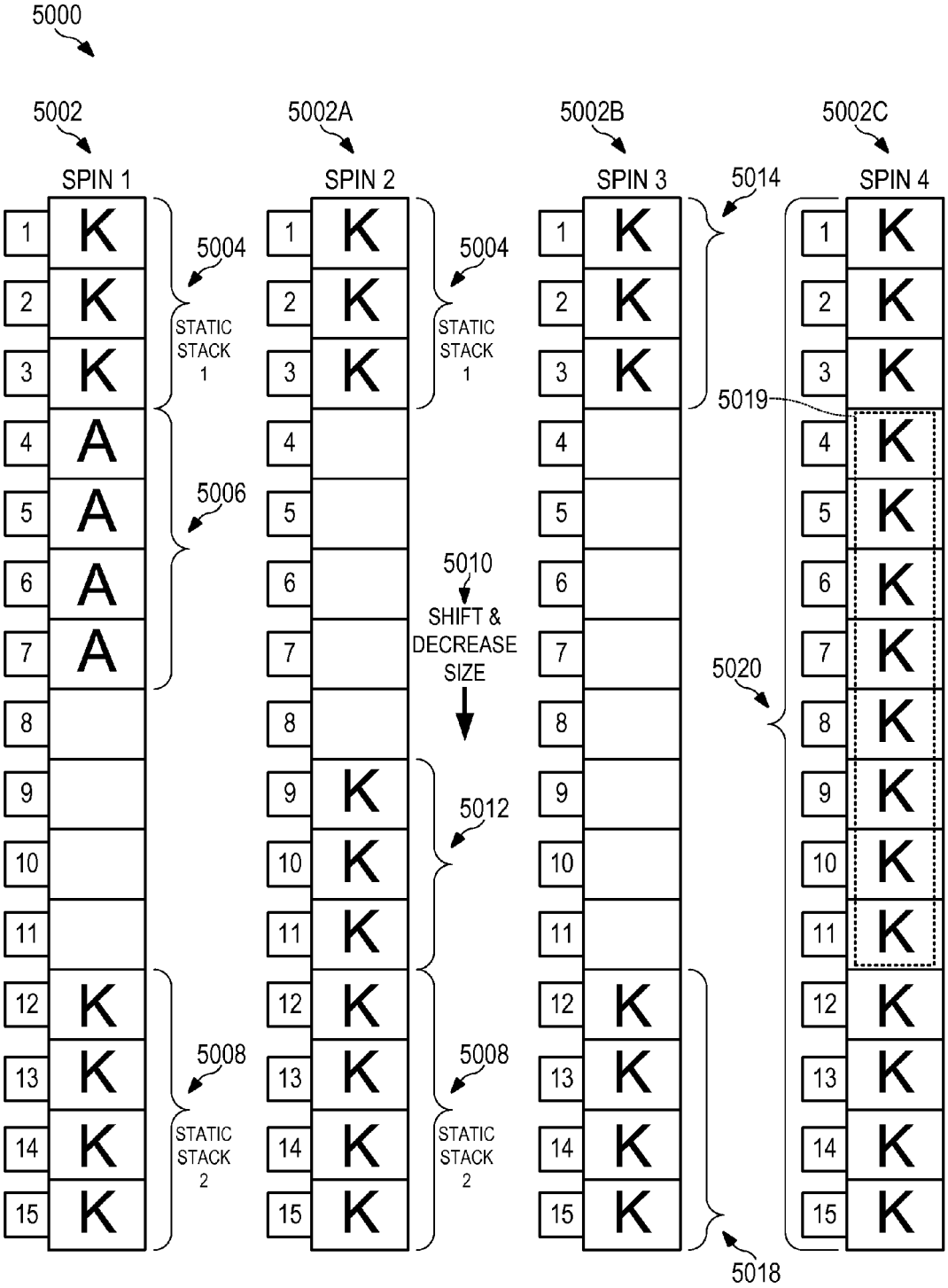

In FIG. 50, another illustration of stacking symbol game play is shown, according to one embodiment. A third image 5000 may include a reel which is utilized for a first spin 5002, a second spin 5002A, a third spin 5002B, and a fourth spin 5002C (and/or an Nth spin). During the first spin 5002, the reel may include a first static stacking symbol area 5004, a first variable stacking symbol area 5006 (up to an Nth variable stacking symbol areas), and a second static stacking symbol area 5008 (up to an Nth static stacking symbol areas). In this example, a static stacking symbol area does not change position and/or stacking symbols from a first spin to a second spin. In other words, the first static stacking symbol area 5004 has the same stacking symbol (e.g., a King) and occupies the same reel positions (e.g., reel positions 1-3) during first spin 5002, second spin 5002A, third spin 5002B, and/or fourth spin 5002C (and/or Nth spin). Whereas, the variable stacking symbol areas may change positions and/or stacking symbols from a first spin to the second spin. In this example, first static stacking symbol area 5004 utilizes a first stacking symbol (e.g., a King) and is located at reel positions 1-3 for first spin 5002. Further, first variable stacking symbol area 5006 utilizes a second stacking symbol (e.g., an Ace) and is located at reel positions 4-7 for first spin 5002. In addition, the second static stacking symbol area 5008 utilizes the first stacking symbol (e.g., the King and/or any other stacking symbol) and is located at reel positions 12-15 for first spin 5002.

Third image 5000 includes second spin 5002A which shows that first static stacking symbol area 5004 remains in the same reel positions (e.g., reel positions 1-3) for second spin 5002A. Also, second static stacking symbol area 5008 remains in the same reel positions (e.g., reel positions 12-15) for second spin 5002A. However, first variable stacking symbol area 5006 from first spin 5002 has shifted (and/or moved) down 5 reel positions and decreased in size by 1 units and now resides at reel positions 9-11 (e.g., first variable stacking symbol area 5012) for second spin 5002A. It should also be noted that a second stacking symbol (e.g., an Ace) used for the first spin 5002 has been changed to a second stacking symbol (e.g., a King). Further, any stacking symbol may be utilized and that the King was used for clarity. In other words, the stacking symbol could have changed from an Ace to a Queen, from an Ace to a Jack, from an Ace to a Ten, from an Ace to a Star, and/or any other symbol. Further, the stacking symbol could change from an Ace to a King to a Star to a Bird to a Car to a Nth type of symbol, etc.

Third image 5000 includes third spin 5002B which shows that first static stacking symbol area 5004 remains in the same reel positions (e.g., reel positions 1-3) for third spin 5002B. Also, second static stacking symbol area 5008 remains in the same reel positions (e.g., reel positions 12-15) for third spin 5002B. However, first variable stacking symbol area 5012 from second spin 5002A has been removed and/or been eliminated for third spin 5002B. Third image 5000 includes fourth spin 5002C (and/or Nth spin) which shows that first static stacking symbol area 5004 remains in the same reel positions (e.g., reel positions 1-3) for fourth spin 5002C (and/or Nth spin). Also, second static stacking symbol area 5008 remains in the same reel positions (e.g., reel positions 12-15) for fourth spin 5002C (and/or Nth spin). However, first variable stacking symbol area 5019 has been regenerated and/or insert and/or created and/or displayed in reel positions 4-11 which when combined with first static stacking symbol area 5004 and second static stacking symbol area 5008 which are all utilizing second stacking symbol (e.g., a King) form a super stacking area 5020. In these examples, there were no error messages and/or error procedures initiated because there were no overlapping areas where a stacking symbol was changed from one spin to another spin (e.g., from a first spin to a second, from a second spin to a third spin, and/or from a third spin to a fourth spin).

Figure 51:
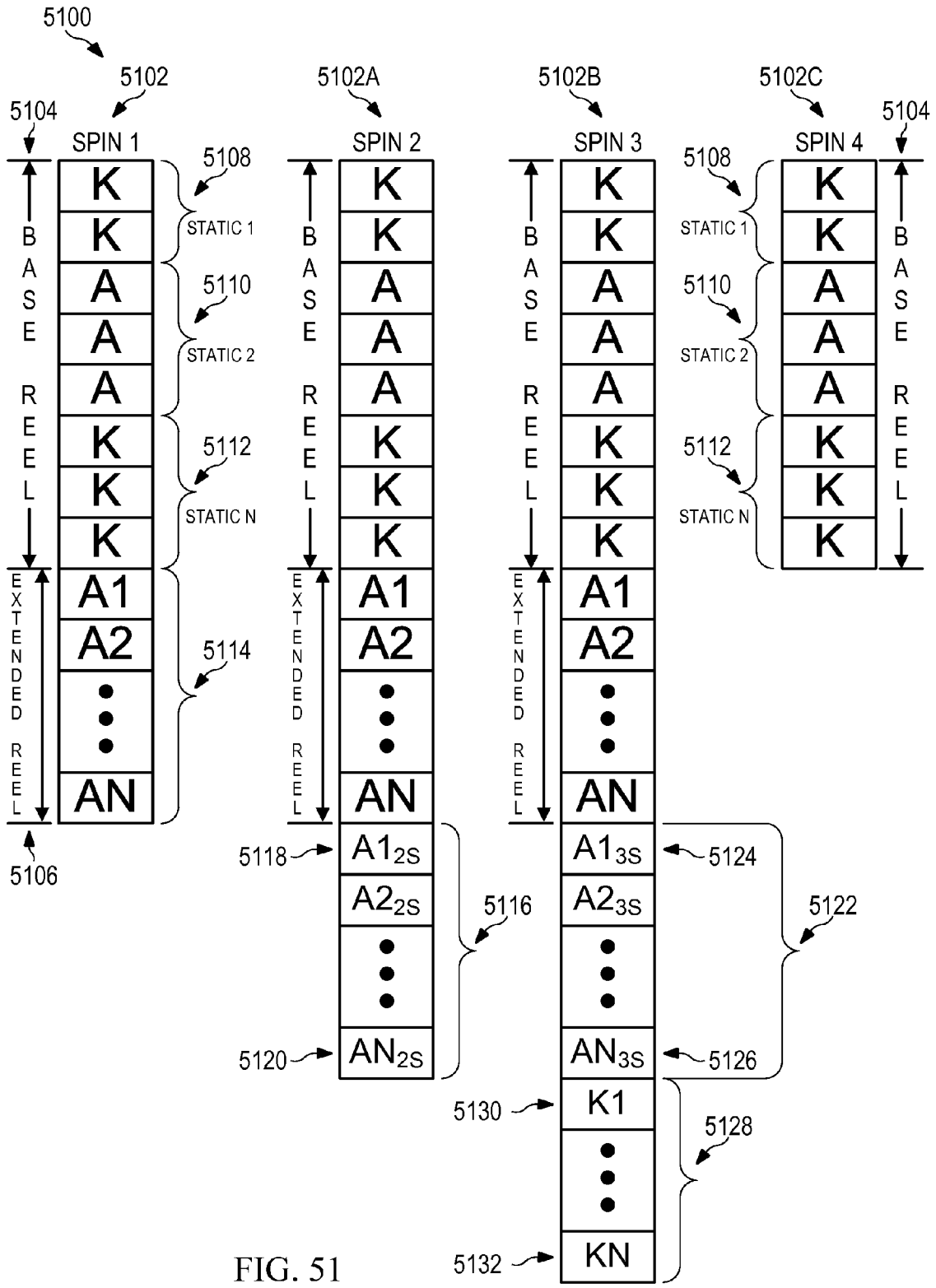

In FIG. 51, a stacking symbol game play is shown, according to one embodiment. A fourth image 5100 may include a reel which is utilized for a first spin 5102, a second spin 5102A, a third spin 5102B, and a fourth spin 5102C (and/or an Nth spin). During the first spin 5102, the reel may include a first static stacking symbol area 5108, a second static stacking symbol area 5110, and up to an Nth static stacking symbol area 5112 within a base reel 5104. Further, there may be one or more non-stacking symbol areas (e.g., symbols that are adjacent to each other but not the same symbol—S1 and S2) and/or one or more non-static symbol areas (e.g., symbol areas that move and/or shift from spin-to-spin). Further, during the first spin 5102, the reel may include an extended reel area 5106 where the extended reel area 5106 may include stacking symbol areas and/or non-stacking symbol areas. In this example, the extended reel area 5106 includes stacking symbols numbered from A1 to AN—A1 to AN are the same symbols but in different extended reel locations (e.g., A, A, A—Corresponding to reel position 1 on the extended reel, reel position 2 on the extended reel, and reel position 3 on the extended reel).

During a second spin 5102A, reel may include the same base reel as in first spin and the same first extended reel section 5114 but now includes another extended reel section 5116 where another extended reel section 5116 may include stacking symbol areas and/or non-stacking symbol areas. In this example, another extended reel section 5116 includes stacking symbols A12S to AN2S which stands for a first symbol in a first another extended reel section for the second spin (e.g., A12S=A=symbol, 1=reel position, 2S=second spin).

During a third spin 5102B, reel may include the same base reel as in first spin and second spin and the same first extended reel section 5114 and the same second extended reel section 5116 but now includes a third extended reel section 5128 where third extended reel section 5118 may include stacking symbol areas and/or non-stacking symbol areas. In this example, third extended reel section 5118 includes stacking symbols K1 to KN. Further, during a fourth spin 5102C, only the base reel section 5104 may be display and the extended reel sections (e.g., first extended reel section 5114, second extended reel section 5116, and third extended reel section 5128) may be eliminated and/or turned off.

Figure 52:
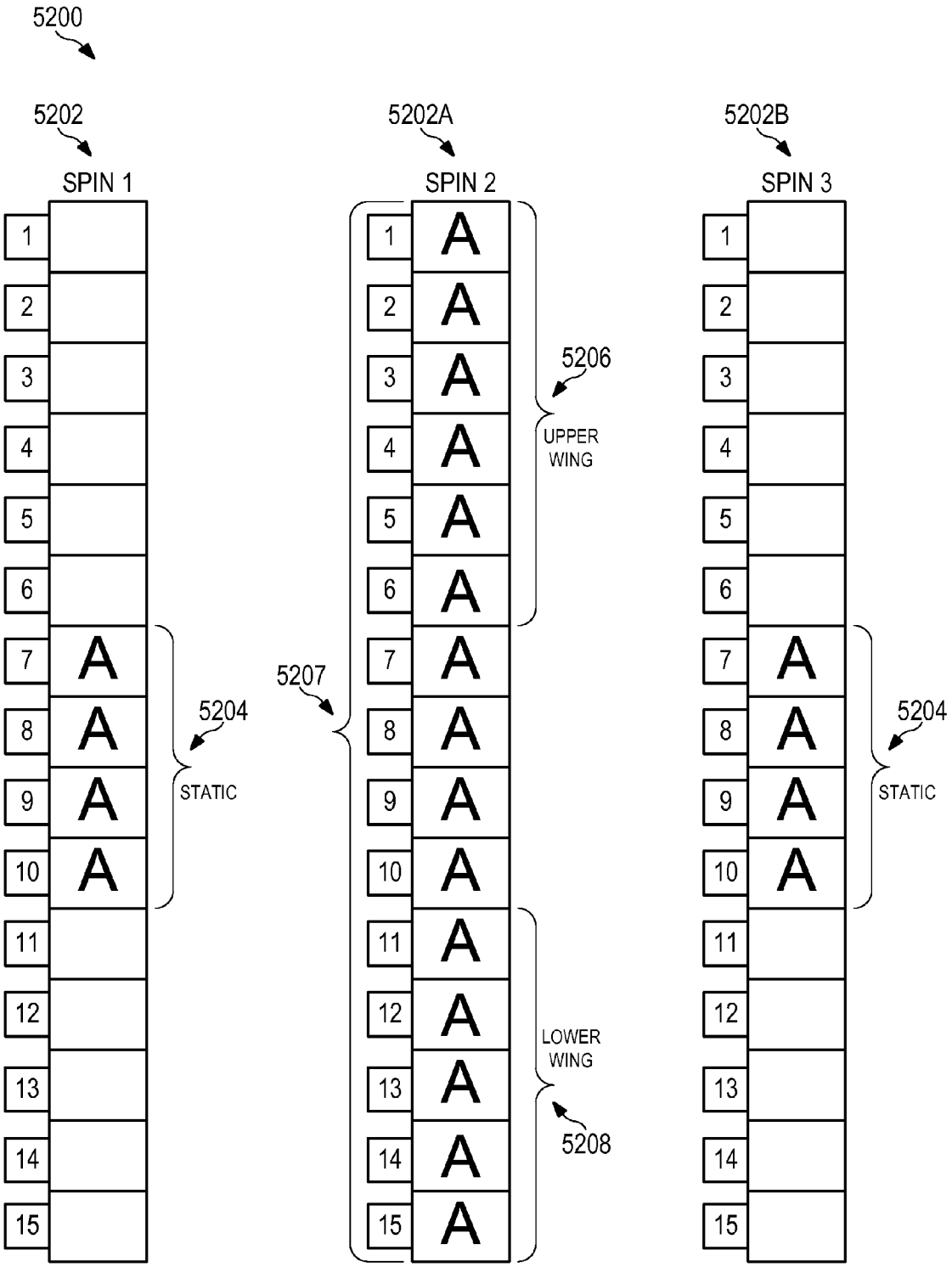

In FIG. 52, a stacking symbol game play is shown, according to one embodiment. A fifth image 5200 may include a reel utilized for a first spin 5202, a second spin 5202, and a third spin 5202B. During the first spin 5202, the reel includes a static stacking symbol area 5204 (and/or up to Nth static stacking symbol areas). During the second spin 5202A, the reel includes the static stacking symbol area 5204 but a first variable stacking symbol area 5206 is added, along with a second variable stacking symbol area 5208 (and/or up to an Nth variable stacking symbol areas) to form a super stacking symbol area 5207. During the third spin 5202B, the first variable stacking symbol area 5206 and/or the second variable stacking symbol area 5208 is removed. In one example, no error may occur when the stacking symbol does not change in a stacking area from a first spin to a second spin.

Figure 53:
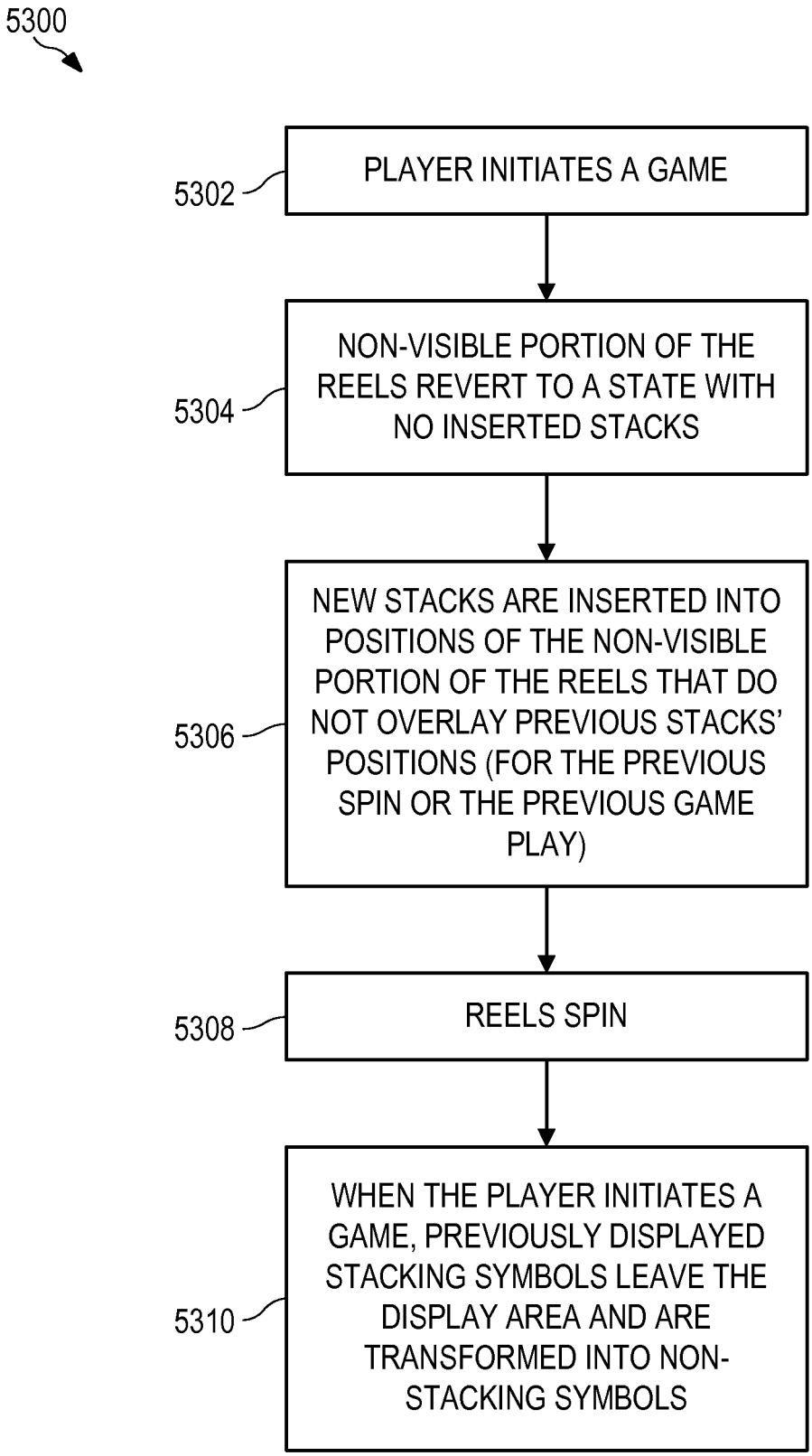

In FIG. 53, a game play process flow is shown, according to one embodiment. The method may include the player initiating game play (step 5302). The method may include one or more processors reverting non-visible portions of the reels to a state with no inserted stacking symbol areas (step 5304). The method may include new stacks being inserted into positions of the non-visible positions of the reels that do not overlay previous stacks' positions (for the previous spin or the previous game play) (step 5306). The method may include the reels spinning (step 5308). The method may include that when the player initiates a game, the previously displayed stacking symbols leave the display area and are transformed into non-stacking symbols (step 5310).

In one example, the gaming device may display three visible stacking areas (any number may be used from 0 to N) for a first spin. Further, the game device may have twenty non-visible stacking areas (any number may be used from 0 to N) which are not displayed but may be presented on the non-visible portion of one or more reels for the first spin. The method may include the player initiating a second spin game play. The method may include one or more processors reverting non-visible portions (the twenty non-visible stacking areas from the first spin) of the reels to a state with no inserted stacking symbol areas. The method may include new stacks being inserted into positions of the non-visible positions of the reels that do not overlay previous stacks' positions (for the previous spin or the previous game play—in other words, no stacking areas where the three visible stacking areas from the first spin were located and no stacking areas where the twenty non-visible stacking areas from the first spin were located if the stacking symbol is going to change—this may occur only if the stacking symbol located in the stacking area changes from a first stacking symbol to a second stacking symbol). If the stacking symbol remains unchanged from a first spin to a second spin, then the stacking area is allowed to remain in the same location from a first spin to a second spin. The method may include the reels spinning. The method may include that when the player initiates a game, the previously displayed stacking symbols leave the display area (e.g., the three visible stacking areas) and are transformed into non-stacking symbols and/or remain the same stacking areas with the same stacking symbols from a first spin to a second spin. In other words, in a five-by-five matrix filed with all Aces that are displayed on a screen with a first non-visible stacking area, a second non-visible stacking area, and an Nth non-visible stacking area, the system, device, and/or method may remove all of the non-visible stacking areas based on a start of a game play. The system, device, and/or method may insert a new first non-visible stacking area, a new second non-visible stacking area, and a new Nth non-visible stacking area into portion of the non-visible reels that do not overlap with old first non-visible stacking area, old second non-visible stacking area, and an old Nth non-visible stacking area when the stacking symbols are changed from the first spin to the second spin (if the stacking symbol does not change, then an overlap may be permitted). The system, device, and/or method may spin the reels and as the five-by-five matrix filed with all Aces leaves the display screen this area transforms into a non-stacking area unless the stacking area is going to utilize Aces again.

Figure 54A:
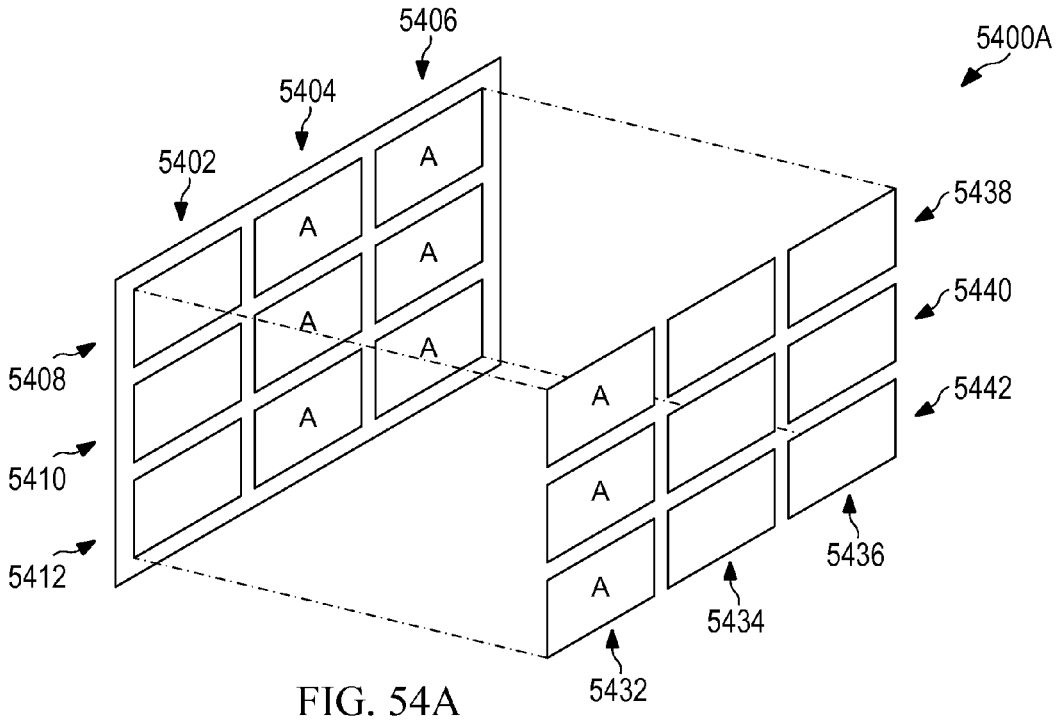
Figure 54B:
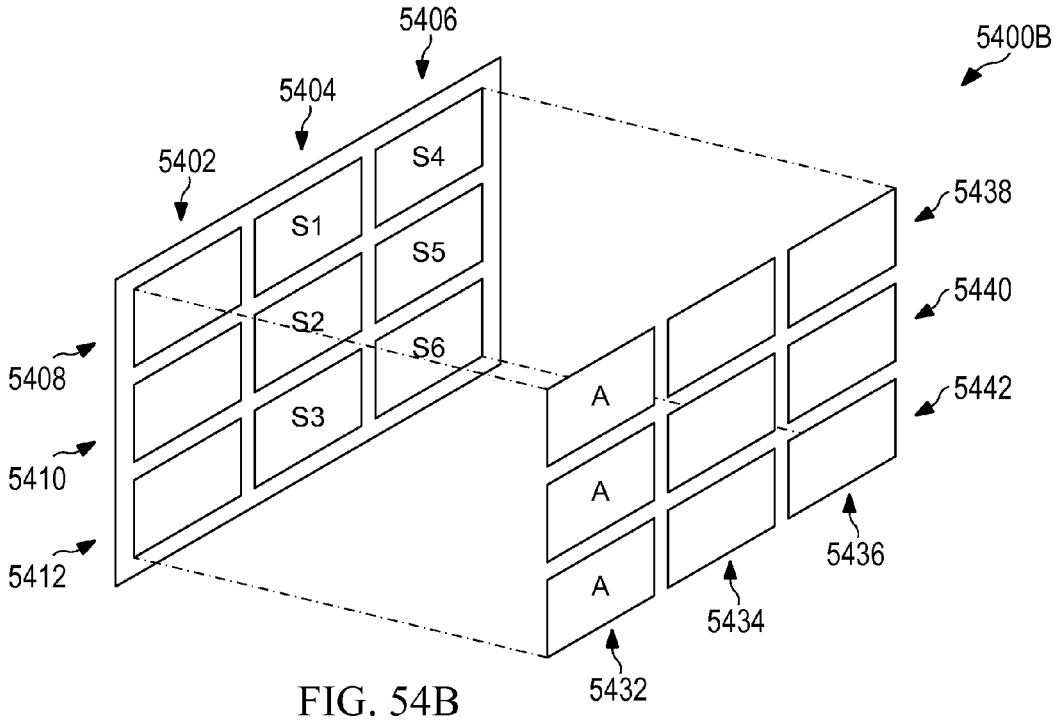

In FIG. 54A, a stacking symbol game play is shown, according to one embodiment. In this example, a plurality of display areas are located in a first column 5302, a second column 5304, and/or an Nth column 5306. Further, a plurality of display areas are located in a first row 5308, a second row 5310, and/or an Nth row 5312. In this example, one or more overlays (e.g., reference numbers 5332, 5334, 5336, 5338, 5340, and/or 5342) may have one or more stacking symbols and be overlaid onto the plurality of display areas (also See FIG. 54B).

In FIG. 55A, a stacking symbol game play matrix is shown, according to one embodiment. In one example, a matrix 5500A may include a title section 5516 which has a reel stop area 5502, a reel 1 area 5504, a reel 2 area 5506, a reel 3 area 5508, a reel 4 area 5510, a reel 5 area 5512, and a weight area 5514. In this example, a zero reel stop 5518 may have a reel stop number of zero, a reel 1 area of A, a reel 2 area of A, a reel 3 area of K, a reel 4 area of K, a reel 5 area of K, and a weight number of 1. Whereas, a 1 reel stop may have a reel stop number of one, a reel 1 area of Q, a reel 2 area of Q, a reel 3 area of Q, a reel 4 area of Q, a reel 5 area of Q, and a weight number of 2. Further, a 2 reel stop may have a reel stop number of two, a reel 1 area of K, a reel 2 area of K, a reel 3 area of K, a reel 4 area of Q, a reel 5 area of Q, and a weight number of 3. In addition, a 3 reel stop may have a reel stop number of three, a reel 1 area of K, a reel 2 area of K, a reel 3 area of K, a reel 4 area of K, a reel 5 area of K, and a weight number of 1. There may be any number (e.g., 1 to N) of reel stops, any number (e.g., 1 to N) of reels, and any number (e.g., 1 to N) of weightings may be utilized.

In FIG. 55B, a second matrix 5500B is shown, according to one embodiment. Second matrix 5500B may include a title section 5540 which has a reel stop area 5522, a reel 1 area 5524, a first location area 5526, a first count area 5528, a reel 2 area 5530, a second location area 5532, a second count area 5534, an etc. area 5536, and a weight area 5538. In this example, a zero reel stop 5542 may have a reel stop number of zero, a reel 1 area of A, a first location area of 0, a first count area of 5, a reel 2 area of A, a second location area of 3, a second count area of 7, and a weight number of 1. Further, a 1 reel stop may have a reel stop number of one, a reel 1 area of Q, a first location area of 0, a first count area of 6, a reel 2 area of Q, a second location area of 3, a second count area of 7, and a weight number of 2. In addition, a 2 reel stop may have a reel stop number of two, a reel 1 area of K, a first location area of 0, a first count area of 7, a reel 2 area of K, a second location area of 4, a second count area of 7, and a weight number of 3. Further, a 3 reel stop may have a reel stop number of three, a reel 1 area of K, a first location area of 3, a first count area of 2, a reel 2 area of K, a second location area of 4, a second count area of 7, and a weight number of 1.

Figure 55C:
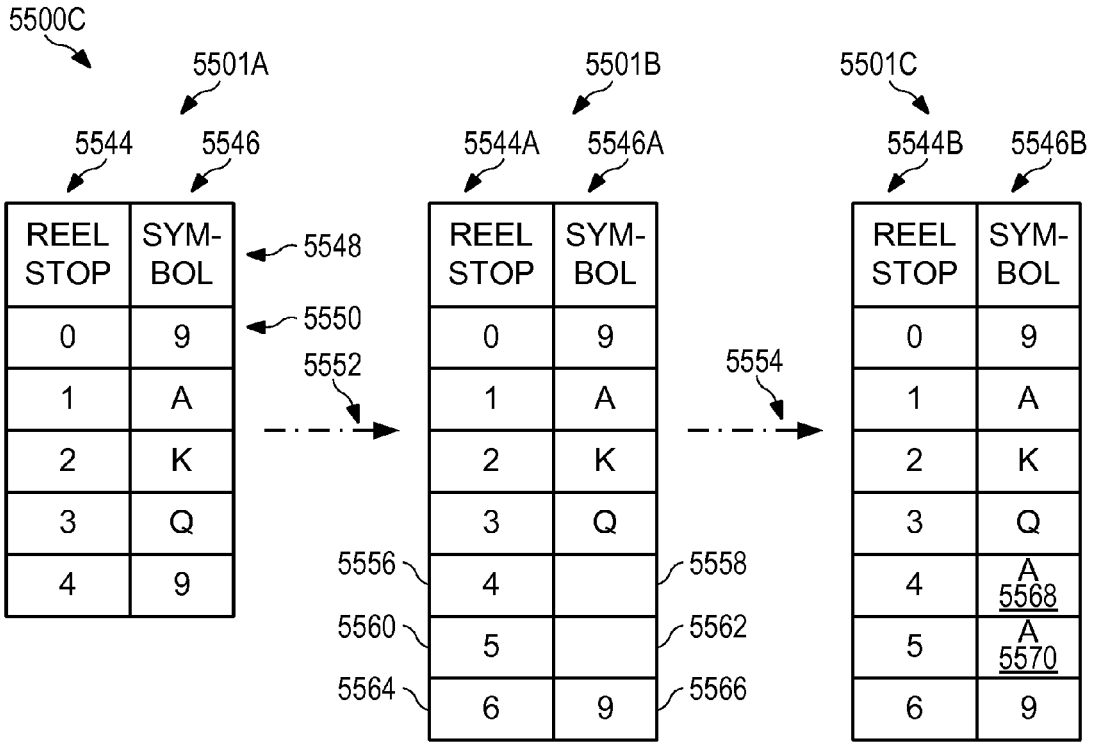

In FIG. 55C, a stacking symbol game play is shown, according to one embodiment. In this example, a first reel matrix 5501A is partially shown with five reel positions (e.g., reel positions 0 to 4). In this example, a second reel matrix 5501B is partially shown with the insertion of cell elements 5556 and 5560. Further, a third reel matrix 5501C is partially shown where the inserted reel elements now contain stacking symbols (e.g., A, A or reference numbers 5568 and 5570).

Figure 55D:
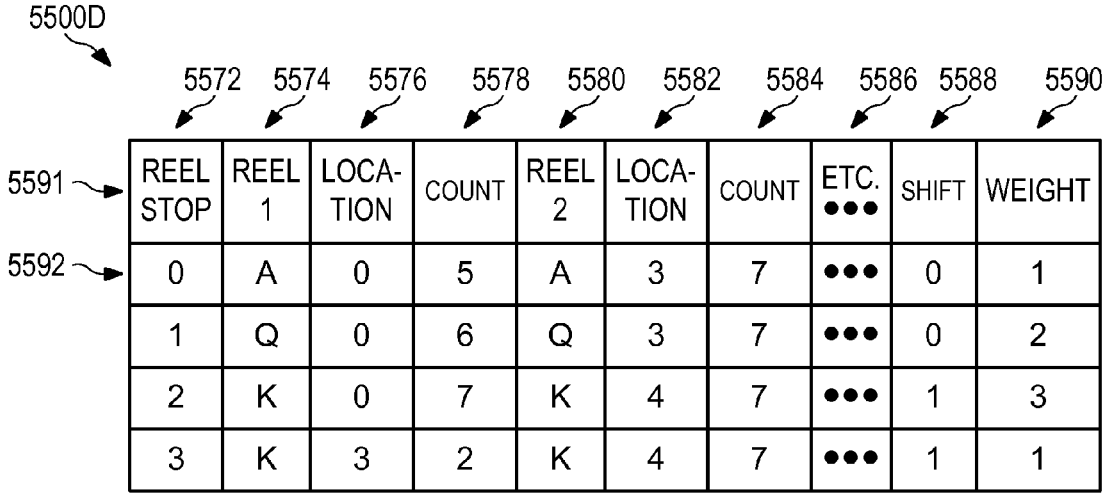

In FIG. 55D, a third matrix 5500D is shown, according to one embodiment. Third matrix 5500D may include a title section 5552 which has a reel stop area 5572, a reel 1 area 5574, a first location area 5576, a first count area 5578, a reel 2 area 5580, a second location area 5582, a second count area 5584, an etc. area 5586, a shifting area 5588, and a weight area 5590. In this example, a zero reel stop 5552 may have a reel stop number of zero, a reel 1 area of A, a first location area of 0, a first count area of 5, a reel 2 area of A, a second location area of 3, a second count area of 7, a shifting area of 0 and a weight number of 1. Further, a 1 reel stop may have a reel stop number of one, a reel 1 area of Q, a first location area of 0, a first count area of 6, a reel 2 area of Q, a second location area of 3, a second count area of 7, a shifting area of 0, and a weight number of 2. In addition, a 2 reel stop may have a reel stop number of two, a reel 1 area of K, a first location area of 0, a first count area of 7, a reel 2 area of K, a second location area of 4, a second count area of 7, a shifting area of 1, and a weight number of 3. Further, a 3 reel stop may have a reel stop number of three, a reel 1 area of K, a first location area of 3, a first count area of 2, a reel 2 area of K, a second location area of 4, a second count area of 7, a shifting area of 1, and a weight number of 1.

Figure 55E:
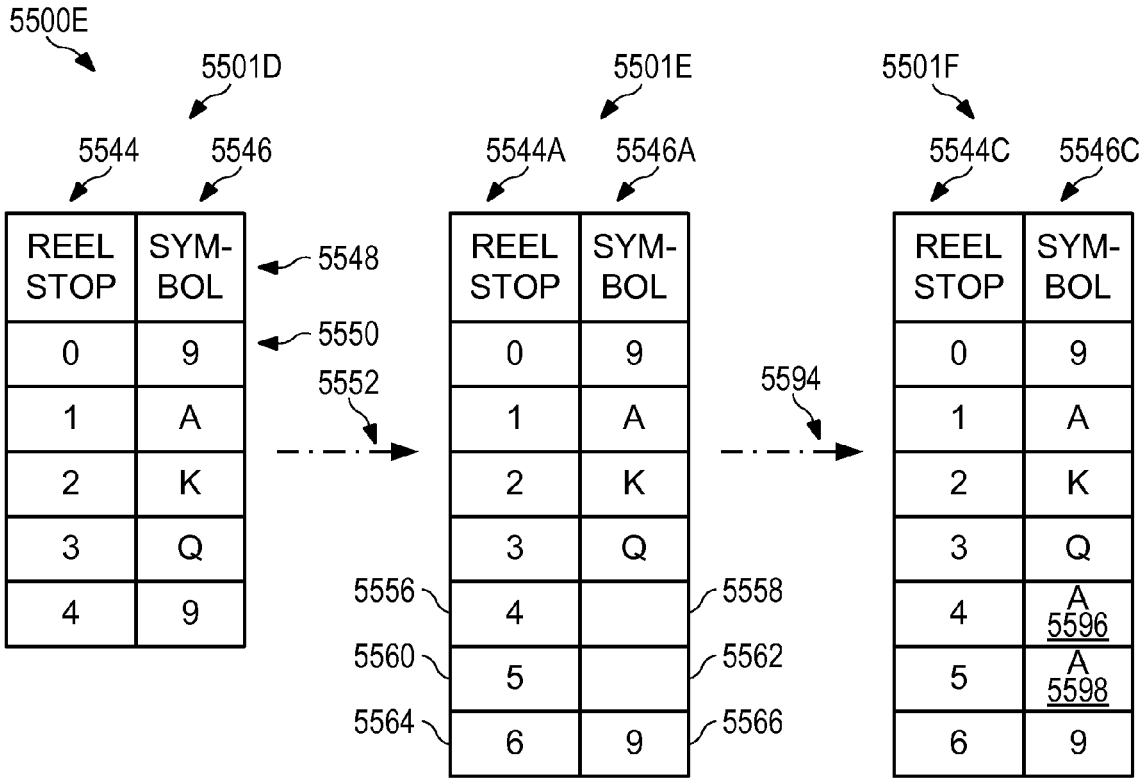

In FIG. 55E, a stacking symbol game play is shown, according to one embodiment. In this example, a fourth reel matrix 5501D is partially shown with five reel positions (e.g., reel positions 0 to 4). In this example, a fifth reel matrix 5501E is partially shown with the insertion of cell elements 5556 and 5560. Further, a sixth reel matrix 5501F is partially shown where the inserted reel elements now contain stacking symbols (e.g., A, A or reference numbers 5596 and 5598).

In this example, a first reel may include a first stacking area, a second stacking area, a third stacking area, a fourth stacking area, and an Nth stacking area which may be turned on and/or off for one or more spins. Further, a second reel may include a first stacking area, a second stacking area, a third stacking area, a fourth stacking area, a fifth stacking area, and an Nth stacking area which may be turned on and/or off for one or more spins. In addition, an Nth reel may include a first stacking area, a second stacking area, a third stacking area, a fourth stacking area, and an Nth stacking area which may be turned on and/or off for one or more spins. In this example, the first reel may have a first stacking area which is turned on; a second stacking area which is turned off; a third stacking area which is turned on; a fourth stacking area which is turned off; and an Nth stacking area which is turned on. In this example, when the stacking area is turned on the stacking symbols are displayed in this stacking area and when the stacking area is turned off the stacking symbols are not displayed but non-stacking symbols are displayed in the turned off stacking areas. Further, the second reel may have a first stacking area which is turned off; a second stacking area which is turned on; a third stacking area which is turned off; a fourth stacking area which is turned off; a fifth stacking area which is turned on; and an Nth stacking area which is turned on. In this example, when the stacking area is turned on the stacking symbols are displayed in this stacking area and when the stacking area is turned off the stacking symbols are not displayed but non-stacking symbols are displayed in the turned off stacking areas. Further, the Nth reel may have a first stacking area which is turned off; a second stacking area which is turned off; a third stacking area which is turned on; a fourth stacking area which is turned on; and an Nth stacking area which is turned on. In this example, when the stacking area is turned on the stacking symbols are displayed in this stacking area and when the stacking area is turned off the stacking symbols are not displayed but non-stacking symbols are displayed in the turned off stacking areas.

The method may include determining one or more stacks to turn on for one or more reels. The method may include turning on one or more stacks for one or more reels. The method may include verifying that no stacking symbols where in the locations of the one or more turned on stacks during the previous spin if the stacking symbol changes. The method may include modifying one or more turned on stacks if a stacking symbol from the previous spin was in a location of the one or more turned on stacks (if different stacking symbols are utilized).

In one example, for any given spin, a first reel may be selected for usage from a plurality of first reels (e.g., Reel 1A, Reel 1B, . . . Reel 1N). In this example, the Reel 1A may include a first stack (e.g., A,A,A) in a first location, a second stack (e.g., K,K,K,K) in a second location, and an Nth stack (e.g., J,J,J,J,J) in an Nth location. In addition, Reel 1B may include a first stack (e.g., A,A) located in a fourth location which has no overlay with the first location, the second location, and/or the third location (if the stacking symbols have changed—A to a K). In this example, Reel 1B may also include a second stack (e.g., K,K,K) located in a fifth location which has no overlay with the first location, the second location, and/or the third location. Further, a third stack on Reel 1B may be inserted at the end of the reel and/or in any other location.

In this example, Reel 1N may include a first stack with four stacking symbols; a second stack with four stacking symbols; and a third stack with five stacking symbols. In this example, for any given spin, an Nth reel may be selected for usage from a plurality of Nth reels (e.g., Reel NA, Reel NB, . . . Reel NN). In this example, the system, device, and/or method may select Reel 1D for reel 1 and Reel 2D for reel 2 and Reel ND for reel N. In this example, the system, device, and/or method may select Reel 1A for reel 1 and Reel 2D for reel 2 and Reel NC for reel N. In these examples, the reel selected from the plurality of reels is selected to ensure that there is no stacking overlays between a first spin and a second spin (if the stacking symbols have changed—A to a K).

The method may include selecting a reel from a plurality of first reels for the first reel to be utilized for a first spin. The method may include selecting a reel from a plurality of the Nth reels for the Nth reel to be utilized from a first spin. The method may include selecting a reel from a plurality of first reels for the first reel to be utilized for a second spin. The method may include selecting a reel from a plurality of Nth reels for the Nth reel to be utilized for a second spin. The method may include verifying the selections for the second spin to ensure no stacking overlays between the first spin and a second spin (if the stacking symbols have changed—A to a K).

In FIG. 56A, an illustration of stacking game play on a gaming device is shown, according to one embodiment. A first image 5600A may include a first reel matrix 5602 which includes a reel 1A 5604, a reel 1B 5606, . . . , and a reel 1N 5610. Reel 1N may be any number from 1 to infinite. Therefore, there may be a plurality of reel 1 options to be utilized as a first reel on a first spin, a second spin, . . . , and an Nth spin. In this example, reel 1A 5604 includes a first stacking area 5612, a second stacking area 5614, and an Nth stacking area 5616. First stacking area 5612 includes a first stacking symbol (e.g., an Ace). Second stacking area 5614 includes a second stacking symbol (e.g., a King). Nth stacking area 5616 includes an Nth stacking symbol (e.g., a Jack). Further, reel 1B 5606 includes a first stacking area 5618, a second stacking area 5620, and a third stacking area 5622 where the third stacking area 5622 is in an extended reel section and/or an inserted section. In one example, a base reel area is a reel area which is utilized for each and every spin, whereas, an extended reel area is a reel area which may be utilized for specific spins (e.g., spin 1, spin 4, spin 10) and not utilized for specific spins (e.g., spins 2-3, 5-9, etc.). First stacking area 5618 includes a first stacking symbol (e.g., an Ace). Second stacking area 5620 includes a second stacking symbol (e.g., a King). Nth stacking area 5622 includes an Nth stacking symbol (e.g., a Queen). In addition, Reel 1N 5610 includes a first stacking area 5624, a second stacking area 5626, and a third stacking area 5628. First stacking area 5624 includes a first stacking symbol (e.g., a Queen). Second stacking area 5626 includes the first stacking symbol (e.g., a Queen). Third stacking area 5622 includes the first stacking symbol (e.g., a Queen). In one example, for a first spin, the system, method, and/or device may select Reel 1B 5606 to be utilized as reel one for the first spin. Further, the system, method, and/or device may select Reel 1A 5604 to be utilized as reel one for a second spin. In addition, the system, method, and/or device may select Reel 1N 5610 to be utilized as reel one for a third spin. In these examples, there would be no errors from a first spin to a second spin because none of the stacking areas overlap between the first spin and the second spin—there would be no errors because none of the stacking areas overlap (e.g., reference numbers 5618, 5620, and 5622 versus reference numbers 5612, 5614, and 5616) with different stacking symbol being utilized for the first spin to the second spin. However, since Reel 1A 5604 was utilized for a second spin and then Reel 1N 5610 was utilized for a third spin, three errors would occur. Since first stack area 5612 for reel 1A 5604 utilizes a first stacking symbol (e.g., an Ace) which is different than the first stacking symbol (e.g., a Queen) for the first stacking area 5624 of Reel 1N 5610, there would be a three symbol area overlap (e.g., reel positions 1-3). Therefore, first stacking area 5624 for the second spin is not in compliance. This may be fixed by converting the Queen symbols into Ace symbols, thereby, utilizing the same stacking symbols in the same locations from the first spin to the second spin. Further, this may be fixed by converting the Queen symbols into non-stacking symbols. In addition, this may be corrected by moving first stacking area 5624 to a compliant position. This may also be corrected by utilizing a different reel 1 option, such as Reel 1B 5606, Reel 1C, Reel 1 D, etc. There would be similar errors for second stacking area 5614 to second stacking area 5626. Also, there would be similar errors for Nth stacking area 5616 to third stacking area 5628. These errors would need to be fixed utilizing one of the options disclosed in this document.

In FIG. 56B, another illustration of stacking game play on a gaming device is shown, according to one embodiment. A second image 5600B may include an Nth reel matrix 5632 which includes a reel NA 5634, a reel NB 5636, . . . , and a reel NN 5640. Reel NN may be any number from 1 to infinite. Therefore, there may be a plurality of reel N options to be utilized as an Nth reel on a first spin, a second spin, . . . , and an Nth spin. In this example, reel NA 5634 includes a first stacking area 5642, a second stacking area 5644, a third stacking area 5646, and an Nth stacking area 5648. First stacking area 5642 includes a first stacking symbol (e.g., a King). Second stacking area 5644 includes a second stacking symbol (e.g., a Queen). Third stacking area 5646 includes a third stacking symbol (e.g., a Queen). Nth stacking area 5616 includes an Nth stacking symbol (e.g., an Ace). Further, reel NB 5636 includes only a first stacking area 5652. First stacking area 5652 includes a first stacking symbol (e.g., a Queen). In addition, Reel NN 5640 includes a first stacking area 5654 and an Nth stacking area 5656. First stacking area 5654 includes a first stacking symbol (e.g., an Ace). Second stacking area 5656 includes a second stacking symbol (e.g., an Ace). In one example, for a first spin, the system, method, and/or device may select Reel NA 5640 to be utilized as reel one for the first spin. Further, the system, method, and/or device may select Reel NB 5636 to be utilized as reel one for a second spin. In addition, the system, method, and/or device may select Reel NN 5640 to be utilized as reel one for a third spin. In these examples, there would be no errors from a first spin to a second spin and from a second spin to a third spin because none of the stacking areas overlap between the first spin and the second spin. Further, there would be no errors for a second spin to a third spin because none of the stacking areas overlap with different stacking symbol being utilized for the second spin to the third spin. However, if Reel NA 5634 was utilized for a first spin and then Reel NN 5640 was utilized for a second spin, three errors would occur. (First Error) Since first stack area 5642 for reel NA 5634 utilizes a first stacking symbol (e.g., a King) which is different than the first stacking symbol (e.g., an Ace) for the first stacking area 5654 of Reel NN 5640, there would be a two symbol area overlap (e.g., reel positions 1-2). Therefore, first stacking area 5654 for the second spin is not in compliance. This may be fixed by converting the Ace symbols into King symbols, thereby, utilizing the same stacking symbols in the same locations from the first spin to the second spin. Further, this may be fixed by converting the Ace symbols into non-stacking symbols. In addition, this may be corrected by moving first stacking area 5654 to a compliant position. This may also be corrected by utilizing a different reel N option, such as Reel NB 5636. (Second Error) Since second stack area 5644 for reel NA 5634 utilizes a second stacking symbol (e.g., a Queen) which is different than the first stacking symbol (e.g., an Ace) for the first stacking area 5654 of Reel NN 5640, there would be a three symbol area overlap (e.g., reel positions 3-5). Therefore, first stacking area 5654 for the second spin is not in compliance. This may be fixed by converting the Ace symbols into Queen symbols, thereby, utilizing the same stacking symbols in the same locations from the first spin to the second spin. Further, this may be fixed by converting the Ace symbols into non-stacking symbols. In addition, this may be corrected by moving first stacking area 5654 to a compliant position. This may also be corrected by utilizing a different reel N option, such as Reel NB 5636. (Third Error) Since third stack area 5646 for reel NA 5634 utilizes a third stacking symbol (e.g., a Queen) which is different than the second stacking symbol (e.g., an Ace) for the second stacking area 5656 of Reel NN 5640, there would be a five symbol area overlap (e.g., reel positions 8-12). Therefore, second stacking area 5656 for the second spin is not in compliance. This may be fixed by converting the Ace symbols into Queen symbols, thereby, utilizing the same stacking symbols in the same locations from the first spin to the second spin. Further, this may be fixed by converting the Ace symbols into non-stacking symbols. In addition, this may be corrected by moving second stacking area 5656 to a compliant position. This may also be corrected by utilizing a different reel N option, such as Reel NB 5636.

(No Error) Since Nth stack area 5648 for reel NA 5634 utilizes a Nth stacking symbol (e.g., an Ace) which is the same as the second stacking symbol (e.g., an Ace) for the second stacking area 5656 of Reel NN 5640, there would be an overlapping area (e.g., reel positions 13-N). However, there would be no error because both stacking areas (e.g., 5648 and 5656) are utilizing the same stacking symbol.

In FIG. 56C, an illustration of stacking game play on a gaming device is shown, according to one embodiment. A third image 5600C may include a first reel matrix 5660, a second reel matrix 5662, . . . , and an Nth reel matrix 5666. In one example, first reel matrix 5660 may include a plurality of reel options 5670 which can be selected for use as a first reel during one or more spins. In this example, second reel matrix 5662 may include a plurality of reel options 5672 which can be selected for uses as a second reel during one or more spins. Further, Nth reel matrix 5666 may include a plurality of reel options 5674 which can be selected for uses as an Nth reel during one or more spins. In this example, a first reel selection of reel 1D 5676 may require a second reel selection of reel 2D 5678 and/or an Nth reel selection of reel N 5680. In this example, all of the reel selections (e.g., reference numbers 5682, 5684, and 5688) are dependent on the first reel selection (e.g., reference number 5676). In another example shown in FIG. 56D, all of the reel selections (e.g., reference numbers 5690, 5686, and 5694) are dependent on the second reel selection (e.g., reference number 5678). In this example, a second reel selection of reel 2D 5678 may require a first reel selection of reel 1D 5676 and/or an Nth reel selection of reel N 5680. Further, the selection of a first reel selection 5676 and a second reel selection 5678 may be independently made while a selection of an Nth reel selection 5680 may be dependent on a second reel selection 5678. In addition, the selection of a first reel selection 5676 and an Nth reel selection 5680 may be independently made while a selection of a second reel selection 5678 may be dependent on an Nth reel selection 5680. In addition, the selection of a second reel selection 5678 and an Nth reel selection 5680 may be independently made while a selection of a first reel selection 5676 may be dependent on an Nth reel selection 5680 and/or a second reel selection 5678.

In FIG. 56E, an illustration of stacking game play on a gaming device is shown, according to one embodiment. In this example, the selection of reel 1A 5676A for a first reel is independent of the selection of reel 2D 5678A for a second reel and the selection of reel NC 5680A for an Nth reel. Further, the selection of reel 2D 5678A for a second reel is independent of the selection of reel 1A 5676A for a first reel and the selection of reel NC 5680A for an Nth reel. In addition, the selection of reel NC 5680A for an Nth reel is independent of the selection of reel 1A 5676A for a first reel and the selection of reel 2D 5678A for a second reel. In FIGS. 56F-56G, the selection of reel 2D 5678A and/or reel NC 5680A is dependent on the selection of reel 1A 5676A. Further, the selection of reel NC 5680A may also be dependent on the selection of reel 2D 5678A.

In FIG. 57, a flow diagram for game play is shown, according to one embodiment. The method may include selecting a reel from a plurality of first reels for the first reel to be utilized for a first spin (step 5702). The method may include selecting a reel from a plurality of Nth reels for the Nth reel to be utilized for the first spin (step 5704). The method may include selecting a reel from a plurality of first reels for the first reel to be utilized for a second spin (step 5706). The method may include selecting a reel from a plurality of Nth reels for the Nth reel to be utilized for the second spin (step 5708). The method may include verifying the selections for the second spin to ensure that no stacking overlays between a first spin and a second spin (step 5710).

In FIG. 58A, an illustration of stacking game play on a gaming device is shown, according to one embodiment. A first image 5800A may include a first reel matrix 5802, a second reel matrix 5804, and a third reel matrix 5806. In one example, first reel matrix 5802 may include a plurality of reel options 5808 which can be selected for use as a first reel during one or more spins. In this example, second reel matrix 5804 may include a plurality of reel options 5810 which can be selected for uses as a second reel during one or more spins. Further, third reel matrix 5806 may include a plurality of reel options 5812 which can be selected for uses as a third reel during one or more spins. In this example, a reel 1C 5814 is selected from the plurality of reel options 5808 from the first reel matrix 5802. Based on the selection of reel 1C 5814, Reels 2D to Reels 2N−1 (reference number 5822) become unavailable for selection for the second reel matrix 5804. Therefore, only reel 2A, reel 2B, reel 2C, and reel 2N may be selected for use as the second reel. In this example, reel 2A 5816 was selected. Based on the selection of reel 1C 5814 and/or the selection of reel 2A 5816, reels 3C to reels 3N (reference number 5824) become unavailable for selection for the third reel matrix 5806. In this example, only reel 3A and reel 3B are available for selection as third reel. In this example, reel 3B 5818 is selected. It should be noted that each selection may be independent of each other, dependent on each other, and/or any combination of independence and dependence. For example as shown in FIG. 58B, a reel 2C 5830 selection may be based on a relationship 5836 with the reel 1N 5832 selection. Further, a reel 3A 5834 selection may be based on a relationship 5838 with a reel 2C 5830 selection.

In FIG. 59, a flow diagram for game play is shown, according to one embodiment. The method may include selecting a reel from a plurality of first reels for the first reel to be utilized for a first spin (step 5902). The method may include selecting a reel from a plurality of Nth reels for the Nth reel to be utilized for a first spin (step 5904). The method may include selecting a reel from a plurality of first reels for the first reel to be utilized for a second spin (step 5906). The method may include making one or more reels unavailable for selection based on one or more previous selections, such as, step 5906. The method may include selecting a reel from a plurality of available Nth reels from the Nth reel to be utilized for a second spin (step 5908). The method may include verifying the selections for the second spin to ensure that no stacking overlays between a first spin and a second spin (step 5910).

In FIG. 60A, an illustration of stacking game play on a gaming device is shown, according to one embodiment. A first image 6000A may include a first reel 6002, a second reel 6004, and a third reel 6006 (up to an Nth reel not shown—N may be from 1 to infinite). Each of the reels (e.g., first reel 6002, second reel 6004, and third reel 6006 (up to an Nth reel)) may have one or more non-stacking symbols (e.g., reference numbers 6008 and 6010—S1 next to S2 next to S3 etc.—Not S1 next to S1 or S2 next to S2, etc.).

In FIG. 60B, another illustration of stacking game play on a gaming device is shown, according to one embodiment. A second image 6000B may include a first reel template 6014, a second reel template 6016, and a third reel template 6018 (up to an Nth reel template). These templates (e.g., 6014, 6016, and 6018) may be combined to form a template 1 overlay 6012. Further, these templates (e.g., 6014, 6016, and 6018) may be individual templates and/or combined with one or more of the other templates. In other words, first reel template 6014 may be combined with second reel template 6016 but not with third reel template 6018 (and/or any other combination). In one example, the first reel template 6014 may include a first stacking area 6022 which in this case is filled with a first stacking symbol (e.g., an Ace). Further, the first reel template 6014 may include a second stacking area (e.g., reel positions 9-10) which utilizes the same stacking symbol (e.g., an Ace); however, any stacking symbol may be utilized. These stacking symbols may be dynamically filled (e.g., changed in a specific reel area from spin to spin), inserted, shifted, moved, and/or modified from spin to spin and/or within a spin. In this example, the second reel template 6016 may include a first stacking area (e.g., reel positions 1-6) which utilizes an Ace stacking symbol. Further, the third reel template 6018 may include a first stacking area (e.g., reel positions 4-8) which also utilizes an Ace stacking symbol. In various examples, the same stacking symbol may be utilized for all stacking areas, different stacking symbols may be utilized for all stacking areas, some same stacking symbols may be utilized for some areas, etc.

In FIG. 60C, an illustration of stacking game play on a gaming device is shown, according to one embodiment. A third image 6000C may include a first reel template 6032, a second reel template 6034, and a third reel template 6036 (up to an Nth reel template). These templates (e.g., 6032, 6034, and 6036) may be combined to form a template 2 overlay 6030. Further, these templates (e.g., 6032, 6034, and 6036) may be individual templates and/or combined with one or more of the other templates. In other words, first reel template 6032 may be combined with third reel template 6036 but not with second reel template 6034 (and/or any other combination). In one example, the first reel template 6032 may include a first stacking area 6022 which in this case is filled with a first stacking symbol (e.g., an Ace). Further, the first reel template 6032 may include a second stacking area (e.g., reel positions 7-8) which utilizes the same stacking symbol (e.g., an Ace); however, any stacking symbol may be utilized. In this example, the second reel template 6034 may include a first stacking area (e.g., reel positions 6-10) which utilizes an Ace stacking symbol. Further, the third reel template 6036 may include a first stacking area (e.g., reel positions 1-3) which also utilizes an Ace stacking symbol and a second stacking area (e.g., reel positions 9-10) which also utilizes an Ace for a stacking symbol.

In FIG. 60D, another illustration of stacking game play on a gaming device is shown, according to one embodiment. A fourth image 6000D may include a first reel template 6042, a second reel template 6044, and a third reel template 6046 (up to an Nth reel template). These templates (e.g., 6042, 6044, and 6046) may be combined to form a template N overlay 6040. Further, these templates (e.g., 6042, 6044, and 6046) may be individual templates and/or combined with one or more of the other templates. In other words, second reel template 6044 may be combined with third reel template 6046 but not with first reel template 6042 (and/or any other combination). In one example, the first reel template 6042 may include a first stacking area 6048 which in this case is filled with a first stacking symbol (e.g., a King). Further, the first reel template 6042 may include a second stacking area (e.g., reel positions 5-10) which utilizes the same stacking symbol (e.g., a King); however, any stacking symbol may be utilized. In this example, the second reel template 6044 may include a first stacking area (e.g., reel positions 1-2) which utilizes an Ace stacking symbol; a second stacking area (e.g., reel positions 3-4) which utilizes a King stacking symbol; and a third stacking area (e.g., reel positions 6-8) which utilizes an Ace stacking symbol. Further, the third reel template 6046 may include a first stacking area (e.g., reel positions 6-10) which also utilizes an Ace stacking symbol.

In FIG. 60E, an illustration of stacking game play on a gaming device is shown, according to one embodiment. A fifth image 6000E may include a first reel 6002 (see FIG. 60A—reference number 6002), a first template overlay 6014 for a first reel (see FIG. 60B—reference number 6014), and a combination of the first reel and the first template overlay 6056. In this example, the combination reel 6056 includes a first stacking area (e.g., three Aces located at reel positions 4-6) and a second stacking area (e.g., two Aces located at reel positions 9-10).

In FIG. 60F, another illustration of stacking game play on a gaming device is shown, according to one embodiment. A sixth image 6000F may include a second reel 6004 (see FIG. 60A—reference number 6004), a first template overlay 6016 for a second reel (see FIG. 60B—reference number 6016), and a combination of the second reel and the first template overlay 6058. In this example, the combination reel 6058 includes a first stacking area (e.g., six Aces located at reel positions 1-6).

In FIG. 60G, another illustration of stacking game play on a gaming device is shown, according to one embodiment. A seventh image 6000G may include a third reel 6006 (see FIG. 60A—reference number 6006), a first template overlay 6018 for a third reel (see FIG. 60B—reference number 6018), and a combination of the third reel and the first template overlay 6060. In this example, the combination reel 6060 includes a first stacking area (e.g., five Aces located at reel positions 4-8).

In FIG. 60H, an illustration of stacking game play on a gaming device is shown, according to one embodiment. An eighth image 6000H may include a first reel 6002 (see FIG. 60A—reference number 6002), a second template overlay 6032 for a first reel (see FIG. 60C—reference number 6032), and a combination of the first reel and the second template overlay 6062. In this example, the combination reel 6062 includes a first stacking area (e.g., three Aces located at reel positions 1-3) and a second stacking area (e.g., two Aces located at reel positions 7-8).

In FIG. 60J, another illustration of stacking game play on a gaming device is shown, according to one embodiment. A ninth image 6000J may include a second reel 6004 (see FIG. 60A—reference number 6004), a second template overlay 6034 for a second reel (see FIG. 60C—reference number 6034), and a combination of the second reel and the second template overlay 6064. In this example, the combination reel 6064 includes a first stacking area (e.g., four Aces located at reel positions 7-10).

In FIG. 60K, another illustration of stacking game play on a gaming device is shown, according to one embodiment. A tenth image 6000K may include a third reel 6006 (see FIG. 60A—reference number 6006), a second template overlay 6036 for a third reel (see FIG. 60C—reference number 6036), and a combination of the third reel and the first template overlay 6066. In this example, the combination reel 6066 includes a first stacking area (e.g., three Aces located at reel positions 1-3) and a second stacking area (e.g., two Aces at reel positions 9-10).

In FIG. 60L, an illustration of stacking game play on a gaming device is shown, according to one embodiment. An eleventh image 6000L may include a first reel 6002 (see FIG. 60A—reference number 6002), an Nth template overlay 6042 for a first reel (see FIG. 60D—reference number 6042), and a combination of the first reel and the Nth template overlay 6068. In this example, the combination reel 6068 includes a first stacking area (e.g., three Kings located at reel positions 1-3) and a second stacking area (e.g., six Kings located at reel positions 5-10).

In FIG. 60M, another illustration of stacking game play on a gaming device is shown, according to one embodiment. A twelfth image 6000M may include a second reel 6004 (see FIG. 60A—reference number 6004), an Nth template overlay 6044 for a second reel (see FIG. 60D—reference number 6044), and a combination of the second reel and the Nth template overlay 6070. In this example, the combination reel 6070 includes a first stacking area (e.g., two Aces located at reel positions 1-2), a second stacking area (e.g., two Kings in reel positions 3-4), and a third stacking area (e.g., three Aces located in reel positions 6-8).

In FIG. 60N, another illustration of stacking game play on a gaming device is shown, according to one embodiment. A thirteenth image 6000N may include a third reel 6006 (see FIG. 60A—reference number 6006), an Nth template overlay 6046 for a third reel (see FIG. 60D—reference number 6046), and a combination of the third reel and the Nth template overlay 6072. In this example, the combination reel 6072 includes a first stacking area (e.g., five Aces located at reel positions 6-10).

The system, device, and/or method may select one or more templates to utilize during a first spin and then the system, device, and/or method may select one or more templates to utilize during a second spin, and during a third spin, and during a fourth spin, etc. The various check steps and correction procedures discussed in this disclosure can be utilized with FIGS. 60A-60N.

In FIG. 61A, an illustration of stacking game play on a gaming device is shown, according to one embodiment. A first image 6100A may include a first reel 6102 where the stacking area locations and/or the stacking symbols to be utilized in the various stacking area locations are determined via the plurality of reels procedure (see at least FIGS. 56A-59). Whereas, a second reel 6014 may determine the stacking area locations and/or the stacking symbols to be utilized in the various stacking area locations are determined via a static stacking and/or shifting stack and/or dynamic stack procedure (see at least FIGS. 35A-36F and 45A-49). In addition, a third reel 6106 may determine the stacking area locations and/or the stacking symbols to be utilized in the various stacking area locations are determined via a base reel and/or extended reel procedure (see at least FIGS. 50-52). Further, an Nth reel 6108 may determine the stacking area locations and/or the stacking symbols to be utilized in the various stacking area locations are determined via the plurality of reels procedure.

In FIG. 61B, another illustration of stacking game play on a gaming device is shown, according to one embodiment. A second image 6100B may include a first reel 6102 and a second reel 6104, and an Nth reel 6122 where the stacking area locations and/or the stacking symbols to be utilized in the various stacking area locations are determined via a static stacking and/or shifting stack and/or dynamic stack procedure. In addition, a third reel 6106 may determine the stacking area locations and/or the stacking symbols to be utilized in the various stacking area locations are determined via a base reel and/or extended reel procedure.

In FIG. 61C, an illustration of stacking game play on a gaming device is shown, according to one embodiment. A third image 6100C may include a first reel 6102 where the stacking area locations and/or the stacking symbols to be utilized in the various stacking area locations are determined via the plurality of reels procedure. Whereas, a second reel 6104 may determine the stacking area locations and/or the stacking symbols to be utilized in the various stacking area locations are determined via a static stacking and/or shifting stack and/or dynamic stack procedure. In addition, a third reel 6106 and an Nth reel 6130 may determine the stacking area locations and/or the stacking symbols to be utilized in the various stacking area locations are determined via a base reel and/or extended reel procedure.

In FIG. 61D, another illustration of stacking game play on a gaming device is shown, according to one embodiment. A fourth image 6100D may include an Nth reel 6134 which only utilizes static stacking areas (e.g., 6136 and 6138). Further, any of these methods may be combined and/or only one method may be utilized for a stacking gaming functionality. Further, these method may be utilized on only one reel (see FIG. 61D), only on two reels (see FIG. 61E), only on three reels, . . . , any portion of reels, and/or all of the reels.

In FIG. 62A, an illustration of stacking game play on a gaming device is shown, according to one embodiment. A first image 6200A may include a first reel matrix 6202 with a reel 1A 6204, a reel 2A 6206, . . . , and a reel 1N 6210. In this example, reel 1A 6204 includes a first stacking area 6212 which has a first stacking symbol (e.g., an Ace) located in reel positions 1-3. Further, reel 1A 6204 includes a first blank area 6214 (e.g., with 3 reel positions where symbols may be determined at a later time). In addition, reel 1A 6204 includes a second stacking area 6216 with a second stacking symbol (e.g., a King) located in reel positions 7-11). In this example, reel 2A 6206 includes a first blank area (reel positions 1-2) and a second blank area (reel positions 9-11). Further, reel 2A 6206 includes a first stacking area 6218 with a first stacking symbol (e.g., a Queen) located in reel positions 3-6) and a second stacking area 6220 with a second stacking symbol (e.g., an Ace) located in reel positions 7-8. In this example, reel 1N 6210 may have a first blank area at reel positions 7-8, a first stacking area 6222 with a first stacking symbol (e.g., a King) located at reel positions 1-4, a second stacking area 6224 with a second stacking symbol (e.g., an Ace) located at reel positions 5-6, and a third stacking area 6226 with a third stacking symbol (e.g., a King) located in reel positions 9-11.

In FIG. 62B, another illustration of stacking game play on a gaming device is shown, according to one embodiment. In this example, reel 1A 6204 includes a first stacking area 6212 which has a first stacking symbol (e.g., an Ace) located in reel positions 1-3. Further, reel 1A 6204 includes a first blank area 6214 (e.g., with 3 reel positions where symbols may be determined at a later time). In addition, reel 1A 6204 includes a second stacking area 6216 with a second stacking symbol (e.g., a King) located in reel positions 7-11). In this example, reel 2A 6206 includes a first blank area (reel positions 1-3) and a second blank area (reel positions 7-11). Further, reel 2A 6206 includes a first stacking area 6218 with a first stacking symbol (e.g., an Ace) located in reel positions 4-6). In this example, reel 1N 6210 may have a first blank area at reel positions 1-8 and a first stacking area 6238 with a first stacking symbol (e.g., an Ace) located at reel positions 9-11.

In FIG. 62C, an illustration of stacking game play on a gaming device is shown, according to one embodiment. A second image 6200C may include a first spin 6242, a second spin 6244, and a third spin 6246 (up to an Nth spin). In this example, the symbol, device, and/or method has selected reel 1B 6248 as a first reel for a first spin. After the first spin is completed, the system, device, and/or method wants to determine a first reel for a second spin. However, various first reel options are no longer available based on the selection of reel 1B 6248 as the first reel for the first spin. In this example, reel 1A 6250 and reel 1 E to reel 1N are not available to be selected as a first reel for a second spin. In this example, the system, device, and/or method has selected reel 1C 6252 as a first reel for a second spin. After the second spin is completed, the system, device, and/or method wants to determine a first reel for a third spin. However, various first reel options are no longer available based on the selection of reel 1C 6252 as the first reel for the second spin. In this example, reel 1A to reel 1C 6256 and reel 1 E to reel 1N are not available to be selected as a first reel for a third spin. In this example, the system, device, and/or method has selected reel 1D 6258 as a first reel for the third spin.

The method may include determining one or more stack locations. The method may include determining one or more stack sizes. The method may include one or more processors determining whether one or more stack sizes and/or stack locations should be modified. If one or more stack sizes and/or stack locations should be modified, then the method may modify one or more stack sizes and/or modify one or more stack locations. Once these modifications are completed and/or no modifications were necessary, then the method may determine one or more stack symbols. The method may place a first stack symbol in one or more stack locations. The method may place an Nth stack symbol in one or more stack locations. In another example, the system, device, and/or method may recheck the stacking areas to ensure compliance.

The method may include determining a first stack symbol from a group of symbols. The method may include modifying the percentage for each symbol in the group of symbols based on the selecting of the first stack symbol. The method may include determining an Nth minus 1 stack symbol from the group of symbols. The method may include modifying the percentages for each symbol in the group of symbols based on the selecting of the Nth minus 1 stack symbol. The method may then select the Nth symbol.

In one embodiment, the electronic gaming device may include a plurality of display areas where one or more paylines are formed on at least a portion of the plurality of display areas, a memory, and a processor. The processor may determine one or more wagers relating to one or more game plays. The processor may determine a first stacking symbol area for a first spin where the first stacking symbol area may be located in a first reel position range. The first stacking symbol area may be a first length with a first starting position and a first ending position. The first stacking symbol area may utilize a first stacking symbol for each symbol position starting with the first starting position and ending in the first ending position for the first spin. The processor may determine a second stacking symbol area for a second spin where the second stacking symbol area may be located in a second reel position range. The second stacking symbol area may be a second length with a second starting position and a second ending position. The second stacking symbol area may utilize a second stacking symbol for each symbol position starting with the second starting position and ending in the second ending position for the second spin. The second stacking symbol being different than the first stacking symbol. The processor may initiate at least one of: determining that there are no overlapping reel positions between the first stacking symbol area and the second stacking symbol area and modifying the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin. The processor may generate one or more first spin payouts for the first spin and to generate one or more second spin payouts for the second spin.

Further, the processor may change a size of the second length for the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin. The processor may reposition the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin. The processor may reposition and/or decrease a size of the second length for the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin. The processor may reposition and/or increase a size of the second length for the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin.

The processor may insert one or more non-stacking symbols into one or more reel positions based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin.

The processor may insert one or more reel positions with one or more non-stacking symbols based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin.

The processor may insert one or more first stacking symbols into the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin.

In another embodiment, a method of providing gaming options via an electronic gaming device may include: determining via one or more processors one or more wagers relating to one or more game plays; determining via the one or more processors a first stacking symbol area for a first spin where the first stacking symbol area is located in a first reel position range; determining via the one or more processors a second stacking symbol area for a second spin where the second stacking symbol area is located in a second reel position range; initiating via the one or more processors at least one of: 1) determining that there are no overlapping reel positions between the first stacking symbol area and the second stacking symbol area and 2) determining that there is at least one overlapping reel position between the first stacking symbol area and the second stacking symbol area and modifying the second stacking symbol area based on the at least one overlapping reel position between the first stacking symbol area and the second stacking symbol area to eliminate the at least one overlapping reel position between the first stacking symbol area and the second stacking symbol area; and/or generating one or more first spin payouts for the first spin and to generate one or more second spin payouts for the second spin. The first stacking symbol area being a first length with a first starting position and a first ending position and the first stacking symbol area utilizes a first stacking symbol for each symbol position starting with the first starting position and ending in the first ending position for the first spin. The second stacking symbol area being a second length with a second starting position and a second ending position and the second stacking symbol area utilizes a second stacking symbol for each symbol position starting with the second starting position and ending in the second ending position for the second spin, the second stacking symbol being different than the first stacking symbol.

The method may further include: changing a size of the second length for the second stacking symbol area based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin; repositioning the second stacking symbol area based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin; repositioning and decreasing a size of the second length for the second stacking symbol area based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin; repositioning and increasing a size of the second length for the second stacking symbol area based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin; inserting one or more non-stacking symbols into one or more reel positions based on the at least one overlapping reel position between the first stacking symbol area and the second stacking symbol area to eliminate the at least one overlapping reel position between the first stacking symbol area and the second stacking symbol area; inserting one or more reel positions with one or more non-stacking symbols based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin; and/or inserting one or more first stacking symbols into the second stacking symbol area based on the at least one overlapping reel position between the first stacking symbol area and the second stacking symbol area to eliminate the at least one overlapping reel position between the first stacking symbol area and the second stacking symbol area when different stacking symbols are utilized on a first spin and a second spin.

In another embodiment, the electronic gaming system may include a plurality of display areas where one or more paylines are formed on at least a portion of the plurality of display areas, a memory, and a server processor. The server processor may determine one or more wagers relating to one or more game plays and/or determine a first stacking symbol area for a first spin where the first stacking symbol area is located in a first reel position range. The first stacking symbol area being a first length with a first starting position and a first ending position. The first stacking symbol area utilizes a first stacking symbol for each symbol position starting with the first starting position and ending in the first ending position for the first spin. The server processor may determine a second stacking symbol area for a second spin where the second stacking symbol area is located in a second reel position range. The second stacking symbol area being a second length with a second starting position and a second ending position, the second stacking symbol area utilizes a second stacking symbol for each symbol position starting with the second starting position and ending in the second ending position for the second spin. The second stacking symbol being different than the first stacking symbol. The server processor may initiate at least one of: 1) determining that there are no overlapping reel positions between the first stacking symbol area and the second stacking symbol area and 2) modifying the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin. The server processor may generate one or more first spin payouts for the first spin and to generate one or more second spin payouts for the second spin.

In addition, the server processors may change a size of the second length for the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin; reposition the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin; and/or reposition and decrease a size of the second length for the second stacking symbol area based on one or more overlapping reel positions between the first stacking symbol area and the second stacking symbol area to eliminate the one or more overlapping reel positions between the first stacking symbol area and the second stacking symbol area when different stacking symbols are utilized on a first spin and a second spin.

In another embodiment, the electronic gaming system, method, and/or device may include a plurality of display areas where one or more paylines are formed on at least a portion of the plurality of display areas, a memory, and a processor. The plurality of display areas may include a first portion which is visible to a player at the conclusion of game play and a second portion which in not visible to the player at the conclusion of game play where one or more stacking structures may be placed in the first portion of the plurality of display areas and one or more stacking structures may be placed in the second portion of the plurality of display areas. Once a new game is initiated, the processor may change all non-visible portions (e.g., second portion of the plurality of display areas) to a state with no inserted stacks. The processor may insert into the non-visible portions (e.g., the second portion of the plurality of display areas) one or more stacking structures that do not overlap with the previous stacking structures which were just removed (e.g., the stacking structures located in the second portion of the plurality of display areas used for the previous spin). It should be noted that the overlapping stacking structures only occurs when a different stacking symbol is utilized for these areas from the first spin to the second spin. In other words, stacking structures with the same stacking symbol in the same location for a first spin and a second spin are acceptable. In this embodiment, the reels are then set in motion and when the areas of the first portion of the plurality of display areas leaves the visible area (e.g., can no longer be seen by the player), any stacking structure in the first portion of the plurality of display areas is transformed into non-stacking structures, unless as previously noted the stacking symbol does not change. In the case where the stacking symbol does not changed, then these stacking areas are allowed to remain stacking areas.

In one embodiment, the electronic gaming device may include a plurality of display areas where one or more paylines are formed on at least a portion of the plurality of display areas, a memory, and a processor. The processor may: determine one or more wagers relating to one or more game plays; determine a first reel from a plurality of first reels, a second reel from a plurality of second reels, and an Nth reel from a plurality of Nth reels for utilization during a first spin. Further, a selected first reel may include a first stacking symbol area for the first spin where the first stacking symbol area is located in a first reel position range. The first stacking symbol area being a first length with a first starting position and a first ending position. The first stacking symbol area utilizes a first stacking symbol for each symbol position starting with the first starting position and ending in the first ending position on the first reel for the first spin. In addition, a selected second reel may include a second stacking symbol area for the first spin where the second stacking symbol area is located in a second reel position range. The second stacking symbol area being a second length with a second starting position and a second ending position. The second stacking symbol area utilizes a second stacking symbol for each symbol position starting with the second starting position and ending in the second ending position on the second reel for the first spin. Further, a selected Nth reel may include an Nth stacking symbol area for the first spin where the Nth stacking symbol area is located in an Nth reel position range. The Nth stacking symbol area being an Nth length with an Nth starting position and an Nth ending position. The Nth stacking symbol area utilizes an Nth stacking symbol for each symbol position starting with the Nth starting position and ending in the Nth ending position on the Nth reel for the first spin. The processor may determine a second first reel from the plurality of first reels, a second second reel from the plurality of second reels, and a second Nth reel from the plurality of Nth reels for utilization during a second spin. A selected second first reel may include a third stacking symbol area (e.g., a second first stacking symbol area) for the second spin where the third stacking symbol area is located in a third reel position range. The third stacking symbol area being a third length with a third starting position and a third ending position, the third stacking symbol area utilizes a third stacking symbol for each symbol position starting with the third starting position and ending in the third ending position on the second first reel for the second spin. A selected second second reel may include a fourth stacking symbol area (e.g., a second first stacking symbol area) for the second spin where the fourth stacking symbol area is located in a fourth reel position range, the fourth stacking symbol area being a fourth length with a fourth starting position and a fourth ending position. The fourth stacking symbol area utilizes a fourth stacking symbol for each symbol position starting with the fourth starting position and ending in the fourth ending position on the second second reel for the second spin. A selected second Nth reel may include a fifth stacking symbol area (e.g., a second first stacking symbol area) for the second spin where the fifth stacking symbol area is located in a fifth reel position range. The fifth stacking symbol area being a fifth length with a fifth starting position and a fifth ending position, the fifth stacking symbol area utilizes a fifth stacking symbol for each symbol position starting with the fifth starting position and ending in the fifth ending position on the second Nth reel for the second spin. The processor may initiate at least one of: 1) determining that there are no overlapping reel positions between the first stacking symbol area and the third stacking symbol area (e.g., a second first stacking symbol area) and 2) modifying the third stacking symbol area based on one or more overlapping reel positions between the first stacking symbol area and the third stacking symbol area to eliminate the one or more overlapping reel positions between the first stacking symbol area and the third stacking symbol area. The processor may initiate at least one of: 1) determining that there are no overlapping reel positions between the second stacking symbol area and the fourth stacking symbol area (e.g., a second first stacking symbol area) and 2) modifying the fourth stacking symbol area based on one or more overlapping reel positions between the second stacking symbol area and the fourth stacking symbol area to eliminate the one or more overlapping reel positions between the second stacking symbol area and the fourth stacking symbol area. The processor may initiate at least one of: 1) determining that there are no overlapping reel positions between the Nth stacking symbol area and the fifth stacking symbol area (e.g., a second first stacking symbol area) and 2) modifying the fifth stacking symbol area based on one or more overlapping reel positions between the Nth stacking symbol area and the fifth stacking symbol area to eliminate the one or more overlapping reel positions between the Nth stacking symbol area and the fifth stacking symbol area. The processor may generate one or more first spin payouts for the first spin and to generate one or more second spin payouts for the second spin.

In addition, the processor may change a size of the third length for the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. Further, the processor may reposition the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. In another example, the processor may reposition and decrease a size of the third length for the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. In addition, the processor may reposition and increase a size of the third length for the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. Further, the processor may insert one or more non-stacking symbols into one or more reel positions based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. In one example, the processor may insert one or more reel positions with one or more non-stacking symbols based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin. In another example, the processor may insert one or more first stacking symbols into the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin.

In another embodiment, a method of providing gaming options via an electronic gaming device may include: determining via one or more processors one or more wagers relating to one or more game plays; determining via the one or more processors a first reel from a plurality of first reels, a second reel from a plurality of second reels, and an Nth reel from a plurality of Nth reels for utilization during a first spin, where a selected first reel includes a first stacking symbol area for the first spin where the first stacking symbol area is located in a first reel position range, the first stacking symbol area being a first length with a first starting position and a first ending position, the first stacking symbol area utilizes a first stacking symbol for each symbol position starting with the first starting position and ending in the first ending position on the first reel for the first spin, where a selected second reel includes a second stacking symbol area for the first spin where the second stacking symbol area is located in a second reel position range, the second stacking symbol area being a second length with a second starting position and a second ending position, the second stacking symbol area utilizes a second stacking symbol for each symbol position starting with the second starting position and ending in the second ending position on the second reel for the first spin, where a selected Nth reel includes an Nth stacking symbol area for the first spin where the Nth stacking symbol area is located in an Nth reel position range, the Nth stacking symbol area being an Nth length with an Nth starting position and an Nth ending position, the Nth stacking symbol area utilizes an Nth stacking symbol for each symbol position starting with the Nth starting position and ending in the Nth ending position on the Nth reel for the first spin; determining via the one or more processors a second first reel from the plurality of first reels, a second second reel from the plurality of second reels, and a second Nth reel from the plurality of Nth reels for utilization during a second spin where a selected second first reel includes a third stacking symbol area for the second spin where the third stacking symbol area is located in a third reel position range, the third stacking symbol area being a third length with a third starting position and a third ending position, the third stacking symbol area utilizes a third stacking symbol for each symbol position starting with the third starting position and ending in the third ending position on the second first reel for the second spin, where a selected second second reel includes a fourth stacking symbol area for the second spin where the fourth stacking symbol area is located in a fourth reel position range, the fourth stacking symbol area being a fourth length with a fourth starting position and a fourth ending position, the fourth stacking symbol area utilizes a fourth stacking symbol for each symbol position starting with the fourth starting position and ending in the fourth ending position on the second second reel for the second spin, where a selected second Nth reel includes a fifth stacking symbol area for the second spin where the fifth stacking symbol area is located in a fifth reel position range, the fifth stacking symbol area being a fifth length with a fifth starting position and a fifth ending position, the fifth stacking symbol area utilizes a fifth stacking symbol for each symbol position starting with the fifth starting position and ending in the fifth ending position on the second Nth reel for the second spin; initiating at least one of: determining that there are no overlapping reel positions between the first stacking symbol area and the third stacking symbol area and modifying the third stacking symbol area based on one or more overlapping reel positions between the first stacking symbol area and the third stacking symbol area to eliminate the one or more overlapping reel positions between the first stacking symbol area and the third stacking symbol area; initiating at least one of: determining that there are no overlapping reel positions between the second stacking symbol area and the fourth stacking symbol area and modifying the fourth stacking symbol area based on one or more overlapping reel positions between the second stacking symbol area and the fourth stacking symbol area to eliminate the one or more overlapping reel positions between the second stacking symbol area and the fourth stacking symbol area; initiating at least one of: determining that there are no overlapping reel positions between the Nth stacking symbol area and the fifth stacking symbol area and modifying the fifth stacking symbol area based on one or more overlapping reel positions between the Nth stacking symbol area and the fifth stacking symbol area to eliminate the one or more overlapping reel positions between the Nth stacking symbol area and the fifth stacking symbol area; and/or generating one or more first spin payouts for the first spin and to generate one or more second spin payouts for the second spin.

In addition, the method may further include: changing a size of the third length for the third stacking symbol area based on the at least one overlapping reel position between the first stacking symbol area and the third stacking symbol area to eliminate the at least one overlapping reel position between the first stacking symbol area and the third stacking symbol area; repositioning the third stacking symbol area based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin; repositioning and decreasing a size of the third length for the third stacking symbol area based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin; repositioning and increasing a size of the third length for the third stacking symbol area based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin; inserting one or more non-stacking symbols into one or more reel positions based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin; inserting one or more reel positions with one or more non-stacking symbols based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin; and/or inserting one or more first stacking symbols into the third stacking symbol area based on the at least one overlapping reel position between the first stacking symbol area and the third stacking symbol area to eliminate the at least one overlapping reel position between the first stacking symbol area and the third stacking symbol area when different stacking symbols are utilized on a first spin and a second spin.

In another embodiment, an electronic gaming system may include a plurality of display areas where one or more paylines are formed on at least a portion of the plurality of display areas; a memory; and a server processor. The server processor may determine one or more wagers relating to one or more game plays, the server processor configured to determine a first reel from a plurality of first reels, a second reel from a plurality of second reels, and an Nth reel from a plurality of Nth reels for utilization during a first spin. A selected first reel includes a first stacking symbol area for the first spin where the first stacking symbol area is located in a first reel position range, the first stacking symbol area being a first length with a first starting position and a first ending position, the first stacking symbol area utilizes a first stacking symbol for each symbol position starting with the first starting position and ending in the first ending position on the first reel for the first spin, a selected second reel includes a second stacking symbol area for the first spin where the second stacking symbol area is located in a second reel position range, the second stacking symbol area being a second length with a second starting position and a second ending position, the second stacking symbol area utilizes a second stacking symbol for each symbol position starting with the second starting position and ending in the second ending position on the second reel for the first spin, and where a selected Nth reel includes an Nth stacking symbol area for the first spin where the Nth stacking symbol area is located in an Nth reel position range, the Nth stacking symbol area being an Nth length with an Nth starting position and an Nth ending position, the Nth stacking symbol area utilizes an Nth stacking symbol for each symbol position starting with the Nth starting position and ending in the Nth ending position on the Nth reel for the first spin. The server processor may determine a second first reel from the plurality of first reels, a second second reel from the plurality of second reels, and a second Nth reel from the plurality of Nth reels for utilization during a second spin where a selected second first reel includes a third stacking symbol area for the second spin where the third stacking symbol area is located in a third reel position range, the third stacking symbol area being a third length with a third starting position and a third ending position, the third stacking symbol area utilizes a third stacking symbol for each symbol position starting with the third starting position and ending in the third ending position on the second first reel for the second spin, where a selected second second reel includes a fourth stacking symbol area for the second spin where the fourth stacking symbol area is located in a fourth reel position range, the fourth stacking symbol area being a fourth length with a fourth starting position and a fourth ending position, the fourth stacking symbol area utilizes a fourth stacking symbol for each symbol position starting with the fourth starting position and ending in the fourth ending position on the second second reel for the second spin, where a selected second Nth reel includes a fifth stacking symbol area for the second spin where the fifth stacking symbol area is located in a fifth reel position range, the fifth stacking symbol area being a fifth length with a fifth starting position and a fifth ending position, the fifth stacking symbol area utilizes a fifth stacking symbol for each symbol position starting with the fifth starting position and ending in the fifth ending position on the second Nth reel for the second spin. The server processor may initiate at least one of: determining that there are no overlapping reel positions between the first stacking symbol area and the third stacking symbol area and modifying the third stacking symbol area based on one or more overlapping reel positions between the first stacking symbol area and the third stacking symbol area to eliminate the one or more overlapping reel positions between the first stacking symbol area and the third stacking symbol area. The server processor may initiate at least one of: determining that there are no overlapping reel positions between the second stacking symbol area and the fourth stacking symbol area and modifying the fourth stacking symbol area based on one or more overlapping reel positions between the second stacking symbol area and the fourth stacking symbol area to eliminate the one or more overlapping reel positions between the second stacking symbol area and the fourth stacking symbol area. The server processor may initiate at least one of: determining that there are no overlapping reel positions between the Nth stacking symbol area and the fifth stacking symbol area and modifying the fifth stacking symbol area based on one or more overlapping reel positions between the Nth stacking symbol area and the fifth stacking symbol area to eliminate the one or more overlapping reel positions between the Nth stacking symbol area and the fifth stacking symbol area. The server processor may generate one or more first spin payouts for the first spin and to generate one or more second spin payouts for the second spin.

In addition, the server processor may change a size of the third length for the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin; reposition the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin; and/or reposition and decrease a size of the third length for the third stacking symbol area based on one or more overlapping reel positions between the first stacking symbol area and the third stacking symbol area to eliminate the one or more overlapping reel positions between the first stacking symbol area and the third stacking symbol area when different stacking symbols are utilized on a first spin and a second spin.

In one embodiment, the electronic gaming device may include: a plurality of display areas where one or more paylines are formed on at least a portion of the plurality of display areas; a memory; and one or more processors. The one or more processors may determine one or more wagers relating to one or more game plays; determine a first stacking symbol area for a first spin where the first stacking symbol area is located in a first reel position range in a base reel, the first stacking symbol area being a first length with a first starting position and a first ending position, the first stacking symbol area utilizes a first stacking symbol for each symbol position starting with the first starting position and ending in the first ending position for the first spin; determine a second stacking symbol area for the first spin where the second stacking symbol area is located in a second reel position range in an extended reel, the second stacking symbol area being a second length with a second starting position and a second ending position, the second stacking symbol area utilizes a second stacking symbol for each symbol position starting with the second starting position and ending in the second ending position for the first spin; determine a third stacking symbol area for a second spin where the third stacking symbol area is located in a third reel position range in the base reel, the third stacking symbol area being a third length with a third starting position and a third ending position, the third stacking symbol area utilizes a third stacking symbol for each symbol position starting with the third starting position and ending in the third ending position for the second spin, the third stacking symbol being different than the first stacking symbol; and/or determine a fourth stacking symbol area for the second spin where the fourth stacking symbol area is located in a fourth reel position range in the extended reel, the fourth stacking symbol area being a fourth length with a fourth starting position and a fourth ending position, the fourth stacking symbol area utilizes a fourth stacking symbol for each symbol position starting with the fourth starting position and ending in the fourth ending position for the second spin, the fourth stacking symbol being different than the second stacking symbol. Further, the processor may initiate one or more of: 1) determining that there are no overlapping reel positions between the first stacking symbol area in the base reel and the third stacking symbol area in the base reel; 2) determining that there are no overlapping reel positions between the second stacking symbol area in the extended reel and the fourth stacking symbol area in the extended reel; 3) modifying the third stacking symbol area based on one or more overlapping reel positions between the first stacking symbol area and the third stacking symbol area to eliminate the one or more overlapping reel positions between the first stacking symbol area and the third stacking symbol area; 4) modifying the fourth stacking symbol area based on one or more overlapping reel positions between the second stacking symbol area and the fourth stacking symbol area to eliminate the one or more overlapping reel positions between the second stacking symbol area and the fourth stacking symbol area; and/or 5) generate one or more first spin payouts for the first spin and to generate one or more second spin payouts for the second spin.

In addition, the processor may change a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the processor may change a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In another example, the processor may reposition the third stacking symbol area based on one or more overlapping reel positions between the first stacking symbol area and the third stacking symbol area to eliminate the one or more overlapping reel positions between the first stacking symbol area and the third stacking symbol area. Further, the processor may reposition the fourth stacking symbol area based on one or more overlapping reel positions between the second stacking symbol area and the fourth stacking symbol area to eliminate the one or more overlapping reel positions between the second stacking symbol area and the fourth stacking symbol area.

In one example, the processor may reposition and decrease a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the processor may reposition and decrease a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In yet another example, the processor may reposition and increase a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the processor may reposition and increase a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In one example, the processor may insert one or more non-stacking symbols into one or more reel positions based on one or more overlapping reel positions between the first stacking symbol area and the third stacking symbol area to eliminate the one or more overlapping reel positions between the first stacking symbol area and the third stacking symbol area. Further, the processor may insert one or more non-stacking symbols into one or more reel positions based on one or more overlapping reel positions between the second stacking symbol area and the fourth stacking symbol area to eliminate the one or more overlapping reel positions between the second stacking symbol area and the fourth stacking symbol area.

In another example, the processor may insert one or more reel positions with one or more non-stacking symbols based on one or more overlapping reel positions between the first stacking symbol area and the third stacking symbol area to eliminate the one or more overlapping reel positions between the first stacking symbol area and the third stacking symbol area. Further, the processor may insert one or more reel positions with one or more non-stacking symbols based on one or more overlapping reel positions between the second stacking symbol area and the fourth stacking symbol area to eliminate the one or more overlapping reel positions between the second stacking symbol area and the fourth stacking symbol area.

In addition, the processor may insert one or more first stacking symbols into the third stacking symbol area based on one or more overlapping reel positions between the first stacking symbol area and the third stacking symbol area to eliminate the one or more overlapping reel positions between the first stacking symbol area and the third stacking symbol area. Further, the processor may insert one or more second stacking symbols into the fourth stacking symbol area based on one or more overlapping reel positions between the second stacking symbol area and the fourth stacking symbol area to eliminate the one or more overlapping reel positions between the second stacking symbol area and the fourth stacking symbol area.

In another embodiment, the method of providing gaming options via an electronic gaming device may include: determining via one or more processors one or more wagers relating to one or more game plays; determining via the one or more processors a first stacking symbol area for a first spin where the first stacking symbol area is located in a first reel position range in a base reel, the first stacking symbol area being a first length with a first starting position and a first ending position, the first stacking symbol area utilizes a first stacking symbol for each symbol position starting with the first starting position and ending in the first ending position for the first spin; determining via the one or more processors a second stacking symbol area for the first spin where the second stacking symbol area is located in a second reel position range in an extended reel, the second stacking symbol area being a second length with a second starting position and a second ending position, the second stacking symbol area utilizes a second stacking symbol for each symbol position starting with the second starting position and ending in the second ending position for the first spin; determining via the one or more processors a third stacking symbol area for a second spin where the third stacking symbol area is located in a third reel position range in the base reel, the third stacking symbol area being a third length with a third starting position and a third ending position, the third stacking symbol area utilizes a third stacking symbol for each symbol position starting with the third starting position and ending in the third ending position for the second spin, the third stacking symbol being different than the first stacking symbol; determining via the one or more processors a fourth stacking symbol area for the second spin where the fourth stacking symbol area is located in a fourth reel position range in the extended reel, the fourth stacking symbol area being a fourth length with a fourth starting position and a fourth ending position, the fourth stacking symbol area utilizes a fourth stacking symbol for each symbol position starting with the fourth starting position and ending in the fourth ending position for the second spin, the fourth stacking symbol being different than the second stacking symbol; initiating via the one or more processors at least one of: 1) determining that there are no overlapping reel positions between the first stacking symbol area in the base reel and the third stacking symbol area in the base reel; 2) determining that there are no overlapping reel positions between the second stacking symbol area in the extended reel and the fourth stacking symbol area in the extended reel; 3) modifying the third stacking symbol area based on one or more overlapping reel positions between the first stacking symbol area and the third stacking symbol area to eliminate the one or more overlapping reel positions between the first stacking symbol area and the third stacking symbol area; and 4) modifying the fourth stacking symbol area based on one or more overlapping reel positions between the second stacking symbol area and the fourth stacking symbol area to eliminate the one or more overlapping reel positions between the second stacking symbol area and the fourth stacking symbol area; and/or generating one or more first spin payouts for the first spin and to generate one or more second spin payouts for the second spin.

In addition, the method may include: changing a size of the third length for the third stacking symbol area based on the at least one overlapping reel position between the first stacking symbol area and the third stacking symbol area to eliminate the at least one overlapping reel position between the first stacking symbol area and the third stacking symbol area; changing a size of the fourth length for the fourth stacking symbol area based on the at least one overlapping reel position between the second stacking symbol area and the fourth stacking symbol area to eliminate the at least one overlapping reel position between the second stacking symbol area and the fourth stacking symbol area; repositioning the third stacking symbol area based on the at least one overlapping reel position between the first stacking symbol area and the third stacking symbol area to eliminate the at least one overlapping reel position between the first stacking symbol area and the third stacking symbol area; repositioning the fourth stacking symbol area based on the at least one overlapping reel position between the second stacking symbol area and the fourth stacking symbol area to eliminate the at least one overlapping reel position between the second stacking symbol area and the fourth stacking symbol area; repositioning and decreasing a size of the third length for the third stacking symbol area based on the at least one overlapping reel position between the first stacking symbol area and the third stacking symbol area to eliminate the at least one overlapping reel position between the first stacking symbol area and the third stacking symbol area; repositioning and decreasing a size of the fourth length for the fourth stacking symbol area based on the at least one overlapping reel position between the second stacking symbol area and the fourth stacking symbol area to eliminate the at least one overlapping reel position between the second stacking symbol area and the fourth stacking symbol area; repositioning and increasing a size of the third length for the third stacking symbol area based on the at least one overlapping reel position between the first stacking symbol area and the third stacking symbol area to eliminate the at least one overlapping reel position between the first stacking symbol area and the third stacking symbol area; repositioning and increasing a size of the fourth length for the fourth stacking symbol area based on the at least one overlapping reel position between the second stacking symbol area and the fourth stacking symbol area to eliminate the at least one overlapping reel position between the second stacking symbol area and the fourth stacking symbol area; inserting one or more non-stacking symbols into one or more reel positions based on the at least one overlapping reel position between the first stacking symbol area and the third stacking symbol area to eliminate the at least one overlapping reel position between the first stacking symbol area and the third stacking symbol area; inserting one or more non-stacking symbols into one or more reel positions based on the at least one overlapping reel position between the second stacking symbol area and the fourth stacking symbol area to eliminate the at least one overlapping reel position between the second stacking symbol area and the fourth stacking symbol area; inserting one or more reel positions with one or more non-stacking symbols based on the at least one overlapping reel position between the first stacking symbol area and the third stacking symbol area to eliminate the at least one overlapping reel position between the first stacking symbol area and the third stacking symbol area; inserting one or more reel positions with one or more non-stacking symbols based on the at least one overlapping reel position between the second stacking symbol area and the fourth stacking symbol area to eliminate the at least one overlapping reel position between the second stacking symbol area and the fourth stacking symbol area; inserting one or more first stacking symbols into the third stacking symbol area based on the at least one overlapping reel position between the first stacking symbol area and the third stacking symbol area to eliminate the at least one overlapping reel position between the first stacking symbol area and the third stacking symbol area; and/or inserting one or more second stacking symbols into the fourth stacking symbol area based on the at least one overlapping reel position between the second stacking symbol area and the fourth stacking symbol area to eliminate the at least one overlapping reel position between the second stacking symbol area and the fourth stacking symbol area.

In another embodiment, the electronic gaming system may include: a plurality of display areas where one or more paylines are formed on at least a portion of the plurality of display areas; a memory; and a server processor. The server processor may: determine a first stacking symbol area for a first spin where the first stacking symbol area is located in a first reel position range in a base reel, the first stacking symbol area being a first length with a first starting position and a first ending position, the first stacking symbol area utilizes a first stacking symbol for each symbol position starting with the first starting position and ending in the first ending position for the first spin; determine a second stacking symbol area for the first spin where the second stacking symbol area is located in a second reel position range in an extended reel, the second stacking symbol area being a second length with a second starting position and a second ending position, the second stacking symbol area utilizes a second stacking symbol for each symbol position starting with the second starting position and ending in the second ending position for the first spin; determine a third stacking symbol area for a second spin where the third stacking symbol area is located in a third reel position range in the base reel, the third stacking symbol area being a third length with a third starting position and a third ending position, the third stacking symbol area utilizes a third stacking symbol for each symbol position starting with the third starting position and ending in the third ending position for the second spin, the third stacking symbol being different than the first stacking symbol; determine a fourth stacking symbol area for the second spin where the fourth stacking symbol area is located in a fourth reel position range in the extended reel, the fourth stacking symbol area being a fourth length with a fourth starting position and a fourth ending position, the fourth stacking symbol area utilizes a fourth stacking symbol for each symbol position starting with the fourth starting position and ending in the fourth ending position for the second spin, the fourth stacking symbol being different than the second stacking symbol; initiate at least one of: 1) determining that there are no overlapping reel positions between the first stacking symbol area in the base reel and the third stacking symbol area in the base reel; 2) determining that there are no overlapping reel positions between the second stacking symbol area in the extended reel and the fourth stacking symbol area in the extended reel; 3) modifying the third stacking symbol area based on one or more overlapping reel positions between the first stacking symbol area and the third stacking symbol area to eliminate the one or more overlapping reel positions between the first stacking symbol area and the third stacking symbol area; and 4) modifying the fourth stacking symbol area based on one or more overlapping reel positions between the second stacking symbol area and the fourth stacking symbol area to eliminate the one or more overlapping reel positions between the second stacking symbol area and the fourth stacking symbol area; and/or generate one or more first spin payouts for the first spin and to generate one or more second spin payouts for the second spin.

In addition, the server processor may change a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the server processor may change a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In another example, the server processor may reposition the third stacking symbol area based on one or more overlapping reel positions between the first stacking symbol area and the third stacking symbol area to eliminate the one or more overlapping reel positions between the first stacking symbol area and the third stacking symbol area. Further, the server processor may reposition the fourth stacking symbol area based on one or more overlapping reel positions between the second stacking symbol area and the fourth stacking symbol area to eliminate the one or more overlapping reel positions between the second stacking symbol area and the fourth stacking symbol area.

In one example, the server processor may reposition and decrease a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the server processor may reposition and decrease a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In yet another example, the server processor may reposition and increase a size of the third length for the third stacking symbol area based on one or more overlapping reel positions between the first stacking symbol area and the third stacking symbol area to eliminate the one or more overlapping reel positions between the first stacking symbol area and the third stacking symbol area. Further, the server processor may reposition and increase a size of the fourth length for the fourth stacking symbol area based on one or more overlapping reel positions between the second stacking symbol area and the fourth stacking symbol area to eliminate the one or more overlapping reel positions between the second stacking symbol area and the fourth stacking symbol area.

In one example, the server processor may insert one or more non-stacking symbols into one or more reel positions based on one or more overlapping reel positions between the first stacking symbol area and the third stacking symbol area to eliminate the one or more overlapping reel positions between the first stacking symbol area and the third stacking symbol area. Further, the server processor may insert one or more non-stacking symbols into one or more reel positions based on one or more overlapping reel positions between the second stacking symbol area and the fourth stacking symbol area to eliminate the one or more overlapping reel positions between the second stacking symbol area and the fourth stacking symbol area.

In another example, the server processor may insert one or more reel positions with one or more non-stacking symbols based on one or more overlapping reel positions between the first stacking symbol area and the third stacking symbol area to eliminate the one or more overlapping reel positions between the first stacking symbol area and the third stacking symbol area. Further, the server processor may insert one or more reel positions with one or more non-stacking symbols based on one or more overlapping reel positions between the second stacking symbol area and the fourth stacking symbol area to eliminate the one or more overlapping reel positions between the second stacking symbol area and the fourth stacking symbol area.

In addition, the server processor may insert one or more first stacking symbols into the third stacking symbol area based on one or more overlapping reel positions between the first stacking symbol area and the third stacking symbol area to eliminate the one or more overlapping reel positions between the first stacking symbol area and the third stacking symbol area. Further, the server processor may insert one or more second stacking symbols into the fourth stacking symbol area based on one or more overlapping reel positions between the second stacking symbol area and the fourth stacking symbol area to eliminate the one or more overlapping reel positions between the second stacking symbol area and the fourth stacking symbol area.

In FIG. 63A, an illustration of stacking game play on a gaming device is shown, according to one embodiment. A first image 6300A may include a reel 6302 with various reel positions 6304 (e.g., reel position 1, reel position 2, . . . , and reel position 16). In one example, a fixed stacking area 6306 may include a first stacking symbol which is static and does not change from spin to spin. Whereas, a first dynamic stacking area 6308, a second dynamic stacking area 6312, and a third dynamic stacking area 6316 (up to an Nth dynamic stacking area) have stacking symbol which may vary from spin to spin. In addition, there may be one or more non-stacking symbol areas (e.g., reference numbers 6310 and 6314, etc.). In one example, a first dynamic matrix 6318 is utilized to determine 6320 a first stacking symbol (e.g., a queen) for the first dynamic stacking area 6308 for a first spin. In addition, a second dynamic matrix 6322 may be utilized to determine 6324 one or more symbols (e.g., A, K, Q, and J) for the second dynamic stacking area 6312. In this example, non-stacking symbols were utilized for second dynamic stacking area 6312 for a first spin. Further, a third dynamic matrix 6326 may be utilized to determine 6328 a second stacking symbol (e.g., a 10) for the third dynamic stacking area 6316 for a first spin. Further for this example, new symbols may be selected for a second spin.

In FIG. 63B, another illustration of stacking game play on a gaming device is shown, according to one embodiment. A second image 6300B may include the reel 6302 where the first dynamic stacking area 6308A is filed with non-stacking symbols (e.g., a first selection 6332 (an Ace), a second selection 6334 (a King), and a third selection 6336 (a Queen)) for a second spin. In various examples, any selections could have been made. For example, an Ace could have been selected for all of the selections (e.g., a first selection 6332 (an Ace), a second selection 6334 (an Ace), and a third selection 6336 (an Ace). In another example, the king could have been selected for all of the selections (e.g., a first selection 6332 (a King), a second selection 6334 (a King), and a third selection 6336 (a King). In addition, the Ace could have been selected for one or more locations, while the King was selected for one or more locations, and the Queen could have been selected for one or more locations, and/or any combination thereof. In addition, second dynamic stacking area 6312A may be filled with a second stacking symbol (e.g., a Jack) which was determined 6338 by second dynamic matrix 6322 for the second spin. Further, various non-stacking symbols may be selected 6342 by third dynamic matrix 6326 to fill third dynamic stacking area 6316A for the second spin. In these examples, the dynamic matrix may selected one or more symbols from a plurality of symbols to insert into one or more reel positions within one or more dynamic stacking areas.

In FIG. 63C, an illustration of stacking game play on a gaming device is shown, according to one embodiment. A third image 6300C may include the first dynamic matrix 6318 selecting 6354 a stacking symbol (e.g., an Ace) to be inserted into all of the reel positions within the first dynamic stacking area 6308A for a third spin. In addition, the second dynamic matrix 6322 may have selected 6356 various non-stacking symbols to be located within the second dynamic stacking area 6312 for a second spin. Meanwhile, the third dynamic matrix 6326 may have selected 6364 a King to insert into all of the reel positions within the third dynamic stacking area 6316A for a third spin.

In FIG. 64A, an illustration of stacking game play on a gaming device is shown, according to one embodiment. A first image 6400A may include a first reel 6404, a second reel 6406, and an Nth reel 6410. First reel 6404 may include a first stacking area 6412, a second stacking area 6414, a third stacking area 6416, a fourth stacking area 6418, and an Nth stacking area 6420. In one example, the first stacking area 6412 may be turned on and/or turned off via a first control area 6422 (which may be virtual). In another example, the second stacking area 6414 may be turned on and/or turned off via a second control area 6424. In another example, the third stacking area 6416 may be turned on and/or turned off via a third control area 6426. In another example, the fourth stacking area 6418 may be turned on and/or turned off via a fourth control area 6428. In another example, the Nth stacking area 6420 may be turned on and/or turned off via an Nth control area 6430. In one example, when a stacking area is turned on this stacking area is utilized as a stacking area for a specific spin and/or a range of spins and/or the stacking area is utilized as a stacking area until the stacking area is turned off. Further, the stacking area may be static and/or dynamic (see FIGS. 63A-63C). When a stacking area is turned off, the stacking area may utilize non-stacking symbols in the stacking area range (e.g., reel positions). Second reel 6406 may include a first stacking area 6432, a second stacking area 6434, a third stacking area 6436, a fourth stacking area 6438, a fifth stacking area 6440, and an Nth stacking area 6442. In one example, the first stacking area 6432 may be turned on and/or turned off via a first control area 6444 (which may be a virtual module and/or programming). In another example, the second stacking area 6434 may be turned on and/or turned off via a second control area 6446. In another example, the third stacking area 6436 may be turned on and/or turned off via a third control area 6448. In another example, the fourth stacking area 6438 may be turned on and/or turned off via a fourth control area 6450. In another example, the fifth stacking area 6440 may be turned on and/or turned off (e.g., controlled) via a fifth control area 6452. In another example, the Nth stacking area 6442 may be turned on and/or turned off via an Nth control area 6454.

Nth reel 6410 may include a first stacking area 6456, a second stacking area 6458, a third stacking area 6460, a fourth stacking area 6462, and an Nth stacking area 6464. In one example, the first stacking area 6456 may be turned on and/or turned off (e.g., controlled) via a first control area 6466 (which may be a virtual module and/or programming). In another example, the second stacking area 6458 may be turned on and/or turned off (e.g., controlled) via a second control area 6468. In another example, the third stacking area 6460 may be turned on and/or turned off via a third control area 6470. In another example, the fourth stacking area 6462 may be turned on and/or turned off via a fourth control area 6472. In another example, the Nth stacking area 6464 may be turned on and/or turned off via an Nth control area 6474. Any stacking symbol and/or any number (e.g., 1 to N) of stacking symbols may be utilized (e.g., $S_N$)

In FIG. 64B, another illustration of stacking game play on a gaming device is shown, according to one embodiment. A second image 6400B may include first reel 6404 having first stacking area 6412, third stacking area 6416, and Nth stacking area 6420 turned on. First stacking area 6412 is utilizing a first stacking symbol (e.g., an Ace). Third stacking area 6416 is utilizing a second stacking symbol (e.g., a Queen). Nth stacking area 6420 is utilizing an Nth stacking symbol (e.g., a 10). It should be noted that the stacking symbols utilized may be the same for one or more stacking areas and/or no stacking symbols may be the same, and/or some stacking symbols may be the same. Further, the stacking areas may be any length (e.g., 1 to N units). In this case, first stacking area 6412 was 3 units, third stacking area 6416 was 2 units, and Nth stacking area 6420 was 6 units. In this example, second stacking area 6414A and fourth stacking area 6418A utilized non-stacking symbols because the stacking areas were turned off. In this example, second reel 6406 has second stacking area 6434, fifth stacking area 6440, and Nth stacking area 6442 turned on as indicated by the on button being highlighted. In this example, first stacking area 6432A, third stacking area 6436A, and fourth stacking area 6438A utilized non-stacking symbol because these stacking areas were turned off which is indicated by the off button being highlighted. Further, the Nth reel 6410 has the third stacking area 6460, the fourth stacking area 6462, and the Nth stacking area 6464 turned on while the first stacking area 6456A and the second stacking area 6458A are turned off. It should be noted that any and/or all of the checking procedures for overlapping stacking areas with different stacking symbols from a first spin to a second spin disclosed in this document can be utilized with these figures and/or any figures in this disclosure.

In FIG. 64C, an illustration of stacking game play on a gaming device is shown, according to one embodiment. A method 6400C may include determining one or more stacks to turn on for one or more reels for a first spin (step 6480). The method may include turning on one or more stacks for one or more reels (step 6482). The method may include verifying that no stacking symbols were in the locations of the one or more turned on stacks during the first spin (when the stacking symbols are the same for both spins) (step 6484). The method may include modifying one or more turned on stacks if a stacking symbol from the previous spin (e.g., first spin) in a location the one or more turned on stacks (step 6486). The method may include modifying one or more turned off stacks if a stack was inadvertently created in the one or more turned off stacks area (step 6488). In one example, a first stacking area on a first reel is turned on and is located at reel positions 1-3 with a first stacking symbol (e.g., a Horse) for a first spin. In this example, the first stacking area on the first reel is turned on and is still located at reel positions 1-3 with a second stacking symbol (e.g., a Dog) for a second spin. This would cause an error because there would be stacking symbols overlapping from a first spin to a second spin when the stacking symbols have changed from a first spin to a second spin. This error may be corrected by converting the second stacking symbol into the first stacking symbol (e.g., a Horse) for the second spin, turning off the first stacking area for the second spin, moving the stacking area to a compliant area for a second spin, and/or any other correction procedure described in this document.

In FIG. 64D, an illustration of stacking game play on a gaming device is shown, according to one embodiment. A third image 6400D may include a reel 6401 with various reel positions 6403 (e.g., reel position 1, reel position 2, . . . , and reel position 16). In one example, a fixed stacking area 6405 may include a first stacking symbol which is static and does not change from spin to spin. Whereas, a first dynamic stacking area 6407, a second dynamic stacking area 6411, and a third dynamic stacking area 6415 (up to an Nth dynamic stacking area) have stacking symbol which may vary from spin to spin. In addition, there may be one or more non-stacking symbol areas (e.g., reference numbers 6409 and 6413, etc.). In one example, a first dynamic matrix 6417 is utilized to determine 6419 a first stacking symbol (e.g., a queen) for the first dynamic stacking area 6417 for a first spin because the first dynamic stacking area 6417 was turned on by a first control module 6421. In addition, a second dynamic matrix 6423 may be utilized to determine 6425 one or more symbols (e.g., A, K, Q, and J) for the second dynamic stacking area 6411 because the second dynamic stacking area 6411 was turned on by a second controller 6427 but the second dynamic matrix 6423 determined only non-stacking symbols for this area. Further, the non-stacking symbols in the second dynamic stacking area 6411 may have been because second dynamic stacking area 6411 was turned off by the second control 6427. In this example, non-stacking symbols were utilized for second dynamic stacking area 6312 for a first spin. Further, a third dynamic matrix 6429 may be utilized to determine 6431 a second stacking symbol (e.g., a 10) for the third dynamic stacking area 6415 for a first spin because a third control module 6433 turned on the third dynamic stacking area 6415. Further for this example, new symbols may be selected for a second spin.

In FIG. 64E, a fourth image 6400E may show the first reel 6401 with the first dynamic stacking area 6407 and the third dynamic stacking area 6415 turned off and filed with non-stacking symbols for a second spin. In this example, second dynamic stacking area 6411 was turned on by second control module 6427 and a third stacking symbol (e.g., a 10) was determined by second dynamic matrix 6423 and placed in every reel position within second dynamic stacking area 6411.

In FIG. 64F, an illustration of stacking game play on a gaming device is shown, according to one embodiment. A fifth image 6400F shows a successful stacking formation (questions 6435 and answer 6439) with no errors from a first spin to a second spin. In this example, a first stacking area 6407A has a first stacking symbol (e.g., a Queen) located in reel positions 3-5 for a first spin and then non-stacking symbols (e.g., 5, 7, J) located in reel positions 3-5 for a second spin, therefore, there are no overlapping reel positions with different stacking symbols from a first spin to a second spin.

In FIG. 64G, an illustration of stacking game play on a gaming device is shown, according to one embodiment. A sixth image 6400G shows a new stacking symbol (e.g., a King) being determined 6419 for the first stacking area 6407B for a third spin. This stacking area was turned on by first control module 6421C. It should be noted that one or more control modules may be combined into one master control module and/or code for implementation by one or more processors. In this example, a successful stacking formation (questions 6435A and answer 6439A) with no errors from a second spin to a third spin (see FIG. 64H). In this example, a first stacking area 6407A has a second stacking symbol (e.g., a King) located in reel positions 3-5 for a third spin and non-stacking symbols (e.g., 5, 7, J) located in reel positions 3-5 for a second spin, therefore, there are no overlapping reel positions with different stacking symbols from a second spin to a third spin.

In FIG. 64J, an illustration of stacking game play on a gaming device is shown, according to one embodiment. A seventh image 6400J shows that first stacking area 6407C now has two aces located in reel positions 3-4 and one queen located in reel position 5 for a fourth spin. However, this causes an error which can be seen in FIG. 64K. Since reel positions 3-4 had a first stacking symbol (e.g., a King) for a third spin and then a second stacking symbol (e.g., an Ace) where the second stacking symbol is different than the first stacking symbol, overlapping reel positions with different stacking symbols has occurred on adjacent spins. This may be corrected by redoing the first stacking area 6407D for the fourth spin and generating non-stacking symbols for reel positions 3-4 (see FIG. 64L and FIG. 64M).

In FIG. 64N, an illustration of stacking game play on a gaming device is shown, according to one embodiment. An eighth image 6400N shows a stacking formation be formed inadvertently in a turned off first stacking area 6407E. In this example as seen in FIG. 64P, an inadvertently created stack 6447 has formed a stack because two adjacent symbols are the same (e.g., a 5 and a 5). This may be corrected by redoing the first stacking area 6407F for the fifth spin and generating non-stacking symbols for reel positions 3-5 (see FIG. 64R and FIG. 64S).

In one embodiment, the electronic gaming device may include: a plurality of display areas where one or more paylines are formed on at least a portion of the plurality of display areas; a memory; and a processor. The processor may: determine one or more wagers relating to one or more game plays; turn on one or more stacking areas for a first spin; determine a first stacking symbol area for the first spin where the first stacking symbol area is located in a first reel position range based on a first stacking symbol area utilization determination, the first stacking symbol area being a first length with a first starting position and a first ending position, the first stacking symbol area utilizes a first stacking symbol for each symbol position starting with the first starting position and ending in the first ending position for the first spin; turn on one or more stacking areas for a second spin; determine a second stacking symbol area for the second spin where the second stacking symbol area is located in a second reel position range based on a second stacking symbol area utilization determination, the second stacking symbol area being a second length with a second starting position and a second ending position, the second stacking symbol area utilizes a second stacking symbol for each symbol position starting with the second starting position and ending in the second ending position for the second spin, the second stacking symbol being different than the first stacking symbol; initiate at least one of: 1) determining that there are no overlapping reel positions between the first stacking symbol area and the second stacking symbol area; and 2) modifying the second stacking symbol area based on one or more overlapping reel positions between the first stacking symbol area and the second stacking symbol area to eliminate the one or more overlapping reel positions between the first stacking symbol area and the second stacking symbol area; and/or generate one or more first spin payouts for the first spin and to generate one or more second spin payouts for the second spin.

In another example, the processor may: change a size of the second length for the second stacking symbol area based on one or more overlapping reel positions between the first stacking symbol area and the second stacking symbol area to eliminate the one or more overlapping reel positions between the first stacking symbol area and the second stacking symbol area; reposition the second stacking symbol area based on one or more overlapping reel positions between the first stacking symbol area and the second stacking symbol area to eliminate the one or more overlapping reel positions between the first stacking symbol area and the second stacking symbol area; reposition and decrease a size of the second length for the second stacking symbol area based on one or more overlapping reel positions between the first stacking symbol area and the second stacking symbol area to eliminate the one or more overlapping reel positions between the first stacking symbol area and the second stacking symbol area; reposition and increase a size of the second length for the second stacking symbol area based on one or more overlapping reel positions between the first stacking symbol area and the second stacking symbol area to eliminate the one or more overlapping reel positions between the first stacking symbol area and the second stacking symbol area; insert one or more non-stacking symbols into one or more reel positions based on one or more overlapping reel positions between the first stacking symbol area and the second stacking symbol area to eliminate the one or more overlapping reel positions between the first stacking symbol area and the second stacking symbol area; insert one or more reel positions with one or more non-stacking symbols based on one or more overlapping reel positions between the first stacking symbol area and the second stacking symbol area to eliminate the one or more overlapping reel positions between the first stacking symbol area and the second stacking symbol area; and/or insert one or more first stacking symbols into the second stacking symbol area based on one or more overlapping reel positions between the first stacking symbol area and the second stacking symbol area to eliminate the one or more overlapping reel positions between the first stacking symbol area and the second stacking symbol area.

In another example, a method of providing gaming options via an electronic gaming device may include: determining via one or more processors one or more wagers relating to one or more game plays; turning on via one or more processors one or more stacking areas for a first spin; determining via the one or more processors a first stacking symbol area for the first spin where the first stacking symbol area is located in a first reel position range based on a first stacking symbol area utilization determination, the first stacking symbol area being a first length with a first starting position and a first ending position, the first stacking symbol area utilizes a first stacking symbol for each symbol position starting with the first starting position and ending in the first ending position for the first spin; turning on via the one or more processors one or more stacking areas for a second spin; determining via the one or more processors a second stacking symbol area for the second spin where the second stacking symbol area is located in a second reel position range based on a second stacking symbol area utilization determination, the second stacking symbol area being a second length with a second starting position and a second ending position, the second stacking symbol area utilizes a second stacking symbol for each symbol position starting with the second starting position and ending in the second ending position for the second spin, the second stacking symbol being different than the first stacking symbol; initiating via the one or more processors at least one of: 1) determining that there are no overlapping reel positions between the first stacking symbol area and the second stacking symbol area; and 2) modifying the second stacking symbol area based on one or more overlapping reel positions between the first stacking symbol area and the second stacking symbol area to eliminate the one or more overlapping reel positions between the first stacking symbol area and the second stacking symbol area; and/or generating one or more first spin payouts for the first spin and to generate one or more second spin payouts for the second spin.

Further, the method may include: changing a size of the second length for the second stacking symbol area based on the at least one overlapping reel position between the first stacking symbol area and the second stacking symbol area to eliminate the at least one overlapping reel position between the first stacking symbol area and the second stacking symbol area; repositioning the second stacking symbol area based on the at least one overlapping reel position between the first stacking symbol area and the second stacking symbol area to eliminate the at least one overlapping reel position between the first stacking symbol area and the second stacking symbol area; repositioning and decreasing a size of the second length for the second stacking symbol area based on the at least one overlapping reel position between the first stacking symbol area and the second stacking symbol area to eliminate the at least one overlapping reel position between the first stacking symbol area and the second stacking symbol area; repositioning and increasing a size of the second length for the second stacking symbol area based on the at least one overlapping reel position between the first stacking symbol area and the second stacking symbol area to eliminate the at least one overlapping reel position between the first stacking symbol area and the second stacking symbol area; inserting one or more non-stacking symbols into one or more reel positions based on the at least one overlapping reel position between the first stacking symbol area and the second stacking symbol area to eliminate the at least one overlapping reel position between the first stacking symbol area and the second stacking symbol area; inserting one or more reel positions with one or more non-stacking symbols based on the at least one overlapping reel position between the first stacking symbol area and the second stacking symbol area to eliminate the at least one overlapping reel position between the first stacking symbol area and the second stacking symbol area; and/or inserting one or more first stacking symbols into the second stacking symbol area based on the at least one overlapping reel position between the first stacking symbol area and the second stacking symbol area to eliminate the at least one overlapping reel position between the first stacking symbol area and the second stacking symbol area.

In another embodiment, the electronic gaming system may include: a plurality of display areas where one or more paylines are formed on at least a portion of the plurality of display areas; a memory; and a server processor. The server processor may: turn on one or more stacking areas for a first spin; determine a first stacking symbol area for the first spin where the first stacking symbol area is located in a first reel position range based on a first stacking symbol area utilization determination, the first stacking symbol area being a first length with a first starting position and a first ending position, the first stacking symbol area utilizes a first stacking symbol for each symbol position starting with the first starting position and ending in the first ending position for the first spin; turn on one or more stacking areas for a second spin, the processor configured to determine a second stacking symbol area for the second spin where the second stacking symbol area is located in a second reel position range based on a second stacking symbol area utilization determination, the second stacking symbol area being a second length with a second starting position and a second ending position, the second stacking symbol area utilizes a second stacking symbol for each symbol position starting with the second starting position and ending in the second ending position for the second spin, the second stacking symbol being different than the first stacking symbol; initiate at least one of: 1) determining that there are no overlapping reel positions between the first stacking symbol area and the second stacking symbol area; and 2) modifying the second stacking symbol area based on one or more overlapping reel positions between the first stacking symbol area and the second stacking symbol area to eliminate the one or more overlapping reel positions between the first stacking symbol area and the second stacking symbol area; and/or generate one or more first spin payouts for the first spin and to generate one or more second spin payouts for the second spin.

Further, the server processor may: change a size of the second length for the second stacking symbol area based on one or more overlapping reel positions between the first stacking symbol area and the second stacking symbol area to eliminate the one or more overlapping reel positions between the first stacking symbol area and the second stacking symbol area; reposition the second stacking symbol area based on one or more overlapping reel positions between the first stacking symbol area and the second stacking symbol area to eliminate the one or more overlapping reel positions between the first stacking symbol area and the second stacking symbol area; and/or reposition and decrease a size of the second length for the second stacking symbol area based on one or more overlapping reel positions between the first stacking symbol area and the second stacking symbol area to eliminate the one or more overlapping reel positions between the first stacking symbol area and the second stacking symbol area.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples. While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed. Further, one or more gaming options may be Internet based gaming options. Therefore, all of the examples and/or embodiments may be utilized via an Internet based gaming system.

The invention claimed is:

1. An electronic gaming device comprising:

a plurality of display areas where one or more paylines are formed on at least a portion of the plurality of display areas;

a wager accepting device configured to accept a physical item associated with a monetary value to increase a credit balance maintained on the electronic gaming device;

a memory;

a processor configured to determine one or more wagers received via a player input device from the credit balance relating to one or more game plays, to turn on one or more stacking areas for a first spin, and to determine a first stacking symbol area for the first spin where the first stacking symbol area is located in a first reel position range based on a first stacking symbol area utilization determination, and the first stacking symbol area being a first length with a first starting position and a first ending position, the first stacking symbol area utilizing a first stacking symbol for each symbol position starting with the first starting position and ending in the first ending position for the first spin;

the processor further configured to turn on one or more stacking areas for a second spin, and to determine a second stacking symbol area for the second spin where the second stacking symbol area is located in a second reel position range based on a second stacking symbol area utilization determination, the second stacking symbol area being a second length with a second starting position and a second ending position, the second stacking symbol area utilizing a second stacking symbol for each symbol position starting with the second starting position and ending in the second ending position for the second spin, and the second stacking symbol being different than the first stacking symbol;

the processor configured to determine when there are one or more overlapping reel positions between the first stacking symbol area and the second stacking symbol area, and to modify the second stacking symbol area based on the one or more overlapping reel positions between the first stacking symbol area and the second stacking symbol area to eliminate the one or more overlapping reel positions between the first stacking symbol area and the second stacking symbol area by repositioning the second stacking symbol area;

the processor further configured to generate one or more first spin payouts for the first spin and to generate one or more second spin payouts for the second spin and to update the credit balance at the electronic gaming device based on the one or more first spin payouts and the one or more second spin payouts.

2. The electronic gaming device of claim 1, wherein the processor is further configured to change a size of the second length for the second stacking symbol area.

3. The electronic gaming device of claim 1, wherein the processor is further configured to decrease a size of the second length for the second stacking symbol area.

4. The electronic gaming device of claim 1, wherein the processor is further configured to increase a size of the second length for the second stacking symbol area.

5. The electronic gaming device of claim 1, wherein the processor is further configured to insert one or more non-stacking symbols into one or more reel positions.

6. The electronic gaming device of claim 1, wherein the processor is further configured to insert one or more reel positions with one or more nonstacking symbols.

7. The electronic gaming device of claim 1, wherein the processor is further configured to insert one or more first stacking symbols into the second stacking symbol area.

8. A method of providing gaming options via an electronic gaming device comprising:

receiving at a wager accepting device of the electronic gaming device a physical item associated with a monetary value to increase a credit balance maintained at the electronic gaming device;

determining via one or more processors one or more wagers received via a player input device funded by the credit balance relating to one or more game plays;

turning on via the one or more processors one or more stacking areas for a first spin;

determining via the one or more processors a first stacking symbol area for the first spin where the first stacking symbol area is located in a first reel position range based on a first stacking symbol area utilization determination, the first stacking symbol area being a first length with a first starting position and a first ending position, and the first stacking symbol area utilizing a first stacking symbol for each symbol position starting with the first starting position and ending in the first ending position for the first spin;

turning on via the one or more processors one or more stacking areas for a second spin;

determining via the one or more processors a second stacking symbol area for the second spin where the second stacking symbol area is located in a second reel position range based on a second stacking symbol area utilization determination, the second stacking symbol area being a second length with a second starting position and a second ending position, the second stacking symbol area utilizing a second stacking symbol for each symbol position starting with the second starting position and ending in the second ending position for the second spin, and the second stacking symbol being different than the first stacking symbol;

determining via the one or more processors when there are one or more overlapping reel positions between the first stacking symbol area and the second stacking symbol area; and modifying the second stacking symbol area based on the one or more overlapping reel positions between the first stacking symbol area and the second stacking symbol area to eliminate the one or more overlapping reel positions between the first stacking symbol area and the second stacking symbol area by repositioning the second stacking symbol area; and generating one or more first spin payouts for the first spin and to generate one or more second spin payouts for the second spin and updating the credit balance based on the one or more first spin payouts and the one or more second spin payouts.

9. The method of claim 8, further comprising changing a size of the second length for the second stacking symbol area.

10. The method of claim 8, further comprising decreasing a size of the second length for the second stacking symbol area.

11. The method of claim 8, further comprising increasing a size of the second length for the second stacking symbol area.

12. The method of claim 8, further comprising inserting one or more nonstacking symbols into one or more reel positions.

13. The method of claim 8, further comprising inserting one or more reel positions with one or more non-stacking symbols.

14. The method of claim 8, further comprising inserting one or more first stacking symbols into the second stacking symbol area.

15. An electronic gaming system comprising:

a plurality of display areas where one or more paylines are formed on at least a portion of the plurality of display areas;

a wager accepting device configured to accept a physical item associated with a monetary value to increase a credit balance maintained on the electronic gaming device;

a memory;

a server processor configured to receive one or more wagers funded by the credit balance via an input device, to turn on one or more stacking areas for a first spin, and to determine a first stacking symbol area for the first spin where the first stacking symbol area is located in a first reel position range based on a first stacking symbol area utilization determination, the first stacking symbol area being a first length with a first starting position and a first ending position, and the first stacking symbol area utilizing a first stacking symbol for each symbol position starting with the first starting position and ending in the first ending position for the first spin;

the server processor further configured to turn on one or more stacking areas for a second spin, and to determine a second stacking symbol area for the second spin where the second stacking symbol area is located in a second reel position range based on a second stacking symbol area utilization determination, the second stacking symbol area being a second length with a second starting position and a second ending position, the second stacking symbol area utilizes a second stacking symbol for each symbol position starting with the second starting position and ending in the second ending position for the second spin, and the second stacking symbol being different than the first stacking symbol;

the server processor configured to determine when there are one or more overlapping reel positions between the first stacking symbol area and the second stacking symbol area; and to modify the second stacking symbol area based on the one or more overlapping reel positions between the first stacking symbol area and the second stacking symbol area to eliminate the one or more overlapping reel positions between the first stacking symbol area and the second stacking symbol area by repositioning the second stacking symbol area;

the server processor further configured to generate one or more first spin payouts for the first spin and to generate one or more second spin payouts for the second spin and to update the credit balance at the electronic gaming device based on the one or more first spin payouts and the one or more second spin payouts.

16. The electronic gaming system of claim 15, wherein the server processor is further configured to change a size of the second length for the second stacking symbol area.

17. The electronic gaming system of claim 15, wherein the server processor is further configured to decrease a size of the second length for the second stacking symbol area.

* * * * *